US006832759B2

(12) United States Patent
Nagasako et al.

(10) Patent No.: US 6,832,759 B2
(45) Date of Patent: Dec. 21, 2004

(54) SHEET-SHAPED MEDIUM ALIGNING APPARATUS, IMAGE FORMING APPARATUS, AND SHEET-SHAPED MEDIUM AFTER-TREATMENT APPARATUS

(75) Inventors: Shuuya Nagasako, Tokyo (JP); Kazuya Tsutsui, Tokyo (JP); Masahiro Tamura, Tokyo (JP); Akihito Andoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 30 days.

(21) Appl. No.: 10/109,992

(22) Filed: Apr. 1, 2002

(65) Prior Publication Data

US 2002/0158405 A1 Oct. 31, 2002

(30) Foreign Application Priority Data

Mar. 30, 2001 (JP) ..... 2001-098812
Mar. 30, 2001 (JP) ..... 2001-098848
May 31, 2001 (JP) ..... 2001-165122

(51) Int. Cl.[7] ..... B65H 33/08

(52) U.S. Cl. ..... 271/222; 271/221; 271/220; 271/223; 399/404; 414/791.2

(58) Field of Search ..... 270/58.01, 52.01; 414/791.2; 399/404; 271/220, 221, 222, 223

(56) References Cited

U.S. PATENT DOCUMENTS 4,073,391 A * 2/1978 O'Brien et al. ..... 414/789
5,188,353 A 2/1993 Parks
5,508,798 A 4/1996 Yamada
5,618,035 A * 4/1997 Coombs et al. ..... 271/213
5,692,411 A 12/1997 Tamura
5,762,328 A 6/1998 Yamada et al.
6,145,825 A 11/2000 Kunihiro et al.
6,199,853 B1 3/2001 Andoh et al.
6,231,039 B1 * 5/2001 Chung ..... 270/58.01
6,231,045 B1 5/2001 Yamada et al.
6,264,191 B1 7/2001 Suzuki et al.
6,296,247 B1 10/2001 Tamura et al.
6,322,070 B2 11/2001 Yamada et al.
6,343,785 B1 2/2002 Yamada et al.
6,382,615 B1 * 5/2002 Ishiguro et al. ..... 270/58.12
6,394,448 B2 5/2002 Suzuki et al.
6,416,052 B2 7/2002 Yamada et al.
6,494,449 B2 12/2002 Tamura et al.
6,494,453 B1 12/2002 Yamada et al.
6,527,269 B2 3/2003 Yamada et al.

FOREIGN PATENT DOCUMENTS

EP 1 072 549 1/2001
JP 62-008965 1/1987
JP 62008965 A * 1/1987 ..... B65H/33/08
JP 62046862 A * 2/1987 ..... B65H/33/08
JP 8-108965 4/1996
JP 2000-086064 3/2000
JP 2000086064 A * 3/2000 ..... B65H/33/08
JP 2000/219408 8/2000
JP 2001341927 A * 12/2001 ..... B65H/31/38

OTHER PUBLICATIONS

Patent Abstracts of Japan, JP 62–046862, Aug. 23, 1987.
Patent Abstracts of Japan, JP 01–203161, Aug. 15, 1989.

* cited by examiner

*Primary Examiner*—Patrick Mackey
(74) *Attorney, Agent, or Firm*—Oblon, Spivak, McClelland, Maier & Neustadt, P.C.

(57) ABSTRACT

A sheet-shaped medium aligning apparatus, an image forming apparatus, and a sheet-shaped medium after-treatment apparatus where an arranging device is moved from a position predetermined to arrange sheet-shaped mediums on a sheet piling device to a position receiving the sheet-shaped mediums in a body so that, in taking out the sheet-shaped mediums from the body, an injury of hands or destruction of the arranging device can be prevented.

126 Claims, 146 Drawing Sheets

ROTATING POSITION FOR ARRANGEMENT

ROTATING POSITION
FOR ARRANGEMENT

ROTATING POSITION
FOR RECEIVING

REAR SIDE

ROTATING POSITION FOR ARRANGEMENT

FRONT SIDE

FRONT SIDE

REAR SIDE

REAR SIDE

ROTATING POSITION FOR ARRANGEMENT

FRONT SIDE

FRONT SIDE

REAR SIDE

ARRANGING MEMBER 102a IS POSITIONED ON ROTATING-SLIDING SHAFT 176

ARRANGING MEMBER 102a IS POSITIONED EVACUATION SHAFT 200a

AS SLIDING SHAFT 176 ROTATES, ARRANGING MEMBER 102a ROTATES

WHEN ARRANGING MEMBER 102a IS CONSTRAINED AND ARRANGING MEMBER 102a ROTATES, ROTATING-SLIDING SHAFT 176 AND ROTATION TRANSFERRING MEMBER 200a ROTATE AND TORSION COIL SPRING 204a IS DISTORTED.

WHEN ARRANGING MEMBER 102a IS CONSTRAINED AND ROTATING-SLIDING SHAFT 176 ROTATES TO A TARGET ANGLE, ROTATING-SLIDING SHAFT 176 AND ROTATION TRANSMITTING MEMBER 200a ROTATES AND TORSION COIL SPRING 204a IS DISTORTED.

ARRANGING MEMBER 102a AND EVACUATION SHAFT 200a ROTATES BY RELEASING EXTERNAL FORCE U

RECEIVING ROTATION POSITION

ARRANGING MEMBER 102a AND EVACUATION SHAFT 200a ROTATES BY RELEASING EXTERNAL FORCE U

OUTPUT WAVEFORM OF POSE DETECTING SENSOR

POSE DETECTING SIGNAL OF ARRANGING MEMBER 102a

POSE DETECTING SIGNAL OF ARRANGING MEMBER 102b

INITIALIZING OPERATION OF ARRANGING MEMBER WHEN POWER SOURCE IS TURNED ON,

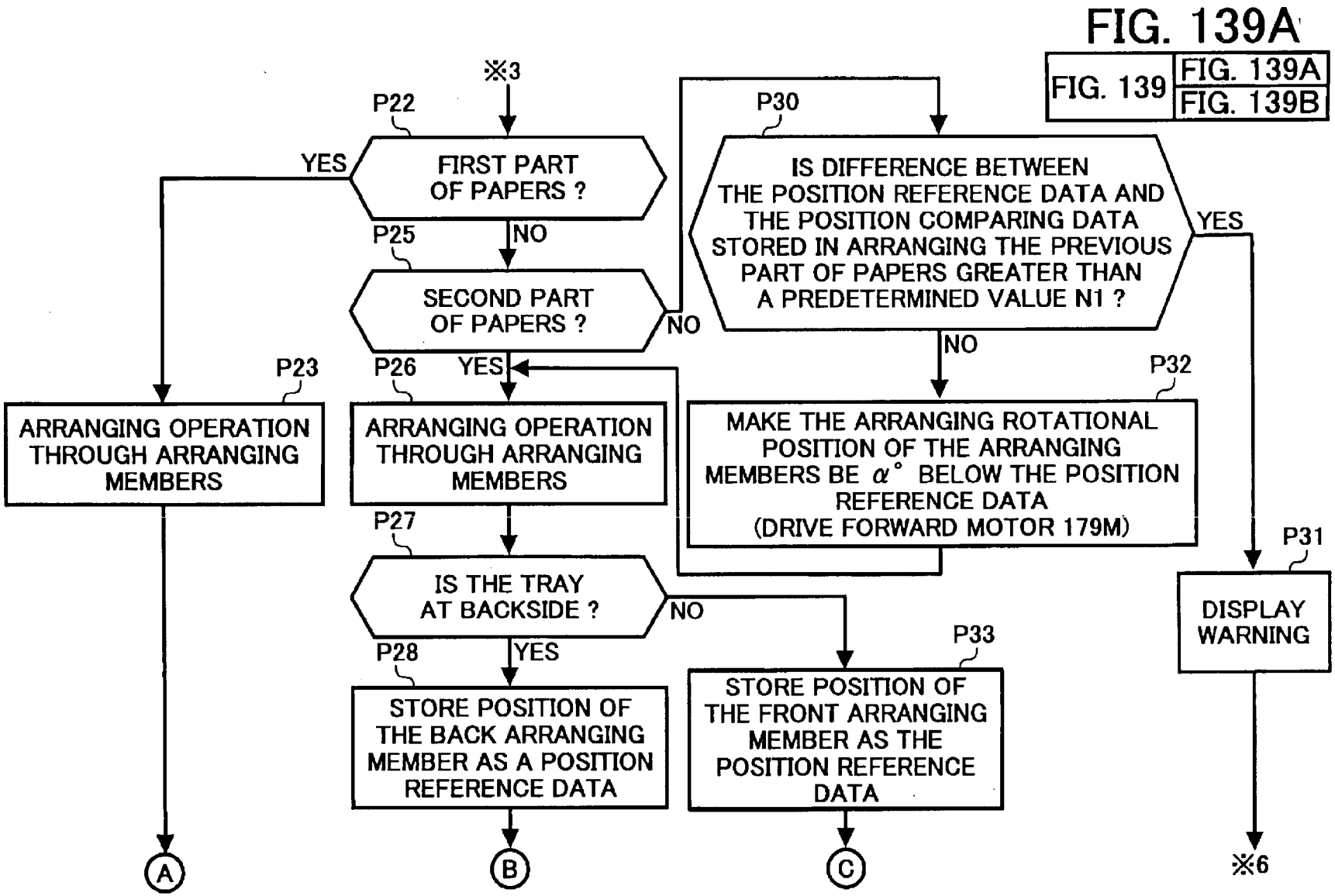
FIG. 139A
FIG. 139
FIG. 139A
FIG. 139B
※3
P22
FIRST PART OF PAPERS ?
YES
NO
P23
ARRANGING OPERATION THROUGH ARRANGING MEMBERS
A
P25
SECOND PART OF PAPERS ?
YES
NO
P26
ARRANGING OPERATION THROUGH ARRANGING MEMBERS
P27
IS THE TRAY AT BACKSIDE ?
YES
NO
P28
STORE POSITION OF THE BACK ARRANGING MEMBER AS A POSITION REFERENCE DATA
B
P30
IS DIFFERENCE BETWEEN THE POSITION REFERENCE DATA AND THE POSITION COMPARING DATA STORED IN ARRANGING THE PREVIOUS PART OF PAPERS GREATER THAN A PREDETERMINED VALUE N1 ?
YES
NO
P31
DISPLAY WARNING
※6
P32
MAKE THE ARRANGING ROTATIONAL POSITION OF THE ARRANGING MEMBERS BE α° BELOW THE POSITION REFERENCE DATA (DRIVE FORWARD MOTOR 179M)
P33
STORE POSITION OF THE FRONT ARRANGING MEMBER AS THE POSITION REFERENCE DATA
C

SHEET-SHAPED MEDIUM ALIGNING APPARATUS, IMAGE FORMING APPARATUS, AND SHEET-SHAPED MEDIUM AFTER-TREATMENT APPARATUS

BACKGROUND OF THE INVENTION

1. Field of the Invention

The present invention relates to a sheet-shaped medium aligning apparatus, an image forming apparatus, and a sheet-shaped medium after-treatment apparatus.

2. Description of the Prior Art

It is known that there exists a sheet-shaped medium aligning apparatus for aligning a sheet-shaped medium, which is image-formed and is conveyed sequentially at regular intervals, and is aligned onto a tray as piling means in a piled state, and for sorting them.

As an example of the sheet-shaped medium aligning apparatus, an unknown highly efficient sheet-shaped aligning apparatus exists. The outline of the apparatus is that it includes discharging means for discharging a sheet-shaped medium conveyed therein, sheet piling means (hereinafter referred to as tray) for piling the sheet-shaped medium discharged by the discharging means, arranging means such as arranging members disposed adjacently each other so that the ends, which are in parallel with sheet-shaped medium discharge direction by said discharging means, of sheet-shaped medium piled on the tray are interposed therebetween, and sorting means for sorting the sheet-shaped medium by moving said tray or said arranging means by certain amount in shift direction which is perpendicular to the sheet-shaped medium discharge direction by said discharging means.

Said sheet-shaped medium aligning apparatus constitutes a part of image forming apparatus, or a part of sheet-shaped medium after-treatment apparatus, so that it aligns the next sheet-shaped medium conveyed sequentially, and executes sorting treatment as necessary.

For said alignment, arranging operation by said arranging means is implemented, and sorting action by said sorting means is implemented for said sorting, with respective actions for the alignment or the sorting being executed at regular intervals which is the same as intervals at which sheet-shaped medium are conveyed sequentially.

For instance, within the time interval during which a sheet-shaped medium is discharged and the next sheet-shaped medium is discharged, (1) returning operation (which is out of the scope of the present invention) for executing arrangement in the direction of discharge by using inclination of tray or by returning sheet-shaped medium until it rests upon end fence by means of returning means to arrange just-discharged sheet-shaped medium with edges, which are in the direction of discharge, of already discharged sheet-shaped medium, (2) arranging operation for interposing edges, which are in the direction of shift, of sheet-shaped medium between arranging means together with the same bundle of sheet-shaped medium already discharged to arrange edges of sheet-shaped medium in the direction of shift, and (3) sorting means for shifting the tray (or arranging member) by certain amount after the last sheet-shaped medium of the same bundle is discharged and before the first sheet-shaped medium of the next bundle arrives, are required.

One example of the sheet-shaped medium aligning apparatus equipped with arranging means which are capable of executing the above sorting action is described in reference to FIG. 163.

In FIGS. 163(*a*) and (*b*), a tray 12 which is movable up and down is arranged on the left of a pair of discharging rollers 3 as discharging means. The tray 12 is controlled through control function which is not shown so that it is at a distance, which is appropriate for discharging, from a nip portion of the discharging rollers 3.

A sheet-shaped medium discharged from the discharging rollers 3 is got contacted with an end fence 131 along with inclination of the tray 12 due to its weight or returning a claw which is not shown, and finally, so-called longitudinal alignment is achieved.

A pair of arranging members, which are shaped as panels, are arranged opposed to each other in the direction of piercing the plane of the drawing above the tray 12. A front arranging member is designated by reference numeral 102*a*, however, one arranging member 102*b* which is located inside through the plane of the drawing farther than the arranging member 102*a* is not shown.

An upper portion (base portion) of the arranging member 102*a* is pivotally connected with a shaft 108 having its length in the direction of piercing the plane of drawing (hereinafter, shift direction). An upper end of the arranging member 102*a* is sliding fitted into a recess defined as a pedestal 105*a*. A pedestal 105*a* is formed so that the shaft 108 and a guide shaft 109 which is parallel with the shaft 108 are capable of sliding by, and its upper portion is affixed to a belt which is mounted on and between a pair of pulleys in the direction of shift. One of pulleys supporting the belt is denoted by reference number 120*a*. In addition, a motor for driving the pulley 120*a* (stepping motor) is denoted by reference number 104*a*.

By driving the motor 104*a*, the pulley 120*a*, and therefore the belt, are rotated. In this manner, the pedestal 105*a* is displaced, and the arranging member 102*a* is displaced in the direction of shift.

A shaft 110 is arranged in parallel with the shaft 108, and is in contact with the shoulder 102*a*4 defined on the arranging member 102*a*. The contact point is located spaced apart and diagonally from the shaft 108 in the right side thereof. The shaft 110 is in contact with free end side of a L-shaped lever 113 which is rotatable about a supporting shaft 112. The other side of the lever 113 is connected to a plunger of a solenoid 115 via a spring 114.

When the solenoid 116 is off, the free end side of the arranging member 102*a* is pivoted about the shaft 108 due to its own weight so that the free end side of the arranging member 102*a* is positioned into the recess 80*a* which is defined in the tray 12, for example, as shown in FIG. 163(*a*). This position is the extremely pivoted position of the arranging member 102*a*, and the position is sustained by contact of a part of the arranging member 102*a* and a recessed portion of the pedestal 105*a*.

When the solenoid 115 is turned off, if there is a sheet-shaped medium during pivoting movement, the arranging member 102*a* rests upon the sheet-shaped medium during pivoting movement and stops pivoting, and otherwise, pivots until it contacts inside the recess 80*a* of the tray 12 (rotating position for arrangement). Rotating position for arrangement is a position in the direction of rotation of the arranging member, and in this rotating position for arrangement, arrangement position in the direction of shift can be taken.

If the solenoid 115 is turned on, as shown in FIG. 163(*b*), shaft 110 is pressed down by lever 113, being guided through a long hole 90*a*, and the arranging member 102*a* pivots about the shaft 108 and is evacuated above the tray 12 (rotating position for evacuation).

As described above, since the same structure as the structure for driving the arranging member 102*a* is applied for the arranging member 102*b*, by operating the stepping motor 104*a* for driving the arranging member 102*a* and stepping motor 104*b* for driving the arranging member 102*b* which is not shown, respectively, the arranging members 102*a* and 102*b* can be approached or separated each other. In addition, by this operation, so-called transverse arrangement which means arrangement of the sheet-shaped medium discharged onto the tray 12 in the direction of shift can be executed.

When discharge for a bundle of sheets having a certain number of sheets are finished by executing the transverse arrangement by action of the arranging member 102*a* and 102*b* upon each sheet-shaped medium being discharged onto the tray 12, the tray 12 is displaced in the direction of shift to sort the next bundle from the previous one before the next bundle of the sheet-shaped medium start to be discharged.

Regarding the first invention, if the arranging members 102*a*, 102*b* remain in the same position as during arranging operations and do not follow the movement of the tray 12, the arranged sheet-shaped medium may be disarranged by being caught by any of the arranging members 102*a*, 102*b*.

Thus, prior to displacement of the tray 12, for example, solenoid is turned on. Then, since free end side of the arranging member 102*a* (102*b*) is moved upward as shown in FIG. 162(*b*), the sheet-shaped medium, which have been already arranged and piled on the tray 12 can be arranged without being disarranged.

According to the sheet-shaped medium alignment apparatus of the present invention, when the arranging member 102*a* (102*b*) is rotated about the shaft 108 toward a rotating position for evacuation, the shaft 110 is pressed down by the force of the solenoid 115. Since the range of pivoting of the arranging member 102*a* (102*b*) is determined by up and down stroke of the shaft 110, the range of pivoting is limited as such. Displacement amounts of the arranging means 102*a*, 102*b* are not determined only by two positions, i.e., the rotating positions for arrangement and evacuation shown in FIG. 163, and the arranging member 102*a* (102*b*) is always located above the tray 12.

When the sheet-shaped medium piled on the tray 12 is taken up by a proper operator, the operator's hand may be injured by being scratched by the arranging member 102*a* (102*b*), or the arranging member 102*a* (102*b*) may be broken during the piled sheet-shaped medium being picked up from the tray 12.

Regarding the second invention, in the structure including sheet piling means moving up and down in the vicinity of discharging opening which is equipped with ejecting means, protruded arranging means may disturb the up and down movement of sheet piling means.

Regarding the third invention, as described above, when the solenoid 115 is off, if there is the sheet-shaped medium during pivoting movement, the arranging member 102*a* will rest upon the sheet-shaped medium during pivoting movement and stop pivoting, and otherwise, pivot until it contacts inside the recess 80*a* of the tray 12 (rotating position for arrangement). The arranging member 102*b* behaves likewise.

Distance from the discharging rollers 3 to the tray 12, i.e., height of tray is sensed by a sensor not shown, and so controlled that the free ends of the arranging members 102*a*, 102*b* face the sides of the sheet-shaped medium on the tray 12, and arranging function is completed in this manner.

In addition, each arranging member 102*a*, 102*b* which is in rotating position for arrangement is in extreme pivot position, as described above, and this position is sustained by part of the arranging member 102*a* being in contact with recessed end of the pedestal 105*a*.

In sorting mode, posture of the arranging member is alternated between two positions per every bundle, that is, between being rested on the sheet-shaped medium and being faced with side ends of sheets. Also, in a simple piling mode, other than sorting mode, free end side of the arranging means is situated at the respective side end of the sheet-shaped medium so that each time sheet-shaped medium is sent to between the arranging members, arranging members are moved toward each other to arrange the sheet-shaped medium.

The sheet-shaped medium discharged and piled onto the tray 12 may be curled due to various factors, and direction of this curling is tend to depend on model of apparatus. Either in the case of sorting mode or simple piling mode without sorting, as the amount of sheet-shaped medium piled on tray is getting increased, tendency to curl becomes intensified, therefore, in accordance with direction or size of curl of the sheet-shaped medium piled on the tray 12, the free end side of the arranging member, which is in rotating position for arrangement, strikes the sheet-shaped medium in vain, or the arranging member disturbs shifting of the tray 12 to impede arrangement of sheets, resulting in incomplete arranging function.

The object of the third invention is to provide a sheet-shaped medium aligning apparatus, an image forming apparatus, and a sheet-shaped medium after-treatment apparatus which can implement good arrangement function by means of arranging member even if curling of a sheet-shaped medium piled on sheet piling means occurs.

SUMMARY OF THE INVENTION

In order to accomplish above objects, the present invention has constitutions as described below.

(The First Invention)

(1) A sheet-shaped medium aligning apparatus including discharging means for discharging a sheet-shaped medium conveyed therein, sheet piling means for piling the sheet-shaped medium discharged by the discharging means, arranging means for arranging the sheet-shaped medium by interposing therebetween the ends, which are parallel with the sheet-shaped medium discharge direction by said discharging means, of the sheet-shaped medium piled on the sheet piling means, and sorting means for sorting the sheet-shaped medium by moving said sheet piling means or said arranging means by certain amount in shift direction which is perpendicular to the sheet-shaped medium discharge direction, wherein said arranging means can be moved from a position where said arranging means perform arranging operation for the sheet-shaped medium on said sheet piling means to position where said arranging means are received in a main body to be received, and also can be moved from said receiving position to position where the arranging means perform said arranging operation (claim 1). According to the first aspect of the present invention, it is possible to avoid injury of operator's hands during picking up the sheet-shaped medium by being disturbed by the arranging means, or breakage of the arranging means.

(2) The sheet-shaped medium aligning apparatus described in paragraph (1), wherein said arranging means are displaced by rotating motion from said receiving position (rotating position for receiving) to position to perform said arranging operation (rotating position for arranging) (claim 2). According to the second aspect of the present invention, a simple structure can be obtained by rotating motion around a rotating shaft.

(3) The sheet-shaped medium aligning apparatus described in paragraph (2), wherein a guide which allows said arranging means to move sliding in said shift direction about the rotating shaft which is the center of said rotating motion is provided (claim 3). According to the third aspect of the present invention, a structure of the apparatus is simplified by common use of driving means. According to the fourth aspect of the present invention, displacement between the rotation position and receiving position can be obtained simply by rotating motion.

(4) The sheet-shaped medium aligning apparatus described in paragraph (3), wherein said arranging member is moved to said rotation position for receiving to be received by rotating said rotating shaft (claim 4). According to the fifth aspect of the present invention, it is possible to pivot said arranging member to three positions by one common driving means.

(5) The sheet-shaped medium aligning apparatus described in any of paragraph (2) to (4), wherein said arranging means can be moved by rotating said rotating shaft so that, in rotating position for arrangement, rotating position for receiving and rotating position between said rotating position for arrangement and said rotating position for receiving, free end side of said arranging member can be moved from the sheet-shaped medium on the tray to rotating position for evacuation where said arranging means are evacuated, and this movement can be executed by a driving source of said rotating shaft (claim 5).

(6) The sheet-shaped medium aligning apparatus described in paragraph (5), wherein said arranging means have certain amount of free rotation area about said rotating shaft (claim 6). According to the sixth aspect of the present invention, an arranging member is rotated with a rotating shaft, while free end side of the arranging member is forced up due to its own weight to perform arranging operation.

(7) The sheet-shaped medium aligning apparatus described in paragraph (6), wherein said rotation area is defined by a gap in said rotation direction in engagement portion between a convex portion formed in either one of said rotating shaft or said arranging member and a concave portion formed in the other one (claim 7), According to the seventh aspect of the present invention, an arranging operation is performed by rotating the arranging member with the rotating shaft, while forcing up free end side of the arranging member using its own weight.

(8) The sheet-shaped medium aligning apparatus described in any one of paragraph (3) through (7), wherein said arranging means include a pair of arranging members for performing arranging operation in which positions of two ends of the sheet-shaped medium, which are in parallel with said discharge direction, are arranged by putting the sheet-shaped medium, which is discharged from said discharging means and piled on said tray, with the two ends thereof lying between the arranging members and getting in contact with the arranging members, and the arranging means perform said arranging operation to arrange the sheet-shaped medium piled after said sorting action in different position from the sheet-shaped medium piled before said sorting action so that the arranging means are received into a main body of the apparatus by being pivoted at a predetermined position as a home position thereof (claim 8). According to the invention described in the 8th aspect of this invention, the arranging member can be briefly moved into received position for every sheet-shaped medium having various sizes available.

(9) The sheet-shaped medium aligning apparatus described in paragraph (8), wherein after completion of a series of arranging actions, said arranging means are moved to said home position, then received into said rotating position for receiving (claim 9). According to the invention of the 9th aspect of this invention, rapid movement from rotating position for receiving to the home position is possible.

(10) The sheet-shaped medium aligning apparatus described in paragraph (9), wherein if there are subsequent jobs to be done, it is prohibited that said arranging member is moved to said home position and received into said rotating position for receiving (claim 10). According to the invention of the 10th aspect of this invention, since time required for reciprocation to the home position is saved, time for moving to receiving position for subsequent job can be shorten.

(11) The sheet-shaped medium aligning apparatus described in any of paragraph (8) to (10), wherein if load exceeding certain amount is applied to the arranging member during rotation of said arranging member, configuration which prevents said arranging member from pivoting toward said rotating position for receiving is employed (claim 11). According to the invention of the 11th aspect of this invention, there is no possibility of injury when rotation is blocked by hands.

(12) The sheet-shaped medium aligning apparatus described in paragraph (11), wherein said load exceeding certain amount is set as a load that is stronger than a load that will not hurt human body in case that pivot movement of the arranging member is blocked by some part of human body (claim 12). According to the invention of the 12th aspect of this invention, injury of human body is avoided.

(13) The sheet-shaped medium aligning apparatus described in paragraph (12), wherein said arranging member is adapted to apply energized force in rotating direction (claim 13). According to the invention of the 13th aspect of this invention, it is easy to establish safe rotation by regulating the energized force.

(14) The sheet-Shaped medium aligning apparatus described in paragraph (13), wherein said energized force is automatically applied by the movement of said arranging member from said receiving position to said home position (claim 14). According to the invention of 14th aspect of this invention, safety for home position is guaranteed.

(15) The sheet-shaped medium aligning apparatus described in paragraph (14), wherein an evacuation shaft with a convex portion or concave portion engagingly separable with a concave portion or convex portion defined in said arranging member is disposed in said home position on said rotating shaft, the evacuation shaft is pressed by energized forcing means so that rotation force which is in the same direction as the direction of rotation of said arranging means during receiving is applied, and rotation of said evacuation shaft by the energized forcing means is stopped by a stopper at a certain rotation position (claim 15). According to the 15th aspect of the present invention, engagement with the arranging member is made easier by holding the position of jogger evacuation shaft.

(16) The sheet-shaped medium aligning apparatus described in paragraph (15), wherein said certain rotation position of said evacuation shaft was selected to be the same rotation position as the convex portion or concave portion defined in said rotating shaft (claim 16). According to the 16th aspect of the present invention, on rotating shaft, it is possible to automatically engage with jogger evacuation member without depending on the movement of the arranging member to the rotation position for receiving. According to the 17th aspect of the present invention, it is possible to maintain the arranging member engaged and integrated with the jogger evacuation shaft in the same rotation position as the convex portion or concave portion defined in said rotating shaft.

(17) The sheet-shaped medium aligning apparatus described in paragraph (16), wherein a stopper of said evacuation shaft is comprised by combination of an arc-shaped long hole, having its center at core of said rotating shaft, which allows said arranging member to rotate in a certain rotation range in opposite direction to the rotation direction thereof during receiving, and projection engaged with the long hole, and the shaft was arranged integrally with said rotating shaft (claim 17).

(18) The sheet-shaped medium aligning apparatus described in paragraph (17), wherein said certain rotation range is pivot range of said arranging member about said rotating shaft, and range in which said arranging member can be displaced by rotating from said rotating position for arrangement to rotating position for receiving (claim 18). According to the 18th aspect of the present invention, since idle rotation of the arranging member about the rotating shaft is possible in the region between rotation positions from rotation position for arrangement to rotation position for receiving, accident can be avoided.

(19) An image forming apparatus including image forming means for performing image forming on a sheet-shaped medium and conveyance means for conveying the sheet-shaped medium on which image forming has been done, wherein the sheet-shaped medium aligning apparatus described in any of paragraph (1) to (18) is provided (claim 19). According to the 19th aspect of the present invention, safety is assured for the image forming apparatus.

(20) A sheet-shaped medium after-treatment apparatus including sheet-shaped medium after-treating means for performing after-treatment on a sheet-shaped medium and conveyance means for conveying the sheet-shaped medium on which after-treatment has been done, wherein the sheet-shaped medium aligning apparatus described in any of paragraph (1) to (18) is provided (claim 20). According to the 20th aspect of the present invention, safety is assured for the sheet-shaped medium after-treatment apparatus.

(21) The sheet-shaped medium after-treatment apparatus described in paragraph (20), wherein said sheet piling means are configured to move up and down through said discharging means (claim 21). According to the 21st aspect of the present invention, arrangement performance for the sheet piling means, which move up and down through the discharging means, are improved by receiving the arranging means in a main body, (The Second Invention)

(1) A sheet-shaped medium aligning apparatus including discharging means for discharging a sheet-shaped medium conveyed therein, sheet piling means for piling the sheet-shaped medium discharged by the discharging means, arranging means for arranging the sheet-shaped medium by interposing therebetween the ends, which are parallel with the sheet-shaped medium discharge direction by said discharging means, of the sheet-shaped medium piled on the sheet piling means, and sorting means for sorting the sheet-shaped medium by moving said sheet piling means or said arranging means by certain amount in shift direction which is perpendicular to the sheet-shaped medium discharge direction, wherein driving means are provided for executing arrangement operation by allowing said arranging means to be received by being moved from arranging operation area, where arranging operation for the sheet-shaped medium can be performed on said sheet piling means, to receiving area in a main body, and by moving said arranging means from said arranging operation area to said receiving area (claim 22). According to the 22nd aspect of the present invention, the structure can be simplified by common use of driving means.

(2) The sheet-shaped medium aligning apparatus described in paragraph (1), wherein, in said shift direction, said receiving area was arranged outside said discharging means (claim 23). According to the 23rd aspect of the present invention, the arranging means can be received in safe area without being interfered by the discharging means.

(3) The sheet-shaped medium aligning apparatus described in paragraph (1), wherein, in said shift direction, position which corresponds to said receiving area was determined as the home position (claim 24). According to the 24th aspect of the present invention, it is easy to control.

(4) The sheet-shaped medium aligning apparatus described in paragraph (1), wherein, in said shift direction, said receiving area was arranged outside said arranging operation area (claim 25). According to the 25th aspect of the present invention, it is relatively easy to arrange receiving area since any member or device necessary for arranging operation is disposed outside arranging operation area.

(5) The sheet-shaped medium aligning apparatus described in paragraph (1), wherein, in said shift direction, said receiving area was arranged outside said sheet piling means (claim 26). According to the 26th aspect of the present invention, in shift direction, up and down movement of the sheet piling means is not disturbed since receiving area is disposed outside the sheet piling means.

(6) The sheet-shaped medium aligning apparatus described in paragraph (5), wherein since said sheet piling means shift between at least two stationary positions, said arranging means are determined to be received in said receiving area when it is in a arbitrary position between the two stationary positions (claim 27). According to the 27th aspect of the present invention, during receiving the arranging means, interference between the arranging means and sorted/arranged sheet-shaped medium is avoidable.

(7) The sheet-shaped medium aligning apparatus described in any of paragraph (1) to (6), wherein said arranging means are engaged sliding and pivotally with a guide shaft which is disposed so that the longitudinal direction of its guide pipe formed in base thereof corresponds to said shift direction (claim 28). According to the 28th aspect of the present invention, arranging means can be evacuated to receiving position where hand of operator is not disturbed during picking up sheet-shaped medium by reciprocating arranging means in shift direction to arrange sheet-shaped medium, and after the arranging operation, by pivoting the arranging means.

(8) The sheet-shaped medium aligning apparatus described in paragraph (7), wherein an engagement recess having depth in perpendicular direction to said guide shaft is defined in said guide pipe, wherein part of driving block for applying driving force reciprocatable in said shift direction is sliding engaged with said engagement recess, and wherein said guide pipe is adapted to pivot to said receiving position about said guide shaft within a range in which said engagement do not released (claim 29). According to the 29th aspect of the present invention, since arranging operation required by arranging means and pivoting action toward receiving position can be performed by power transmission from driving block, operational mechanism can be simplified.

(9) The sheet-shaped medium aligning apparatus described in paragraph (8), wherein regulating means for regulating position of pivot of said arranging means are formed in outer periphery of said guide pipe (claim 30). According to the 30th aspect of the present invention, the arranging means can take certain position such as rotating positions for arrangement, evacuation and receiving.

(10) The sheet-shaped medium aligning apparatus described in paragraph (9), wherein said regulating means comprise a first projection which is part of means for regulating rotation of said arranging means due to its own weight to put posture of said arranging means into rotating position for arranging in said arranging operation area, and a second projection engageable with recess of cam disposed in area corresponding to said receiving area (claim 31). According to the 31st aspect of the present invention, rotating position for arrangement for rotating area for arrangement, and received state for receiving area are automatically realized.

(11) The sheet-shaped medium aligning apparatus described in paragraph (10), wherein said recess of cam comprises a straight line section extending toward said shift direction and curved section for rotating free end of said arranging means toward said receiving area (claim 32). According to the 32nd aspect of the present invention, the second projection can be guided into the recess of cam smoothly.

(12) The sheet-shaped medium aligning apparatus described in paragraph (10) or (11), wherein said first projection is engaged with weight rod guided and supported on said driving block to be operative within certain range of stroke so that arranging means are pivoted about said guide shaft by moment due to self-weight of said arranging means toward said rotating position of arrangement, and press-driven by press-driving means using solenoid to be displaced from rotating position for arrangement to rotating position for evacuation (claim 33). According to the 33rd aspect of the present invention, by means of the press-driving means, the arranging means can be switched simply and reliably at rotating position for arrangement and rotating position for evacuation.

(13) The sheet-shaped medium aligning apparatus described in paragraph (12), wherein said weight rod is disposed to correspond to the arranging operation area, and does not reach the area corresponding to said receiving area, and wherein a sensor for switching said press-driving means to off state is disposed just before the position where said guide pipe is introduced into said recess of cam (claim 34). According to the 34th aspect of the present invention, the second projection can be introduced smoothly into the recess of cam by automatically displacing arranging means to arranging position for evacuation.

(14) The sheet-shaped medium aligning apparatus described in paragraph (10) to (12), wherein said first projection is engaged with weight rod, with the first projection above said second projection (claim 35). According to the 35th aspect of the present invention, in the arranging operation area where weight rod can reach, the arranging means can be put reliably in rotating position for arrangement or in rotating position for evacuation by securely press-driving weight rod with the first projection.

(15) The sheet-shaped medium aligning apparatus described in paragraph (12), wherein said arranging means press up said weight rod to upper limit of said stroke using its own weight so that said arranging means are sustained at said rotating position for arrangement, and wherein weight rod press-driving means press- drive said weight rod said weight rod to lower limit of said stroke so that said arranging means are displaced to said rotating position for evacuation (claim 36). According to the 36th aspect of the present invention, by means of the press-driving means, arranging means can be simply and securely switched to rotating position for arrangement and evacuation.

(16) The sheet-shaped medium aligning apparatus described in paragraph (15), wherein, when said weight rod press-driving means are on, said arranging means are in a position where said second projection conforms to inlet of said recess of cam (claim 37). According to the 37th aspect of the present invention, the second projection can be smoothly directed to the recess of cam.

(17) The sheet-shaped medium aligning apparatus described in paragraph (16), wherein as means for detecting whether said arranging means are received in said receiving area, a sensor which detects a position of said driving block in shift direction is disposed (claim 38). According to the 38th aspect of the present invention, although indirect, it can be sensed whether the arranging means reach the receiving area.

(18) An image forming apparatus including image forming means for forming image on a sheet-shaped medium and means for conveying the sheet-shaped medium on which an image has been formed, wherein the sheet-shaped medium aligning apparatus described in any of paragraph (1) to (17) is provided (claim 39). According to the 39th aspect of the present invention, safety can be assured for the image forming apparatus.

(19) A sheet-shaped medium after-treatment apparatus including after-treatment means for an after-treating sheet-shaped medium and conveyance means for conveying the sheet-shaped medium on which after-treatment has been formed, wherein the sheet-shaped medium aligning apparatus described in any of paragraph (1) to (17) is provided (claim 40). According to the 40th aspect of the present invention, safety can be assured for the sheet-shaped medium after-treatment apparatus during evacuation of an arranging member.

(20) The sheet-shaped medium after-treatment apparatus described in paragraph (19), said sheet piling means are configured to reciprocate through said discharging means (claim 41). According to the 41st aspect of the present invention, by receiving the arranging means in the main body, aligning performance for the sheet piling means which reciprocate through the discharging means can be enhanced.

(The Third Invention)

(1) A sheet-shaped medium aligning apparatus including discharging means for discharging a sheet-shaped medium conveyed therein, sheet piling means for piling a sheet-shaped medium discharged by the discharging means, arranging members for arranging the sheet-shaped medium by interposing therebetween the ends, which are parallel with a sheet-shaped medium discharge direction by said discharging means, of sheet-shaped medium piled on the sheet piling means, wherein said arranging member is supported on a rotating shaft so that its base can rotate freely in certain range of rotation, and wherein posture of said arranging member can be controlled toward arrangement position where said ends are interposed between said arranging members by controlling amount of rotation of the rotating shaft (claim 42). According to the 42nd aspect of the present invention, on arranging operation, the arranging operation can be executed without being affected by direction of and size of curl of the sheet-shaped medium piled on the sheet piling means.

(2) The sheet-shaped medium aligning apparatus described in paragraph (1), wherein sorting means for sorting the sheet-shaped medium by moving said sheet piling means or said arranging means by certain amount in shift direction which is perpendicular to the sheet-shaped medium discharge direction are further provided, and wherein, during arranging operation in sorting mode, under the condition that one arranging member rides on top of the sheet-shaped medium constituting previous bundle which have been completely piled and the other arranging member faces said end of the bundle of the sheet-shaped medium at arranging position, when the arranging members arrange sheet-shaped medium so that the ends of the medium which are parallel with discharge direction of the sheet-shaped medium get interposed between the opposed arranging members upon each discharge of the sheet-shaped medium, posture of said other arranging member can be controlled to interpose said ends therebetween based on detection result on posture of said one arranging member which rides on said bundle of the sheet-shaped medium (claim 43). According to the 43rd aspect of the present invention, arranging members arrange the sheet-shaped medium so that arranging portion thereof can surely abut against the end of the sheet-shaped medium without being affected by direction or size of curl of the sheet-shaped medium piled on the sheet piling means.

(3) The sheet-shaped medium aligning apparatus described in paragraph (2), wherein, when arranging next bundle of the sheet-shaped medium, ends of the sheet-shaped medium can be interposed between the arranging members by detecting rotation angle of the arranging member riding on said bundle of the sheet-shaped medium from the position of said sheet-piling means (claim 44). According to the 44th aspect of the present invention, the sheet-shaped medium can be reliably arranged by arranging members regardless of direction and amount of curl of the sheet-shaped medium, and the number of the sheet-shaped medium piled on the sheet piling means.

(4) The sheet-shaped medium aligning apparatus described in paragraph (2), wherein each arranging member is rotated from rotating position for evacuation, where the sheet-shaped medium piled on the sheet piling means are not disturbed by the arranging member, until rotation of the member is stopped by said certain range of angle, the rotation angles are compared, the arranging member which rides on said sheet-shaped medium is identified from the fact that the arranging member whose rotation angle is smaller than the other corresponds the riding arranging member, and rotation angle of the arranging member is detected, and in this manner, postures of the arranging members are controlled so that ends of the sheet-shaped medium can be interposed therebetween during arranging operation for the next bundle of the sheet-shaped medium (claim 45). According to 45th aspect of the present invention, the sheet-shaped medium can be reliably arranged by the arranging members regardless of direction and amount of curl of the sheet-shaped medium, and the number of the sheet-shaped medium piled on the sheet piling means.

(5) The sheet-shaped medium aligning apparatus described in paragraph (4), wherein, if difference between rotation angles compared about each arranging member exceeds certain amount, alarm is triggered (claim 46). According to the 46th aspect of the present invention, even if a serious curl, which can make further arranging operation in sorting mode impossible, is occurred, since further arranging operation in that situation can be prohibited, arranging operation for total bundle can be executed.

(6) The sheet-shaped medium aligning apparatus described in any of paragraph (2) to (6), wherein an encoder is disposed at said base of said arranging member so that slit of the encoder can be detected by a plurality of detectors disposed at several other positions (claim 47). According to the 47th aspect of the present invention, when the arranging member rotates upwardly and downwardly about the sliding rotating shaft, since it can be detected whether upward or downward rotation is done, posture position of the arranging member can be properly determined.

(7) The sheet-shaped medium aligning apparatus described in paragraph (6), wherein said sensor moves in connection with said arranging member in the direction which is perpendicular with discharge direction of the sheet-shaped medium (claim 48). According to the 48th aspect of the present invention, although position of the arranging member is changed to conform with size of the sheet-shaped medium, posture of arranging member can always be detected.

(8) The sheet-shaped medium aligning apparatus described in paragraph (1), wherein the arranging members are controlled so that said arranging position corresponding to the number of the sheet-shaped medium piled on said sheet-shaped means is taken (claim 49). According to the 49th aspect of the present invention, since arranging portion of the arranging member can certainly abuts against ends of the sheet-shaped medium under arrangement, arrangement can be surely executed regardless of direction of curl.

(9) The sheet-shaped medium aligning apparatus described in paragraph (1), wherein, during simple piling mode, if certain number of the sheet-shaped medium is to be discharged onto said sheet piling means, said free end of one arranging member is put on said sheet-shaped medium, posture of said arranging member is detected, and, based on this data, said arranging member can be changed in its posture to a position where said ends are interposed between said arranging members (claim 50). According to the 50th aspect of the present invention, arrangement for simple piling can be executed without being affected by direction or amount of curl of the sheet-shaped medium piled on the sheet piling means.

(10) The sheet-shaped medium aligning apparatus described in paragraph (1), wherein, during simple piling mode, if certain number of the sheet-shaped medium is to be discharged onto said sheet piling means, each free end of two arranging members opposed in the direction perpendicular to discharge direction of the sheet-shaped medium is put on said sheet-shaped medium, posture of said arranging member is detected, and, based on this data, said arranging member can be changed in its posture to said position where said ends are interposed between said arranging members (claim 51). According to the 51st aspect of the present invention, arrangement can be reliably executed in that arranging portion of the arranging members surely abut against ends of the sheet-shaped medium without being affected by direction or amount of curl of the sheet-shaped medium piled on the sheet piling means.

(11) The sheet-shaped medium aligning apparatus described in paragraph (10), wherein arranging member's posture is adjusted to interpose said ends of the sheet-shaped medium therebetween based on position of the arranging member, among said two arranging members, whose free end side is lower than the other (claim 52). According to the 52nd aspect of the present invention, arrangement can be reliably executed because arranging portion of the arranging members surely abut against ends of the sheet-shaped medium without being affected by direction or amount of curl of the sheet-shaped medium piled on sheet piling means.

(12) The sheet-shaped medium aligning apparatus described in any of paragraph (9) to (11), wherein time interval for discharging the sheet-shaped medium is lengthened by delaying discharge timing for the sheet-shaped medium from said discharging means, and posture of said arranging member is detected and adjusted during the time interval for discharging (claim 63). According to the 53rd aspect of the present invention, time for detecting or adjusting the posture of the arranging member is secured.

(13) The sheet-shaped medium aligning apparatus described in paragraph (12), wherein, for delaying said discharge timing, conveyance velocity on which the sheet-shaped medium conveyed into is reduced (claim 54). According to the 54th aspect of the present invention, time for detecting or adjusting the posture of the arranging member is secured.

(14) The sheet-shaped medium aligning apparatus described in paragraph (10), wherein difference between positions (heights) of said each free end side of said two arranging member above said sheet-shaped medium exceeds certain value, alarm is triggered (claim 55). According to the 55th aspect of the present invention, by being notified by alarm, piling of the sheet-shaped medium on the sheet piling means without any extra arrangement by operator is avoidable.

(15) A sheet-shaped medium aligning apparatus including discharging means for discharging a sheet-shaped medium conveyed therein, sheet piling means for piling the sheet-shaped medium discharged by the discharging means, arranging members for arranging the sheet-shaped medium by interposing therebetween the ends, which are parallel with the sheet-shaped medium discharge direction by said discharging means, of the sheet-shaped medium piled on the sheet piling means, wherein sorting mode in which sorting the sheet-shaped medium by moving said sheet piling means or said arranging member by certain amount in shift direction which is perpendicular to the sheet-shaped medium discharge direction is possible, base of said arranging member is supported on the rotating shaft, and, by controlling rotating amount of the rotating shaft, said arranging member can be displaced to arranging position where said ends of the sheet-shaped medium is located between said arranging members or to rotating position for evacuation which is at a distance from top surface of said sheet-shaped medium, so that the sheet-shaped medium aligning apparatus is configured to arbitrarily control said rotating position for evacuation (claim 56). According to the 56th aspect of the present invention, during shift operation of sheet piling means, arranging member can be reliably and rapidly evacuated without being affected by direction of curl of the sheet-shaped medium piled on the sheet piling means.

(16) The sheet-shaped medium aligning apparatus described in paragraph (15), wherein during operations of arranging previous bundle of sheets, evacuation angle for arranging member resting on the sheet-shaped medium on said sheet piling means from said evacuation position to said resting position on said sheet-shaped medium is memorized, then, during operation of arranging next bundle, total value of the memorized angle plus additional value is Bet as an evacuation angle of said arranging member (claim 57). According to the 57th aspect of this invention, it is possible to evacuate said arranging means reliably and rapidly during operation of shifting sheet piling means without being affected by curling direction, curling amount, and the number of piled sheets of sheet-shaped medium piled on sheet piling means.

(17) The sheet-shaped medium aligning apparatus described in paragraph (16), wherein said evacuation angle was determined on the basis of position of the arranging member, among said two arranging members, whose free end side is located higher than the other (claim 58). According to invention of 58th aspect of this invention, it is possible to evacuate said arranging means reliably and rapidly during operation of shifting the sheet piling means without being affected by unevenly occurring curl direction, curling amount, and the number of piled sheets of the sheet-shaped medium piled on the sheet piling means.

(18) The sheet-shaped medium aligning apparatus described in paragraph (15), wherein said rotating position for evacuation is determined in response to the number of the piled sheet-shaped medium on said sheet piling means (claim 59). According to the 59th aspect of the present invention, it is possible to evacuate said arranging means reliably and rapidly for any image forming apparatus.

(19) An image forming apparatus including image forming means for performing image forming on a sheet-shaped medium and conveyance means for conveying the sheet-shaped medium on which image has been formed, wherein the sheet-shaped medium aligning apparatus described in any of paragraph (1) to (18) is provided (claim 60). According to the 60th aspect of the present invention, it is possible to arrange a curled sheet-shaped medium by the arranging member for the image forming apparatus.

(20) A sheet-shaped medium after-treatment apparatus including after-treatment means for performing after-treatment on a sheet-shaped medium and conveyance means for conveying the sheet-shaped medium on which after-treatment has been done, wherein the sheet-shaped medium aligning apparatus described in any of paragraph (1) to (18) is provided (claim 61). According to the 61st aspect of the present invention, it is possible to arrange a curled sheet-shaped medium by an arranging member for the sheet-shaped medium after-treatment apparatus.

BRIEF DESCRIPTION OF THE DRAWINGS

FIG. 120(*a*) shows means for moving the arranging members seen from the left side, FIG. 120(*b*) is a front view of means for moving the arranging member, and FIG. 120(*c*) shows means for moving the arranging members seen from the right side.

FIG. 121(*a*) shows means for moving the arranging members seen from the left side, FIG. 121(*b*) is a front view of means for moving the arranging member, and FIG. 121(*c*) shows means for moving the arranging members seen from the right side.

FIG. 122(*a*) is a front view of means for moving the arranging member, and FIG. 122(*b*) is a side view of means for moving the arranging members.

FIG. 123(*a*) is a front view of means for moving the arranging member, and FIG. 123(*b*) is a side view of means for moving the arranging members.

FIG. 124(*a*) is a front view of means for moving the arranging members, and FIG. 124(*b*) shows means for moving the arranging members seen from the right side.

FIG. 125(*a*) illustrates evacuation amount of means for moving the arranging members upon being upwardly curled, and FIG. 126(*b*) illustrates evacuation amount of means for moving the arranging members upon being downwardly curled.

FIG. 126(*a*) illustrates evacuation amount of means for moving the arranging members upon being upwardly curled, and FIG. 126(*b*) illustrates evacuation amount of means for moving the arranging members mean upon being downwardly curled.

FIG. 127(*a*) shows means for moving the arranging members seen from the left side, FIG. 127(*b*) is a front view of means for moving the arranging member, and FIG. 127(*c*) shows means for moving the arranging members seen from the right side.

FIG. 128(*a*) shows means for moving the arranging members seen from the left side, FIG. 128(*b*) is a front view of means for moving the arranging member, and FIG. 128(*c*) shows means for moving the arranging members seen from the right side.

FIG. 129(*a*) shows means for moving the arranging members seen from the left side, FIG. 129(*b*) is a front view of means for moving the arranging member, and FIG. 129(*c*) shows means for moving the arranging members seen from the right side.

FIG. 130(*a*) shows means for moving the arranging members seen from the left side, FIG. 130(*b*) is a front view of means for moving the arranging member, and FIG. 130(*c*) shows means for moving the arranging members seen from the right side.

FIG. 131 is a front view of means for moving the arranging members.

Figure 132:
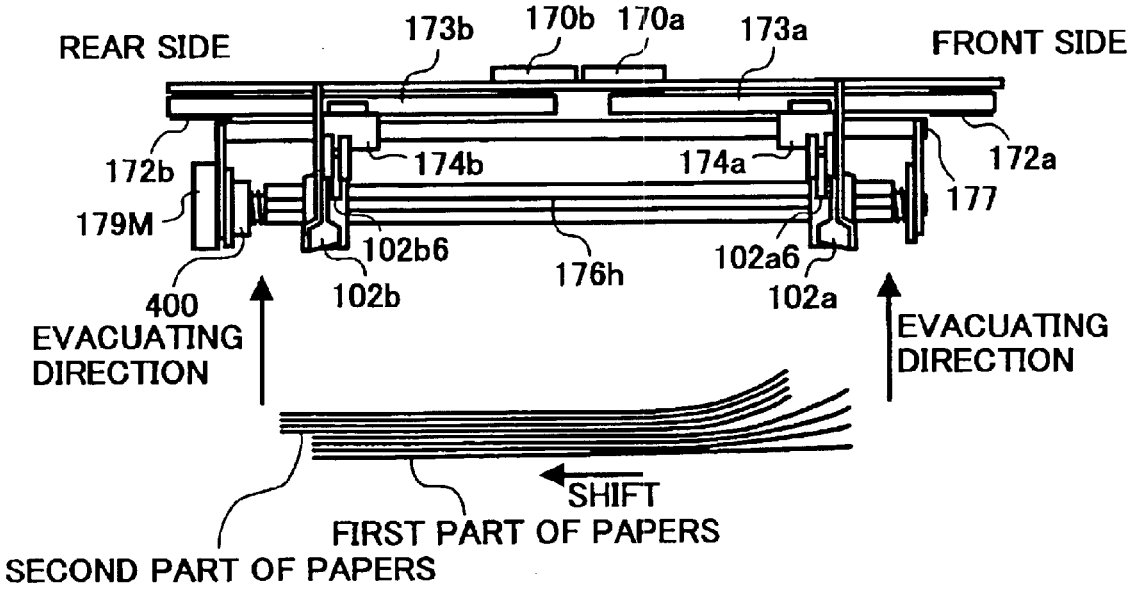

FIG. 132 is a front view of means for moving the arranging members.

Figure 133:
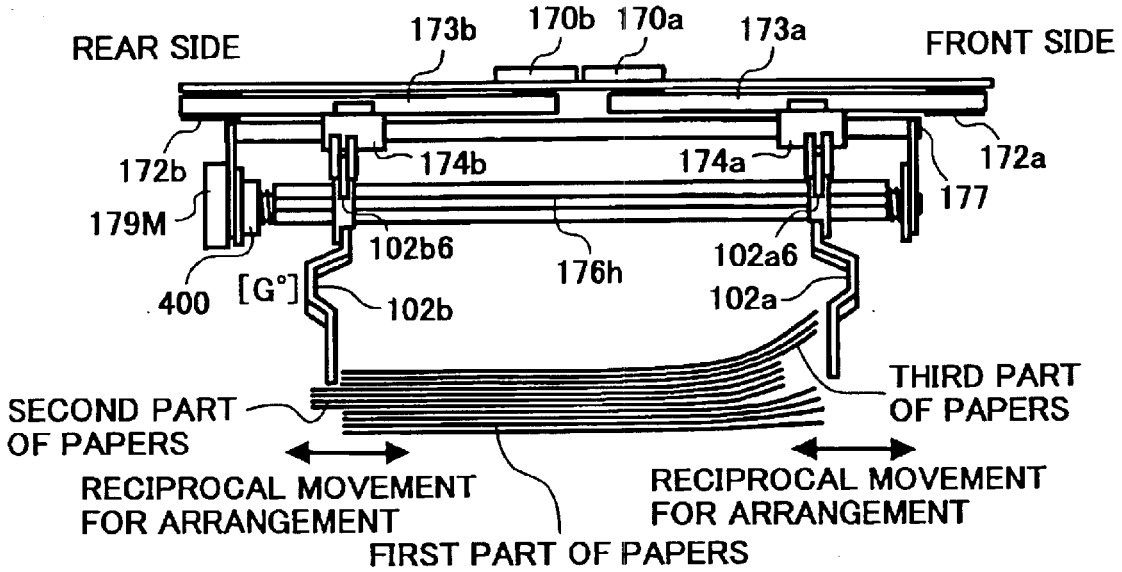

FIG. 133 is a front view of means for moving the arranging members.

Figure 134:
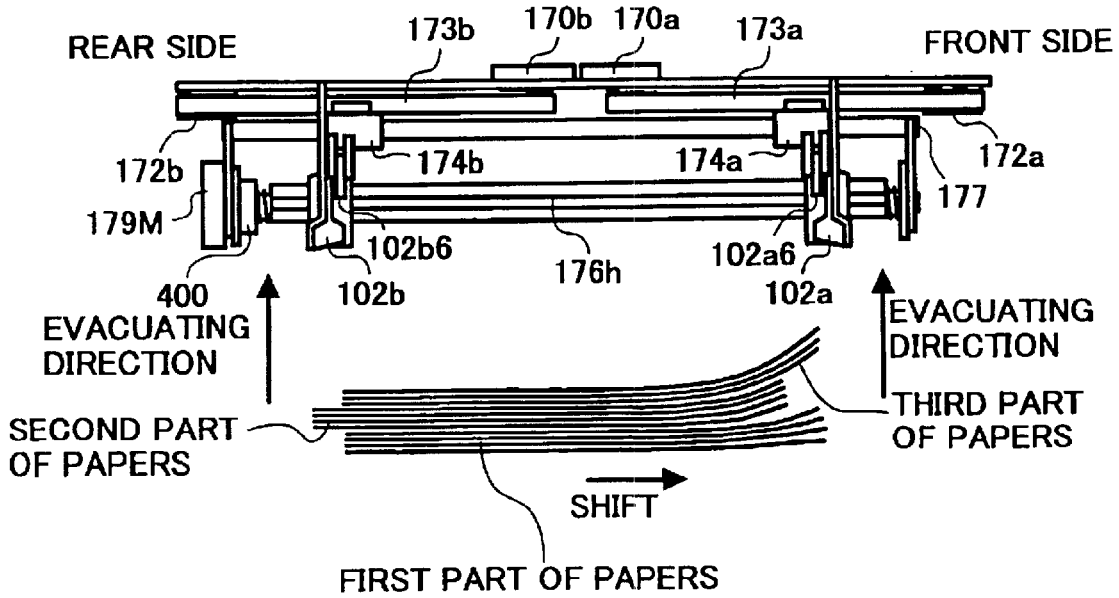

FIG. 134 is a front view of means for moving the arranging members.

Figure 135:
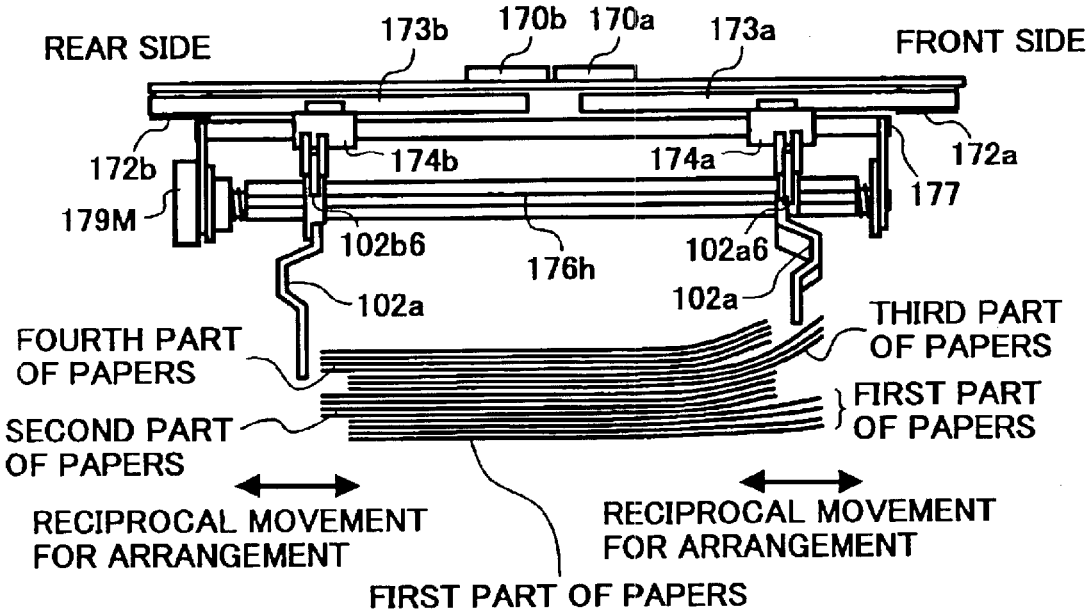

FIG. 135 is a front view of means for moving the arranging members.

Figure 136:
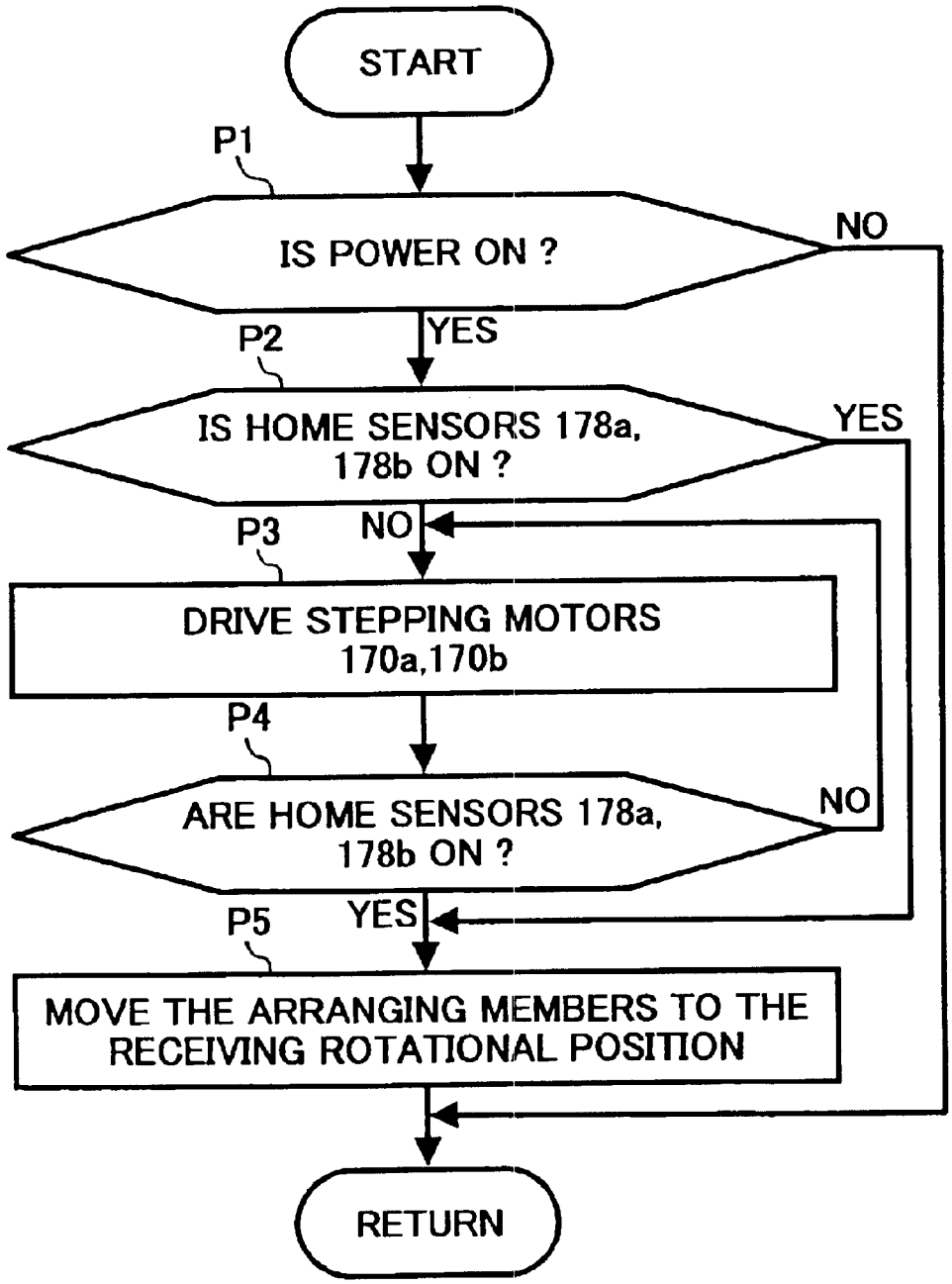

FIG. 136 is a flowchart for initial operation of arranging member when power is turned on.

Figure 137:
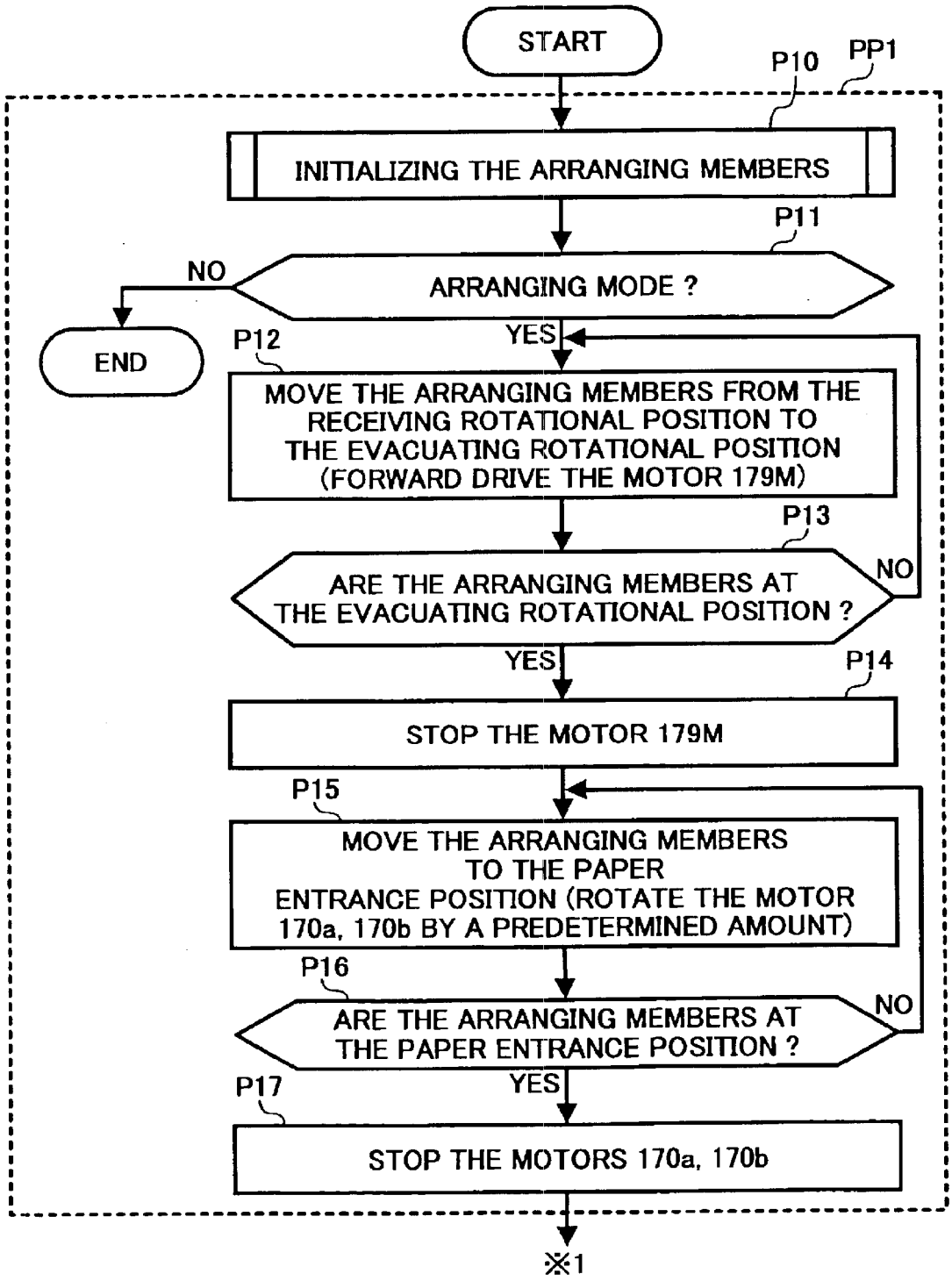

FIG. 137 is a flowchart with respect to arranging operation.

Figure 138:
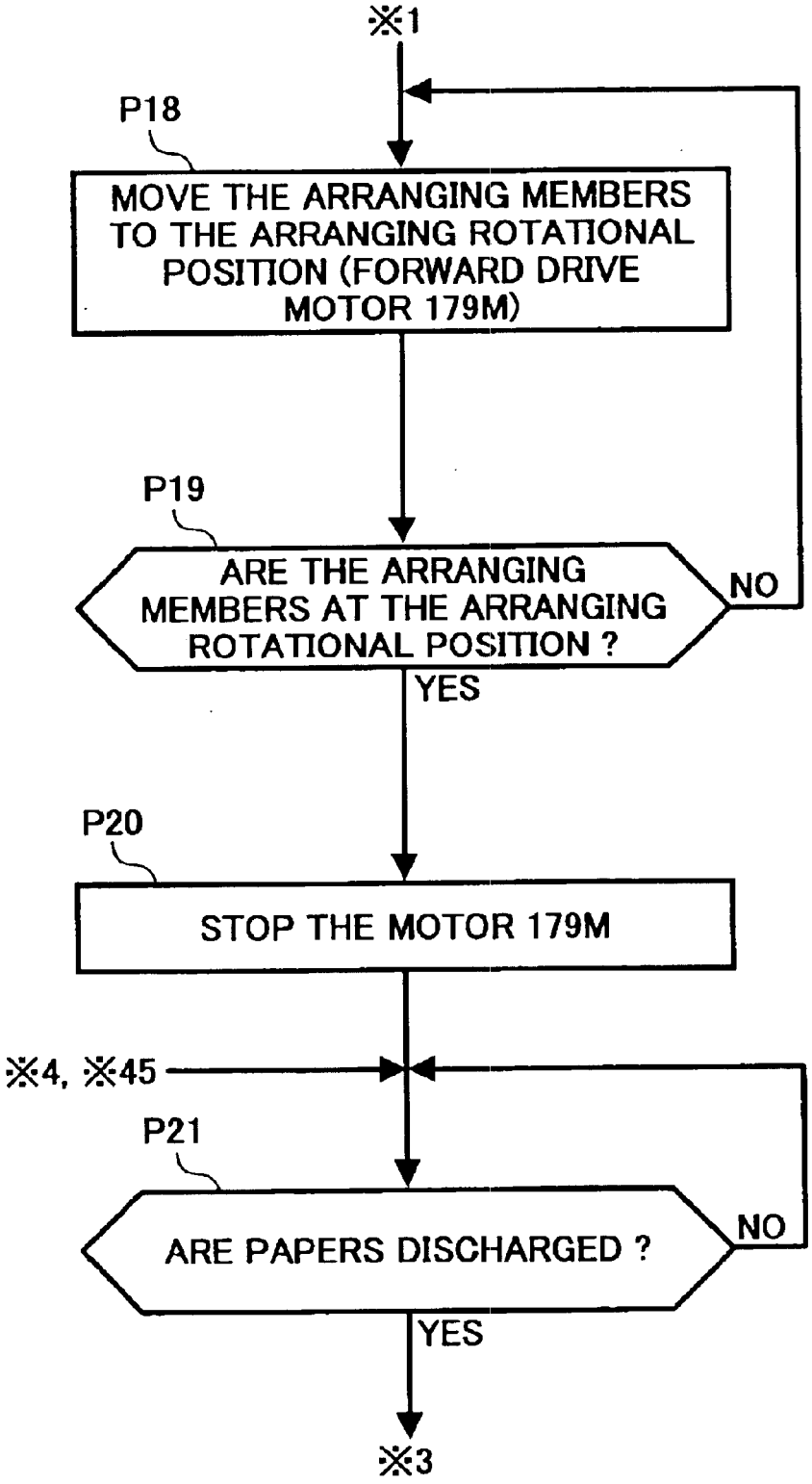

FIG. 138 is a flowchart with respect to arranging operation.

Figure 139B:
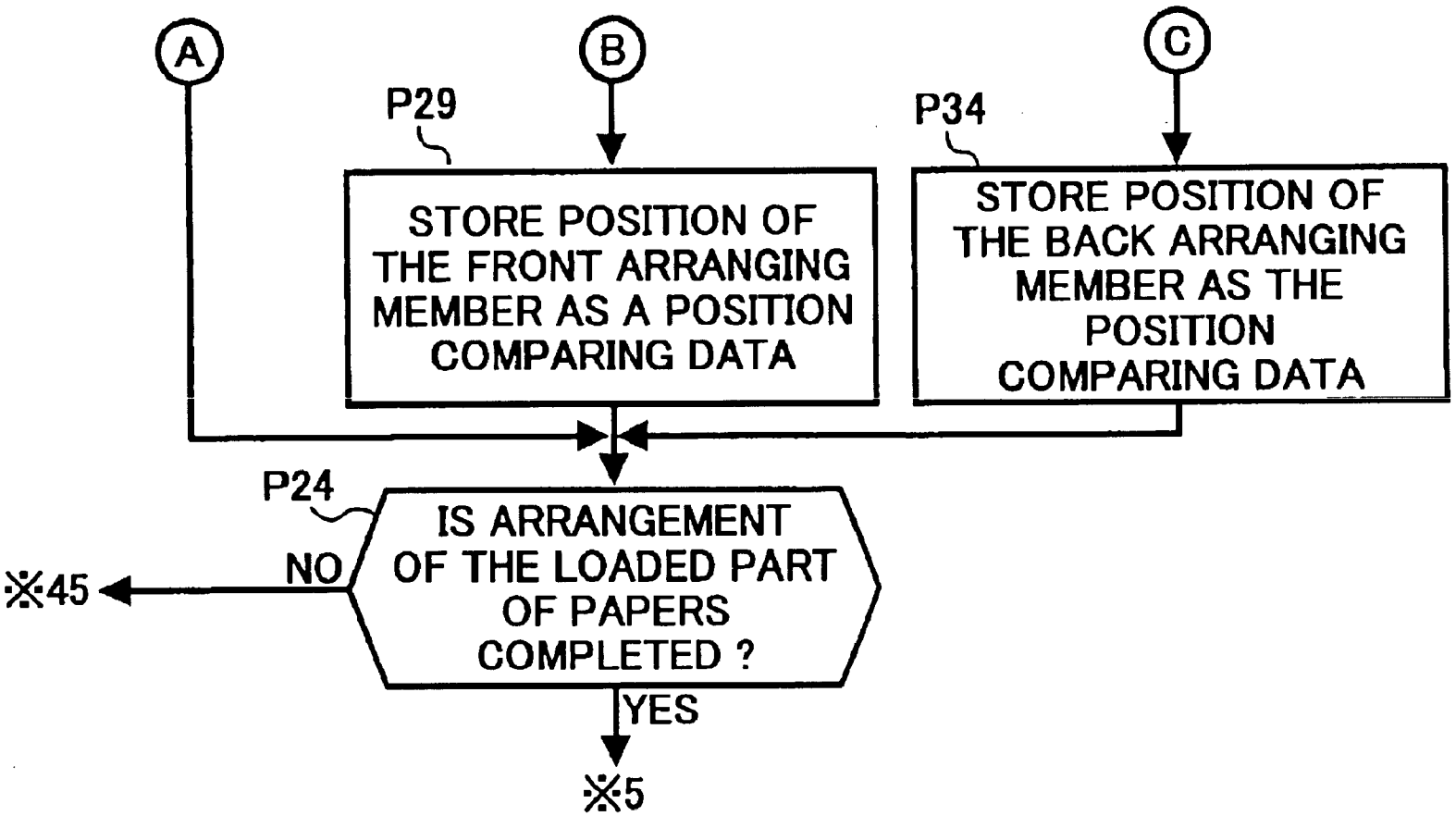

FIG. 139 is a flowchart with respect to arranging operation.

Figure 140:
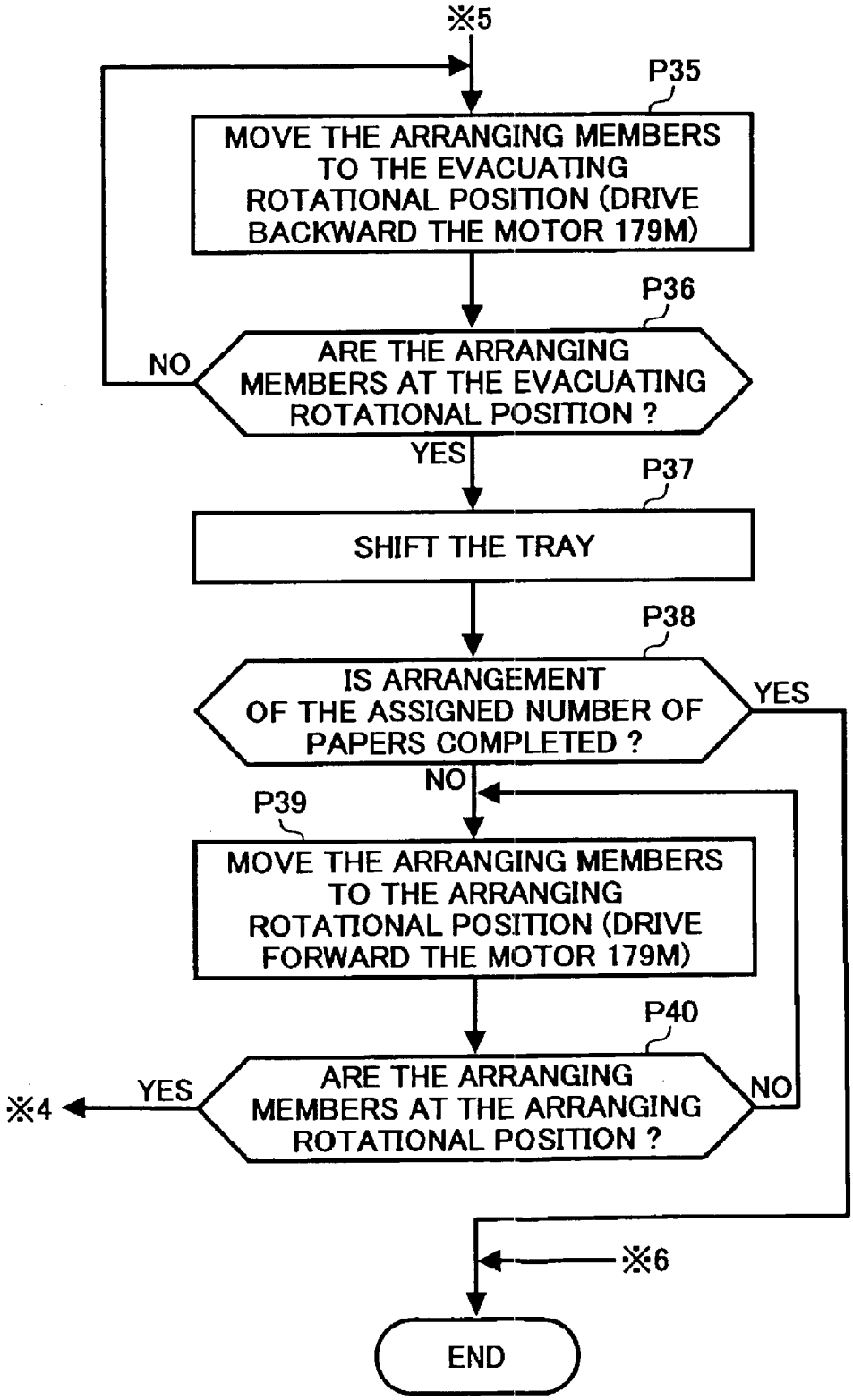

FIG. 140 is a flowchart with respect to arranging operation.

Figure 141:
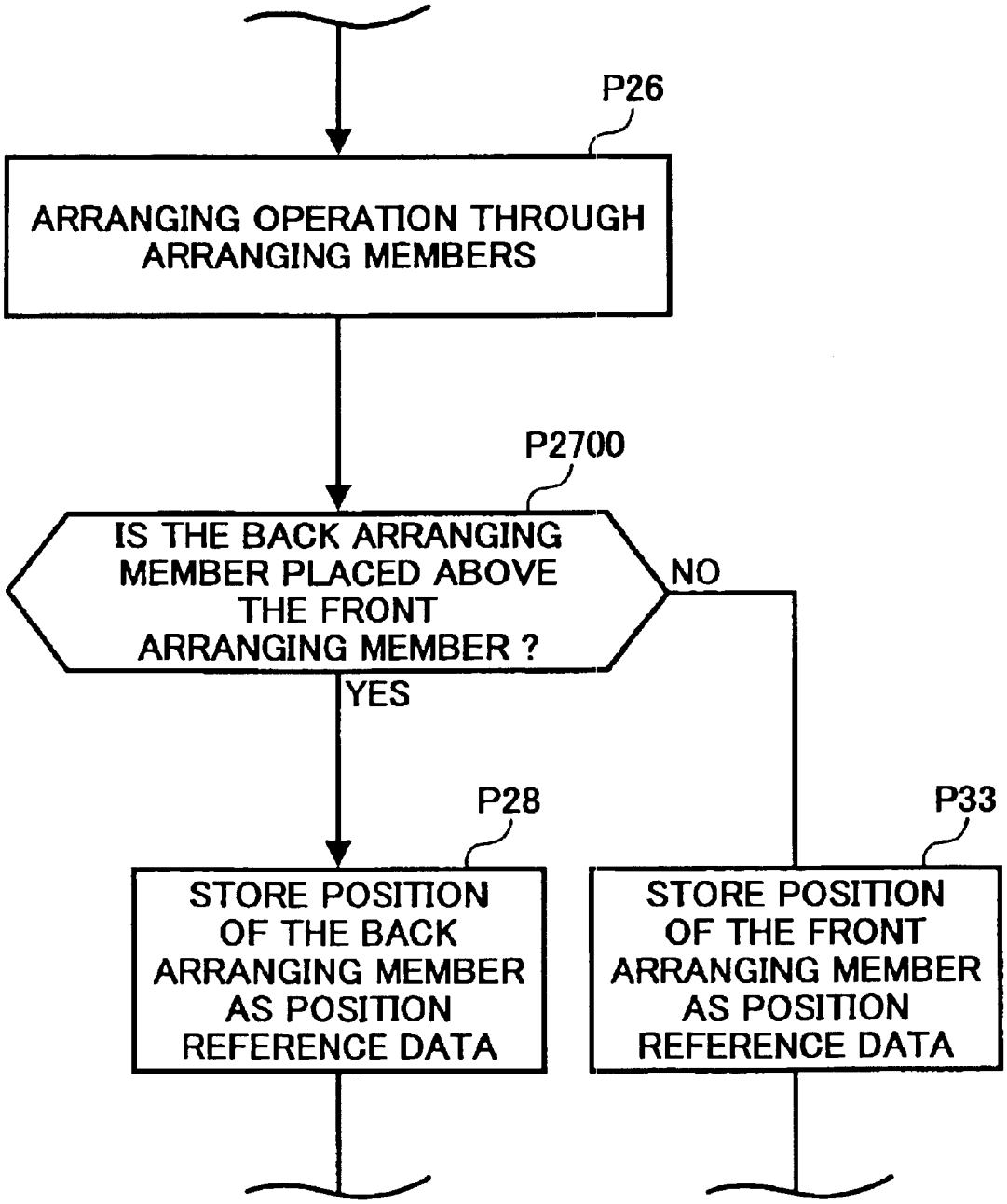

FIG. 141 is a flowchart with respect to arranging operation.

Figure 142:
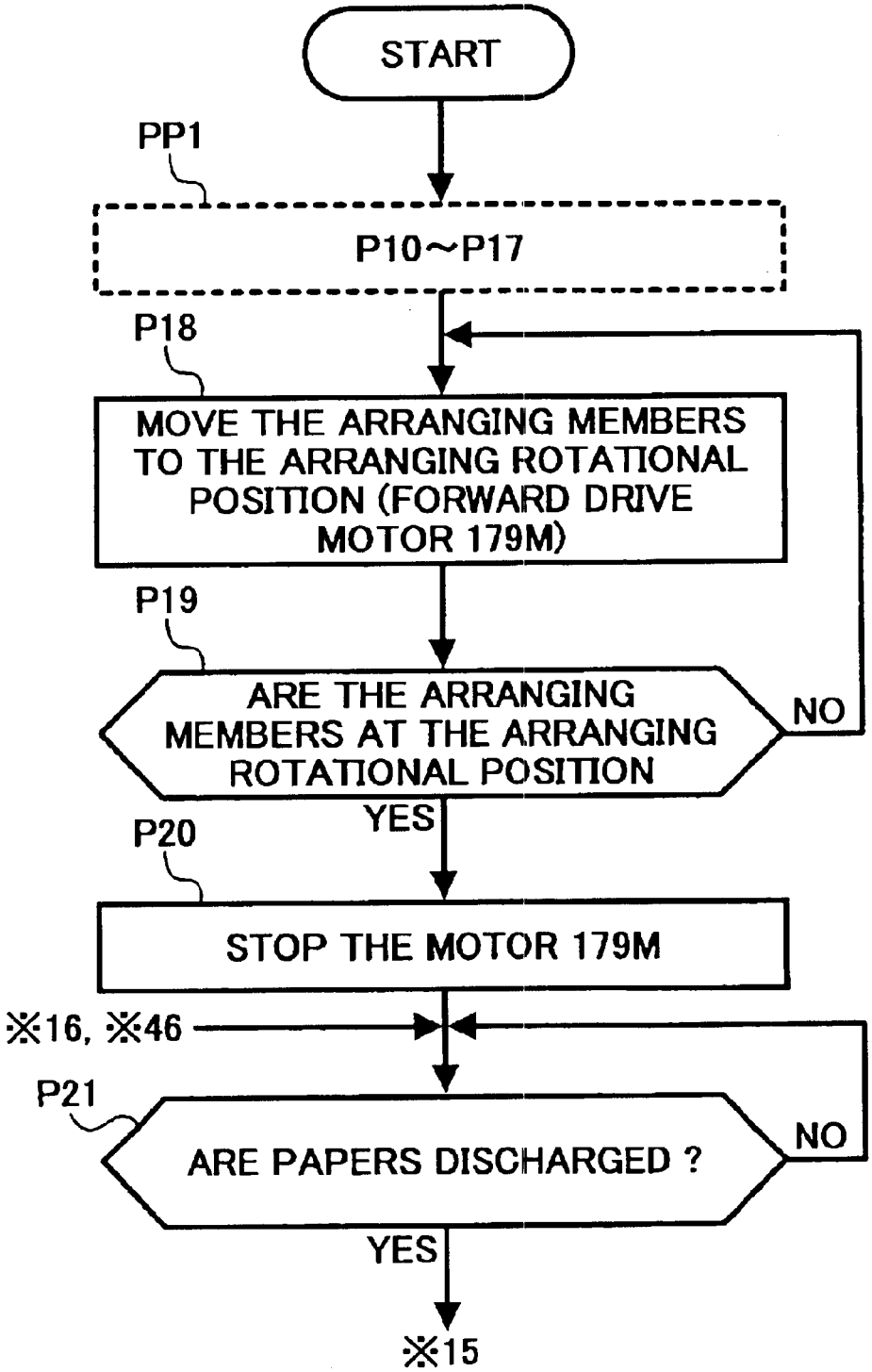

FIG. 142 is a flowchart with respect to arranging operation.

Figure 143:
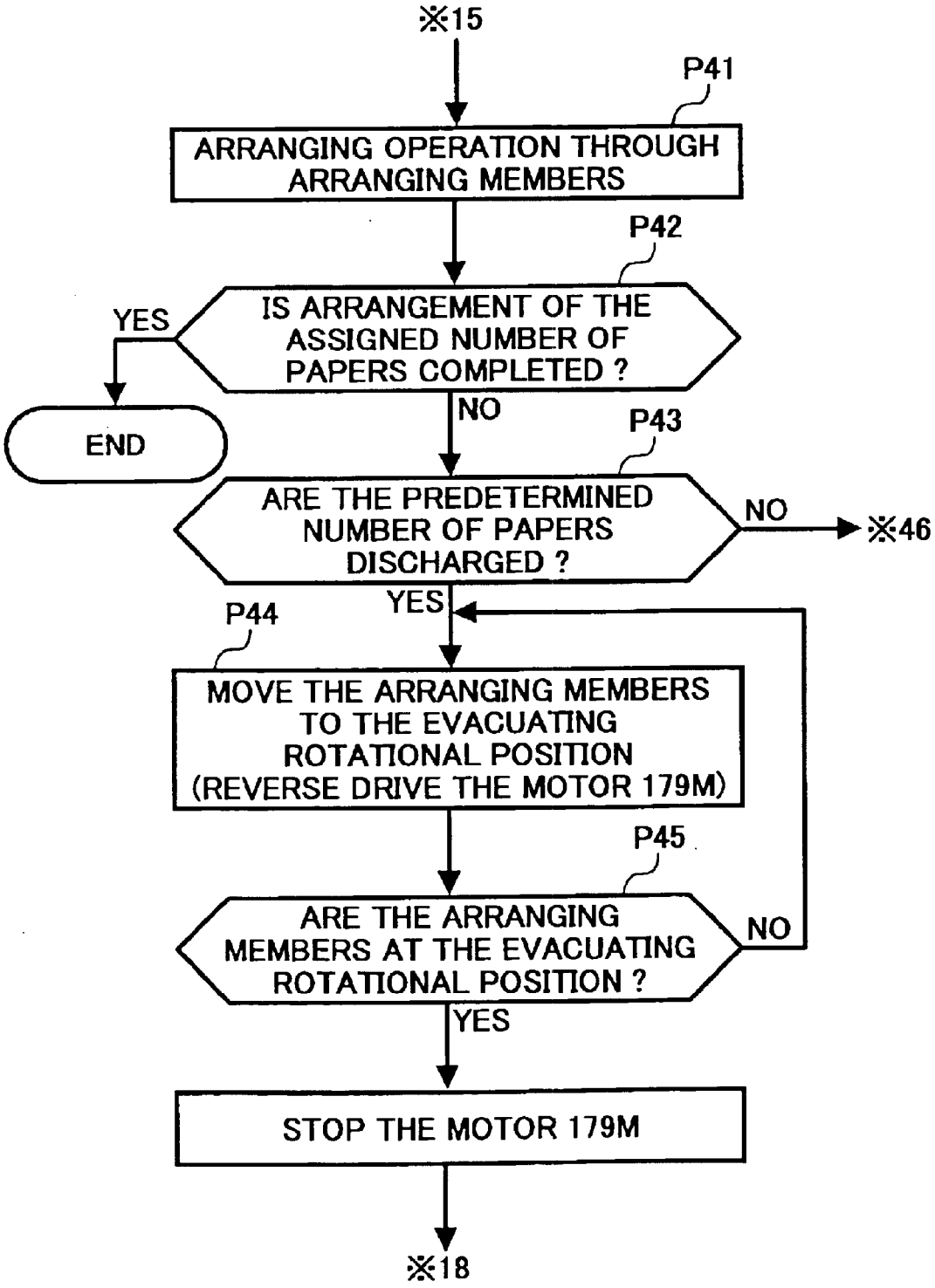

FIG. 143 is a flowchart with respect to arranging operation.

Figure 144:
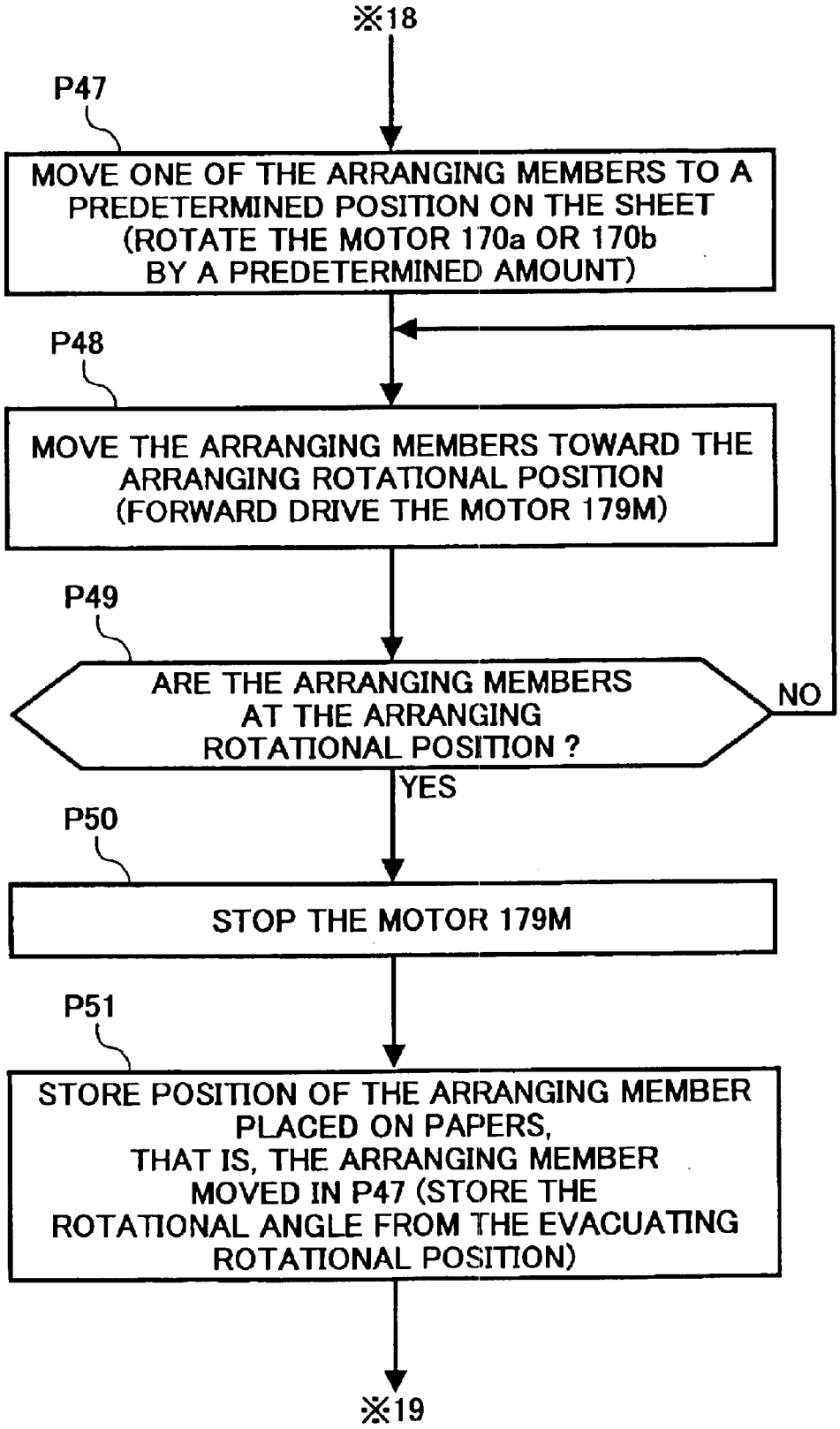

FIG. 144 is a flowchart with respect to arranging operation.

Figure 145:
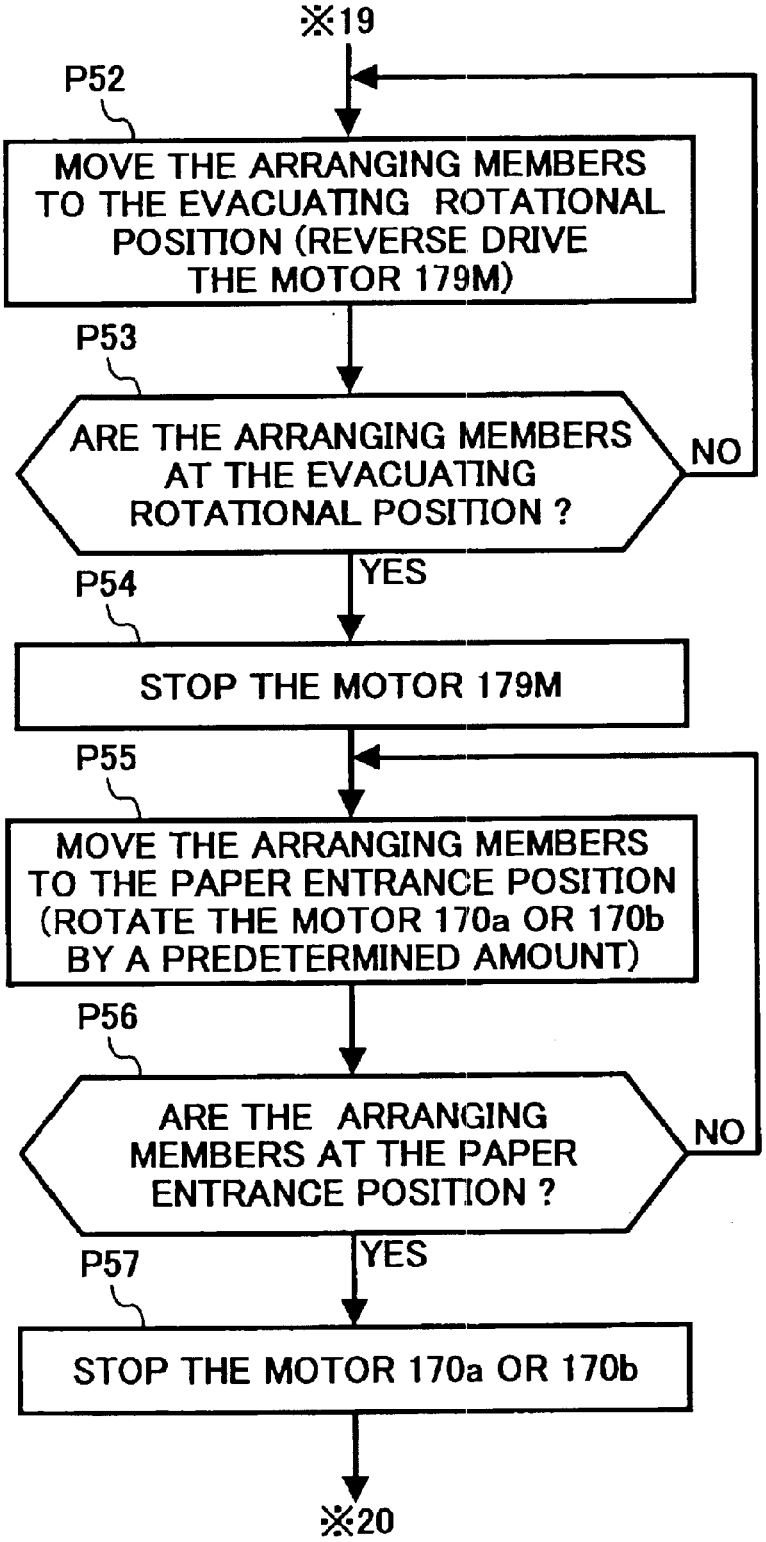

FIG. 145 is a flowchart with respect to arranging operation.

Figure 146:
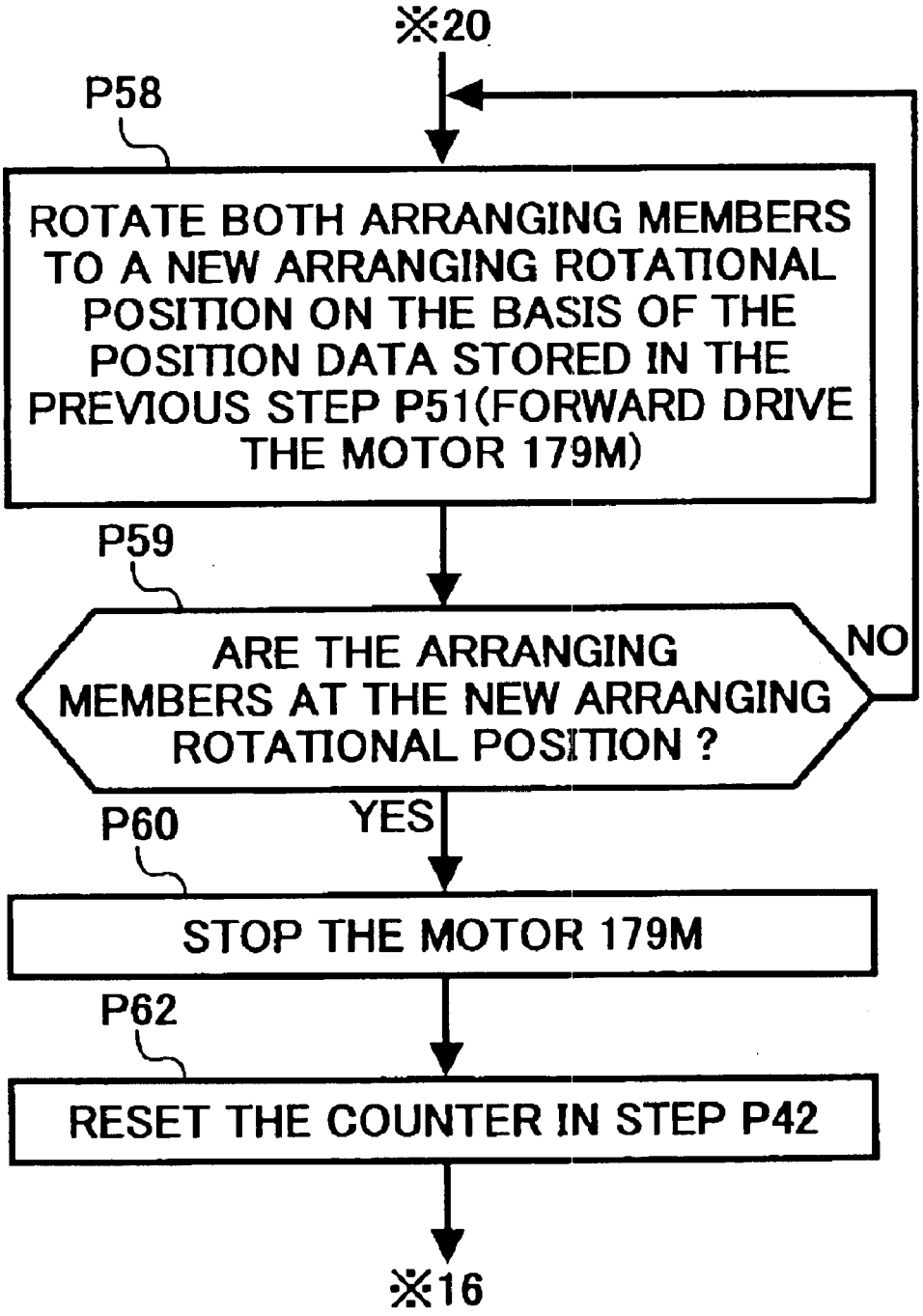

FIG. 146 is a flowchart with respect to arranging operation.

Figure 147:
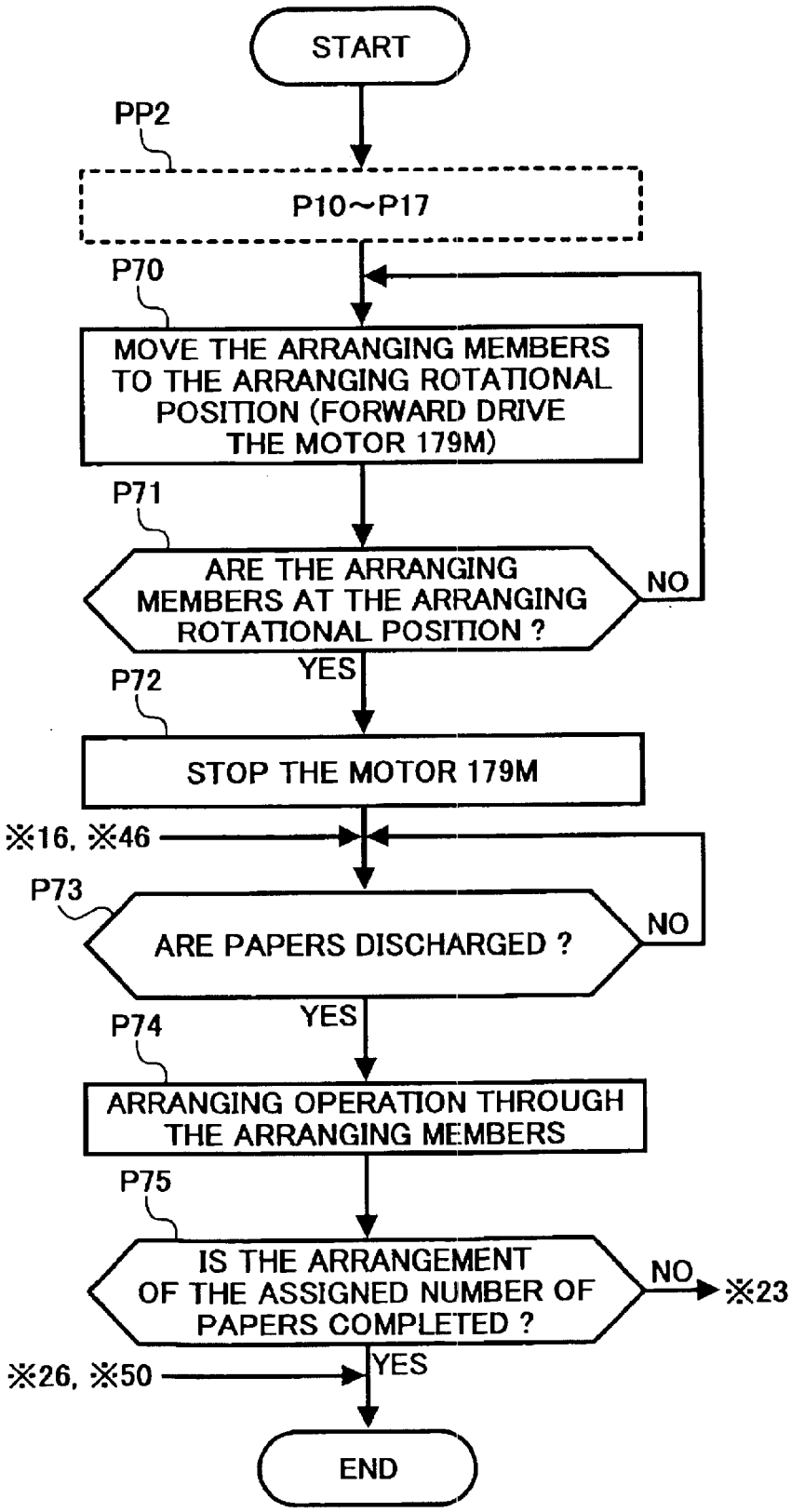

FIG. 147 is a flowchart with respect to arranging operation.

Figure 148:
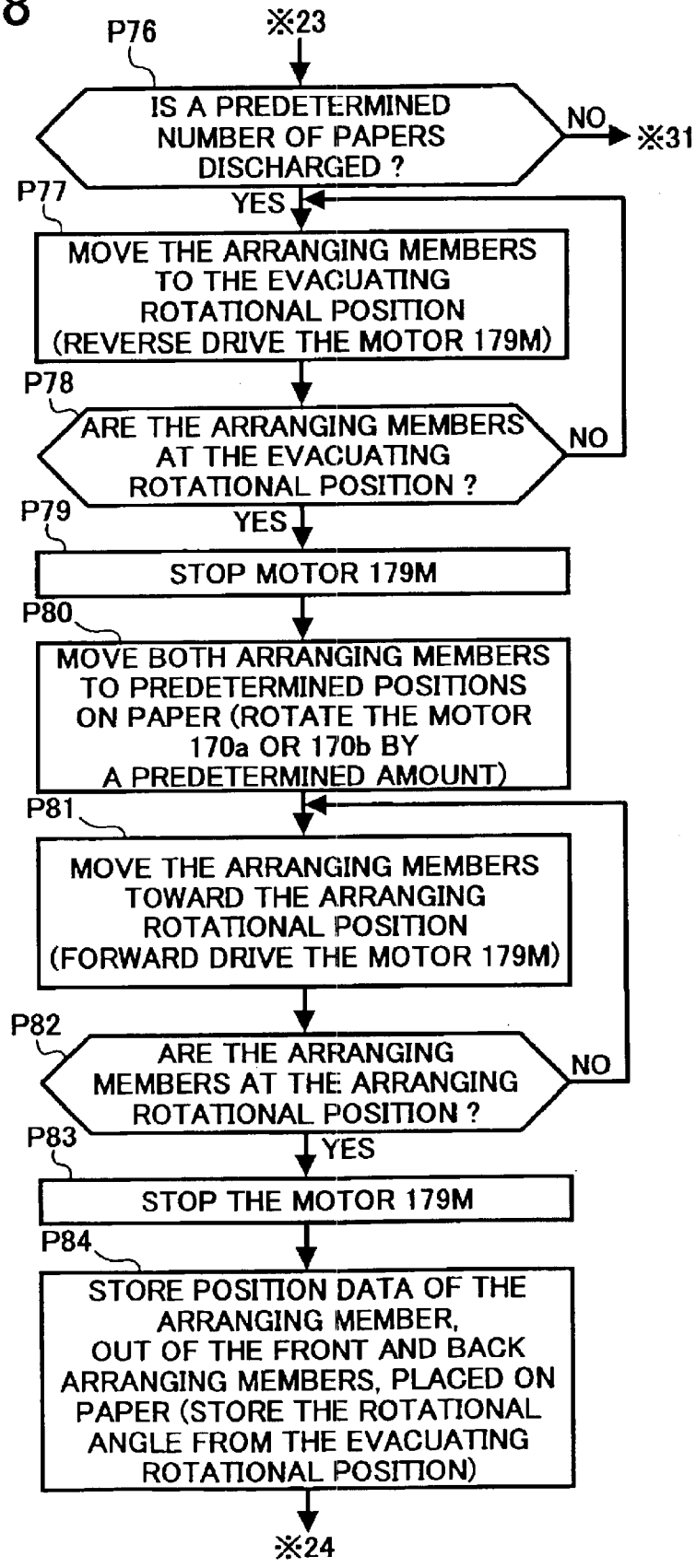

FIG. 148 is a flowchart with respect to arranging operation.

Figure 149:
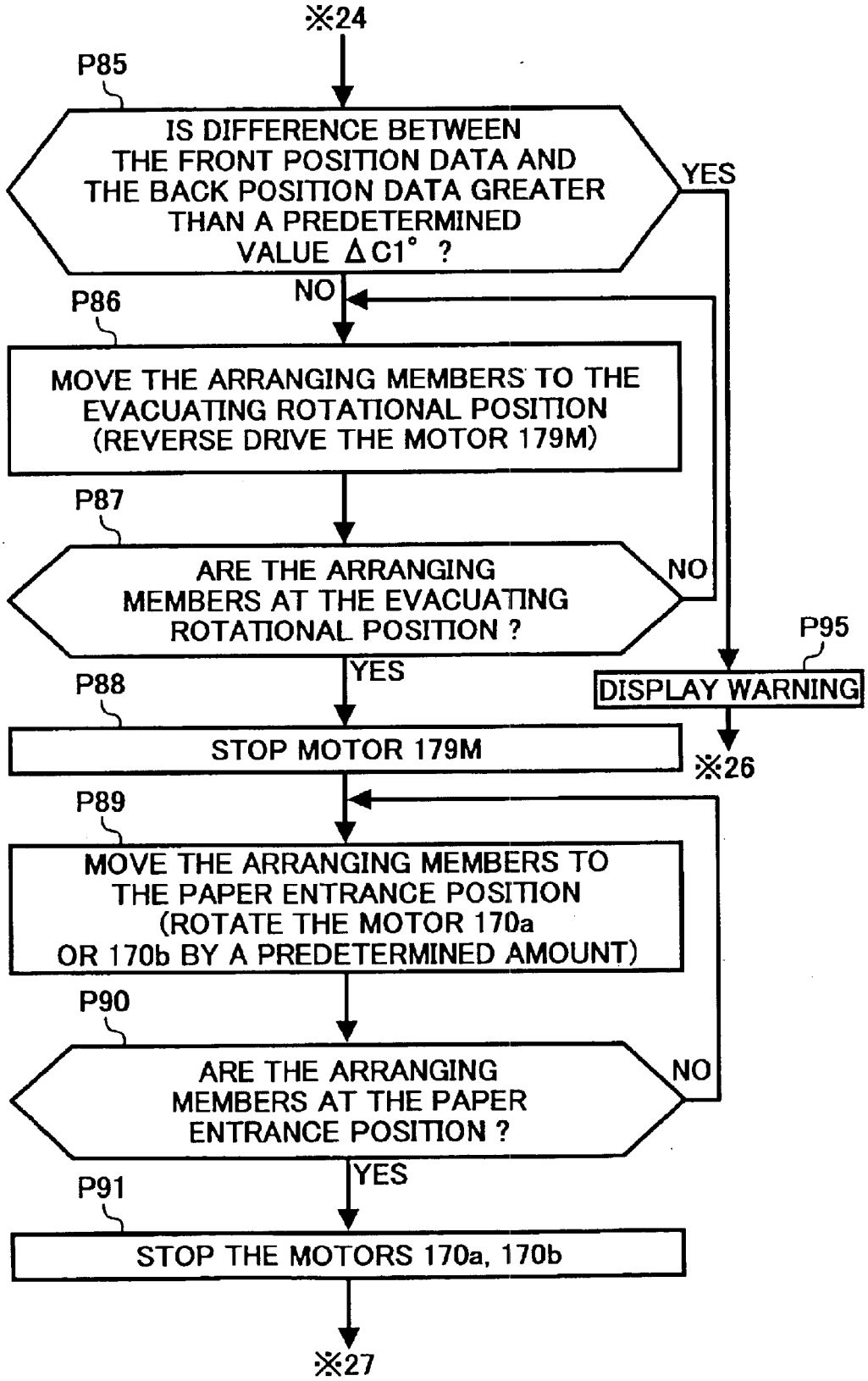

FIG. 149 is a flowchart with respect to arranging operation.

Figure 150:
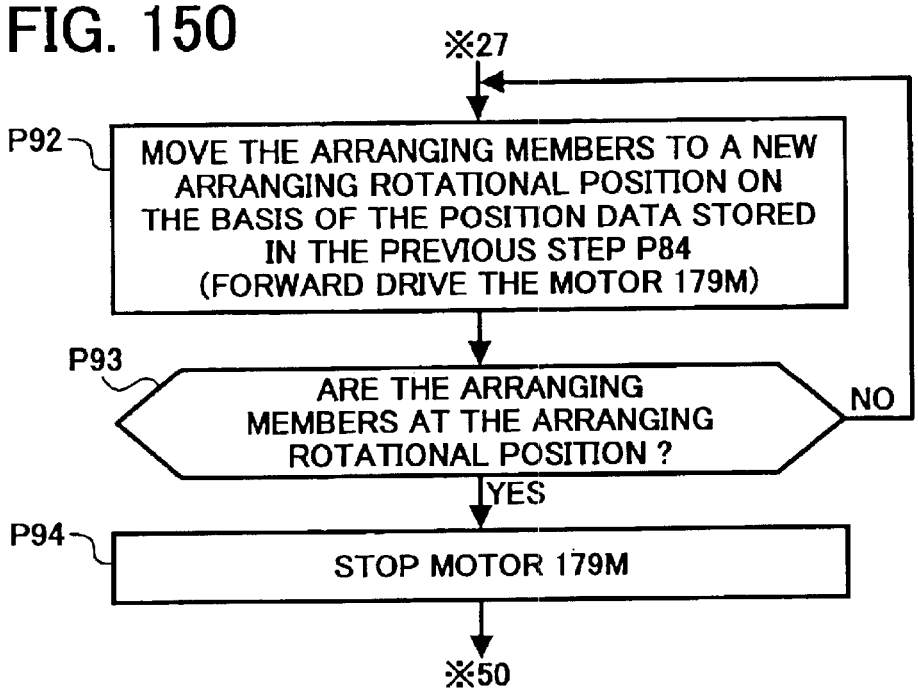

FIG. 150 is a flowchart with respect to arranging operation.

Figure 151:
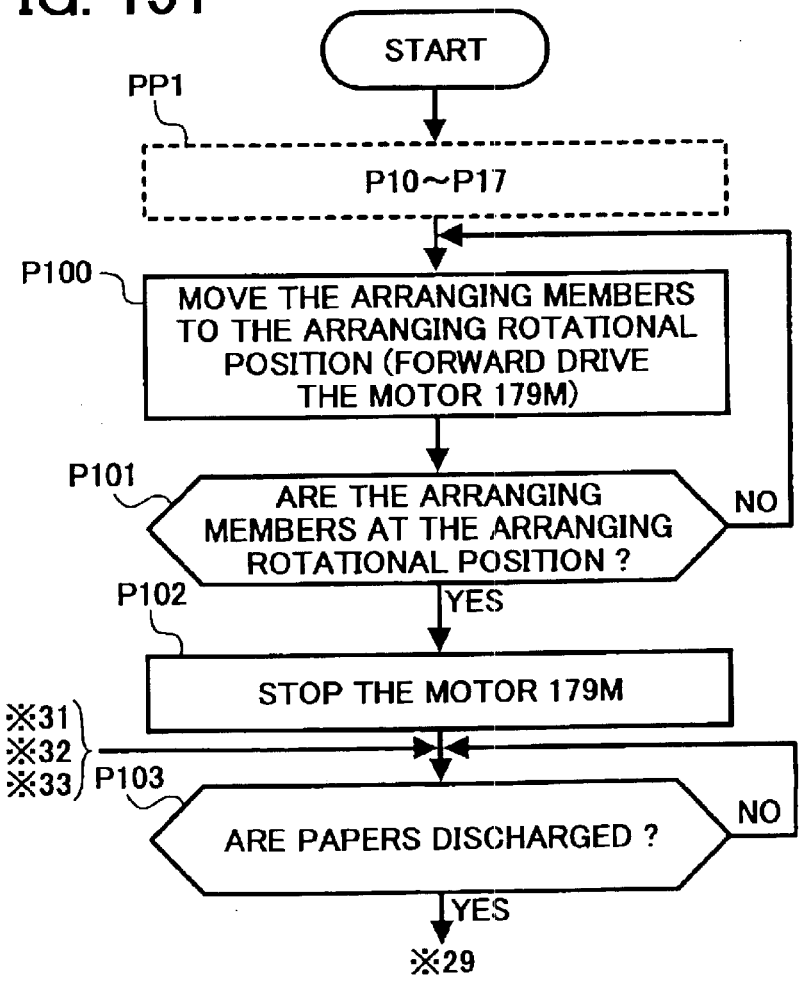

FIG. 151 is a flowchart with respect to arranging operation.

Figure 152:
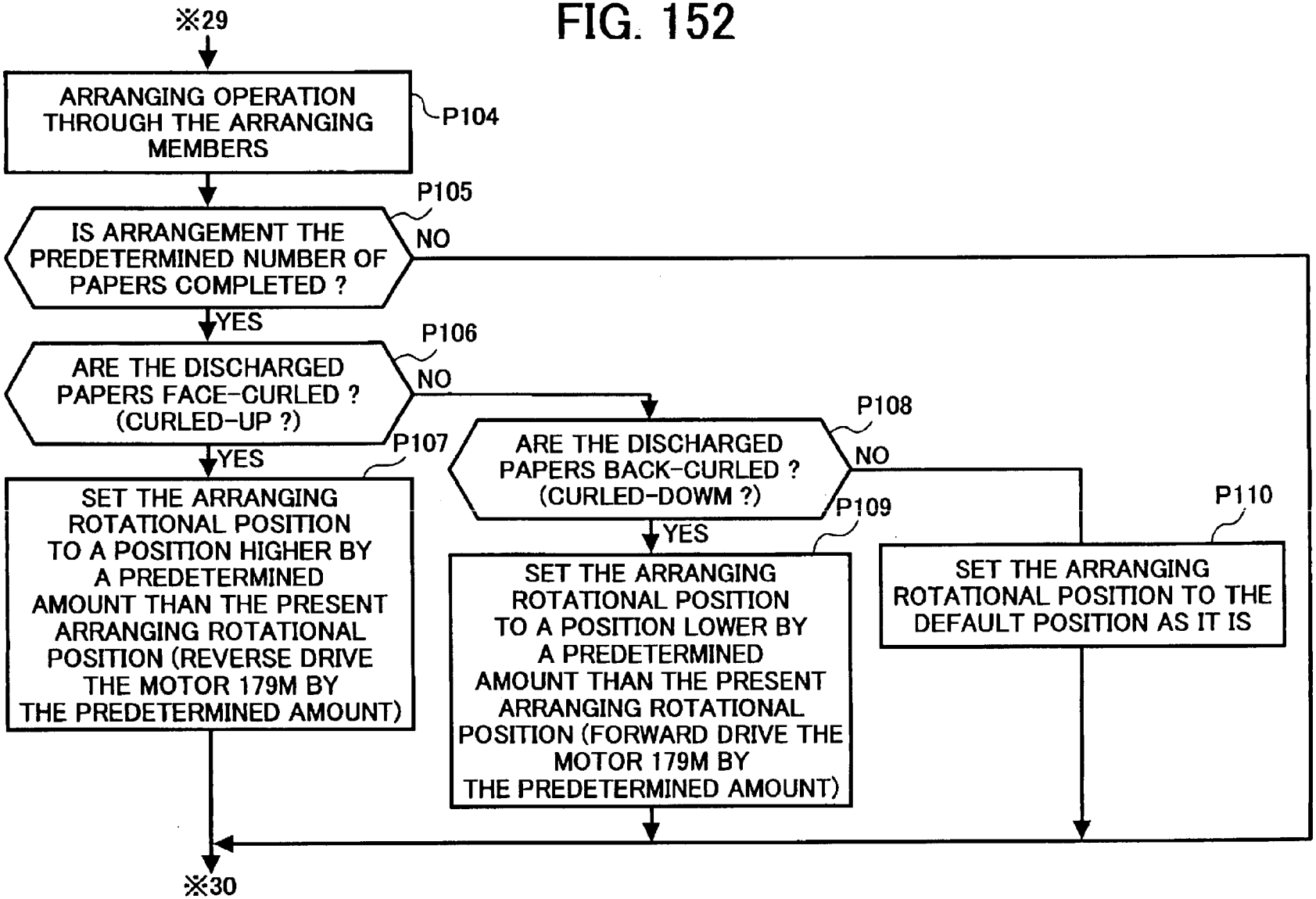

FIG. 152 is a flowchart with respect to arranging operation.

Figure 153:
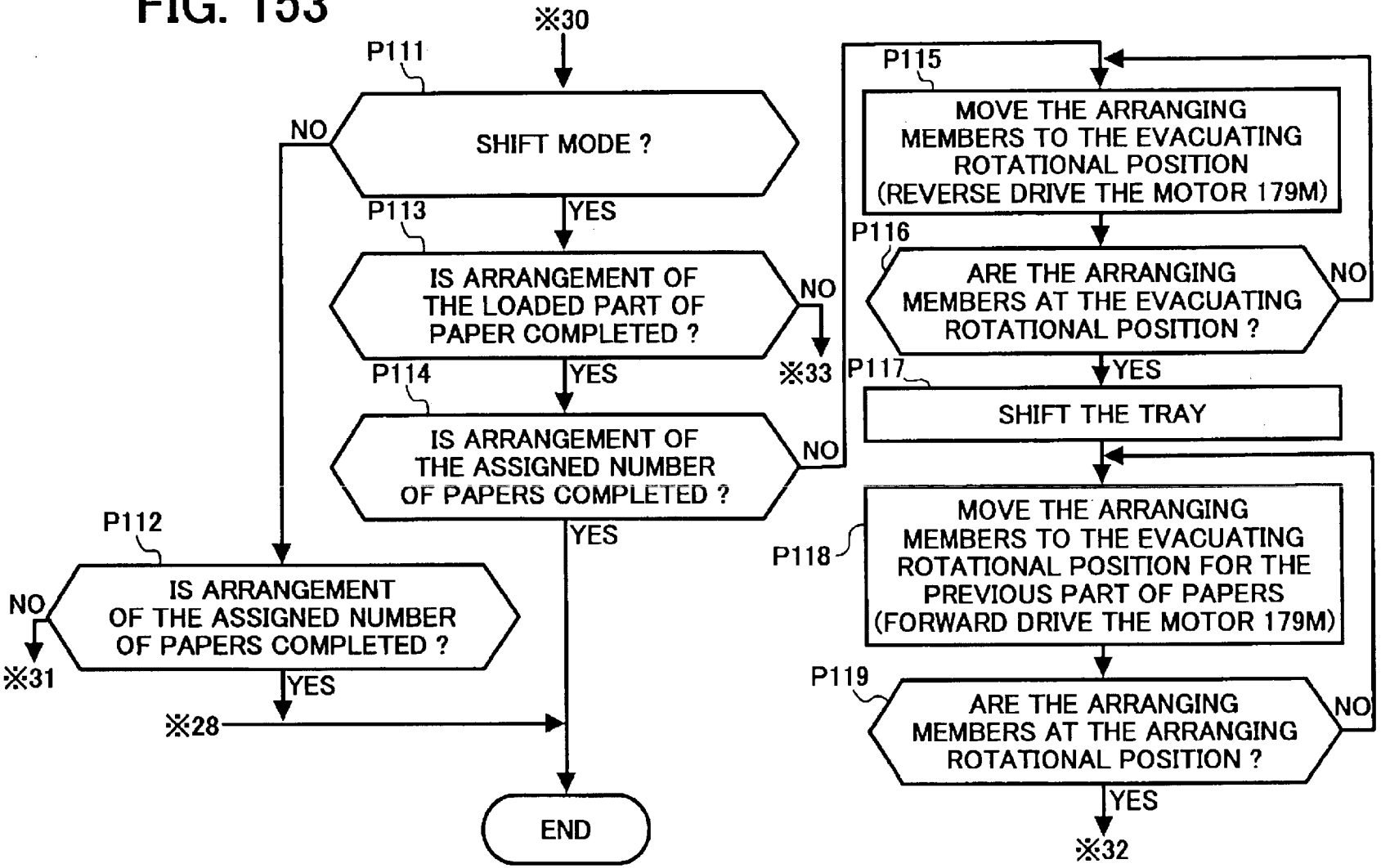

FIG. 153 is a flowchart with respect to arranging operation.

Figure 154:
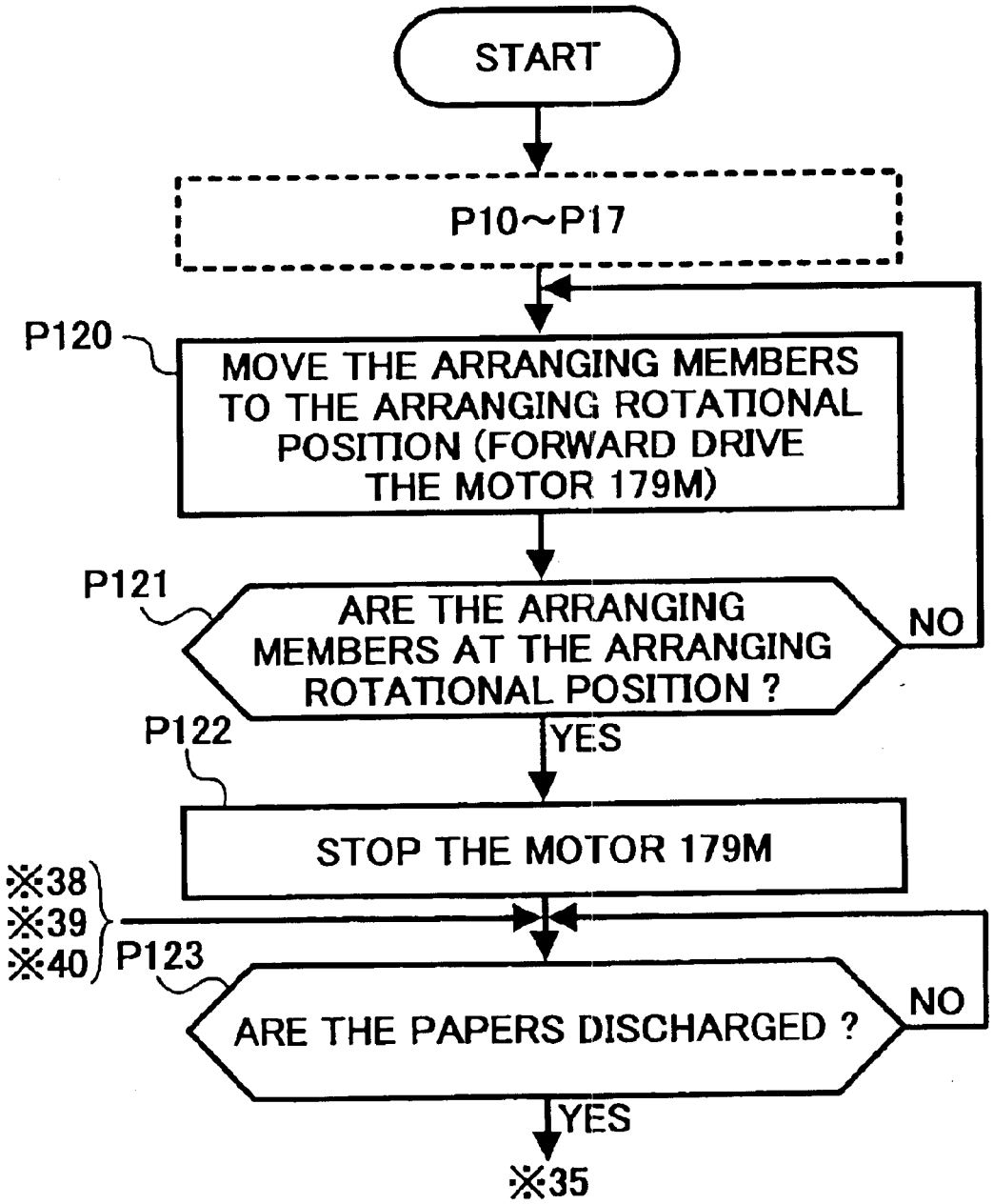

FIG. 154 is a flowchart with respect to arranging operation.

Figure 155:
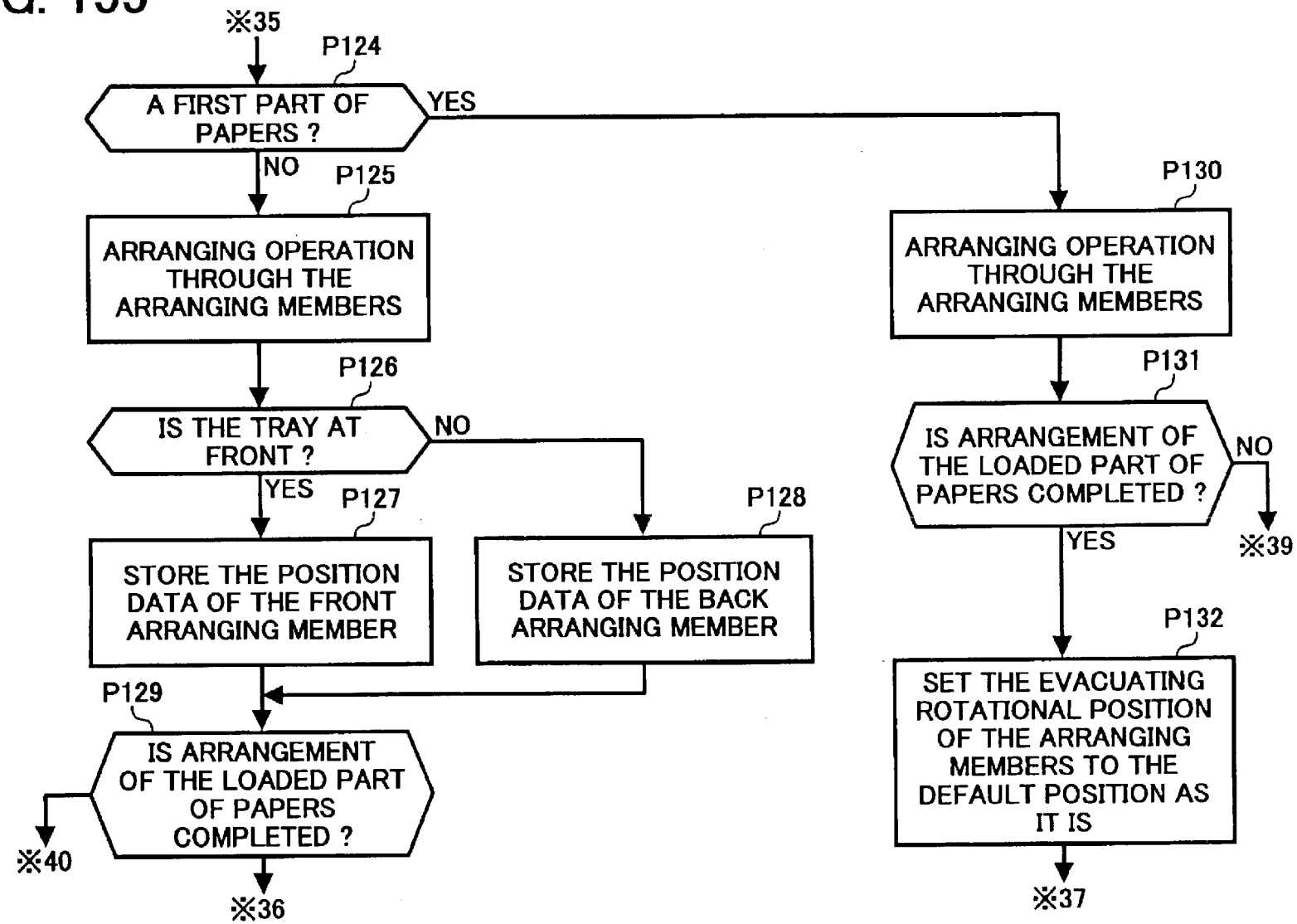

FIG. 155 is a flowchart with respect to arranging operation.

Figure 156:
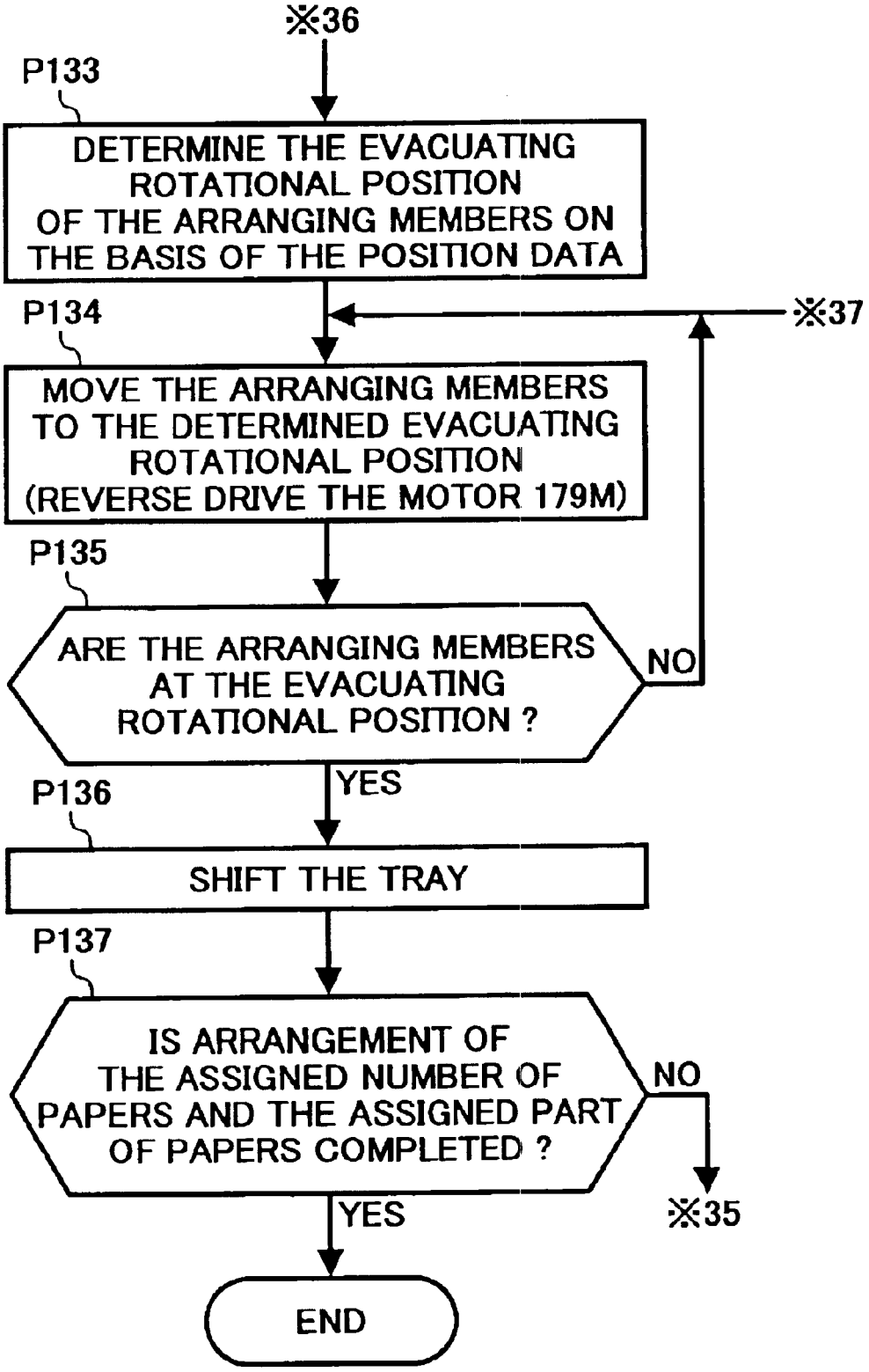
Figure 157:
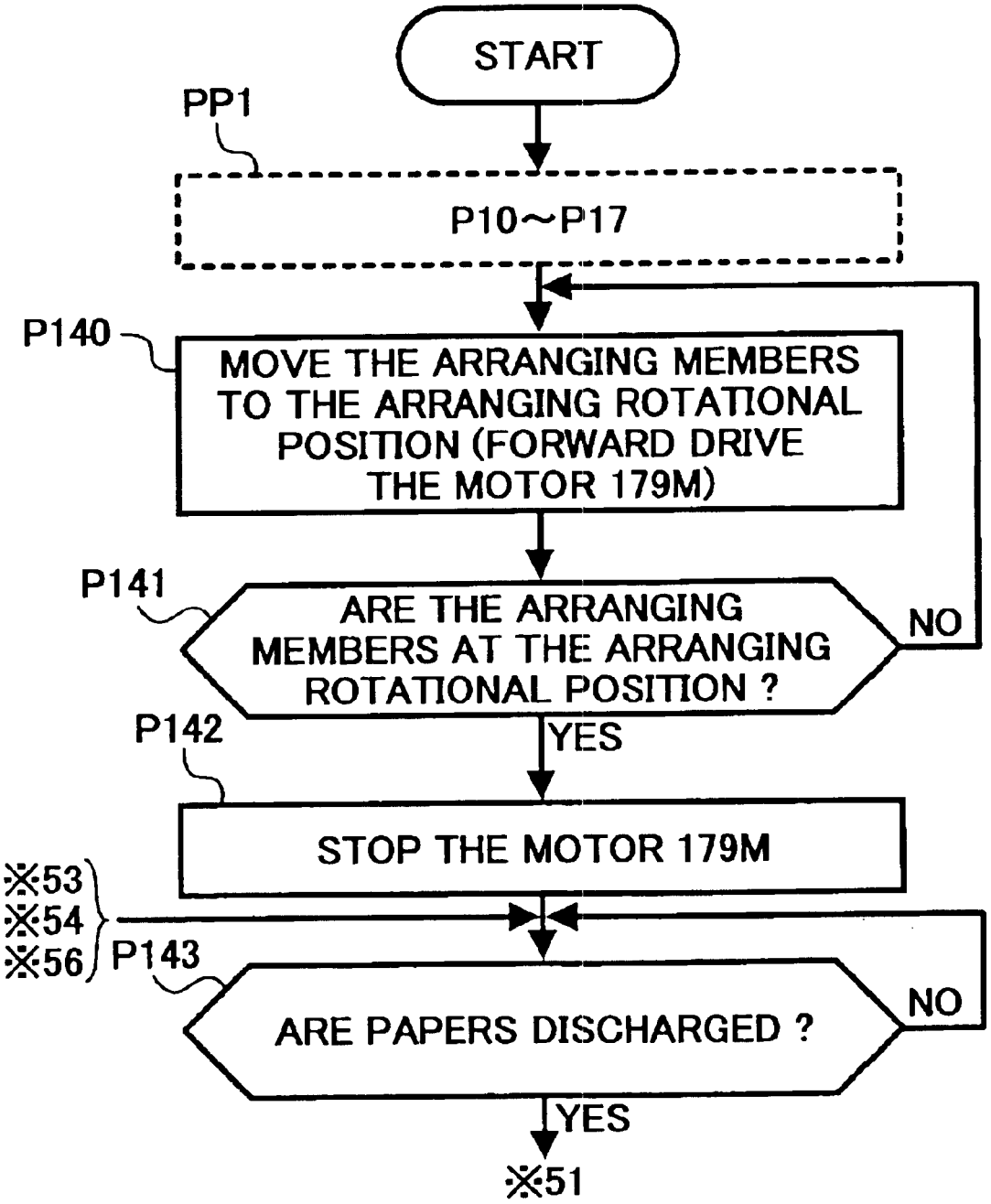

FIG. 156 is a flowchart with respect to arranging operation,

FIG. 157 is a flowchart with respect to arranging operation.

Figure 158:
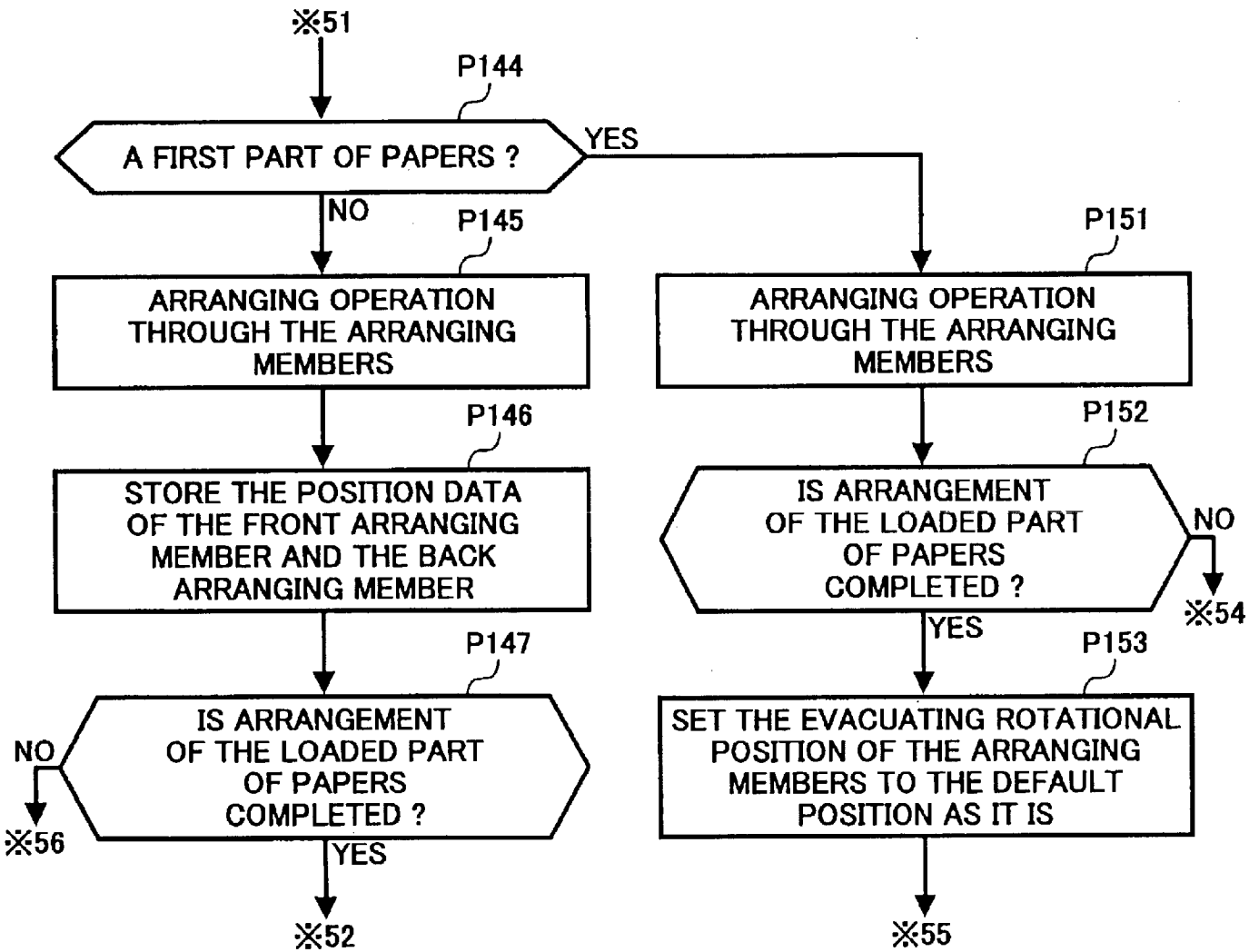

FIG. 158 is a flowchart with respect to arranging operation.

Figure 159A:
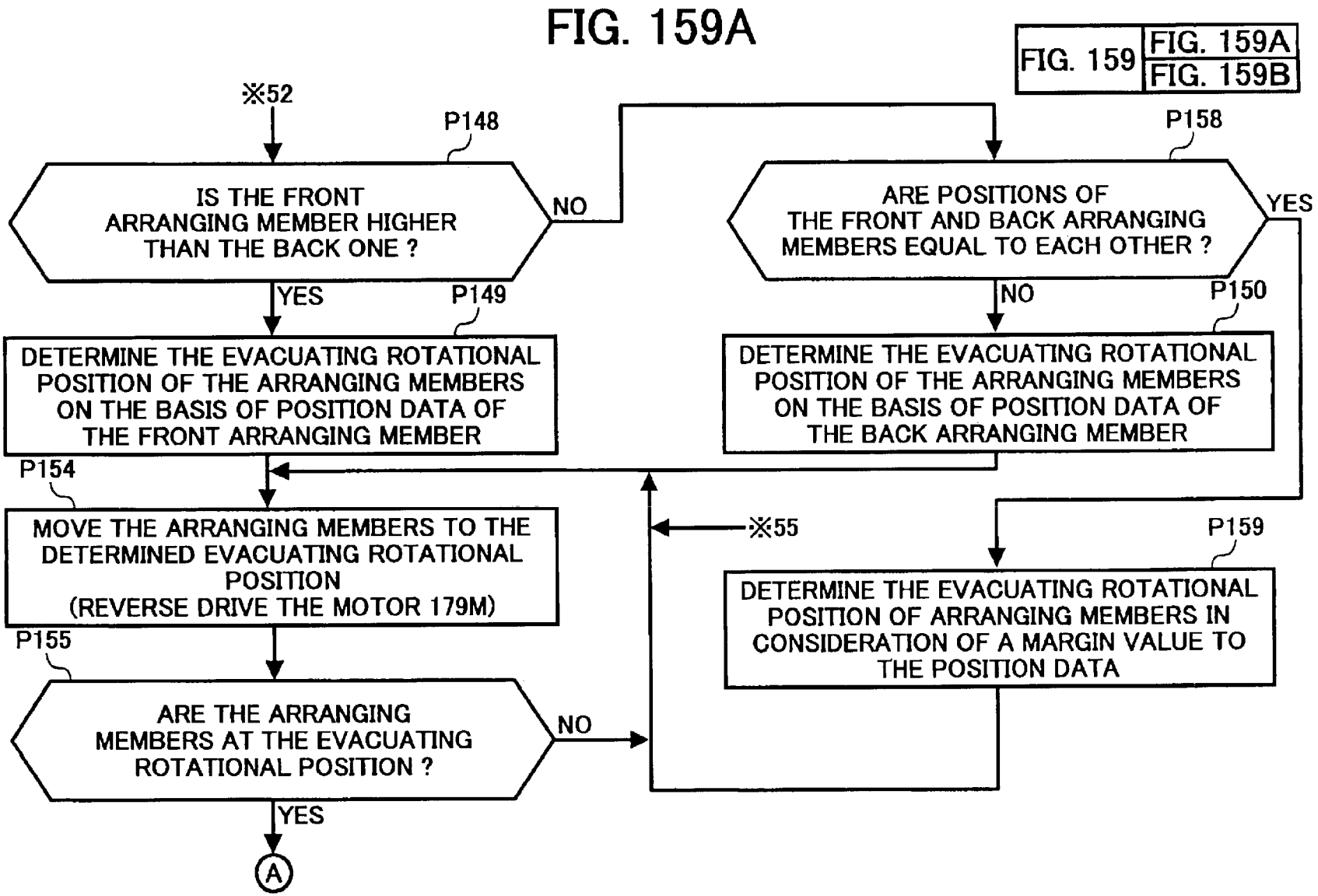
Figure 159B:
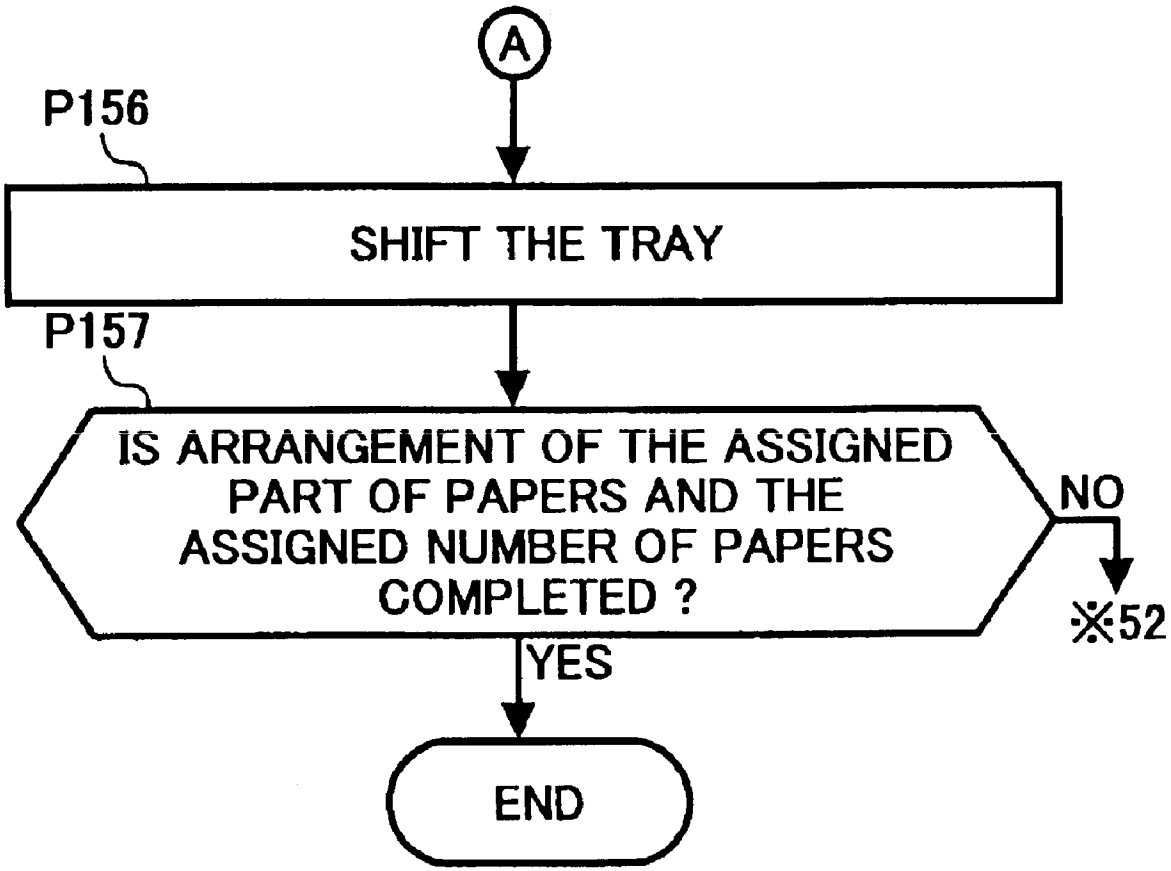

FIG. 159 is a flowchart with respect to arranging operation.

Figure 160:
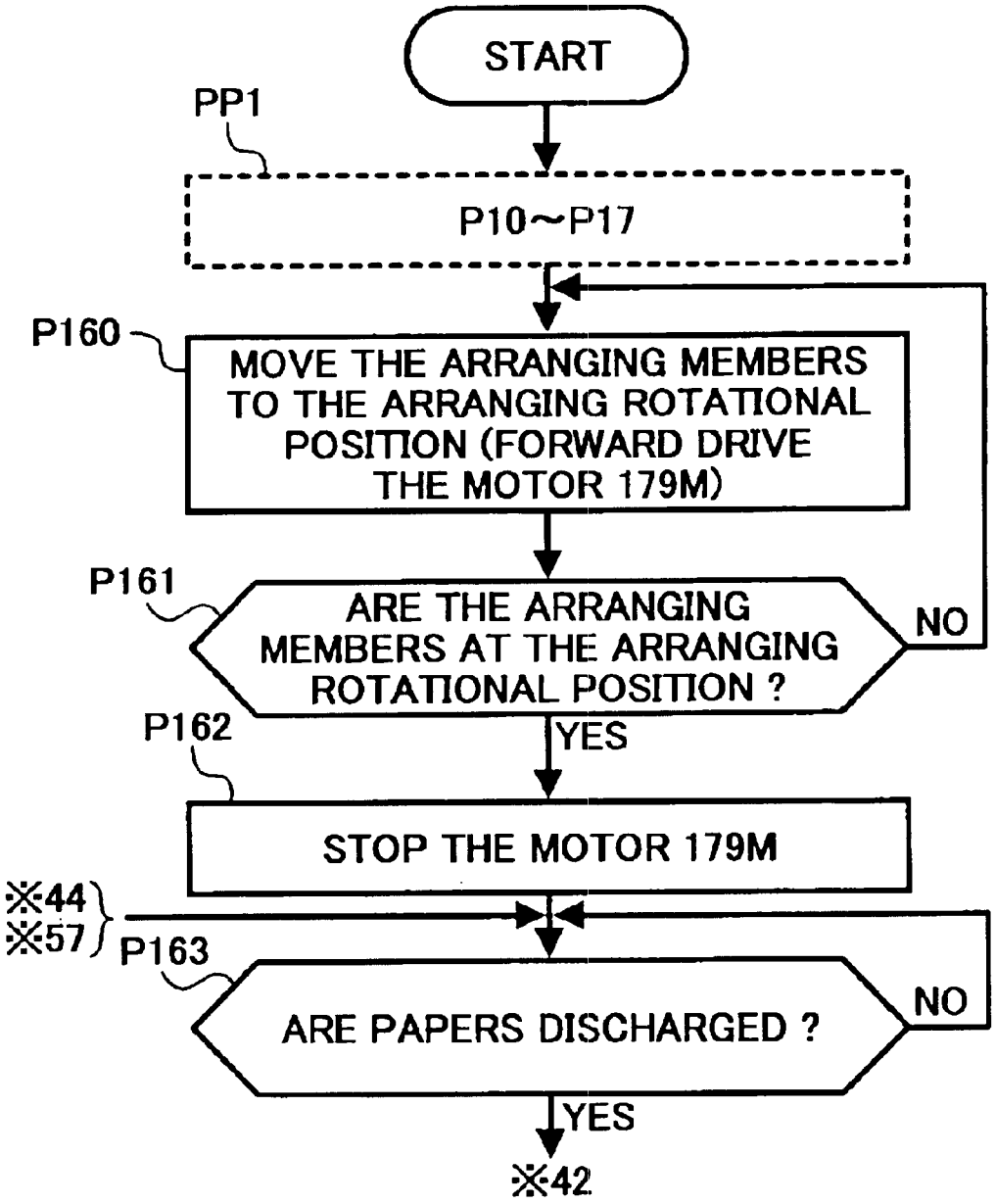

FIG. 160 is a flowchart with respect to arranging operation.

Figure 161:
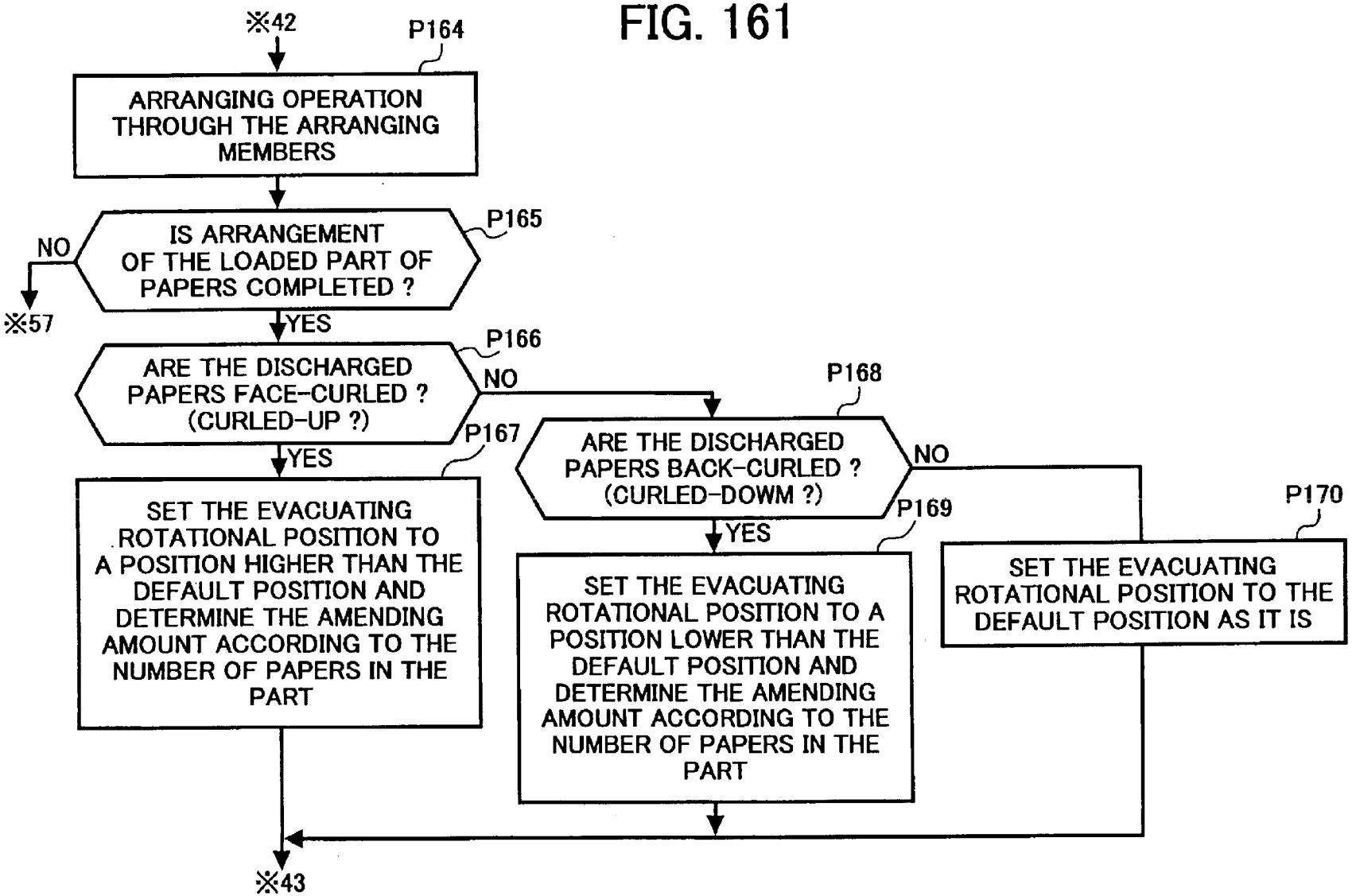

FIG. 161 is a flowchart with respect to arranging operation.

Figure 162:
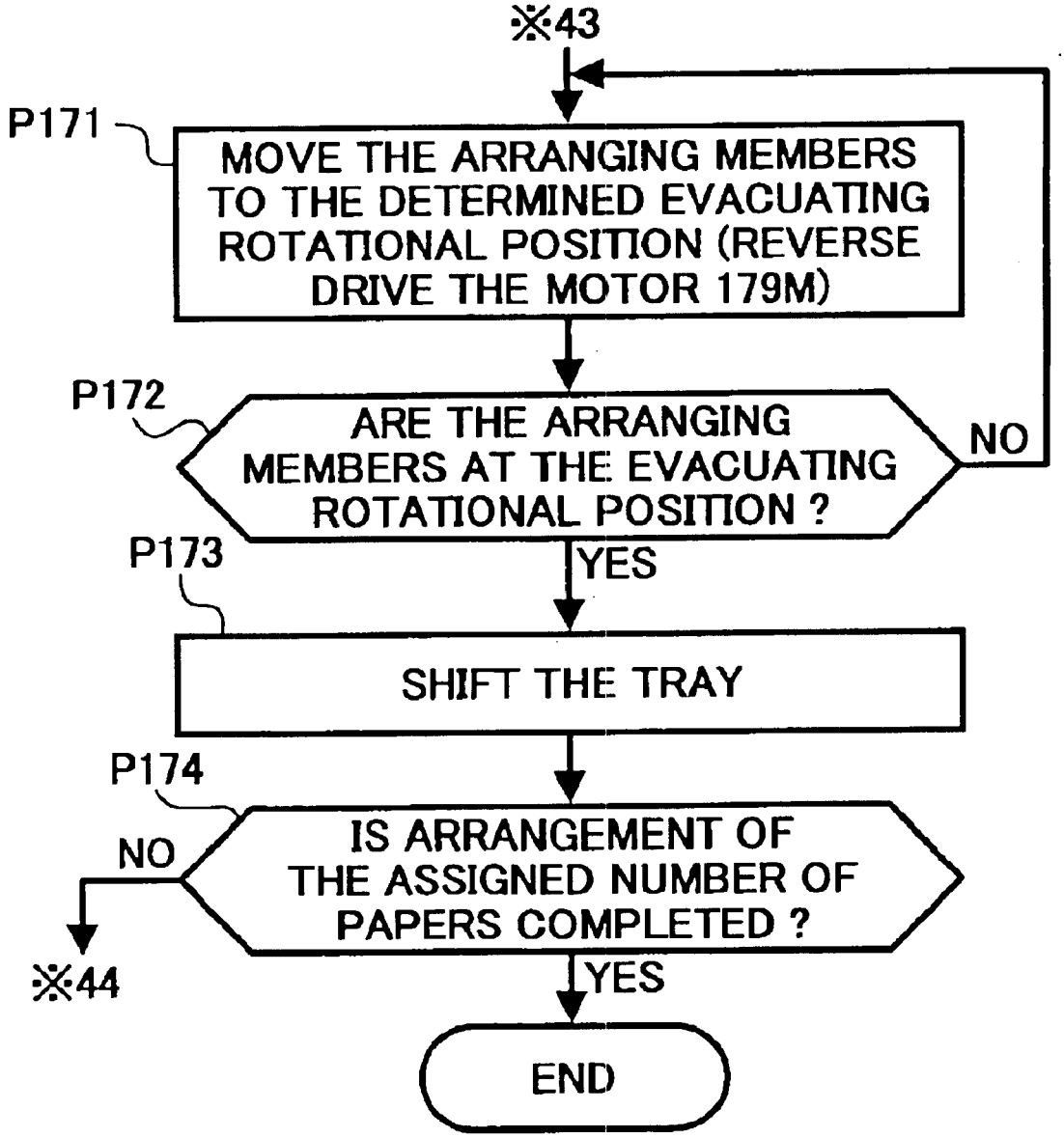

FIG. 162 is a flowchart with respect to arranging operation.

Figure 163A:
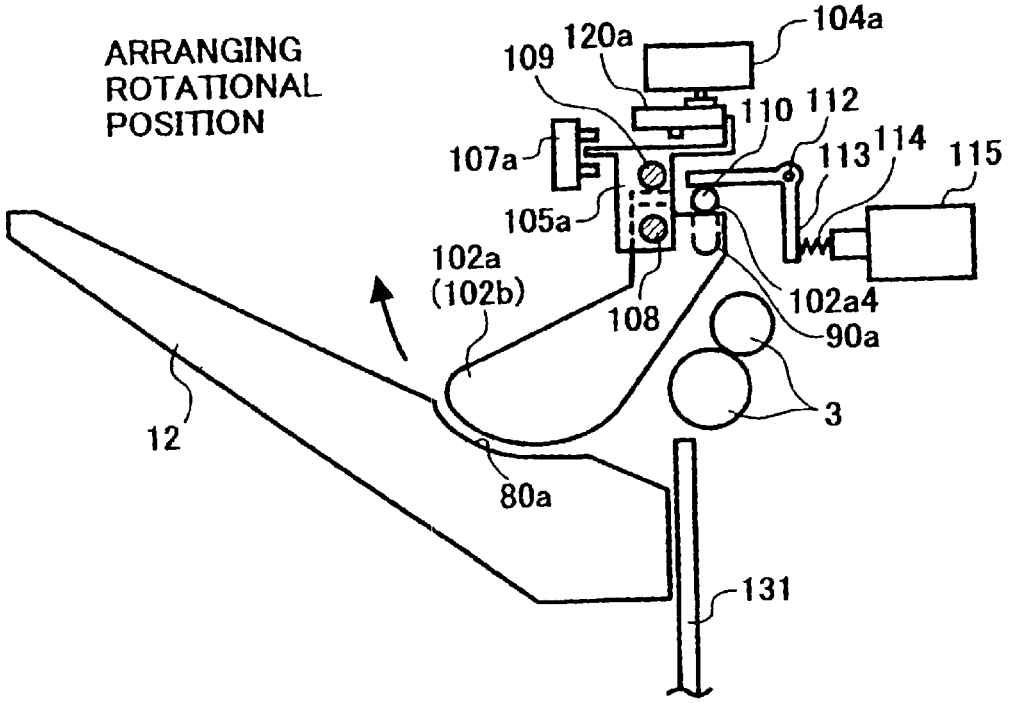
Figure 163B:
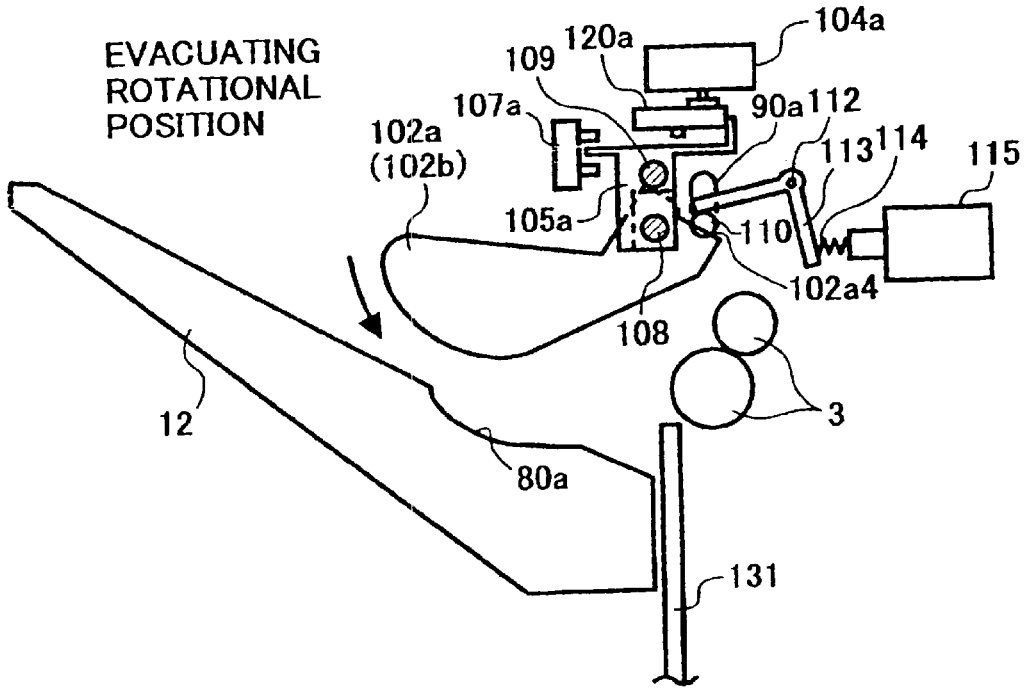

FIG. 163(*a*) illustrates rotating position for arrangement of the arranging member according to unknown prior art, and FIG. 163(*b*) illustrates rotating position for evacuation of the arranging members according to the unknown prior art.

DESCRIPTION OF THE PREFERRED EMBODIMENTS (The First Invention)

First, a sheet-shaped medium in this specification includes copying paper, transfer paper, recording paper, covering paper, paper board, paper for computer, special purpose paper, and OHP sheet, etc., however, hereinafter, the word "paper" is used for all the names above.

In a sheet-shaped medium after-treatment apparatus which performs after-treatment such as stamping, punching unit for punching for filing, staple means, or image forming apparatus, for copiers, a paper discharged from discharging means is required to be piled in a preferable precise sorting state so that a bundle of papers sorted and piled can be sent to the next process, for example, to punching machine.

If the degree of precision about arrangement for the bundle of papers is bad, since the bundle of papers discharged out from a tray need to be arranged by hands one more time, the efficiency of process is very low. On this reason, upper segment, for example, so-called copier wants high degree of arranging precision for piled papers, therefore, there is need for improving the degree of arranging precision, and such need can be satisfied by employing arranging means, returning means or sorting means described below, and danger by arranging member can be avoided in the same manner.

According to a sheet-shaped medium aligning apparatus of the present invention, it is possible to make (1) the apparatus as an integrated unit, and, (2) the apparatus can be used as integrally with or combined by other apparatus having means for discharging the sheet-shaped medium, for example, an image forming apparatus without arranging function and sorting function, or a sheet-shaped medium after-treatment apparatus without arranging function and sorting function so that the sheet-shaped medium is arranged and sorted on the tray by arranging function and sorting function.

At first, by using, as an example, the sheet-shaped medium after-treatment apparatus with the sheet-shaped medium aligning apparatus, discharging means for discharging sheet-shaped medium, the tray as sheet piling means for piling the sheet-shaped medium discharged by discharging means, arranging means, sorting means, sorting action, structure for safety measures for arranging means, control type of sorting, especially, the image forming apparatus with the sheet-shaped medium aligning apparatus, and the sheet-shaped medium after-treatment apparatus using two trays will be described below.

[1] Sheet-shaped Medium After-treatment Apparatus a. General Outline of the Sheet-shaped Medium After-treatment Apparatus The apparatus will be described by using as examples an independent sheet-shaped medium after-treatment apparatus connected to the image forming apparatus and integrally formed sheet-shaped medium aligning apparatus In FIGS. 1 to 4, the sheet-shaped medium after-treatment apparatus 51 as after-treatment means for performing after-treatment on paper is connected with the image forming apparatus 50. According to the contents of after-treatment instructed by operator, paper S on which image forming has been executed by the image forming means in the image forming apparatus 50 is conveyed to the sheet-shaped medium after-treatment apparatus 51.

If the image forming apparatus 50 is a copying machine, the contents of after-treatment in the sheet-shaped medium after-treatment apparatus 51 may be as follows. (1) General mode for simply piling the papers in order of discharge. In this mode, the processes arc implemented by instructing the size of paper and the number of copying. (2) Staple mode for executing staple treatment. In this mode, the processes are implemented by handling the size of paper and the number of copying through the instruction about the number of papers to be filed and position of filing. (3) Mode for executing sorting treatment. In this mode, the processes are implemented by instructing size of paper and the number of papers to be sorted. (4) Punch mode. In this mode, punching is done. Additionally, other treatments can be done as necessary.

When command to operate after-treatment is transferred from control panel of copying machine to control means having a CPU by manipulating keys, the after-treatment is implemented by signal communications regarding the after-treatment action which is executed between the image forming apparatus 50 and the sheet-shaped medium after-treatment apparatus 51, and the control means. Also, this sheet-shaped medium after-treatment apparatus is integrated with a sheet-shaped medium arranging apparatus having arranging means which will be described below.

With the sheet-shaped medium after-treatment apparatus, the after-treatment can be selected to be executed or not, and after-treated papers in case of after-treatment execution, or non-after-treated papers in case of no execution of the after-treatment can be arranged in sorted manner using sorting function and arranging function of the sheet-shaped medium arranging apparatus.

Figure 4:
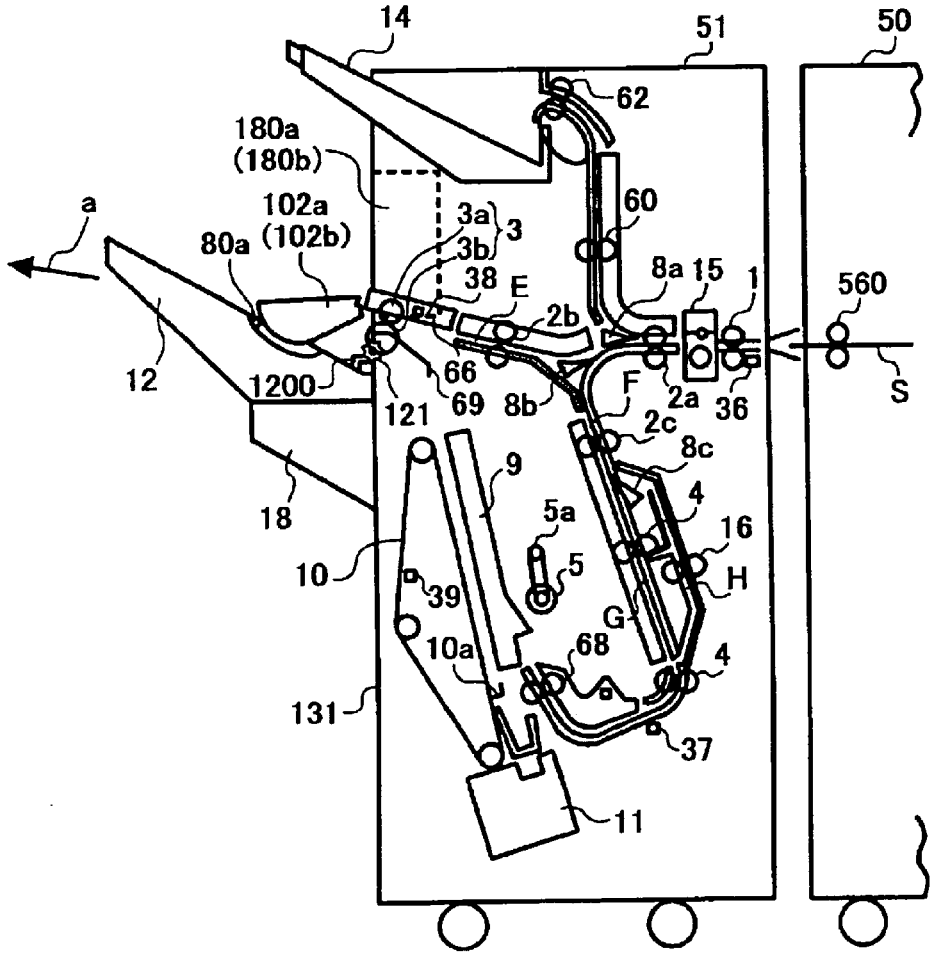
FIG. 4 is a schematic view showing the structure of the sheet-shaped medium after-treatment apparatus and image forming apparatus.

FIG. 4 depicts an example of whole configuration of the sheet-shaped medium after-treatment apparatus 61. The sheet-shaped medium after-treatment apparatus of the present embodiment can be used as being connected to other apparatus having sheet-discharging means, for example, image forming apparatus 50 without arranging function, and can arrange the papers on tray 12 with arranging function.

Papers that are image-formed in the image forming apparatus 50 are transferred to the sheet-shaped medium after-treatment apparatus 51. The after-treatment can be selected to be executed or not, and after-treated papers in case of after-treatment execution, or non-after-treated papers in case of non-execution of the after-treatment are arranged on the tray in the direction of discharge a by arranging operation of the sheet-shaped medium arranging apparatus connected with the sheet-shaped medium after-treatment apparatus 51, and, if necessary, are piled in sorted manner spaced apart by certain numbers of openings in the direction of shift d which is perpendicular to the discharge direction a (direction orthogonal to the plane of FIG. 4, hereinafter see FIG. 6). This sorting function is fulfilled by tray moving means 98 which move the tray in the direction of shift d (which will be described below).

As shown in FIG. 4, the sheet-shaped medium after-treatment apparatus 51 has a liftable tray 12 as sheet piling means, while it has a proof tray 14 as a position holding tray at the upper portion thereof.

In the vicinity of sheet-transporting position of the image forming apparatus 50, an inlet sensor 36 and a pair of inlet rollers 1 are disposed, and paper inserted by the inlet rollers 1 is conveyed along respective conveyance path according to after-treatment mode.

Downstream of a pair of inlet rollers 1, a punch unit 15 which performs punching is arranged, and conveyance rollers 2*a* are arranged downstream of the punch unit 15. Downstream of a pair of conveyance rollers 2*a*, a branch claw 8*a* is arranged, and papers are guided along conveyance path toward the proof tray 14 by the branch claw 8*a*, or along substantially horizontally extended conveyance path, selectively. When conveyed toward the proof tray 14, papers are conveyed through a pair of conveyance rollers 60, and then discharged to the proof tray 14 through a pair of discharging rollers 62.

A branch claw 8*b* is arranged downstream the branch claw 8*a*, and papers are guided by the branch claw 8*b* to a non-staple route E, or staple route F, selectively. The branch claws 8*a*, 8*b* are configured to change their positions by on/off control of solenoid which is not shown.

A paper which is guided to the non-staple route E is conveyed by the pair of conveyance rollers 2*b*, and discharged to tray 12 by a discharging roller 3 which is discharging means. A return roller 121 (not shown in other figures since it has no direct relation with the present invention) which is returned to an end fence 131 is arranged as returning means to be overlapped with the lower portion of the pair of discharging rollers 3 or to arrange paper with its rear end being in lower position thereof.

A discharging roller 3 has an upper roller 3*a* and a lower roller 3*b* with the lower roller 3*b* rotatably connected to free end of supporting means 66 which are pivotally fixed and movable upward and downward with its upstream side of sheet-discharge direction supported. The lower roller 3*b* is in contact with the upper roller 3*a* by its weight or energized force, and papers are discharged through the interfacial faces of the two rollers. When a bundle of papers on which filing treatment has been done are discharged, the supporting means 66 are moved upward pivotally, and returned in a predetermined timing. This timing is determined based on detection signal of a discharging sensor 38. The discharging sensor 38 is arranged proximate to the upstream of the discharging roller 3.

A paper guided to the staple route F is conveyed by a pair of conveyance rollers 2*c*. The branch claw 8*c* is arranged downstream of the conveyance rollers 2*c* and the paper is selectively guided to an original staple route G, or evacuation route H by the branch claw 8*c*. The branch claw 8*c* is also adapted to change its position through on/off control of a solenoid which is not shown.

A paper guided to the original staple route G is conveyed through a pair of conveyance rollers 4, detected by a discharging sensor 37, and piled in staple tray (not shown) by a pair of discharging rollers 68. During this process, each paper is aligned in longitudinal direction (sheet conveying direction) by a beating roller 5, and aligned in transverse direction (sheet width direction perpendicular to discharge direction a) by a jogger fence 9. Amid jobs, i.e., between the last paper of previous bundle and the first paper of the next. bundle, a stapler 11 is operated by a staple signal from a control means not shown, and filing treatment is executed.

If the distance between papers discharged from the image forming apparatus 50 is short and the next paper arrives before completion of filing treatment, the next paper is guided to a evacuation route H, and evacuated temporarily. The paper which was guided to the evacuation route H is returned by a pair of conveyance rollers 16.

A bundle of papers on which filing treatment has been finished are subsequently transported to the discharging roller 3 via a guide 69 by an ejecting belt 10 having an ejecting claw 10*a*, and then discharged to the tray 12. The ejecting claw 10*a* is adapted to be detected its position by a sensor 39.

The beating roller 5 imparts pendular movement about a supporting point 5*a* by the solenoid (not shown), and acts upon the paper transported into said staple tray intermittently, so that the paper collides against an end fence 131. Although not shown, the pair of discharging rollers 68 have a brush roller which prevents rear end portion of paper from flowing reversely. In addition, the beating roller 5 rotates counterclockwise. Described above is the outline of structure and operation of intrinsic functional parts of the sheet-shaped medium after-treatment apparatus.

The sheet-shaped medium after-treatment apparatus 51 can arrange and sort papers piled on the tray 12, as will be described below, as well as can implement after-treatment as an intrinsic function. The word, arrangement includes two meanings such as arrangement of ends of paper in discharge direction a, and arrangement of ends of paper in shift direction d, while the former is achieved by a function of the return roller 121 as a return means which execute collision against the end fence 131, and the latter is achieved by a pair of arranging members 102*a*, 102*b* as arranging means.

In FIG. 4, the sheet-shaped medium after-treatment apparatus includes, as its main components, the discharging roller 3, the tray 12 which receives the paper S discharged from the discharging roller 3, lifting/lowering means which lift/lower the tray 12, position determining means which control the direction of lifting/lowering of the tray 12, tray moving means as sorting means which reciprocate the tray 12 in shift direction d (direction of piercing the plane of FIG. 2) perpendicular to discharge direction a of FIG. 4, the arranging members 102*a*, 102*b* as arranging means, and driving means thereof.

Among these components, said tray lifting/lowering means are designated by reference number 95 in FIG. 5(*a*), position determining means for direction of lifting/lowering are designated by reference number 96 in FIGS. 5(*a*) and (*b*), and the tray moving means are designated by 98 in FIGS. 6 and 7, details of which being described below.

b. Tray and Tray Moving Means as Sorting Means

Referring to FIG. 4, the paper S is conveyed by a pair of conveyance rollers 2*b* as conveyance means from the branch claw 8*b* to the tray 12 via the discharging sensor 38, and delivered toward discharge direction a by the discharging roller 8.

Figure 5A:
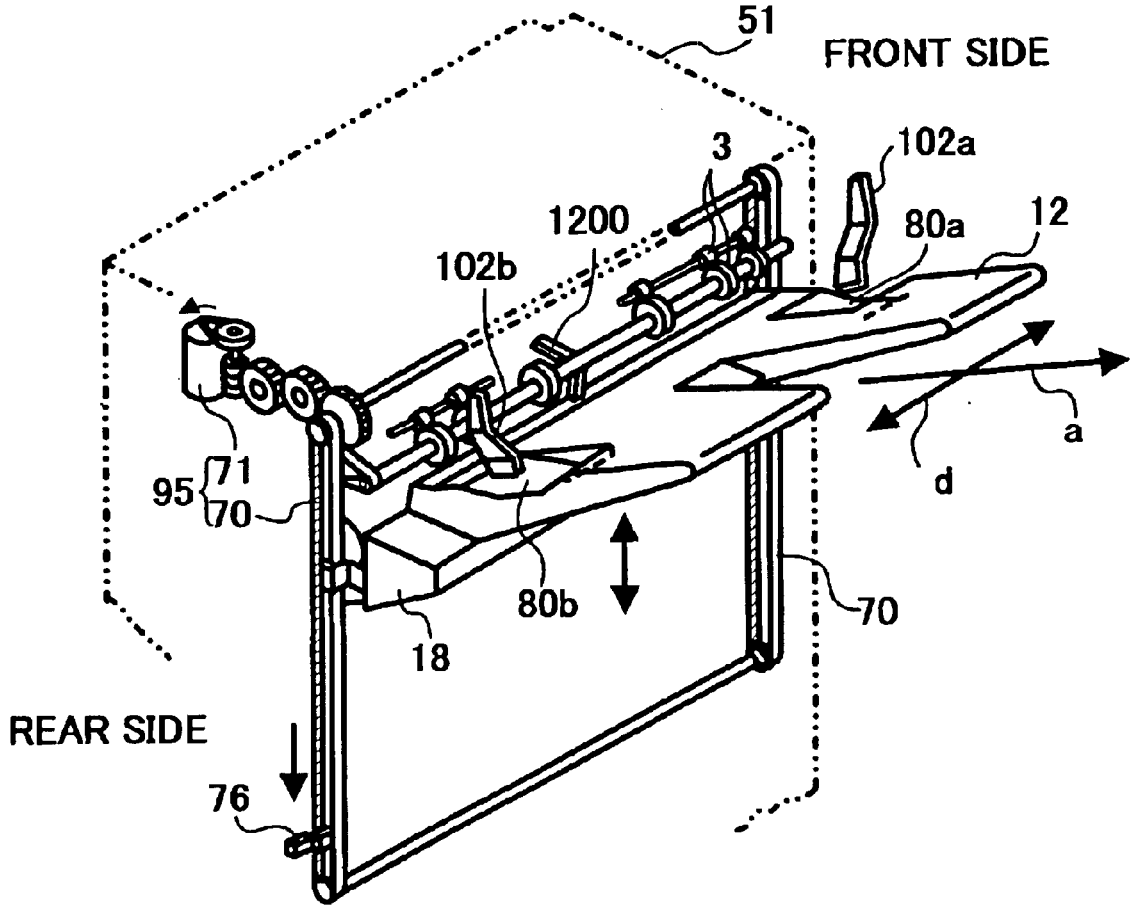
FIG. 5(*a*) is a perspective view showing the main part of the sheet-shaped medium after-treatment apparatus, and FIG. 5(*b*) is a schematic perspective view of sensor peripherals which control the height of tray.
Figure 5B:
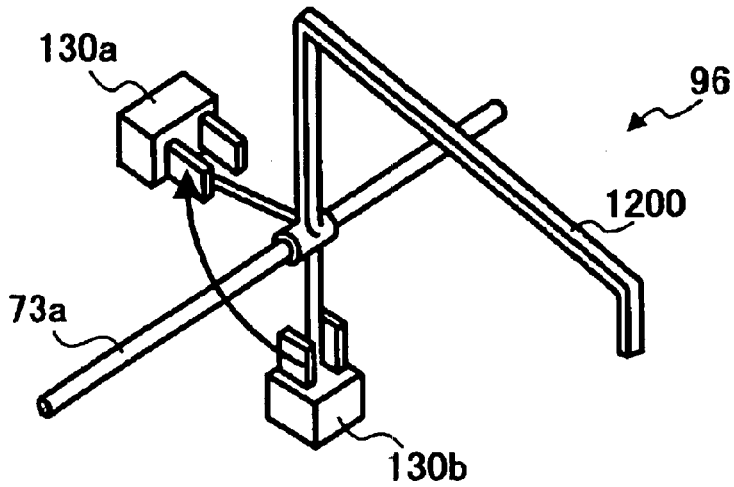

As shown in FIGS. 4 and 5, upper side of the tray 12 is inclined upwardly so that the height thereof is getting higher in discharge direction a. An end fence 131 consisting of vertical plane is located at the bottom of the inclined plane of the tray 12.

In FIG. 4, the discharged paper S from the discharging roller 3 is entered between the arranging members 102*a* and 102*b* which are staying at receiving positions, and is slipped onto the tray 12 along said inclination, and if the return roller 121 is disposed, on account of the function of the return roller 121, rear end of the paper is aligned by colliding against the end fence 131. The paper S on the tray 12 with its rear-end aligned is arranged in the shift direction d (width direction) due to arranging operation of the arranging members 102*a* and 102*b*.

As shown in FIG. 5(*a*), on upper side of the tray 12, since a recess 80*a* is defined at the portion corresponding to the arranging member 102*a* and a recess 80*b* is defined at the portion corresponding to the arranging member 102*b*, certain portions arc configured to be partially lower than the upper side of the tray 12, If there is no paper piled at least on the recesses 80*a* and 80*b*, arranging members 102*a*, 102*b* in their receiving position are oriented so that some portions of the members are located above the recesses 80*a*, 80*b* and maintained to be overlapped with the tray 12. This ensures that the arranging members 102*a*, 102*b* would be made contact with the end face of the paper S during arranging operation.

Referring to FIG. 5(*a*), the tray 12 is lifted/lowered by the lifting/lowering means 95, while being controlled by the position determining means 96 to be always in proper position for the paper S to be landed.

Consequently, if the height of the piled surface is getting higher according to continuous discharge of papers from the discharging roller 3 onto the tray 12, the tray 12 is controlled to be lowered by appropriate amount by means of the tray lifting/lowering means 95 and position determining means 96 regulating lifting/lowering direction of tray, so that the position of top surface of papers remain at a certain height from the nip portion of the arranging roller 3 and landing position remains in a certain level.

In FIGS. 4 and 5(*a*), the discharging roller 3 is in a constant position. Thus, without lifting/lowering of the tray 12, since the height of the bundle of paper becomes higher as the papers S are discharged onto the tray 12 and piled, the bundle of papers impede any discharge of paper, therefore, discharge of the paper S is made impossible consequently.

By preparing lifting/lowering means, it is possible to lift/lower the tray 12, and therefore, maintain the distance between the nip portion of the discharging roller 3 and top surface of the tray 12, or the distance between the nip portion of the discharging roller 3 and top surface of the papers S on the tray 12 at an appropriate distance by means of position determining means so that discharging is smoothly operated. In this way, it is possible to discharge the papers S onto the tray 12 with small deviation of landing position.

As shown in FIG. 5(*a*), the tray 12 is suspended by a lifting/lowering belt 70. The lifting/lowering belts 70 are driven by a lifting/lowering motor 71 through a gear train and a timing belt, and lifted or lowered by forward rotation and reverse rotation of the lifting/lowering motor 71. These lifting/lowering belt 70, lifting/lowering motor 71, gear train and timing belt are main components of the lifting/lowering means 95 which lift/lower the tray. The paper S discharged onto the tray 12 is slipped down over inclined surface of the tray 12, and aligned in discharge direction by its rear-end being collided with the end fence 131.

Thus, subsequently, while the papers S on which image forming has been done are plied in turn on the tray 12, the top surface of the papers S is getting higher. In the proximity of the return roller 121, at the top surface of the piled papers, as shown in FIGS. 5(*a*) and (*b*), there is provided a paper surface lever 1200, one end of which is supported swingably on the shaft 73*a* and is disposed to contact due to its own weight, and the other end of which is adapted to be detected by a paper surface sensor 130*a* or 130*b* comprising photo-interrupter.

The paper surface sensor 130*b* is to control the upward and downward positions of the tray 12 in a normal sheet piling mode, and the paper surface sensor 10*a* is to perform the same kind of control in a staple mode, wherein paper discharging position is changed in accordance with the modes.

The paper surface lever 1200 is supported so that it is rotated by moment of its own weight with the supporting shaft 73*a* as a center. If the position of the top surface of papers piled on the tray 12 becomes higher, curved end of the paper surface lever 1200 is pressed up by the top surface and rotated with the shaft 73*a* as a supporting point, and therefore, the paper surface sensor 130*b* is turned on upon detecting the fan-shaped plate part formed at the other end of the paper surface lever 1200. At this time, the tray 12 is configured to be lowered by the driving lifting/lowering motor 71.

At the timing when the paper surface sensor 130*b* is turned off upon the paper surface lever 1200 being rotated by lowering the tray 12, descent of the tray 12 by the lifting/lowering motor 71 is stopped. By repeating such operation, the gap between the tray 12 and the nip portion of the discharging roller 3 is controlled to be maintained at a certain distance. Control by the paper surface sensor 130*b* is performed in a normal mode, while control by the paper surface sensor 130*a* is performed in a staple mode.

At this time, since, in a normal mode, top surface of the papers S is getting higher every time paper S is discharged, every time free end of the paper surface lever 1200 is overlapped with the paper surface sensor 130*b*, the tray 12 is controlled to be lowered until the paper surface sensor 130*b* is turned off by the driving lifting/lowering motor 71. Thereby, positional condition for landing on the tray of the paper S is determined by said proper control of the gap between the discharging roller 3 and tray 12 (topmost surface of papers). The paper surface sensors 130*a*, 130*b* and the paper surface lever 1200 are main constituents of means for determining the position of the tray 96 to constantly control the height of the tray 12, and they detect information for determining the position and send it to the control means.

The height of the tray 12 under such suitable gap is referred to as a suitable discharging position, and is a position established as a suitable position for receiving the papers in normal status rather than special status such as a curl.

When the paper is discharged one by one in the normal mode, and a stapled bundle of papers are discharged in staple mode, since the discharging conditions are, of course, different, the suitable discharging positions for the tray 12 are also different. It is also obvious from the fact that the positions of the paper surface sensors 130*a*, 130*b* are differently established. Also, upon completing the after-treatment, the operation for lowering the tray 12 by approximately 30 mm is preformed to be prepared to pick up the papers.

In the normal mode, staple mode, or other modes related to any after-treatment, at each proper reference height, the paper S from the discharging roller 3 is discharged onto the tray 12, the tray 12 is lowered every time paper S is piled, and finally, the lower limit position is detected by the lower limit sensor 76. Also, when lifting the tray, the tray 12 is lifted by a reference height based on detected information about the paper surface by using the means for determining position such as the paper surface sensors 130*a*, 130*b* and paper surface lever 1200, etc.

To perform the sorting operation, the tray 12 is moved from one end to the other in shift direction which is penetrating direction of the drawing plane of FIG. 4, i.e., the direction indicated by symbol "d" of FIG. 5(*a*), and is supported sliding on the pedestal 18 to be moved from the other end to the one end.

The tray moving means 98 will be described below.

In FIG. 5, the tray 12 is moved from one end to the other end in shift direction d for performing sorting operation, and then, is moved from the other end to the one end. If a work unit, in which certain number of the discharged papers consisting of a bundle of the papers as one sorting unit are treated, is defined as 1 job, the tray 12 is not moved in shift direction d during one same job, however, the tray 12 is moved in the shift direction d when every 1 job (bundle) is finished so that the papers S discharged in the next job are received in one moving end thereof.

Every time the papers S are discharged and piled onto the tray 12, the returning operation for the paper and the arranging operation by the arranging members 102*a*, 102*b* are performed. Also, in sorting mode, when piling of the last paper is completed, sorting operation is performed by movement of the tray 12 to the shift direction d.

Figure 6:
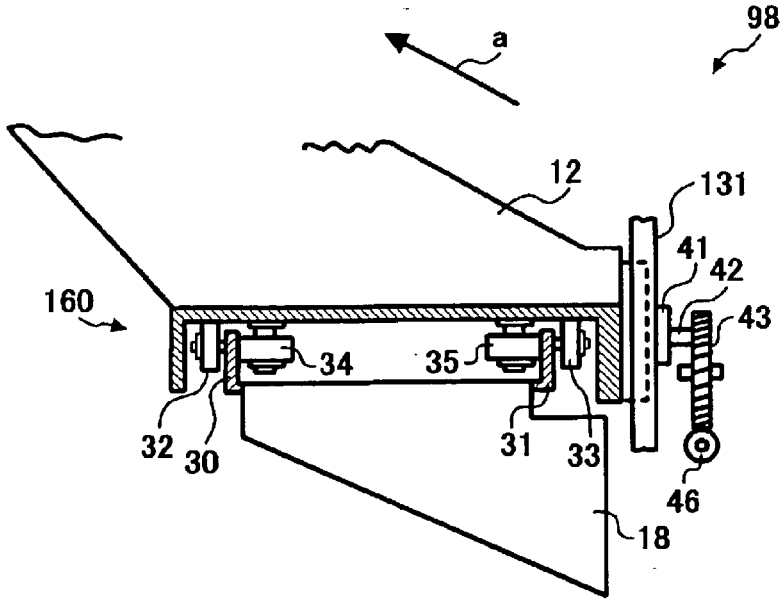
FIG. 6 is a sectional view of the main part of the means for moving the tray which move the tray to shift direction, showing the structure thereof.
Figure 7:
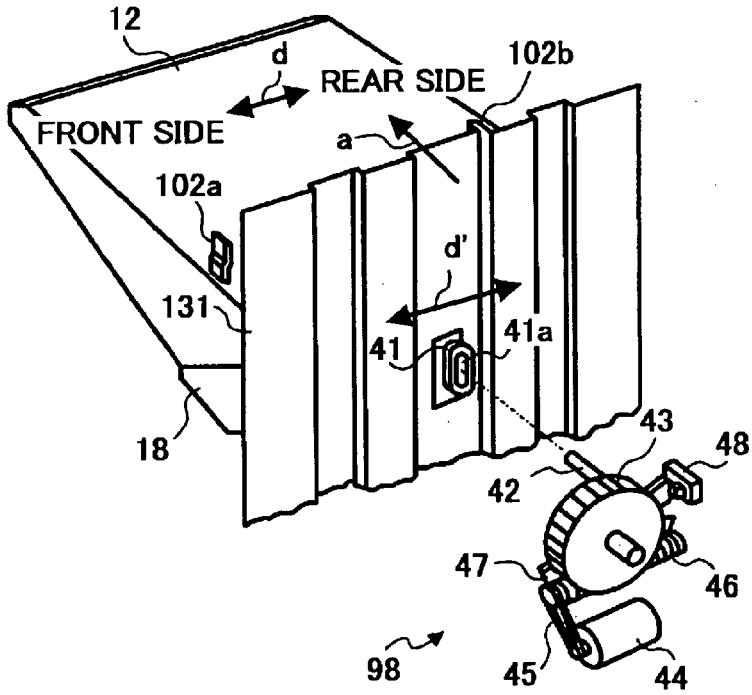
FIG. 7 is a perspective view illustrating the main part of a tray driving mechanism.

Referring to FIGS. 6 and 7, the tray moving means 98 which, in order to sort the papers (including a bundle of papers) piled on the tray 12, perform the sorting operation by moving the tray 12 in the shift direction d are shown. Since the displacement amount d' of the tray 12 is an amount necessary for sorting, it is preferable that it is determined depending on paper size or kind of paper, and operator's preference, etc., however, for example, about 20 mm will be good.

The tray moving means 98, as shown in FIG. 6, include a tray supporting structure for supporting the tray 12 on a pedestal 18, and as shown in FIGS. 6 and 7, the tray reciprocating mechanism for reciprocating the tray 12.

The tray supporting structure 160 is described in reference to FIG. 6. In FIG. 4, two guide plates 30, 31 which are opposed widthwise are integrally arranged on the pedestal 18, and they have their lengths in shift direction d. Outside each of these guide plates 30, 31, the shaft is protruded and rollers 32, 33 are axially supported.

Beneath the tray 12, a flat portion comprising a flat surface having its inner length which is bigger than the distance between the rollers 32, 33 widthwise and which is long enough to cover the amount of shift of tray in the shift direction d. The flat portion is mounted on the rollers 32, 33. In addition, in said flat portion of the tray 12, two pairs of shafts are disposed at positions corresponding to inside of the guide plates 30, 31 so that each roller 34, 35 is axially supported on the two pairs of shafts. These rollers 34, 35 are in contact with inside of each guide plate 30, 31.

The rollers 32, 33, 34, 35 and guide plates 30, 31 constitute a tray supporting structure 160 which supports the tray 12 in shift direction d. By the tray supporting structure 160, weight of the tray 12 is supported by the rollers 32, 33, and the tray 12 is guided in the guide plates 30, 31 in shift direction d to be moved.

Driving force for reciprocating movement are applied by combining tray reciprocating mechanism with the tray 12 supported by the tray supporting structure 160 so that reciprocating movement in shift direction d is possible. By means of the tray moving means composed as such, the tray 12 can be reciprocated in shift direction d by certain amount necessary for paper sorting.

Now, exemplary embodiment of the tray reciprocating mechanism will be explained together with the position determining means. In FIG. 7, the tray 12 is actuated in the same direction as the end fence 131 is actuated in the shift direction d since the tray 12 is inserted in the convexo-concave part of the end fence 131. A bracket 41 having a long hole 41*a* is mounted at center portion of shift direction d of the end fence 131, and a pin 42 is inserted in said long hole 41*a*.

The pin 42 is securely inserted in a worm wheel 43 axially supported on a main body not shown. The secure insertion position is located eccentrically from center of rotation of the worm wheel 43. The amount of eccentricity is a half of displacement amount d' of the tray 12 in shift direction d.

The worm wheel 43 is configured to rotate by means of a worm 46 rotating from a motor 44 via a timing belt 45. The pin 42 is rotated by rotation of the worm wheel 43, and the tray 12 is changed in its direction of movement to reciprocate straightly in shift direction d according to the amount of eccentricity. The structure of the pin 42 rotating eccentrically, the long hole 41*a* and the peripherals thereof constitute main part of the tray reciprocating mechanism.

Figure 8:
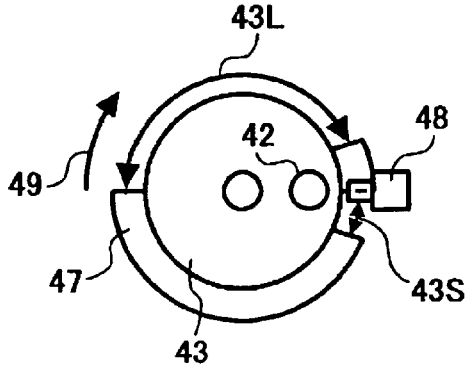
FIG. 8 is a front view showing a worm wheel and a home sensor.
Figure 9:
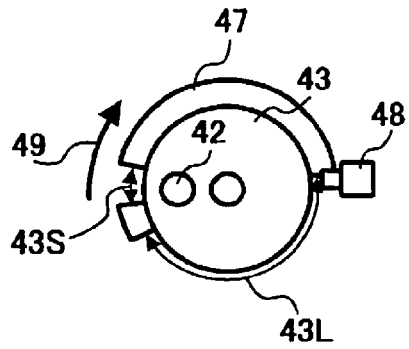
FIG. 9 is a front view showing the worm wheel and home sensor.

As shown in FIGS. 8 and 9, a disk-shaped encoder 47 having two big different cutouts 43L, 43S, a semi-circular long convex portion and a short convex portion adjacent therewith which were formed relatively by the two cutouts 43L, 43S are provided the worm wheel 43.

The cutout 43L is a long cutout, and the cutout 43S is a short cutout. Upon every half-rotation of the encoder 47, a home sensor 48 detects cut-out length of the encoder 47 by the gap between two said convex portions so that signal for stopping a driving motor 44 is emitted from control means.

In FIG. 8, when the cutout 43S, which is a short one, of the encoder 47 being rotated in direction of arrow 49 is passed through the home sensor 48, and overlapped with the short convex portion, the motor 44 stops. In this state, the pin 42 is in rear side, and the tray 12 is also moved to the rear side by the end fence 131 of FIG. 7 being moved to the rear side.

In FIG. 9, when the cutout 43L, which is a long one, of the encoder 47 being rotated from the state shown in FIG. 8, especially in direction of arrow 49, is passed through the home sensor 48, and overlapped with long convex portion, the motor 44 stops, In this state, the pin 42 is in front side, and the tray 12 is also moved to front side by the end fence 131 of FIG. 7 being moved to front side.

In this manner, whether the tray 12 is in rear side or front side can be identified by sensing the length of cutout of encoder 47 by means of the home sensor 48 and by using the sensed information.

In this manner, discharge of papers comprising a bundle under the same job is received by going-stroke of reciprocation of the tray 12, among the strokes of reciprocation of the tray 12 in shift direction d, while discharge of papers comprising another bundle under the next job is received by coming-stroke of the tray 12.

By repeating this sorting action, a bundle of papers for each job is piled in a condition that each bundle is concavo-convexly offset one another by certain amount so that every bundle for each job (bundle) can be sorted. Displacement amount d' can be determined as a proper value, 5–25 mm which is enough to clarify the sorting in regard to the size of paper, for example, 20 mm for A4 size.

c. Arranging Operation

The pair of arranging members 102*a*, 102*b* constituting arranging means consist of panel-shaped body, and arranging portions 102*a*1 102*b*1 are located at the lowest of the arranging members 102*a*, 102*b*, and mutually facing surfaces are plane surfaces which are perpendicular to said shift direction d.

In this manner, by preparing the mutually facing surfaces of the arranging portions 102*a*1, 102*b*1 as plane surfaces perpendicular to shift direction d, it is possible that a bundle of papers are arranged through reliable contact and separation between the arranging portions 102*a*1, 102*b*1 and ends of the papers S piled on the tray 12 by movement of arranging member 102, 103 in shift direction d. Furthermore, by employing panel-shaped body, compact structure can be obtained.

The arranging means include a pair of arranging members for executing arranging operation in which positions of two ends, which are in parallel with discharge direction, of said paper discharged from the discharge roller 3 and piled onto the tray 12 close together to got contacted by the arranging portion 102*a*1, 102*b*1 for arrangement, and said arranging means perform said arranging operation to arrange papers, which were piled after sorting, in different position with the position of the sheet-shaped medium which has been filed before said sorting.

Figure 2:
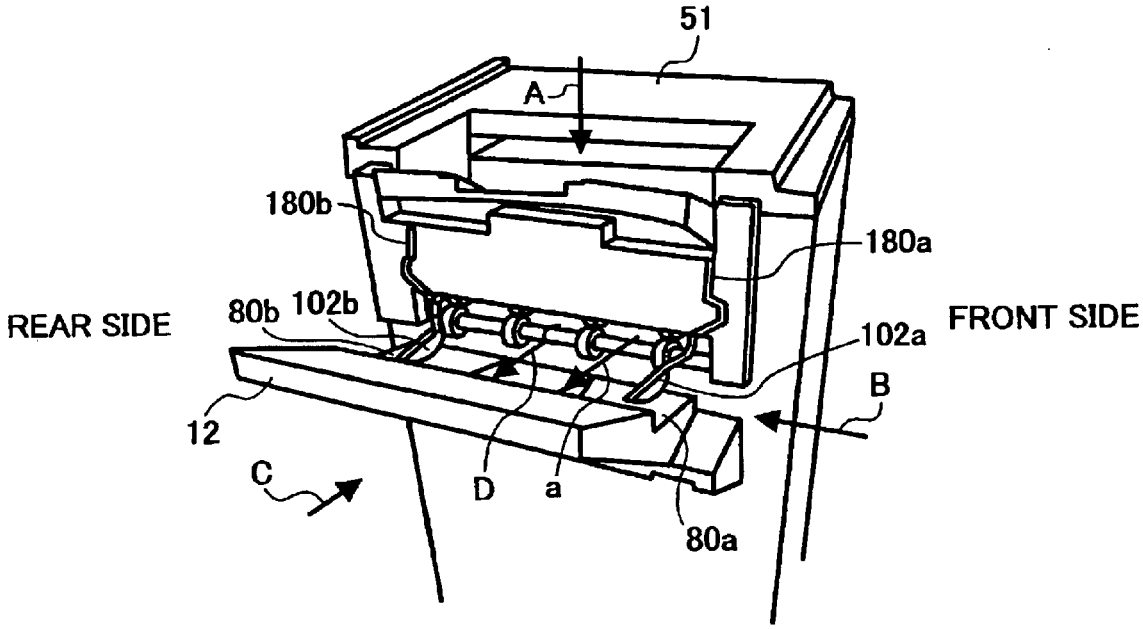
FIG. 2 is a partial perspective view of a sheet-shaped medium after-treatment apparatus seen from inclined direction.
Figure 10:
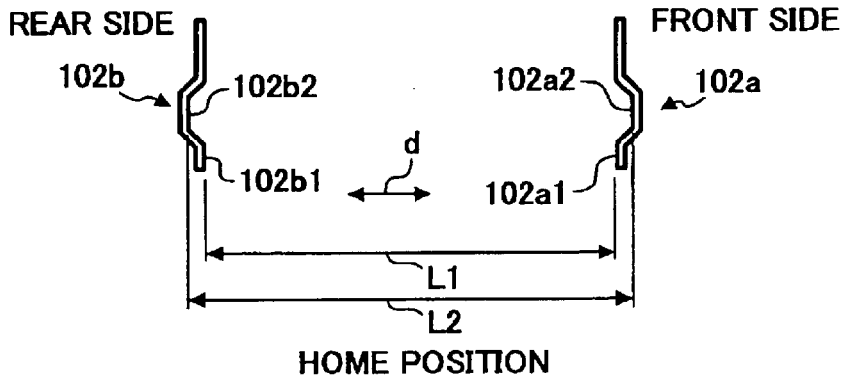
FIG. 10 is a schematic front view of an arranging member and means for moving the arranging member seen from downstream of discharge direction.

In FIG. 10 illustrating arranging members seen from upstream of discharge direction a in FIG. 2, the arranging members 102*a*1, 102*b*1 are configured to have opposing gap of each arranging portion 102*a*1, 102*b*1 as L1.

Figure 11:
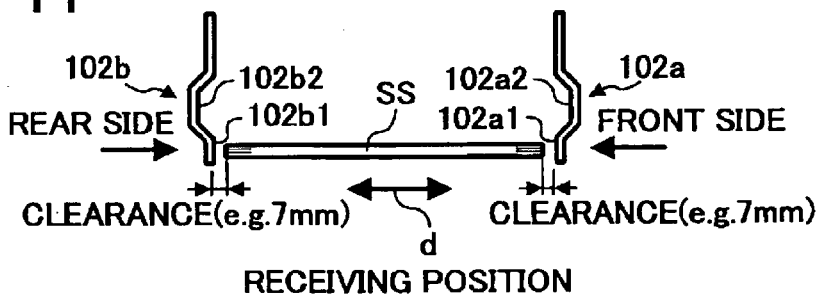
FIG. 11 is a schematic front view of the arranging member and means for moving arranging member seen from downstream of discharge direction.

Around the time of arranging operation, when the paper S is discharged onto the tray 12, the arranging members 102*a*, 102*b* are moved to a insertion position where the arranging portions 102*a*1, 102*b*1 can wait the paper S from the paper roller 3 to be inserted, with the distance between the arranging portions wider than the width of said paper, and in the insertion position, wait the discharge of the paper S from the paper roller 3. In FIG. 11 seen from downstream of discharge direction a in FIG. 2, the insertion position is, for example, a position in which the distance is wider by 7 mm in one side than the paper width of a bundle SS of A4 size papers.

Figure 12:
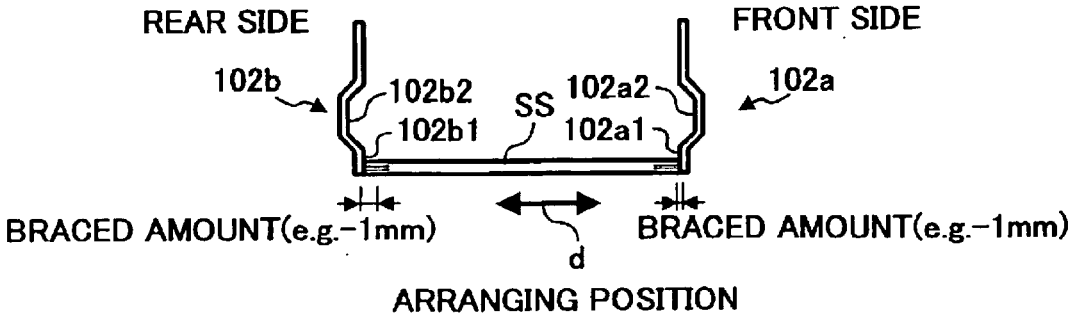
FIG. 12 is a schematic front view of the arranging member and means for moving the arranging member seen from downstream of discharge direction.

The arranging members 102*a*, 102*b* are staying at position, where they can receive the paper discharged slightly displaced in shift direction d and they can receive the paper with minimum clearance, and if the papers are discharged and piled onto the tray 12, the arranging members are moved to the position which is narrower than paper width as shown in FIG. 12 to arrange the papers. The reason why the receiving position is set as above is that it takes more time to return to a home position if the clearance is bigger during arranging operation. Of course, it is possible to move the arranging members from the home position to the arranging position each time.

As certain amount of time for the paper S to be discharged from the discharge roller 3 onto the tray 12 and completely stopped lapses, (1) by approaching the arranging members 102*a*, 102*b* each other, as indicated by arrows in FIG. 11, or (2) by moving one arranging member among the two arranging members 102*a*, 102*b* in the direction of arrow in FIG. 11, with the other member prevented from moving, consequently, as shown in FIG. 12, the arranging portions 102*a*1, 102*b*1 abuts against the two ends, which are in parallel with discharge direction of the bundle of the papers SS (direction of piercing the drawing plane), at a position where the gap of arranging positions is slightly narrower than width of said paper.

Said narrowed amount is, for example, a status in which the arranging portions 102*a*1, 102*b*1 abuts the ends of the bundle of the papers SS so that one side of the paper is braced by 1 mm, and the ends of the bundle of the papers SS are arranged by the braced amount. Thereafter, the arranging members 102*a*, 102*b* return to receiving position described in FIG. 11 and wait the discharge of the next paper S.

Furthermore, when performing arranging operation such as said (1), it is called as both sides movement mode that the arranging members 102*a*, 102*b* are approached with respect to each other to execute arrangement. Also, for operation as said (2), it is called as one side movement mode that one arranging member 102*a* or 102*b* is moved in the arrow direction to execute arrangement in a state that the other arranging member is stopped. These arrangement types will be explained in more detail in the following "arranging operation".

During same job, until all the papers constituting the same bundle are discharged, the arranging members 102*a*, 102*b* are moved between receiving position, illustrated in FIG. 11 as one moving end of the tray 12, and arranging position illustrated in FIG. 12.

When the arranging members 102*a*, 102*b* are staying at receiving position shown in FIG. 11, each position of the paper S discharged from the discharge roller 3 in shift direction d is not always same, and there may be a bias due to skew, etc. Thus, if receiving position, which is determined by distance between the arranging portions 102*a*1, 102*b*1, is wider, it is easier to receive papers, however, if it becomes too wide, displacement amount of the arranging members 102*a*, 102*b* under arranging operation are so big that it is not applicable to models for rapid discharge.

Thus, it is preferable to receive the papers S under the condition that distance between the arranging portions 102*a*1, 102*b*1 is as narrow as possible, that is to say, receiving position of the arranging members 102*a*, 102*b* is as small as possible while the distance between upper portions of the arranging portions 102*a*1, 102*b*1 is wide.

In shift mode, in either of one side movement mode or both sides movement mode, when arranging operation is executed so that a bundle of papers for current job, e.g., A4 size papers and shift amount of 20 mm, are piled on a bundle of papers relating to previous job, which were already arranged, with offset corresponding to amount of shift, the arranging member 102*a* or 102*b*, which is in the downstream of shift completed just before the current job, is in contact with top surface of the bundle of papers for the previous job.

In one side movement mode, arrangement is performed by preventing the arranging member on top surface of the bundle of the papers for previous job from moving and by moving the opposite the arranging member, while in both sides movement mode, since both arranging members 102*a*, 102*b* are moved, arrangement is performed with one arranging member being in contact with the top surface of the papers.

In addition, in either of one side movement mode or both sides movement mode, if the arranging member is returned to receiving position shown in FIG. 11 after completion of previous job, since a bundle of the papers for the previous job which were already arranged may be disarranged on the tray 12 by being caught by the arranging members 102*a*, 102*b* during shift of the tray 12 for the next job, in order to avoid above disarrangement, evacuation operation is employed to separate the arranging members 102*a*, 102*b* from the top of the papers after completion of one job.

Evacuating operation can be executed by moving the arranging members 102*a*, 102*b* or lowering the tray 12, however, in this embodiment, pivoting the arranging members 102*a*, 102*b* about a supporting point to evacuate is employed. Respective arranging operation in one side movement mode or both side movement mode will be described below.

(1) One Side Movement Mode

Figure 13A:
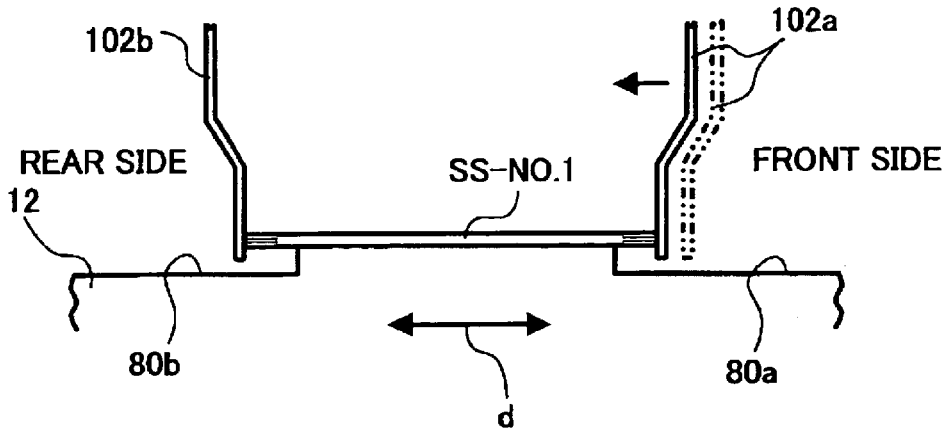
FIGS. 13(*a*), (*b*) and (*c*) show a sequence of sorting and arranging operation according to one side moving state.
Figure 13B:
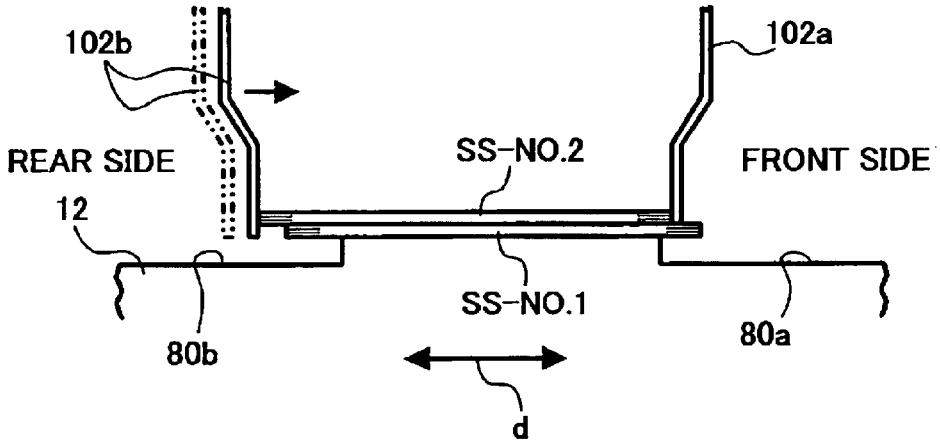
Figure 13C:
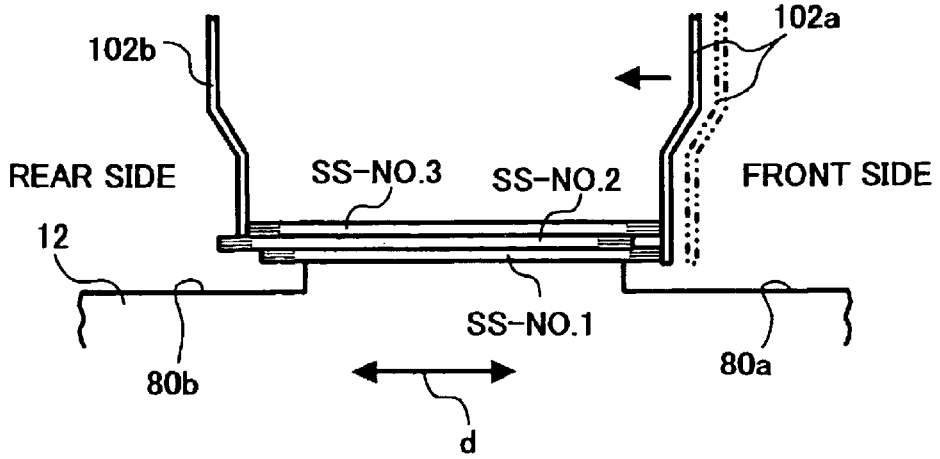

Referring to FIG. 13, arranging operation in one side movement mode of the arranging members 102*a*, 102*b* will be explained. In FIG. 4, the paper S is discharged at the discharge roller 3 in discharge direction a through the conveyance path where the pair of conveyance rollers 2*b*, discharge sensor 38, and discharge roller 3, etc. are disposed.

[The First Job]

In FIGS. 2 and 13(*a*), the paper S discharged toward discharge direction a is discharged in the direction of slanted downward arrow D, and dropped onto the tray 12 due to its own weight. Here, the number of papers constituting a bundle of the papers are assumed to be already piled. Before the discharge of the papers S, the tray 12 is moved to one end side of shift direction d, e.g., rear side, by the tray reciprocating mechanism shown in FIGS. 6 to 9 in advance, and, in the direction of shift direction d, the arranging member 102*a* is in receiving position (which is indicated as two-dot chain line in FIG. 13(*a*)) corresponding to explanation about FIG. 11, and the arranging member 102*b* is near the end of paper, and, in up/down direction, each arranging member 102*a*, 102*b* is at arranging position where its rotation due to self-weight is stopped by the stopper or paper, i.e., where the arranging portion 102*a*1, 102*b*1 faces side of the bundle of papers, and an amount of papers that can constitute the first bundle of papers SS-No. 1 relating to the first job are piled.

When a new paper S is discharged, the arranging member 102*b* is not moved, while the arranging member 102*a* is move toward the bundle of papers SS-No. 1 to contact or collide with. ends of the papers which is in parallel with discharge direction a so that the bundle SS-No. 1 is narrowed, and is moved to arranging position (which is indicated by solid line in FIG. 13) where it is located inwardly of the paper by approximately 1 mm from ends of papers to perform arranging operation as explained in FIG. 12.

By such arranging operation, the bundle of papers SS-No. 1 are arranged in a condition that there occurs no deflection Δx (see FIG. 3) during free fall of the paper S from the nip portion of discharge roller 3 onto top surface of the papers. Thereafter, the arranging member 102*a* is returned to receiving position indicated by solid line. Such operation is performed every time paper S is discharged and piled onto the tray 12.

Some of the papers discharged in are carrying shift command signal. A paper carrying a shift command signal is the first paper, and whether shift command signal is carried or not is detected by control means when the paper passes the discharge sensor 38.

If no command signal is detected by the control means after discharge of certain number of papers constituting the first bundle of papers SS-No. 1 is completed, the arranging members 102*a*, 102*b* are returned to the home position (see FIG. 10) without shifting the tray 12 since such no command signal implies end of the job.

[Second Job]

If a command signal is detected by the control means after discharge of certain number of papers constituting the first bundle of papers SS-No. 1 is completed, the tray 12 is shifted for the next job while the paper reaches the tray 12 since the paper is the first paper of the next job. Prior to the shift, the arranging members 102*a*, 102*b* are displaced from top surface of the papers to rotating position for evacuation (which is reference state in said FIG. 195(*b*)) in up/down direction to be in evacuation state, and the tray 12 is shifted from rear side to front side in this evacuation state.

After said shift, the arranging members 102*a*, 102*b* are displaced to receiving position illustrated in FIG. 11 in shift direction, and are moved from said rotating position for evacuation to rotating position for arrangement referred in FIG. 196(*a*) in up/down direction.

Here, said rotating position for arrangement is a position in which the arranging members 102*a*, 102*b* are rotated about supporting point due to moment of self-weight to be stopped at a stopper by their bottom ends being lowered into the recesses 80*a*, 80*b*, or a position where, if there exist papers, the rotation of said members due to self-weight is stopped by the papers.

In FIG. 13(*b*), after forward shift of the tray 12, the front arranging member 102*a* is near the ends of papers in shift direction and is in a rotating position where it rides on the first bundle of papers SS-No. 1 to perform arrange in up/down direction, while the rear arranging member 102*b* is lowered to the recess 80*b* in up/down direction and is in a certain receiving position from ends of papers in shift direction as indicated by two-dot chain line. In addition, in FIG. 13(*b*), an amount of papers that can constitute the second bundle of papers SS-No. 2 relating to the second job are piled.

When the papers S relating to the second job are discharged, the front arranging member 102*a* is not moved, while rear arranging member 102*b* is move in shift direction d toward the second bundle of papers SS-No. 2 to contact or collide with ends of papers which is in parallel with discharge direction a so that the bundle SS-No. 2 is narrowed, and is moved to arranging position indicated by solid line in FIG. 13(*b*) to perform arranging operation, By such arranging operation, the second bundle of papers SS-No. 2 are arranged. Thereafter, the arranging member 102*b* is returned to receiving position. Such operation is performed every time paper S is discharged and piled onto the tray 12.

There are two cases, a case of carrying a sift command and the case of no carrying the sift command in the papers discharged. Paper carrying the shift command is the first paper, and whether shift command is carried or not is detected by control means when the paper passes the discharge sensor 38.

If no command signal is detected by control means after discharge of certain number of papers constituting the second bundle of papers. SS-No. 2 is completed, the arranging members 102*a*, 102*b* are returned to home position (see FIG. 10) without shifting the tray 12 since such no command signal implies end of the job.

[The Third Job]

If a command signal is detected by control means after discharge of certain number of papers constituting the second bundle of papers SS-No. 2 is completed, the tray 12 is shifted for the next job while the paper reaches the tray 12 since the paper is the first paper (leading paper) of the next job. Prior to the shift, the arranging members 102*a*, 102*b* are displaced from the top surface of the papers to rotating position for evacuation (which is the reference state in said FIG. 195(*b*)) in up/down direction to be in evacuation state, and the tray 12 is shifted from front side to rear side in this evacuation state.

After said shift, the arranging member 102*b* is located at receiving position spaced apart from end of paper as indicated by two-dot chain line in FIG. 13(*c*), while the arranging member 102*a* is located at receiving position spaced apart from end of paper as illustrated in FIG. 13(*c*). Also, in up/down direction, the arranging members 102*a*, 102*b* are moved from rotating position for evacuation to rotating position for arrangement.

Consequently, the rear arranging member 102*b* abuts against the second bundle of papers SS-No. 2, and is located near the end of the third bundle of papers SS-No. 3 conveyed thereafter, while the front arranging member 102*a* is at certain receiving position indicated by two-dot chain line. In addition, FIG. 18(*c*) depicts a state in which an amount of papers that can constitute the third bundle of papers SS-No. 3 relating to the third job are piled.

When the papers S relating to the third job are discharged, the rear arranging member 102*b* is not moved, while the front arranging member 102*a* is move in shift direction d toward the third bundle of papers SS-No. 3 to contact or collide with ends of papers which is in parallel with discharge direction a so that the bundle SS-No. 3 is narrowed, and is moved to arranging position shown in FIG. 12 to perform arranging operation.

Thereafter, the arranging member 102*a* is returned to receiving position indicated by two-dot chain line. Such operation is performed every time paper S is discharged and piled onto the tray 12. Some of the papers discharged in are carrying shift command signal. Paper carrying a shift command signal is the first paper, and whether shift command is carried or not is detected by control means when the paper passes the discharge sensor 38.

If no command signal is detected by control means after discharge of certain number of papers constituting the third bundle of papers SS-No. 3 is completed, arranging members 102*a*, 102*b* are returned to home position (see FIG. 10) without shifting the tray 12 since such no command signal implies end of the job.

When the discharge of the predetermined number of papers forming the third bundle of paper SS-No. 3 is completed, if control means identify a shift command signal, since the paper is a head paper of the next job, the tray 12 is shifted for the next job until the first paper reaches the tray 12. Prior to the tray 12 being shifted, the discharging of the first paper is performed by moving the arranging members 102*a*, 102*b* to a rotating position for evacuation and by shifting the tray 12 from rear side to front side under the state that the arranging members 102*a*, 102*b* move to the rotating position for evacuation. Thereafter, the same type of the procedure as described above is repeated.

(2) Both Sides Movement Mode

Figure 14A:
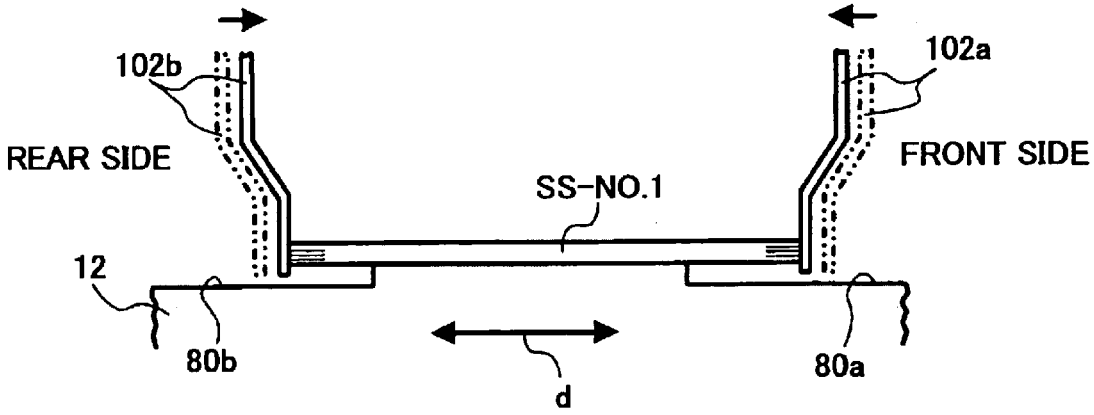
FIGS. 14(*a*), (*b*) and (*c*) show a sequence of sorting and arranging operation according to both sides moving state.
Figure 14B:
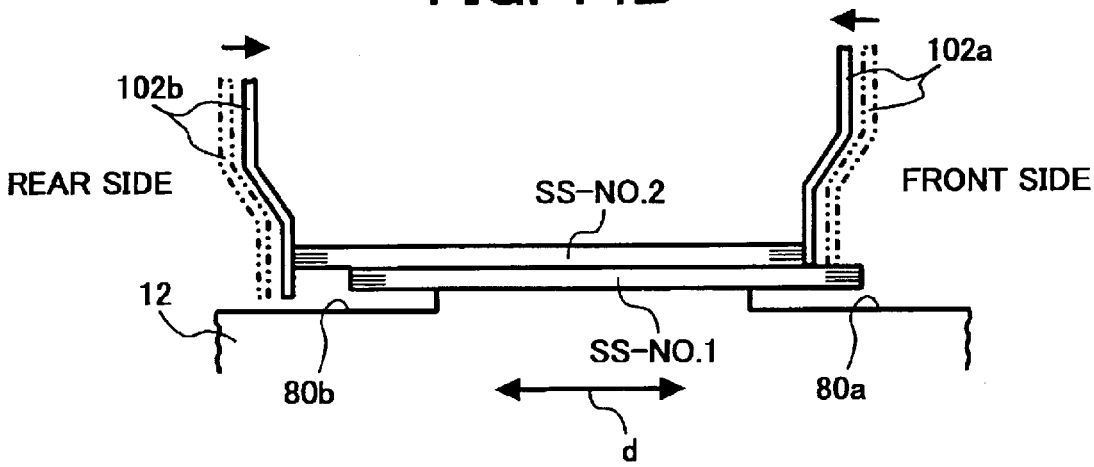
Figure 14C:
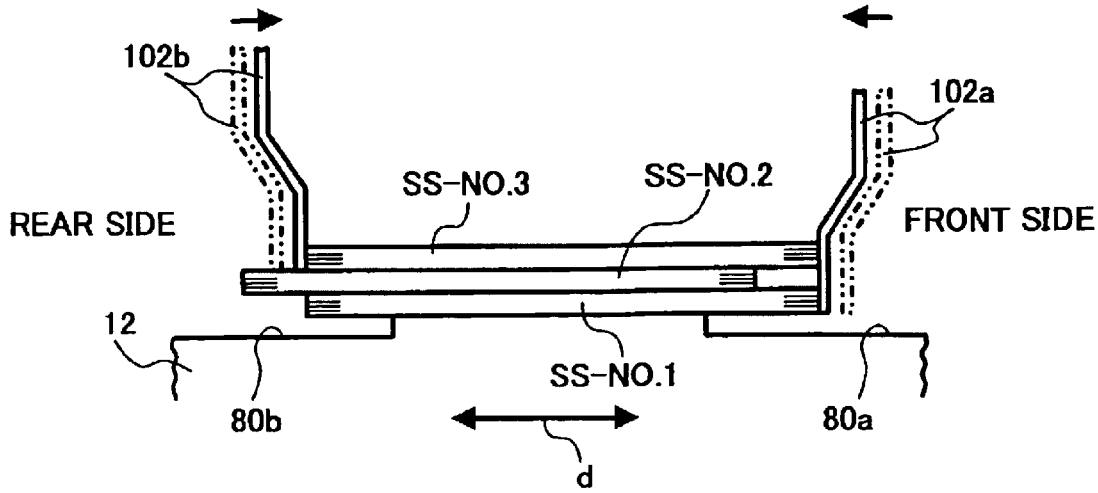

FIG. 14 illustrates arranging operation according to both sides movement mode by means of the arranging members 102*a*, 102*b*. In FIG. 4, paper S is transferred from the discharging roller 3 in discharge direction a via conveyance path where the pair of conveyance rollers 2*b*, discharge sensor 38 and discharging roller 3 are disposed.

[The First Job]

In FIG. 14(*a*), as in the case of one side movement mode, paper is dropped down onto the tray 12. Here, a number of papers which form a bundle of papers are already piled. Prior to discharge of the paper S, the tray 12 is adjacent to one end of shift direction d, for example, a rear side, in advance by means of tray reciprocating mechanism described in FIGS. 6 to 9, and the arranging members 102*a*, 102*b* are, as shown in FIG. 11, located in receiving positions, that is, positions shown as alternate two-dot chain line, respectively, referring to a rotating position for arrangement as shown in FIG. 196(*a*), wherein an amount of papers that can constitute the first bundle of papers SS-No. 1 relating to the first job are piled up.

When the paper S is discharged, the arranging members 102*a*, 102*b* contact or collide with ends, which are in parallel with discharge direction a, of papers and are transferred into an arranging position as shown in FIG. 12 in the direction of access to the bundle of papers SS-No. 1 so that they interpose the bundle of papers SS-No. 1 therebetween to perform arranging operation. By this arranging operation, a bundle of papers SS-No. 1, likewise in event of said one side movement mode, are arranged without transverse deflection $\Delta x$ (see FIG. 3) which may be produced during free fall of paper S. Thereafter, the arranging members 102*a*, 102*b* are returned to receiving position shown in FIG. 11. This operation is performed every time paper S is discharged and piled onto tray 12.

Some of the papers discharged in are carrying a shift command signal. The papers carrying a shift command signal is a head paper of a bundle of papers, and whether the shift command signal is carried or not is detected by control means when the paper passes the discharge sensor 38.

When the discharge of the predetermined number of papers forming the first bundle of paper SS-No. 1 is completed, if control means do not detect a shift command signal, which means the end of this job, this cause the tray 12 not to be shifted and the arranging members 102*a*, 102*b* to be returned to the home position (see FIG. 10).

[The Second Job]

When the discharge of the predetermined number of papers forming the first bundle of paper SS-No. 1 is completed, if control means identify a shift command signal, since the paper is a head paper of the next job, the tray 12 is shifted for the next job until the first paper reaches the tray 12, At the time of such shifting of the tray 12, the arranging members 102*a*, 102*b* are evacuated toward upper side remotely from top surface of papers by being moved to rotating position for evacuation (reference position in FIG. 195(*b*)), and the tray 12 is shifted from rear side to front side under this evacuated condition.

After said shift, in shift direction, the arranging members 102*a*, 102*b* are located in receiving position indicated by alternate two-dot chain line in FIG. 14(*b*), and in up/down direction, they are displaced from rotating position for evacuation referred to FIG. 195(*b*) as shown in FIG. 14(*b*) so that the arranging member 102*a* is displaced onto the papers and the arranging member 102*b* is displaced into the recess 80*b*. In addition, in FIG. 14(*b*), an amount of papers that can constitute the second bundle of papers SS-No. 2 relating to second job are piled up.

When the papers S relating to the second job are discharged, the same arranging members 102*a*, 102*b* as described above contact or collide with ends, which are in parallel with discharge direction a, of papers to be moved to arranging position shown in FIG. 10 by being moved from position of two-dot chain line to position shown by solid line, that is, in the direction of access to the second bundle of papers SS-No. 2 so that they interpose the bundle of papers SS-No. 2 therebetween to perform arranging operation. By this arranging operation, the second bundle of papers are arranged. Thereafter, the arranging members 102*a*, 102*b* move back and are returned to receiving position as shown by two-dot chain line in FIG. 14(*b*). Such operation is performed every time paper S is discharged and piled upon the tray 12.

Some of the papers discharged are with and without carrying shift command signal. The papers carrying a shift command signal is a head paper of a bundle of papers, and whether shift command signal is carried or not is detected by control means when the paper passes the discharge sensor 38.

When the discharge of the predetermined number of papers forming the second bundle of paper SS-No. 2 is completed, if control means do not detect a shift command signal, which means the end of this job, this cause the tray 12 not to be shifted and the arranging members 102*a*, 102*b* to be returned to the home position (see FIG. 10).

[The Third Job]

When the discharge of the predetermined number of papers forming the second bundle of paper SS-No. 2 is completed, if control means identify a shift command signal, since the paper is a head paper of the next job, the tray 12 is shifted for the next job until the first paper reaches the tray 12. At the time of such shifting of the tray 12, the arranging members 102*a*, 102*b* are evacuated by being moved to rotating position for evacuation, and tray 12 is shifted from front side to rear side under this evacuated condition.

After said shift, in right/left direction, both the arranging members 102*a*, 102*b* are located in receiving position indicated by two-dot chain in FIG. 14(*c*), and in up/down direction, the arranging member 102*a* is lowered to the recess 80*a* and the arranging member 102*b* rests on the second bundle of papers SS-No. 2 due to its own weight. In addition, in FIG. 14(*c*), an amount of papers that can constitute the third bundle of papers SS-No. 3 relating to third job are piled up.

When the papers S relating to the third job are discharged, the arranging members 102*a*, 102*b* are moved in the direction of access to the third bundle of papers SS-No. 3 to interpose the third bundle of papers SS-No. 3 therebetween so that they contact or collide with ends, which are in parallel with discharge direction a, of papers, and as a result, they are moved to arranging position indicated by solid line of FIG. 14(*c*) to perform arranging operation. By this operation, the third bundle of papers SS-No. 3 are arranged.

Thereafter, the arranging members 102*a*, 102*b* move back and are returned to receiving position as shown by two-dot chain line in FIG. 14(*c*). Such operation is performed every time paper S is discharged and piled upon the tray 12.

Some of the papers discharged in are carrying a shift command signal. The papers carrying a shift command signal is a head paper of a bundle of papers, and whether shift command signal is carried or not is detected by control means when the paper passes the discharge sensor 38.

When the discharge of the predetermined number of papers forming the third bundle of paper SS-No. 3 is completed, if control means do not detect a shift command signal, which means the end of this job, this cause the tray 12 not to be shifted and the arranging members 102*a*, 102*b* to be returned to home position (see FIG. 10).

When the discharge of the predetermined number of papers forming the third bundle of paper SS-No. 3 is completed, if control means identify a shift command signal, since the paper is a head paper of the next job, the tray 12 is shifted for the next job until the first paper reaches the tray 12. At the time of such shifting of the tray 12, the arranging members 102*a*, 102*b* are evacuated by being moved to rotating position for evacuation, and the tray 12 is shifted from rear side to front side under this evacuated condition to allow the head paper to discharge. Thereafter, the same type of the procedure as described above is repeated.

Also, to execute the sorting, another embodiment is also available in which shift and arrangement can be performed together by performing the arrangement in a position where the arranging members 102*a*, 102*b* are moved by an amount as necessary without the shift of the tray 12 rather than by moving the tray 12 in shift direction as described above.

d. Example of structure for rotating the arranging means

Figure 15:
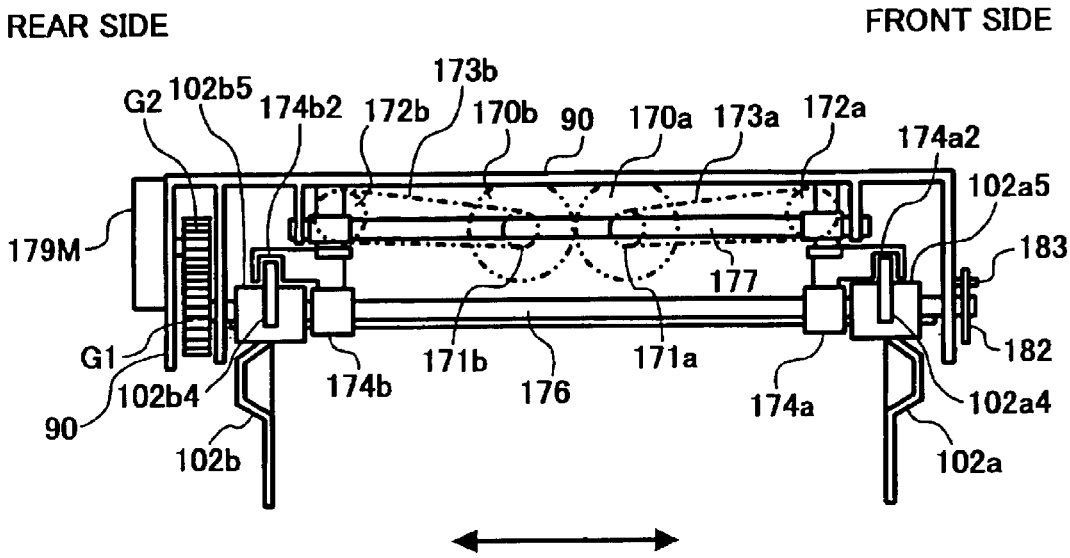
FIG. 15 shows the main part of the sheet-shaped medium aligning apparatus seen from the direction of A of FIG. 2.
Figure 16:
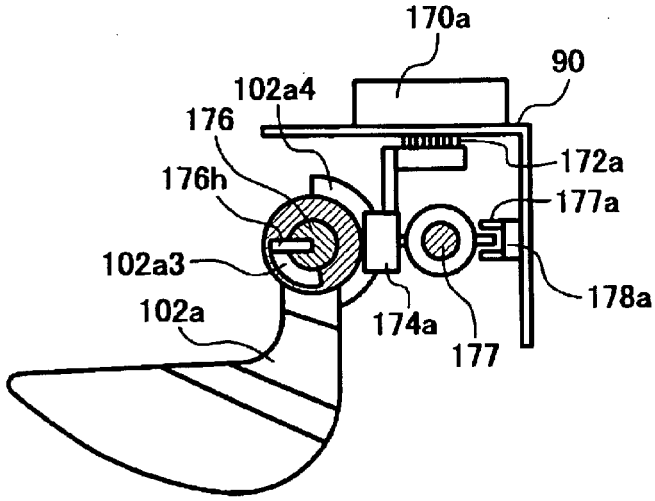
FIG. 16 shows the main part of the sheet-shaped medium aligning apparatus seen from the direction of B of FIG. 2.

FIG. 15 is a view of the sheet-shaped medium after-treatment apparatus 51 of FIG. 2 seen from above, that is, in a direction of arrow A. FIG. 16 is a view seen from a direction of arrow B likewise, and FIG. 17 is a view seen from a direction of arrow C likewise.

Figure 17:
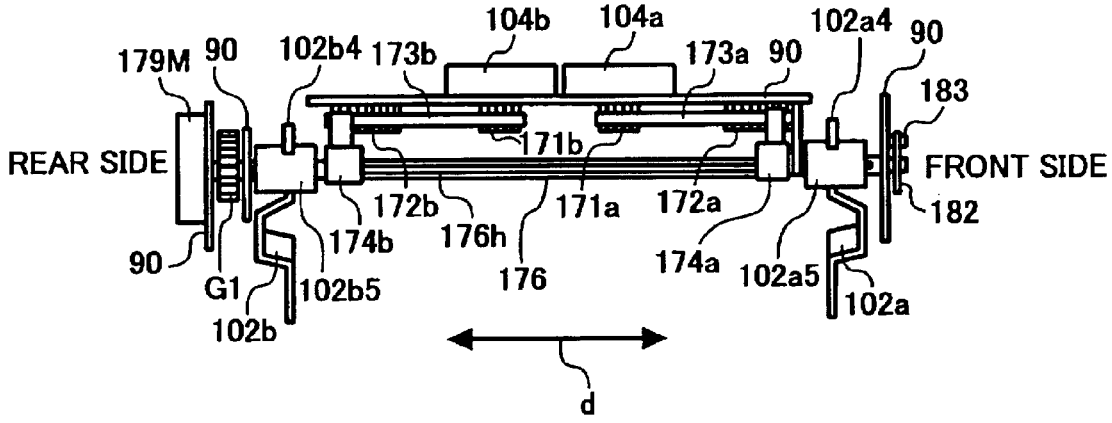
FIG. 17 shows the main part of the sheet-shaped medium aligning apparatus seen from the direction of C of FIG. 2.

In FIGS. 16 through 17, since a mechanism for driving an arranging member 102*a* and a mechanism for driving arranging member 102*b* are independent each other, they have same configuration. For a mechanism for driving arranging member 102*a*, subscript 'a' is added to reference number of each constituent for explanation, while for the arranging member 104*b*, subscript 'b' is added to the same reference number but explanation for which is omitted.

For approximate center portion in shift direction d of a bracket 90 which has its length in the shift direction d, two stepping motors 170*a*, 170*b* are installed on upper portion of the bracket.

A timing pulley 172*a* is axially supported in a position forwardly remote from a pulley 171*a* integral with a stepping motor 170*a* so that a timing belt 173*a* extends between the pulleys. Upper portion of a pedestal 174 is attached to a portion parallel with shift direction G of the timing belt 173*a*.

Both ends in longitudinal direction of the bracket 90 having its length in the shift direction d are bent in L-shaped, and a sliding rotating shaft 176 and a slidable shaft 177, which are parallel with shift direction d, are installed between the bends opposed each other. The sliding rotating shaft 176 is axially supported to the bracket 90, and the slidable shaft 177 is secured to the bracket 90. The sliding rotating shaft 176 is sliding fitted in the pedestal 174*a*.

The convex portion 176*h* is formed along the shift direction d in the sliding rotating shaft 176. A pedestal 174*a* is sliding fitted with and pierced by the sliding rotating shaft 176 having the convex portion 176*h* in shift direction d, and is provided with a groove 174*a*2 perpendicular to axis of the sliding rotating shaft 176.

At the same time, upper end of arranging member 102*a* is sliding fitted with and pierced by the sliding rotating shaft 176 as shown in FIG. 16, and an arc-shaped void 102*a*3 originated from the sliding rotating shaft 176 is formed.

At base of the arranging member 102*a* is formed a bossed portion 102*a*5, and the sliding rotating shaft 176 is sliding passed therethrough. The bossed portion 102*a*5 is provided with an arc-shaped convex plate 102*a*4, in the form of manes, originated from the sliding rotating shaft 176. Plane of the convex plate 102*a*4 is perpendicular to axis of the sliding rotating shaft 176.

Referring to FIG. 15, the convex plate 102*a*4 is inserted into groove 174*a*2 with clearance. In FIG. 16, arranging member 102*a* pivots about the sliding rotating shaft 176 by moment of its weight, but the pivoting is blocked by contact between the convex portion 176*h* and collision portion of one end of the void 102*a*3.

As shown in FIG. 16, when the sliding rotating shaft 176 is stopped at a predetermined rotating position, the convex portion 176*h* is got contacted by collision portion formed by side surface of one end of the void 102*a*3 due to moment of self-weight of the arranging member 102*a*, so that counter clockwise rotating motion is prevented, and such status that the arranging member 102*a* is located within the recess 80 is called as a status that the arranging member 102*a* is in rotating position for arrangement.

In the rotating position of arrangement, lower end of the arranging member 102*a* is located in the recess 80*a* if whole papers are not piled on the tray 12 If papers have been piled on the tray 12, the arranging member 102*a* is pressed by the papers and is rotated about the sliding pivoting shaft 176 so that the void 102*a*3 is moved with respect to the convex portion 176*h* which is in a stationary position, and therefore, a state that the arranging member 102*a* is put on the papers, that is, a state shown in FIG. 13(*b*) or FIG. 14(*b*) is obtained. The same operation is applied to the arranging member 102*b*.

The arranging members 102*a*, 102*b* have the arc-shaped void 102*a*3 originated from the sliding rotating shaft 176, and a predetermined amount of clearance in rotation direction is produced as free rotation area between the void 102*a*3 and convex portion 176*h* which is engaged therewith.

In the area of the clearance, the arranging members 102*a*, 102*b* can freely be rotated, and have their width in rotating position for arrangement. The predetermined amount is an amount by which, for example, as shown in FIG. 195(*a*), the arranging member 102*a* can be moved upwardly from the recess 80*a* and apart from the top surface of a bundle of paper SS-No. 1 piled on the tray 12 before the tray 12 is shifted as shown in FIG. 13(*b*).

As discussed above, in FIG. 16, the convex portion 176*h* and the void 102*a*3 are disposed so that they have clearance, which is indispensable, along rotation direction, and, as shown in the figure, the arranging member 102*a* can be lifted when the sliding rotating shaft 176 is rotated in clockwise direction with the convex portion 176 being in contact with collision portion of one end of the void 102*a*3 by moment of its weight, while rotating motion of the sliding rotating shaft 176 is not transferred to the arranging member 102*a* when the sliding rotating shaft 176 is rotated in counter clockwise direction with the arranging member 102*a* held down. By means of these, arranging treatment in sorting mode can be performed.

The pedestal 174*a* is stably supported by the two shafts, that is, the sliding rotating shaft 176 and the slidable shaft 177, thereby can be moved in shift direction d. The movement of the arranging member 102*a* in the shift direction d is achieved by driving the stepping motor 170*a* because driving force by the motor is transferred to the timing belt 175*a*, and to the pedestal 174*a* related to the timing belt, and finally, the driving force is transferred from the pedestal 174*a* to the arranging member 102*a* via fitted portion between the groove 174*a*2 and the convex plate 102*a*4, and in the process, the sliding rotating shaft 176 and slidable shaft 177 is used as a guide.

Similarly, the movement of the arranging member 102*b* in the shift direction d is achieved driving the stepping motor 170*b* because driving force by the motor is transferred to a timing belt 173*b*, and to a pedestal 174*b* related to the timing belt 173*b*, and finally, the driving force is transferred from the pedestal 174*b* to the arranging member 102*b* via fitted portion between the groove 174*b*2 (not shown) and the convex plate 102*a*4 (not shown), and in the process, the sliding rotating shaft 176 and slidable shaft 177 are used as a guide.

As described above, if the stepping motors 170*a*, 170*b* are driven independently forwardly and reversely, independent position determining control for the respective arranging member 102*a*, 102*b* in the shift direction d is made possible. That is, the arranging member 102*a*, 102*b* can be located in the respective position illustrated in FIGS. 10 through 14. A position which is a reference position for movement in the shift direction d is a home position, and the home position is detected by a home sensor 178*a* attaching an actuator 177*a*, which is integrated with the pedestal 174*a*, to the bracket 90, and the arranging members are moved to receiving position or arranging position on the basis of the detected position.

In FIG. 15 and FIG. 17, a gear G1 forming deceleration gear train is attached to axial end in the rear side of the sliding rotating shaft 176, and a gear G2, which is directly connected to shaft of the stepping motor 179M, is meshed to the gear G1.

Drive of the stepping motor 179M is transferred from the gear G2 to the gear G1, thereby the sliding rotating shaft 176 rotates. In FIG. 16, the arranging member 102*a* is pivoted by rotating the convex portion 176*h* in clockwise direction together with the sliding rotating shaft 176 to obtain rotating position for evacuation corresponding to FIG. 195(*b*) under the condition that the convex portion 176*h* is held in contact with collision portion of the void 102*a*3 for pressing rotation.

Preferably, such rotating position for evacuation is the minimum level where it is possible to prevent the arranging members 102*a*, 102*b* from interfering with the papers on the tray during shift of the tray 12.

Figure 18A:
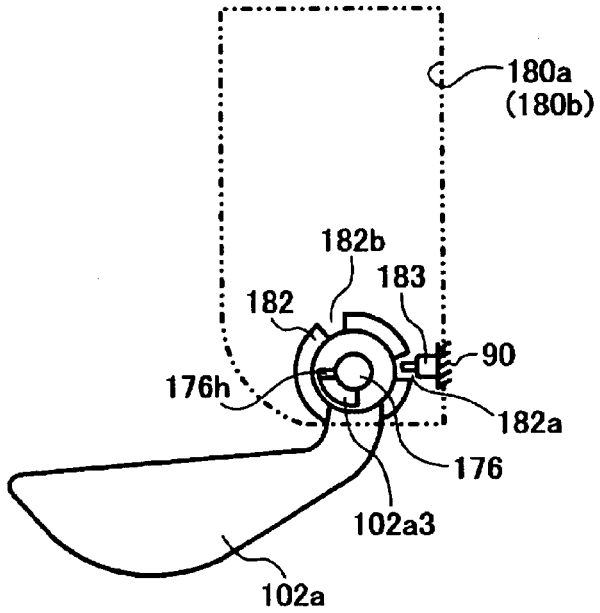
FIG. 18(*a*) shows the status in which the arranging member is at rotating position for arrangement, and FIG. 18(*b*) shows the status in which the arranging member is at rotating position for receiving.
Figure 18B:
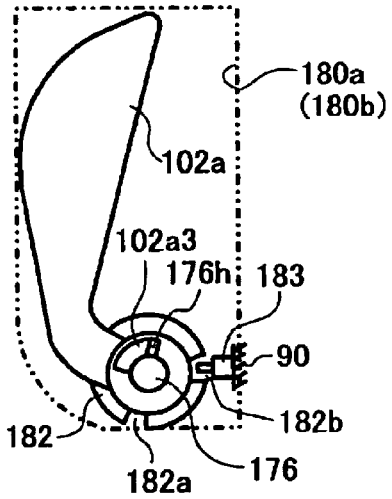

In this example, it is possible to make the rotating position of the arranging member 102*a* to be considerably bigger than to prior art in accordance with the driving amount of the stepping motor 179M, because pivoting positions of the arranging members 102*a*, 102*b* are stabilized by directly rotating the sliding rotating shaft 176. Therefore, for example, when the position shown in FIG. 18(*a*) is used as the rotating position for arrangement, as shown in FIG. 18(*b*), the arranging member 102*a* can be inserted into receiving space 180*a*, 180*b* by rotation in clockwise direction by 90°.

Figure 3:
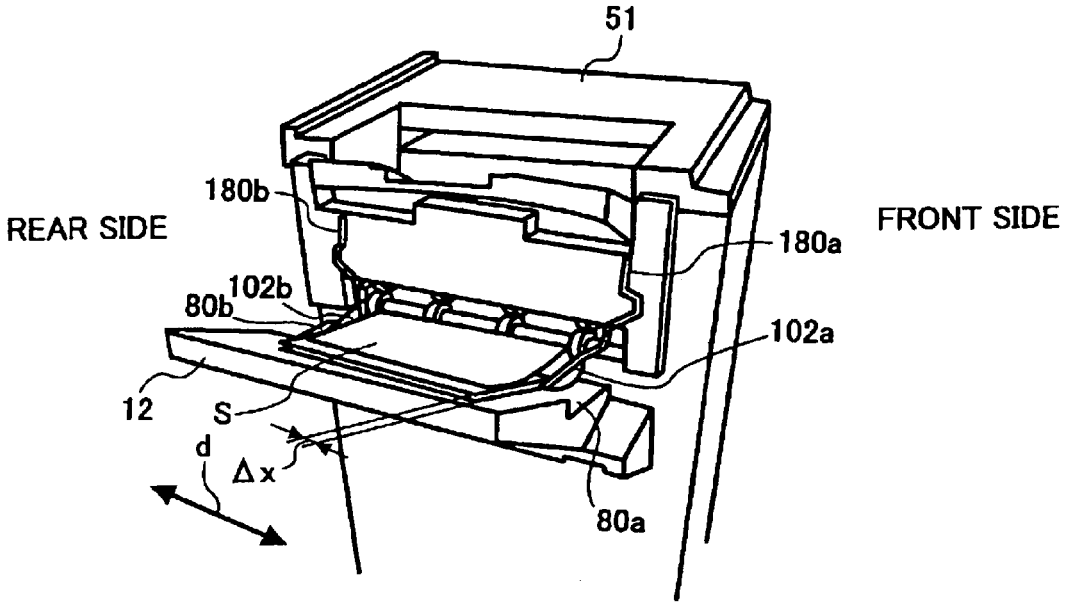
FIG. 3 is a partial perspective view of the sheet-shaped medium after-treatment apparatus seen from inclined direction.

Here, the main body as an object, in which the receiving spaces 180*a*, 180*b* are provided, is sheet-shaped medium alignment apparatus, in this example, because the receiving spaces 180*a*, 180*b* are integrally formed with the sheet-shaped medium after-treatment apparatus 51, the receiving spaces 180*a*, 180*b* are preferably provided therein (see FIGS. 2 to 4).

The arranging members 102*a*, 102*b* are, in shift direction d, intended to be received into the receiving spaces 180*a*, 180*b* defined in the main body by being pivoted at the home position shown in FIG. 10. As described above, for any size of paper to be considered to use, it is possible that papers are moved to receiving position in short time.

As will be described below, after arranging operation during a set of jobs are completed, the arranging member is moved to said home position and is inserted into said rotation position for receiving, so that the arranging member can be transferred from the rotation position for receiving to the home position.

As will be described below, at the time when a set of arranging operation is completed, if subsequent job remains, the arranging members 102*a*, 102*b* are moved to home position, and which prevents the arranging members 102*a*, 102*b* from being inserted in the receiving position. Therefore, since time required for reciprocating to the home position is removed, movement time to the receiving position for subsequent job can be shorten.

As means for determining positions for the arranging members 102*a*, 102*b* with regard to determination their positions at rotating position for arrangement in FIGS. 16 and 18(*a*) or rotating position for receiving in FIG. 18(*b*), in this example, as shown in FIGS. 15, 17 and 18, control disk 182, where cutout for controlling in front shaft end of the sliding rotating shaft 176 is formed, is defined integrally with the sliding rotating shaft 176, and the two cutouts 182*a*, 182*b* defined in a control disk 182 are detected by a stationary sensor 183 disposed on the bracket 90, and rotation stop position of a stepping motor 179M is determined.

The rotating position for arrangement shown in FIG. 18(*a*) is determined by detecting the cutout 182*a* by means of the sensor 183, and the rotating position for receiving is determined by detecting the cutout 182*b* by means of the sensor 183. Also, rotating position for evacuation can be determined by means of the stepping motor 179M, based on either of rotating position for arrangement or rotating position for receiving.

The sliding rotating shaft 176 is a shaft which is the core of rotation of the arranging members 102*a*, 102*b*, and the shaft 176 transfers rotating motion of rotating position for arrangement, rotating position for evacuation, and rotating position for receiving to the arranging members 102*a*, 102*b*, at the same time, acts as a guide for movement of the arranging members 102*a*, 102*b* in shift direction d.

The arranging members 102*a*, 102*b* can be moved to each one of home position shown in FIG. 10, receiving position in shown FIG. 11, and arranging position shown in FIG. 12 by using guiding function of the sliding rotating shaft 176 by driving the stepping motors 104*a*, 104*b*.

e. Embodiment of Sorting, and Receiving of Arranging Member e-1. Sorting

Figure 19A:
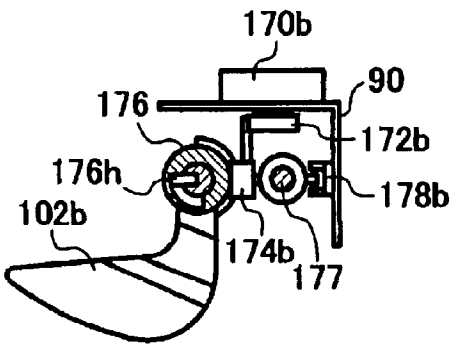
FIG. 19(*a*) is a partial sectional view showing the rear arranging member at rotating position for arrangement, FIG. 19(*b*) is a perspective view of the sheet-shaped medium after-treatment apparatus showing the arranging member at rotating position for arrangement, and FIG. 19(*c*) is a partial sectional view showing the front arranging member at rotating position for arrangement.
Figure 19B:
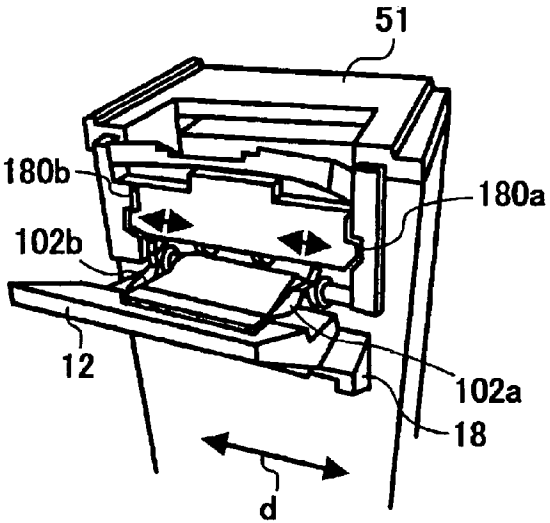
Figure 19C:
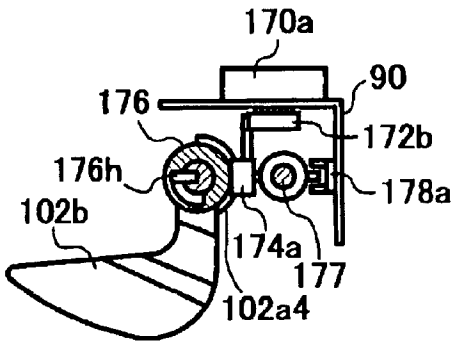

When performing sorting arrangement using both sides movement mode shown in FIG. 14, as shown in FIGS. 19(*a*), (*b*), and (*c*), for papers which are discharged from the discharging roller 3 of the paper after-treatment apparatus 51 and piled on the tray 12, so-called transverse arrangement, which is in shift direction d of papers, is implemented by jogging the arranging members 102*a*, 102*b* in shift direction d (see FIG. 14(*a*)).

Next, as shown in FIGS. (a), (b), and (c), the tray 12 is shifted toward front side in the direction of shift so that piling position for the next bundle of papers discharged is got offset before discharging the next bundle, and also, the tray 12 is evacuated by rotating the arranging members 102*a*, 102*b* upwardly so that the arranging members 102*a*, 102*b* and piled papers on the tray 12 are not contacted each other. For this actions, the sliding rotating shaft 176 is rotated in the direction of upward rotation by driving the stepping motor 179M.

As a result of this rotation, the arranging members 102*a*, 102*b* are displaced to rotating position for evacuation by lifting the collision portion of one end of the arc-shaped void 102*a*3, 102*b*3 by means of the convex portion 176*h* which is integral with the convex portion 176*h* of the sliding rotating shaft 176.

Next, the arranging members 102*a*, 102*b* which are in the rotating position for evacuation through upward rotation should be returned to rotating position for arrangement where arrangement for papers is possible, in order to execute arrangement for the next bundle of papers. For this reason, as shown in FIGS. 21 (*a*), (*b*), and (*c*), the sliding rotating shaft 176 is rotated to the same position as in FIG. 19 in the direction of downward rotation, with the convex portion 176*h* which is integral with the sliding rotating shaft 176 being contacted with collision portion defined in one end of the void 102*a*4, 102*b*4 which is formed in the arranging members 102*a*, 102*b* The arranging members 102*a*, 102*b* are rotated in the direction of downward rotation about the sliding rotating shaft 176. Thereby, the arranging member 102*a*, which is in the side where papers are piled on tray 12 already, rides onto said bundle of papers, while, the other arranging member 102*b* is located at the side face of said bundle of papers (see FIG. 14(*b*)) by rotating the sliding rotating shaft 176 to the same position as in FIG. 19 in the direction of downward rotation.

Figure 20C:
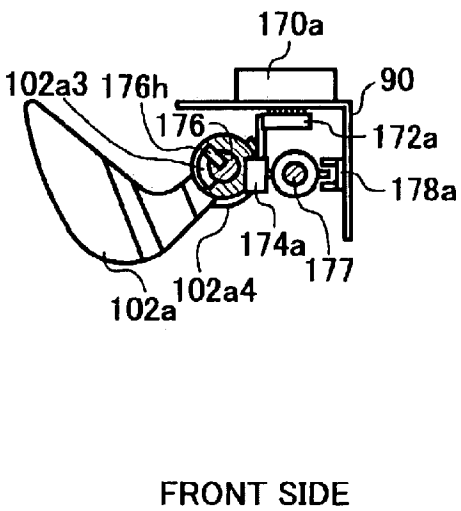
FIG. 20(*a*) is a partial sectional view showing the rear arranging member at rotating position for evacuation, FIG. 20(*b*) is a perspective view of the sheet-shaped medium after-treatment apparatus showing the arranging member at rotating position for evacuation, and FIG. 20(*c*) is a partial sectional view showing the front the arranging member at rotating position for evacuation.
Figure 20B:
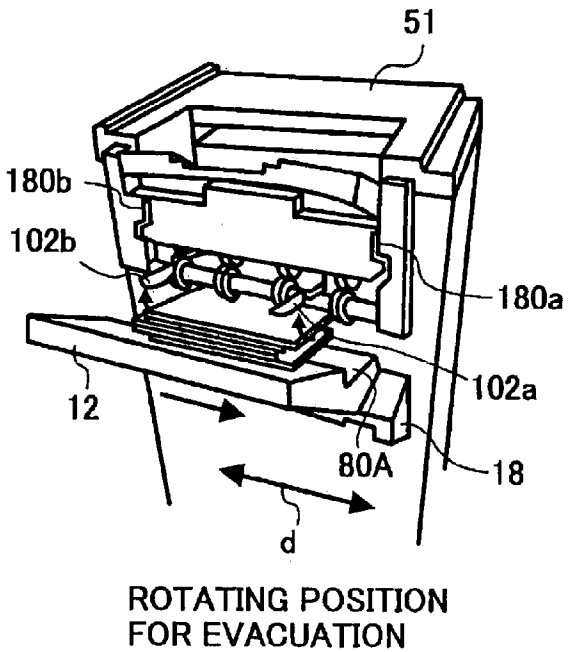
Figure 20A:
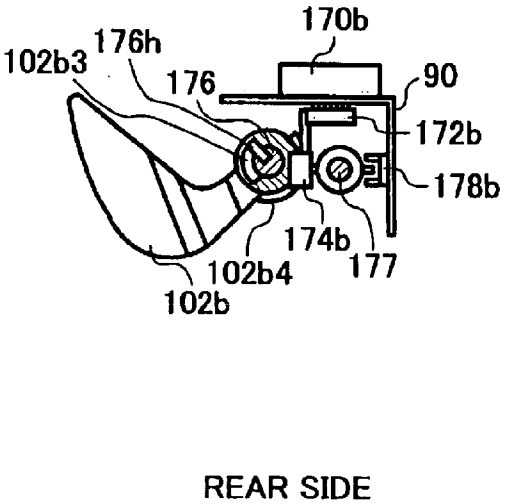
Figure 21C:
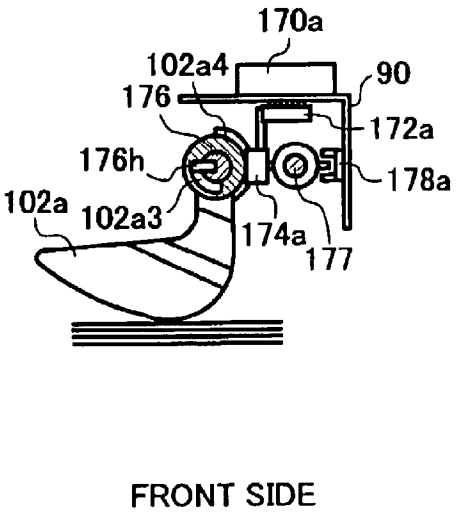
FIG. 21(*a*) is a partial sectional view showing the rear arranging member at rotating position for arrangement, FIG. 21(*b*) is a perspective view of the sheet-shaped medium after-treatment apparatus showing the arranging member at rotating position for arrangement, FIG. 21(*b'*) is a partial perspective view of the sheet-shaped medium after-treatment apparatus showing the arranging member at rotating position for arrangement, and FIG. 21(*c*) is a partial sectional view showing the front arranging member at rotating position for arrangement.
Figure 21B:
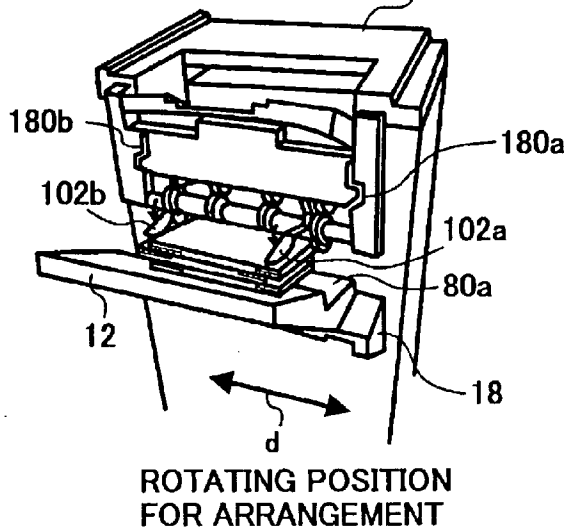
Figure 21B:
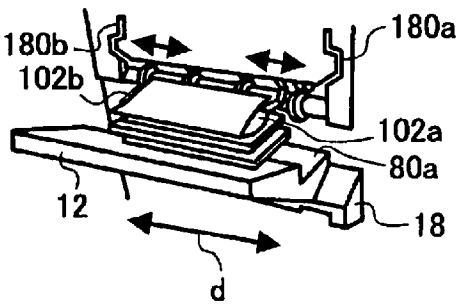
Figure 21A:
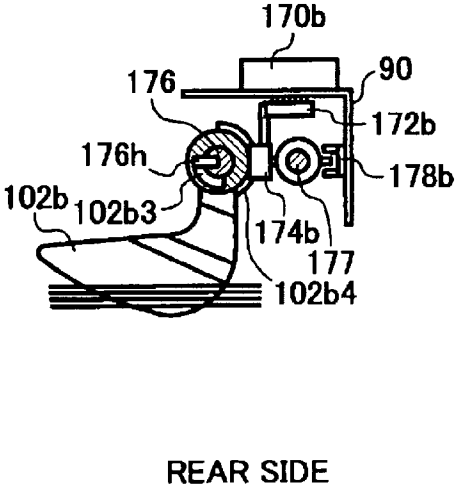

The reason why the above is possible is that when the sliding rotating shaft 176 is rotated in the direction of downward rotation from the position shown in FIGS. 20(*a*), (*b*), and (*c*) to the position shown in FIGS. 19(*a*), (*b*), and (*c*), although the arranging member 102*a* which is in piled side on the tray 12 is put on top of said bundle of papers, the convex portion 176*h* within the void 102*a*3 is continuously rotated in the direction of downward rotation so that it is continuously rotated to the position where it can face the side face of said bundle of papers, and also, if the arranging members 102*a*, 102 in these positions are jogged afterward in the shift direction d, it is possible to arrange the next bundle of papers discharged in the direction perpendicular to paper conveying direction.

Thus, when the next bundle of papers are discharged as shown in FIG. 21(*b*), the papers are piled with offset from previous bundle of papers in the direction (shift direction) perpendicular to paper conveying direction, and arranged by jogging of the arranging members 102*a*, 102*b* in shift direction d. Arranging operation is performed by repeating such a series of operation (see FIG. 14(*b*)).

When sorting arrangement treatment is being done, in order to avoid contact between the arranging members 102*a*, 102*b* and a bundle of papers on the tray 12 while the tray 12 is shifted in shift direction c, the arranging members 102*a*, 102*b* are rotated about sliding rotating shaft in the direction of upward rotation by the upward rotation of the sliding rotating shaft 176, and at this time, the arranging members 102*a*, 102*b* can be rotated as much as the sliding rotating shaft 176 is rotated since the sliding rotating shaft 176 has no limit about rotation angle.

Figure 22B:
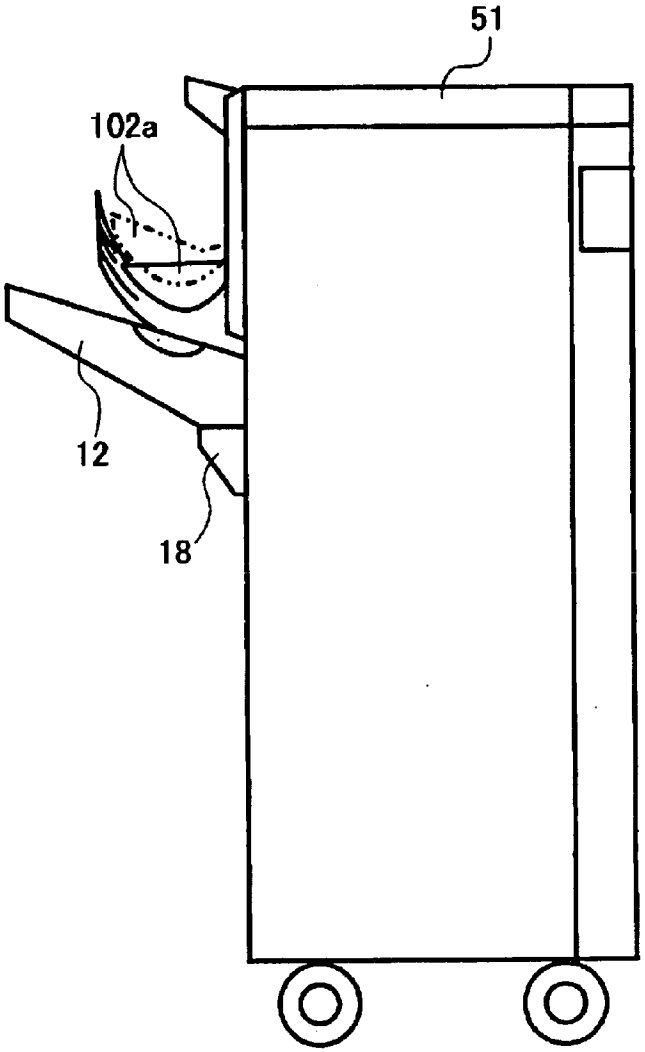
FIG. 22(*a*) is a partial perspective view of the sheet-shaped medium after-treatment apparatus showing the arranging member arranging curled papers, and FIG. 22(*b*) is a side view of the same sheet-shaped medium after-treatment apparatus.
Figure 22A:
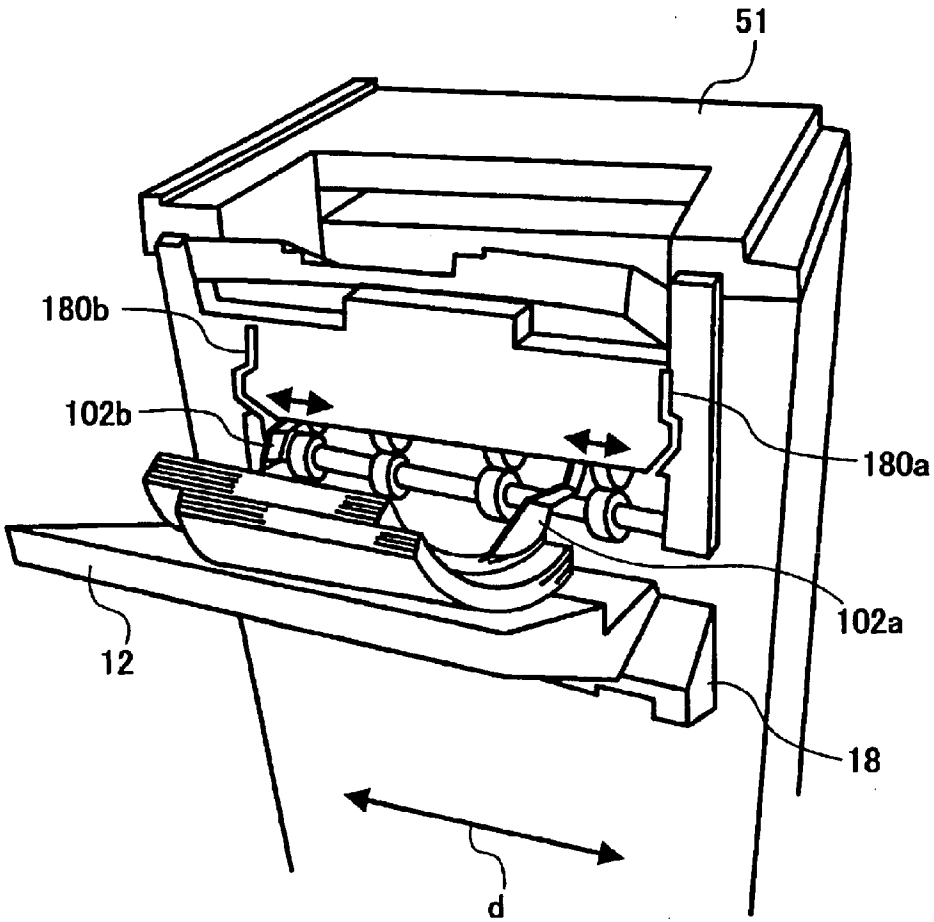
Figure 23B:
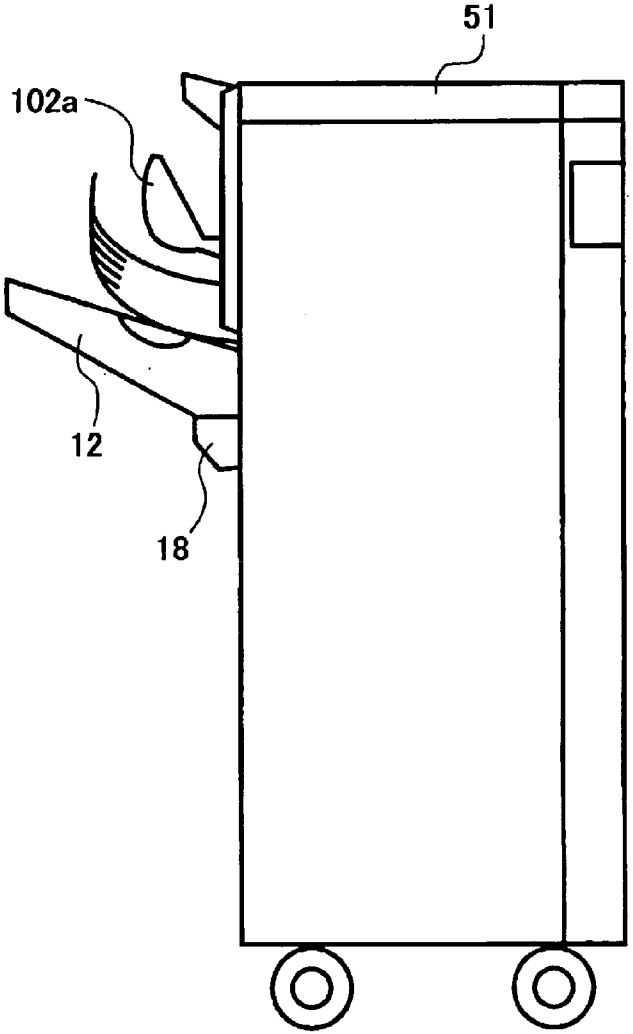
FIG. 23(*a*) is a partial perspective view of the sheet-shaped medium after-treatment apparatus showing the arranging member in evacuated status after arranging the curled papers, and FIG. 23(*b*) is a side view of the same sheet-shaped medium after-treatment apparatus.
Figure 23A:
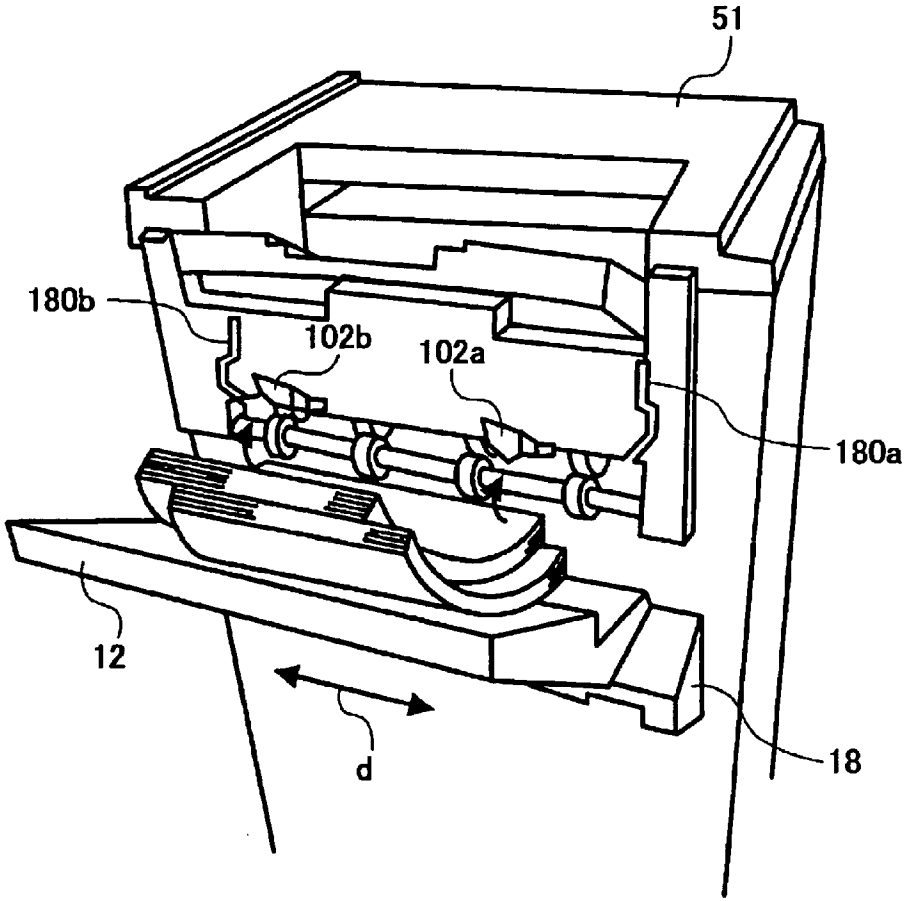

On this reason, as shown in FIG. 22, if papers discharged are curled upwardly, contact between the arranging members 102*a*, 102*b* and a bundle of papers on the tray 12 is avoidable while the tray 12 on which the bundle of papers are piled is shifted in shift direction d, as shown in FIG. 23.

e-2. Receiving Operation

Figure 24C:
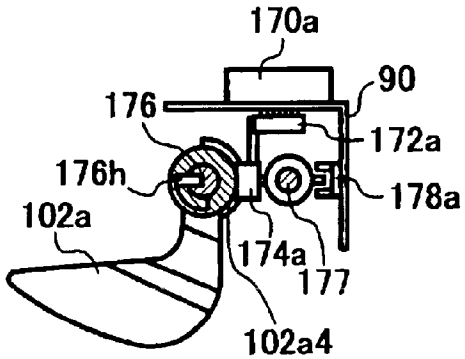
FIG. 24(*a*) is a partial sectional view showing the rear arranging member at rotating position for arrangement, FIG. 24(*b*) is a perspective view of the sheet-shaped medium after-treatment apparatus showing the arranging member at rotating position for arrangement, and FIG. 24(*c*) is a partial sectional view showing the front arranging member at rotating position for arrangement.
Figure 24B:
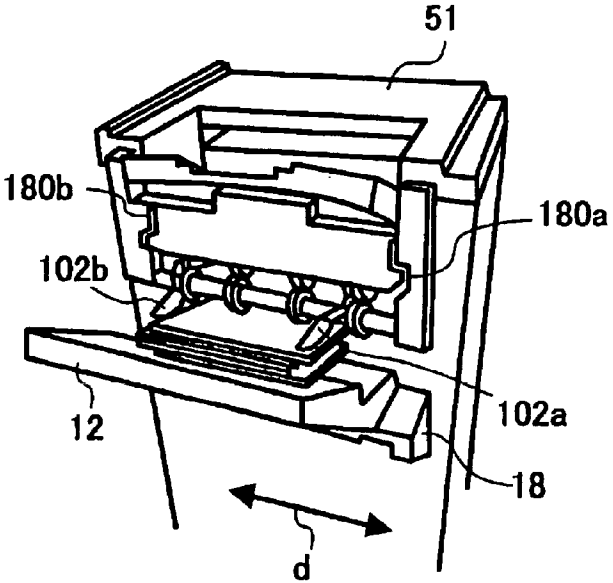
Figure 24A:
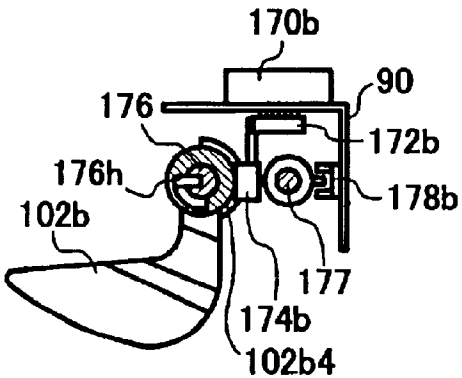
Figure 25A:
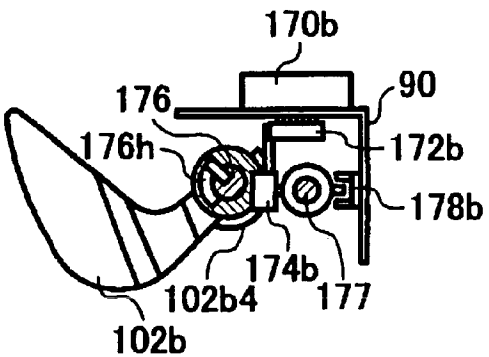
FIG. 25(*a*) is a partial sectional view showing the rear arranging member at rotating position for evacuation, FIG. 25(*b*) is a perspective view of the sheet-shaped medium after-treatment apparatus showing the arranging member at rotating position for evacuation, and FIG. 25(*c*) is a partial sectional view showing the front arranging member at rotating position for evacuation.
Figure 25B:
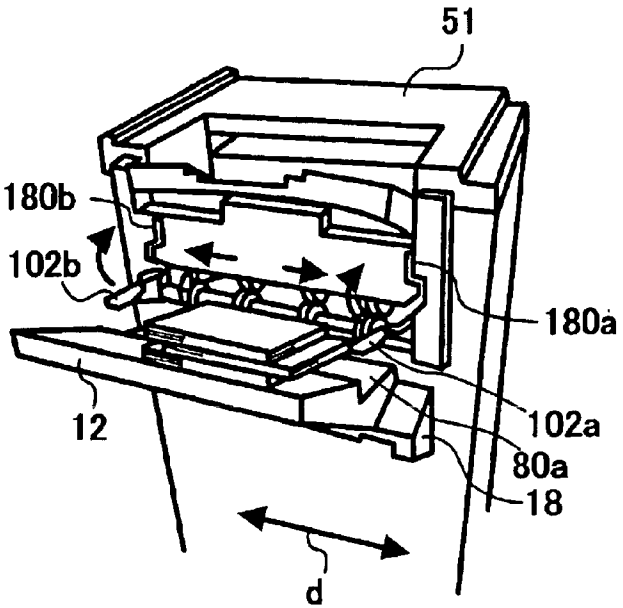
Figure 25C:
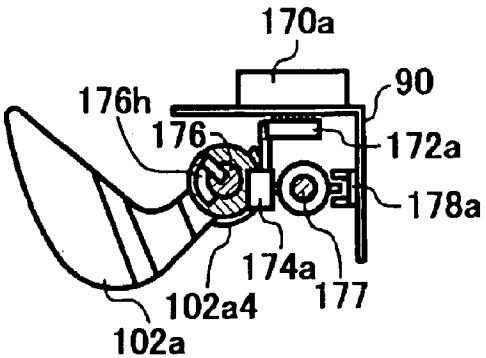
Figure 26C:
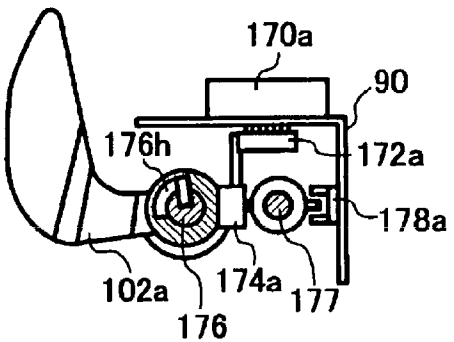
FIG. 26(*a*) is a partial sectional view showing the rear arranging member at rotating position for receiving, FIG. 26(*b*) is a perspective view of the sheet-shaped medium after-treatment apparatus showing the arranging member at rotating position for receiving, and FIG. 26(*c*) is a partial sectional view showing the front arranging member at rotating position for receiving.
Figure 26B:
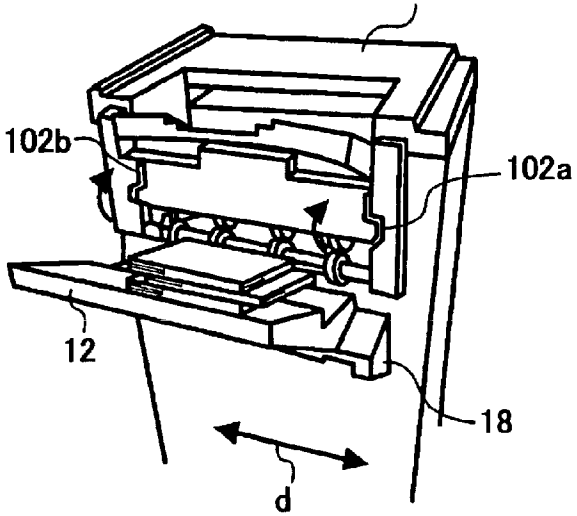
Figure 26A:
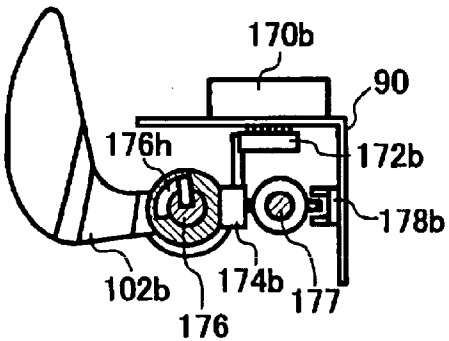
Figure 27:
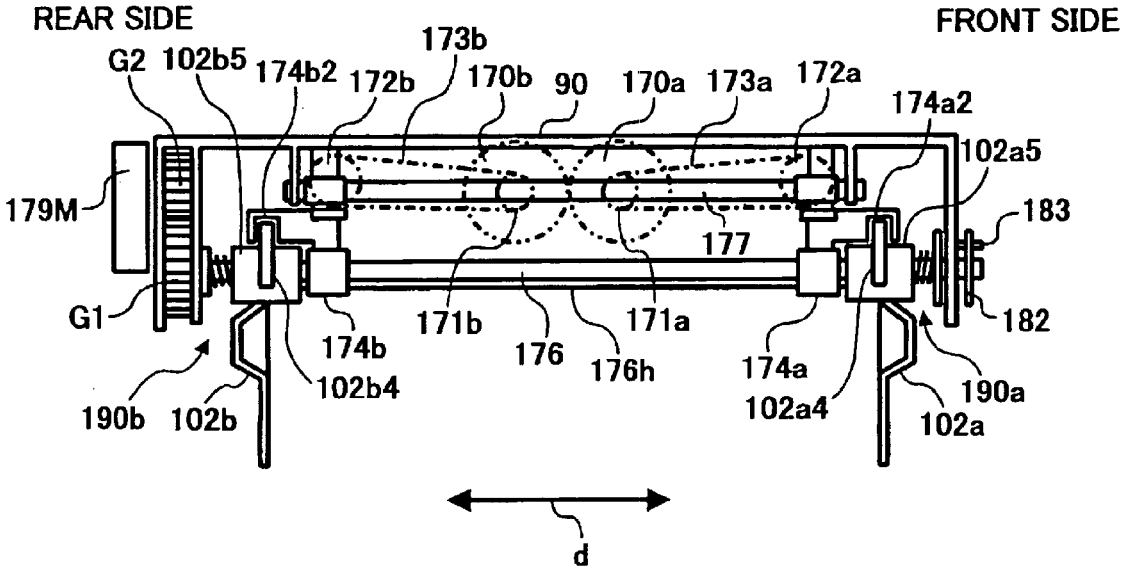
FIG. 27 shows the main part of the sheet-shaped medium aligning apparatus seen from the direction of A of FIG. 2.

If printing of desired amount of papers is finished as shown in FIGS. 24(*a*), (*b*), and (*c*), as shown in FIGS. 25(*a*), (*b*), and (*c*), the arranging members 102*a*, 102*b* are moved separately from each other in shift direction d, and the pedestals 174*a*, 174*b* are moved to the sensors 178*a*, 178*b* for detecting the home positions of each arranging member 102*a*, 102*b* and then detected by the sensors 178*a*, 178*b*, and finally, the sliding rotating shaft 176 is rotated in the direction of upward rotation. By this operation, the respective arranging member 102*a*, 102*b* is rotated to be received in the receiving space 180*a*, 180*b* arranged in the main body, i.e., the paper after-treatment apparatus as illustrated in FIG. 26.

In the above-described examples, although cases n which the arranging members 102*a*, 102*b* are received in the position above the sliding rotating shaft 176 are explained, if they are received in the position below the sliding rotating shaft 176, for example, in FIGS. 18(*a*) and (*b*), position of the void 102*a*3 is set to be point-symmetric about core of the sliding rotating shaft 176, and positional relation of the convex portion 176*h* in the void and positional relations between respective component are established so that the condition shown in FIGS. 18(*a*), (*b*) can be obtained.

f. Safety Mechanism

In the configuration of the sheet-shaped medium aligning apparatus described heretofore, when the arranging members 102*a*, 102*b* are pivoted from the rotating position for arrangement shown in FIGS. 16, 18(*a*), 19 and 21 to rotating position for receiving shown in FIG. 18(*b*), if the pivoting is disturbed by any obstacle in pivot path, the arranging members 102*a*, 102*b* may be broken or, if the obstacle is human hand, hand might get hurt. Thus, a safety mechanism as follows can be added.

Figure 28:
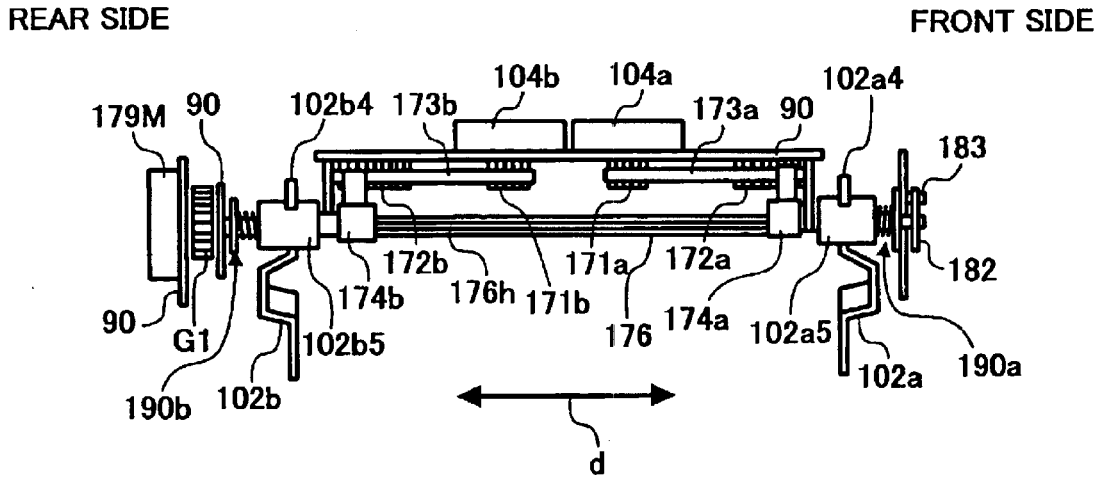
FIG. 28 shows the main part of the sheet-shaped medium aligning apparatus seen from the direction of C of FIG. 2.
Figure 29:
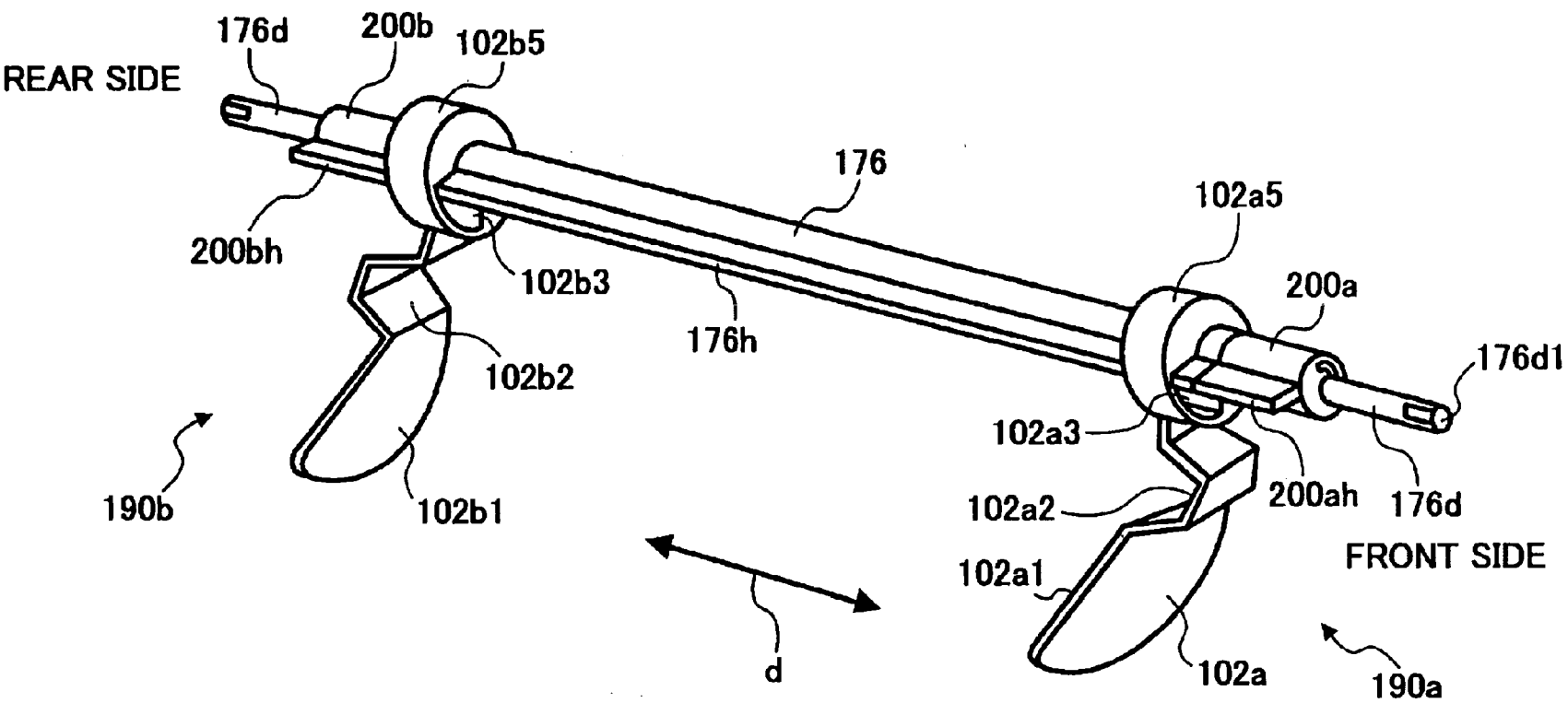
FIG. 29 is a perspective view of the arranging member and a sliding rotating shaft.

Such a safety policy is required when the arranging members 102*a*, 102*b* are received and rotated, and because receiving and rotation are performed in the home positions, these safety mechanisms are constructed respectively on the front side and rear side ends in the shift direction d on the rotating-sliding shaft 176 which are the home positions, within which the arranging members are received and rotated, in FIGS. 28 and 29. The safety mechanisms provided on the front side and the rear side ends are indicated by referential numeral 190*a* and 190*b*, respectively.

In FIG. 29, showing the arranging members 126*a*, 126*b* are taken along with the rotating-sliding shaft 176 for easy understanding, both ends of the rotating-sliding shaft 176 in the shift direction d are provided with a front side evacuation shaft 200*a* and a rear side evacuation shaft 200*b*, which are separately independent from the rotating-sliding shaft 176.

Each of front and rear side ends of rotating-sliding shaft 176 is formed with a small diameter shaft 176*d* in a stepped form. The evacuation shafts 200*a*, 200*b* have an external shape and size identical to that of the rotating-sliding shaft 176, and its internal diameter part is formed to have a dimension that the small diameter part 176*d* can be fitted into it.

Figure 30:
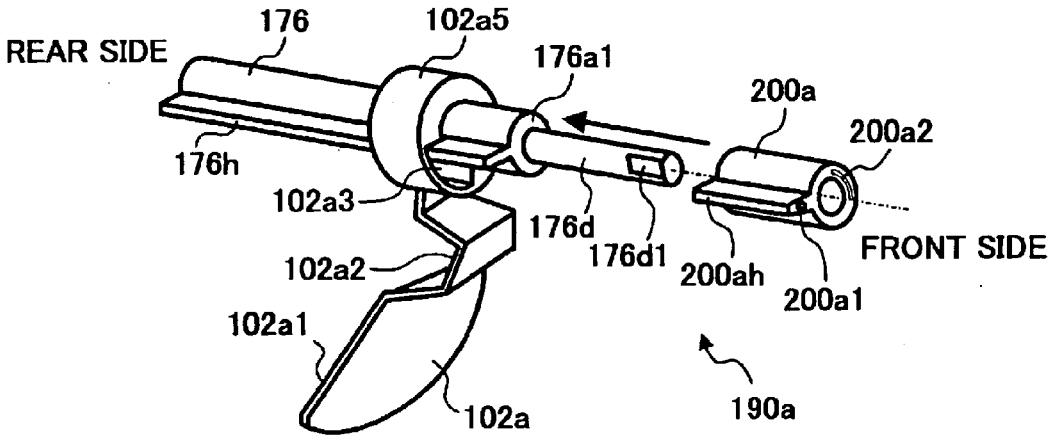
FIG. 30 is an exploded perspective view showing the structure of rear side of the sliding rotating shaft.

In FIG. 30 illustrating the construction on the front side end of the rotating-sliding shaft 176, the evacuation shaft 200*a* is formed with a convex part 200*ah*, which is identical to the convex part 176*h*, with a diameter same with that of the rotating-sliding shaft 176*a*. By engaging this evacuation shaft 200*a* on the small diameter shaft 176*d* as shown in FIG. 30, the state that the evacuation shaft abuts against the step shaped end is obtained. FIG. 29 shows this state.

As shown in FIG. 29, if the convex part 200*ah* and 176*h* are aligned with each other in the sate that the evacuation shaft 200*a* is engaged on the small diameter shaft 176, it is possible to slide the boss part 102*a*5 of the arranging member 102*a* to the front side and thus to guide the boss part 102*a*5 onto the evacuation shaft 200*a*. Likely, it is possible to slide the boss part 102*b*5 of the arranging member 102*b* to the rear side and thus to guide the arranging member 102*b*5 onto the evacuation shaft 200*b*.

Figure 31:
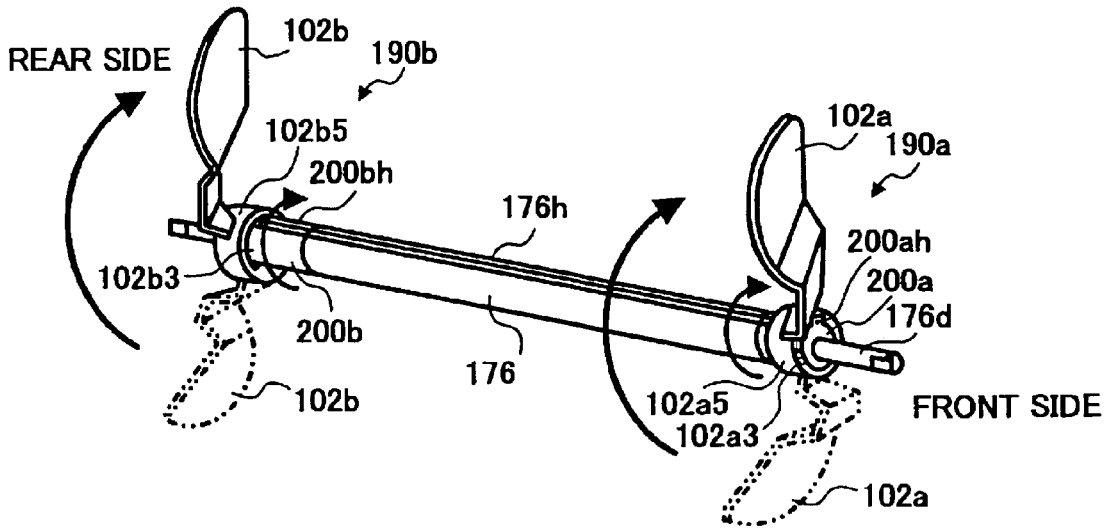
FIG. 31 is a perspective view showing operation of the arranging member.
Figure 32:
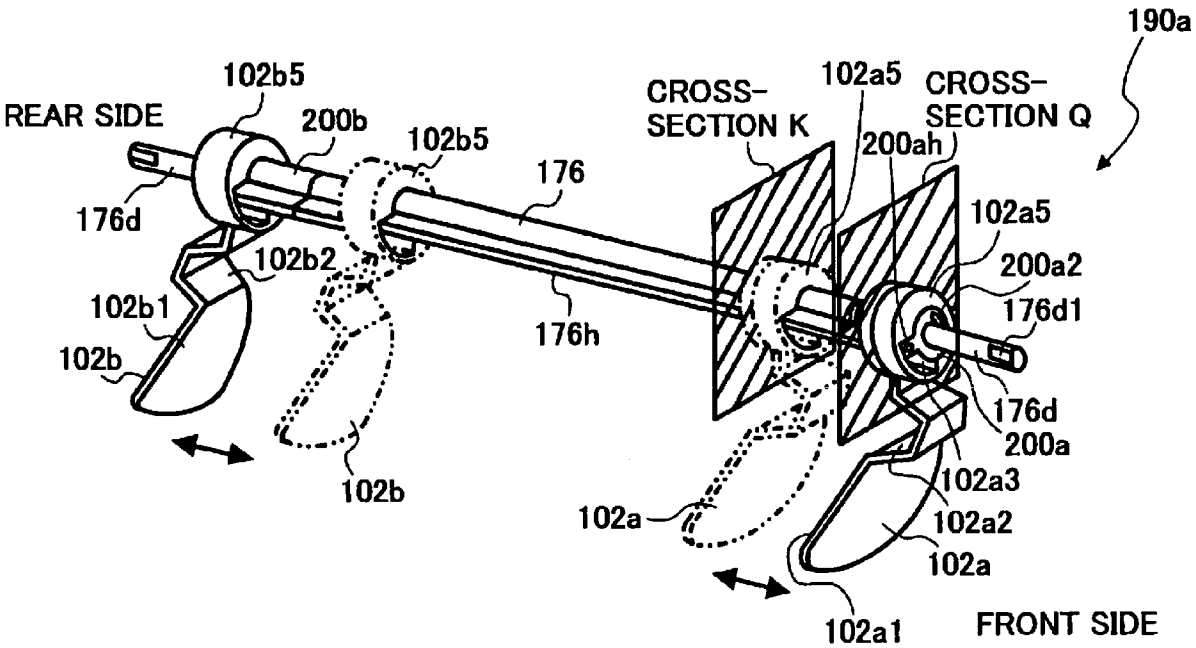
FIG. 32 is a perspective view showing the structure for supporting the arranging member at the shaft end of the sliding rotating shaft.

As sown in FIGS. 31 and 32, when the boss part 102*a*5 is positioned on the evacuation shaft 200*a*, it is possible to rotate the arranging member 102*a* around the small diameter shaft 176*d* together with the evacuation shaft 200*a* as shown in FIG. 31.

Similarly, with respected to the rear side as shown in FIGS. 31 and 32, when the boss part 102*a*5 is positioned on the evacuation shaft 200*b*, it is possible to rotate the arranging member 102*b* around the small diameter shaft 176*d* together with the evacuation shaft 200*b* as shown in FIG. 31. Their rotations can be performed in either forward direction or reverse direction. With these rotations, the arranging members 102*a*, 102*b* can be received within the receiving spaces 180*a*, 180*b*.

Figure 33:
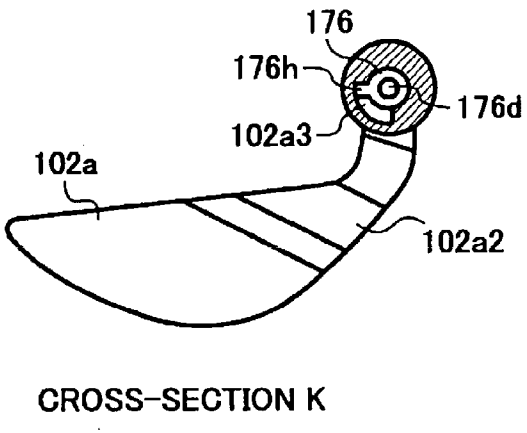
FIG. 33 shows a sectional view of section K of FIG. 32.

In FIG. 32, when the convex part 176*h* is fixed in the crosswise position regarding the front side and thus the boss part 102*a*5 is positioned on the rotating-sliding shaft 176, that is to say in the state of cross-section K that it is positioned inner side more inwardly than the home position, the rotational movement produced by a moment due to the self weight of arranging member 102*a* is stopped because the abutting part of upper end of the clearance 102*a*3 is abutted on the convex part 176*h* as shown in FIG. 33. This state corresponds to the arranging rotation position shown in FIG. 18(*a*) and the lower end of the arranging member 102*a* is located within the concave part 80*a*. In this way, because the arranging is allowed to rotate clockwise, it is possible to obtain the state as shown in FIG. 21(*c*) if the top surface of paper upwardly pushes the arranging member 102*a*.

In FIG. 32, when the convex part 176 and the convex part 200*ah* is fixed in the crosswise direction (in the horizontal direction) regarding the front side and thus the boss part 102*a*6 is positioned on the evacuation shaft 200*a*, that is to say, in the state of cross-section Q that it is positioned on the home position, the rotational movement produced by a moment due to the self weight of arranging member 102*a* is stopped because the abutting part of upper end of clearance 102*a*3 is abutted on the convex part 200*ab*.

Herein, the evacuation shaft 200*a* and the small diameter part 176*d* are connected each other through energizing means as described herein below, a rotation moment in the counterclockwise direction is applied to the arranging member 102*a* about the small diameter shaft 176*d* in FIG. 34, and the rotation of the arranging member 102*a* by this energizing means is blocked by a stopper provided between the arranging part 102*a* and the small diameter shaft 176*d*.

Figure 34:
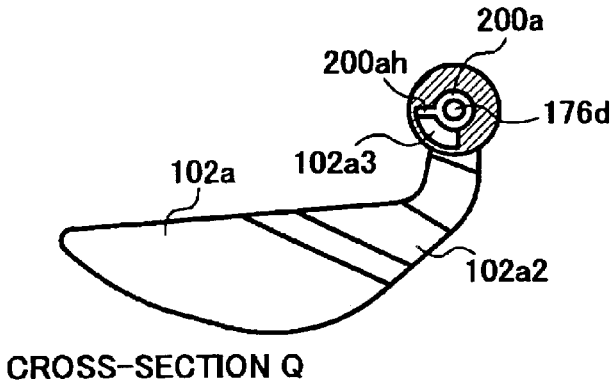
FIG. 34 shows a sectional view of section Q of FIG. 32.

Due to this, it is possible to upwardly push the arranging member 102*a* with a force overcoming the elastic force of energizing means in FIG. 34. In other words, when it is intended to rotate the small diameter shaft 176*d* in the clockwise direction for locating the arranging member 102*a* in the received rotation position, it is possible to rotate only the small diameter shaft 176*d* even if the arranging member 102*a* is pressed by an external force, thereby functioning as a safety mechanism.

Herein below, the connection state between the evacuation shaft 200*a* and the small diameter shaft 176*d* by said energizing means will be explained.

Figure 36:
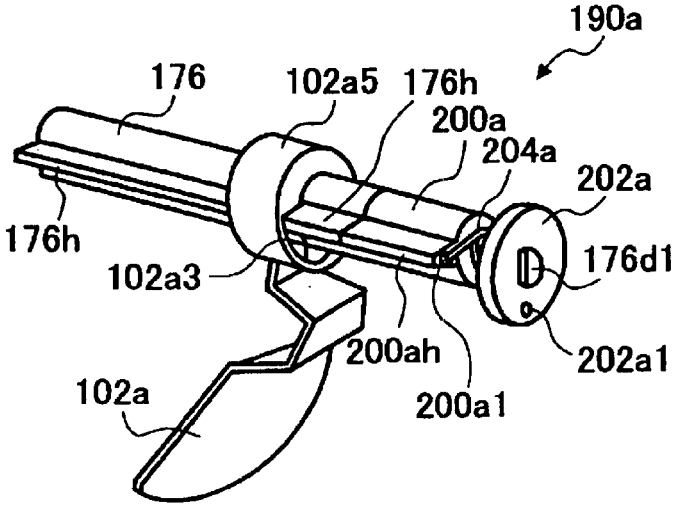
FIG. 36 is a perspective view showing the structure for supporting arranging member at the front shaft end of the sliding rotating shaft.

In FIG. 36, the axial end of a small diameter part 176*d* is formed with a D-shaped part 176*d*1 by plane grinding, and a rotation-transmitting member 202 is fitted into this D-shaped part 176*d*1. By this, the rotating-sliding shaft 176 and the rotation-transmitting member 202*a* can integrally rotate. The rotation-transmitting member 202*a* and the evacuation shaft 200*a* are connected by a torsion coil spring 204 with legs biased to be opened.

One end side of a torsion coil spring 204*a* is inserted into a hole 202*a*1 of the rotation-transmitting member 202*a* and the other end side of the torsion coil spring 204*a* is inserted in a hole 200*a*1 provided in an axial end of the rotation-transmitting member 202*a*.

A projection 202*a*2 formed on a side surface of the rotation-transmitting member 202*a* is inserted into the long hole 200*a*2 provided on an axial end of the evacuation shaft 200*a* and extended in an arc shape centered on the axis of the rotation-transmitting member 200*a*.

Under the state that the rotation-transmitting member 202*a* is fixed to the D-shaped part 176*d*1, the evacuation shaft 200*a* is rotatably maintained between the rotation-transmitting member 202*a* and the step part 176*a*1 of the rotating-sliding shaft 176.

Figure 35:
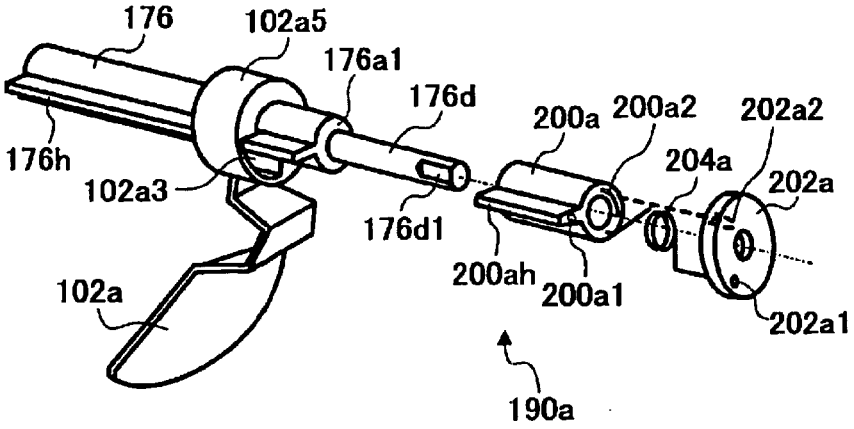
FIG. 35 is an exploded perspective view showing the structure for supporting arranging member at the front shaft end of the sliding rotating shaft.

In FIG. 35, relative to the rotating-sliding shaft 202*a* integral to the rotation-transmitting member 176, the evacuation shaft 200*a* is energized in the clockwise direction by the torsion coil spring 204*a*. The rotation of evacuation shaft 200*a* by this energy is stopped if one end of the long hole 200*a*2 is abutted against the projection 202*a*2. In this case, the convex part 176*h* and the convex part 200*ah* are located in an identical phase position and contacted without forming a stepped part as shown in FIG. 36.

Figure 37:
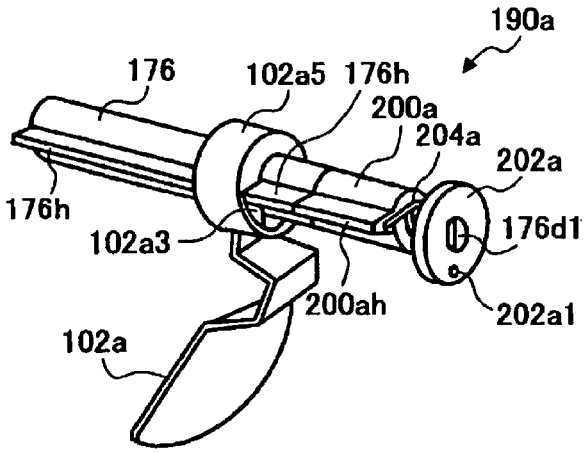
FIG. 37 is a perspective view showing the structure for supporting arranging member at the front shaft end of the sliding rotating shaft.
Figure 38:
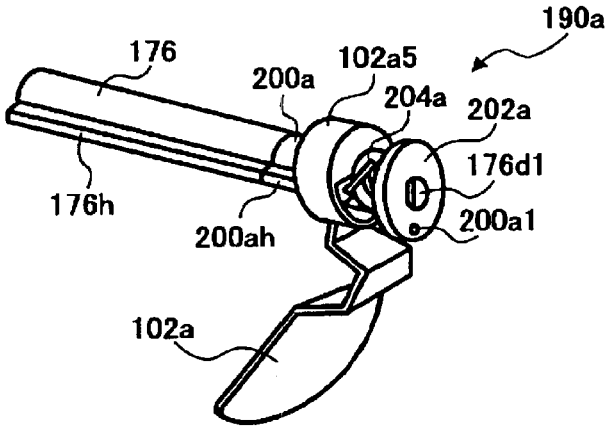
FIG. 38 is a perspective view showing the structure for supporting arranging member at the front shaft end of sliding rotating shaft.
Figure 39:
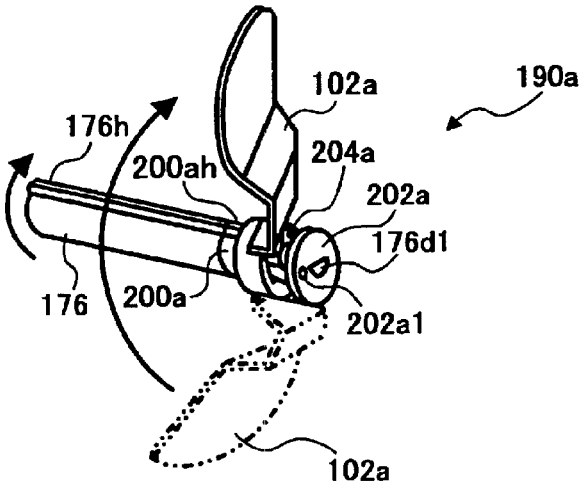
FIG. 39 is a perspective view showing the structure for supporting the arranging member at the front shaft end of the sliding rotating shaft.

If the arranging member 102*a* which was located on the rotating-sliding member 176 as shown in FIG. 37 is slid onto the evacuation shaft 200*a* as shown in FIG. 38 and the rotating-sliding shaft 176 is rotated, the rotation-transmitting member 202*a* also rotates by being integrated with the rotating-sliding member 176 and the rotation is transmitted to the evacuation shaft 200*a* via the torsion coil spring 204*a* as shown in FIG. 39.

By this, the evacuation shaft 200*a* rotates about the small diameter part 176*d*, the convex part 200*ah* of evacuation shaft 200*a* compresses the boss part 102*a*5, whereby the arranging member 102*a* can be rotated.

Figure 40A:
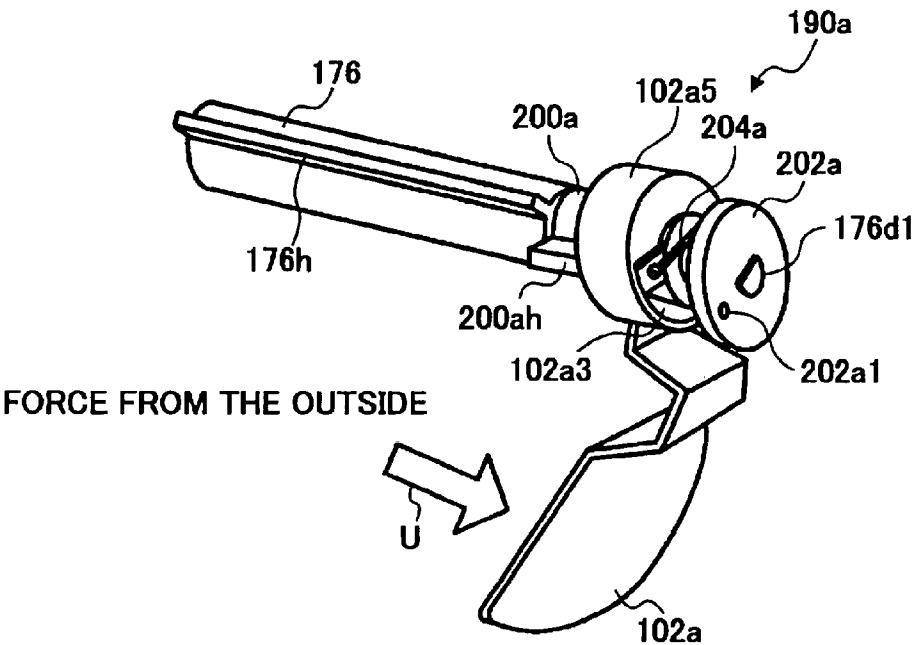
FIG. 40(*a*) is a perspective view showing the structure for supporting the arranging member at the front shaft end of the sliding rotating shaft, and FIG. 40(*b*) is a schematic view seen from axial direction.
Figure 40B:
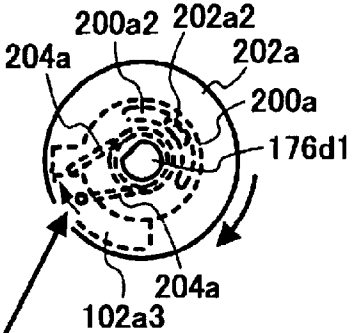

In FIGS. 40(*a*) and (*b*), when the external force U is exerted on the arranging member 102*a* and the arranging member and the evacuation shaft can not be rotated as shown in FIG. 39, even if the rotating-sliding shaft 176 and the rotation-transmitting member 202*a* are start upward rotation (clockwise direction), the evacuation shaft 200*a* is stopped so that the torsion coil spring 204*a* becomes being twisted.

Figure 41B:
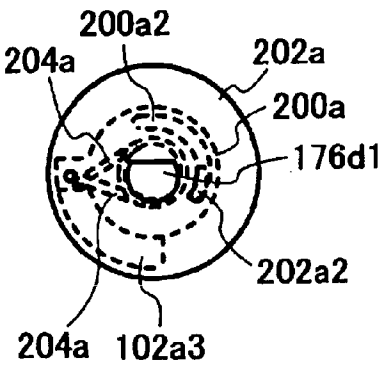
FIG. 41(*a*) is a perspective view showing the structure for supporting the arranging member at the front shaft end of the sliding rotating shaft, and FIG. 41(*b*) is a schematic view seen from axial direction.
Figure 41A:
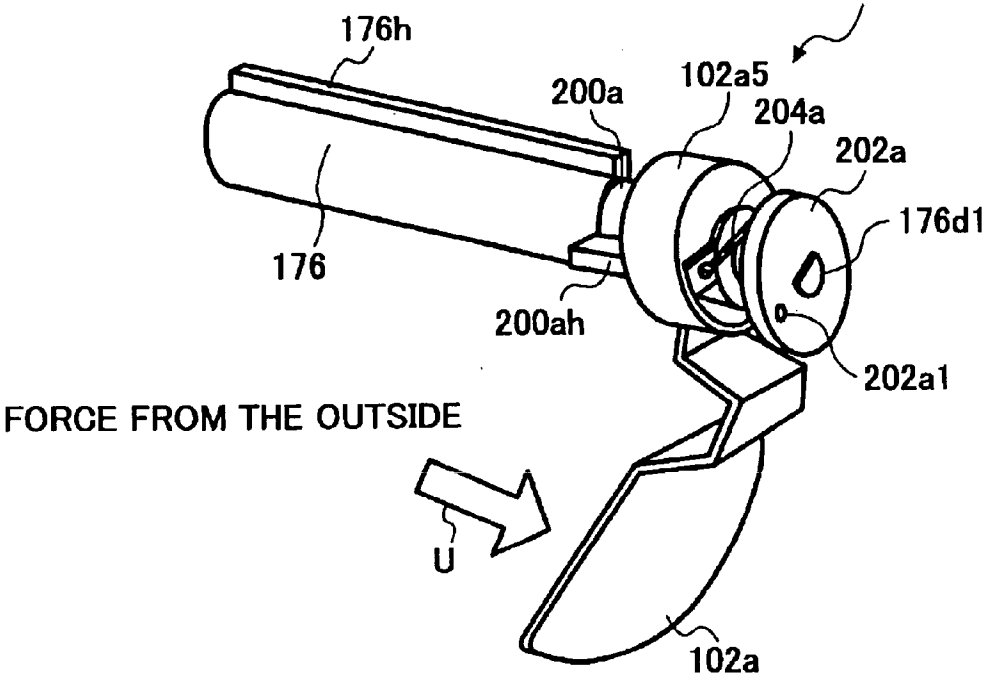

In FIGS. 41(*a*) and (*b*), the rotating-sliding shaft 176 and the rotation-transmitting member 202*a* rotate to a target angle and terminates the rotation. The torsion coil spring 204*a* is distorted by the difference in rotational angle between the evacuation shaft 200*a*, rotating-sliding member 176, and rotation-transmitting member 202*a*.

Figure 42A:
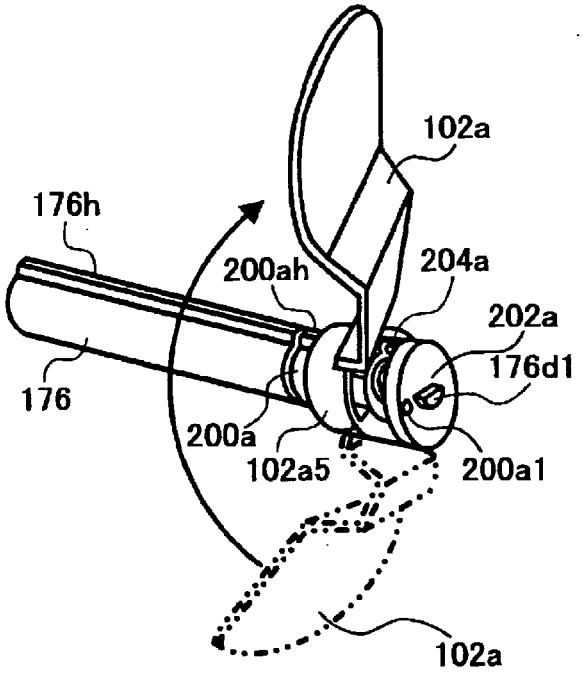
FIG. 42(*a*) is a perspective view showing the structure for supporting the arranging member at the front end portion of the sliding rotating shaft, and FIG. 42(*b*) is a schematic view seen from axial direction.
Figure 42B:
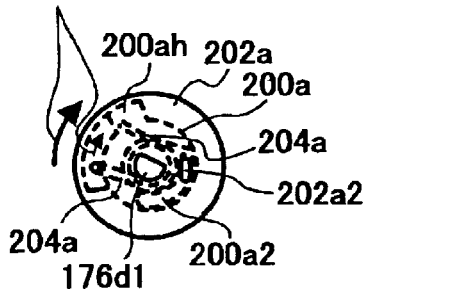

Herein, in FIG. 42, because the evacuation shaft 200*a* becomes rotatable about the small diameter part 176*d* of the rotating-sliding shaft 176 if the external force U applied to the arranging member 102*a* as shown in FIG. 41 is released, the evacuation shaft 200*a* starts to rotate in a direction same with that of the rotating-sliding shaft 176 by the force that the torsion coil spring 204*a* distorted from FIGS. 40(*a*) and (*b*) to FIGS. 41(*a*) and (*b*) tends to return to its origin, whereby the arranging member 102*a* also rotates to the upward direction (clockwise direction) same with that of rotating-sliding shaft. The arranging member 102*b* of rear side is likely constructed and performs same actions.

Like this, if a load over a predetermined value corresponding to the external force U, e.g., a hand or the other body part of operator is hold out to the arranging member 102*a* into a position blocking its rotation, when the arranging member 102*a* is rotating, the torsion coil spring 204*a* as an energizing means is flexed and thus passes through a level that the hold out body part will not be damaged.

Since the evacuation shaft 200*a* energized by the torsion coil spring 204*a* is positioned at the home position, the arranging member 102*a* is automatically provided by moving from the received position to the home position.

The strength of the torsion coil spring 204*a* is set to such an extent that the arranging member 102*a* will not rotate the evacuation shaft 200*a* when the boss part 102*a*5 is moved from the rotating-sliding shaft 176 onto the evacuation shaft 200*a* under the action of rotational moment due to self-weight in FIG. 38, This is in order to secure a certain evacuation position of rotation that the arranging member 102*a* will not be downwardly suspended from a predetermined position.

The combination of the long hole 200*a*2 and projection 202*a*2 forms a stopper that constrains the rotation of evacuation shaft 200*a*. The rotating extent allowed to the evacuation shaft 200*a* by the long hole 200*a*2 corresponds to the extent that the arranging member 102*a* may be rotated from the arranging rotational position to the receiving position in the receiving space.

Figure 43B:
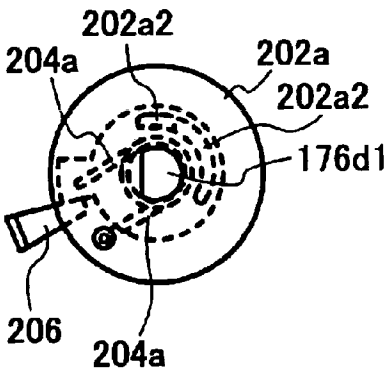
FIG. 43(*a*) is an exploded perspective view showing the structure for supporting the arranging member at the front end portion of sliding rotating shaft, and FIG. 43(*b*) is a schematic view seen from axial direction.
Figure 43A:
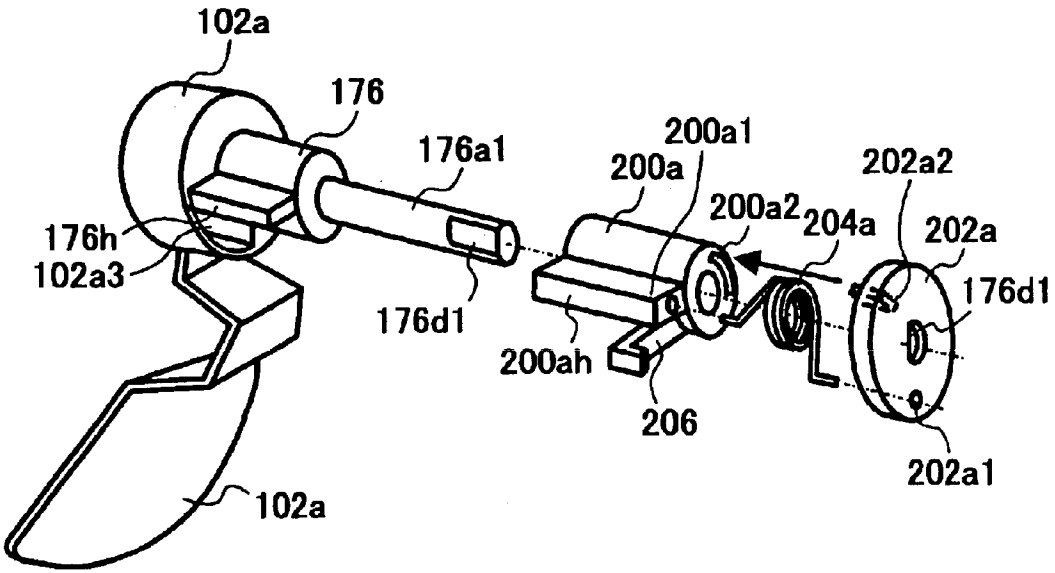

FIGS. 43(*a*) and (*b*) shows the positional relationship of the rotating-sliding shaft 176, arranging member 102*a*, evacuation shaft 200*a*, torsion coil spring 204*a*, and rotation-transmitting member 202*a*, and also shows the aspect that the stopper 206*a* abutted against the evacuation shaft 200*a* and the stopper provided in the long hole 200*a*2 formed along the circumference of the evacuation shaft 200*a* are being inserted.

Herein, while the arranging member is being fixed in position by a force applied to the arranging member 102*a* from the external when the arranging member 102*a* is received within the sheet-shaped medium after-treatment apparatus, the rotating-sliding shaft 176 and rotation-transmitting member 202*a* upwardly rotate to a desired position and then stop, and if the force applied to the arranging member 102*a* from the external is released, the evacuation shaft 200*a* rotates to a direction identical to that of the rotating-sliding shaft 176 by the torsional restoring force of torsion coil spring. However, due to the aftereffect, the evacuation shaft 200*a* tends to rotate to an angle larger than that of the rotating-sliding shaft 176.

Figure 44B:
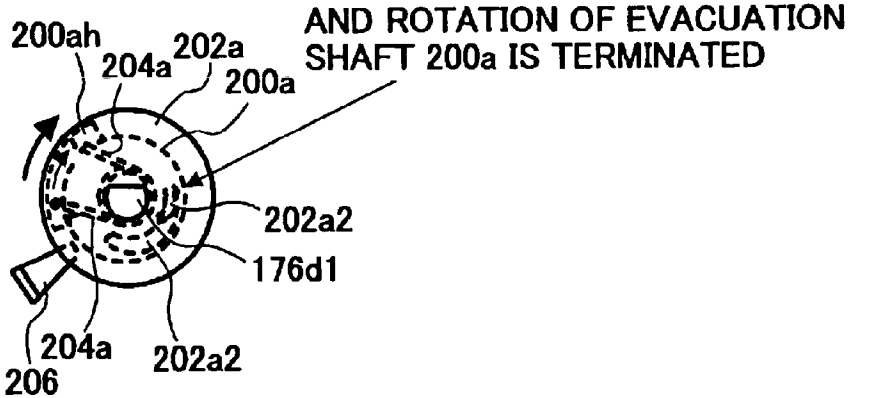
FIG. 44(*a*) is a perspective view showing the structure for supporting the arranging member at the front end portion of the sliding rotating shaft, and FIG. 44(*b*) is a schematic view seen from axial direction.
Figure 44A:
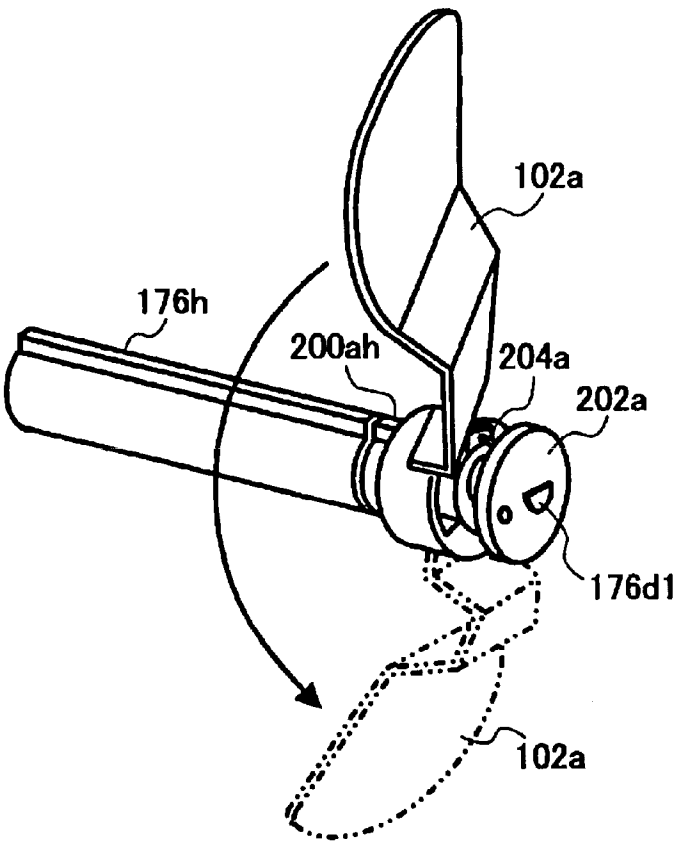

Therefore, by the construction of the long hole 200*a*2 provided in the rotation-transmitting member 202*a* and projection 202*a* as shown in FIG. 44, the rotation angle of the evacuation shaft 200*a* is limited, whereby the evacuation shaft 200*a* is blocked to rotate exceeding the rotation angle of the rotating-sliding shaft 176.

Furthermore, when returning the arranging member 102*a*, which was received in the sheet-shaped medium after-treatment apparatus, out of its original position, the evacuation shaft 200*a* is rotated opposite to the direction at the time of receiving the arrangement member. In this case, however, a force, which tends to rotate the evacuation shaft 200*a* about the rotating-sliding shaft 176*h* downwardly in the drawing, is also applied to the evacuation shaft 200*a* by the aftereffect of rotation of the evacuation shaft 200*a* and the weight of the arranging member 102*a*.

Figure 45B:
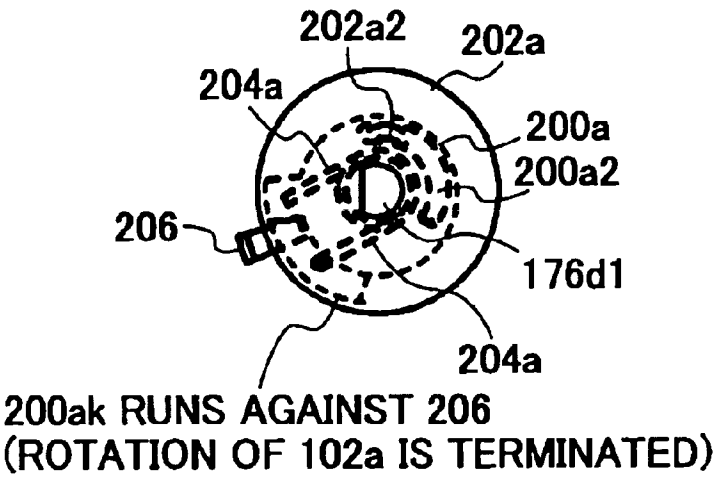
FIG. 45(*a*) is a perspective view showing the structure for supporting the arranging member at the front end portion of the sliding rotating shaft, and FIG. 45(*b*) is a schematic view seen from axial direction.
Figure 45A:
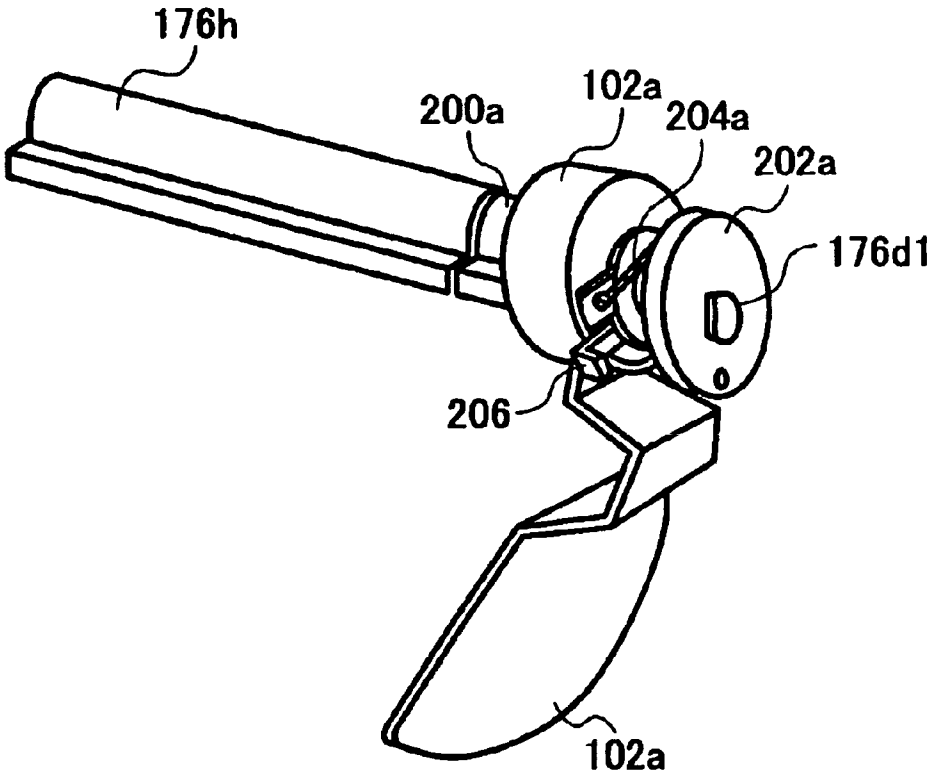

Therefore, the evacuation shaft 202*a* is made to run against the stopper 206 anchored on an immovable member as shown in FIG. 45, thereby blocking the rotation beyond it. In addition, the description made as to the surrounding of the arranging member 102*a* can be applied to the surrounding of the arranging member 102*b* as it is.

g. Example of Control Using Control Means

Figure 1:
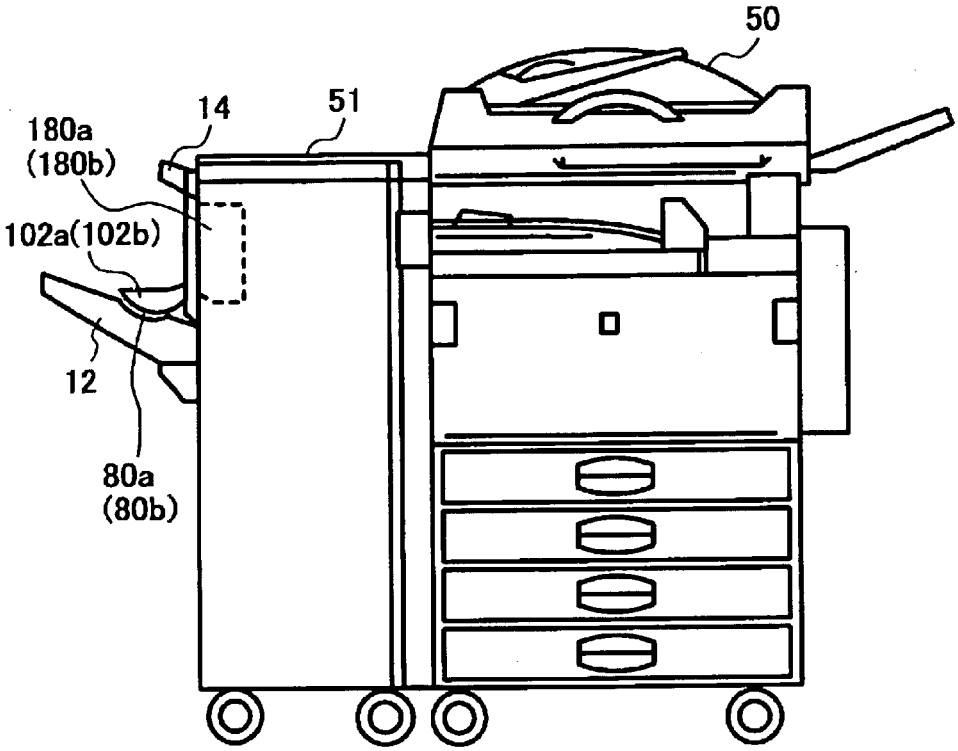
FIG. 1 is a front view of an image forming apparatus and a sheet-shaped medium after-treatment apparatus.

This example is an example of sorting control performed under the entire construction of apparatus in which the sheet-shaped medium after-treatment apparatus 51 is connected to the image forming apparatus 50 as shown in FIGS. 1 and 2 and the sheet-shaped medium after-treatment apparatus 51 is provided with the sheet-shaped medium aligning apparatus according to the present invention. In addition, the arranging operation will be explained based on the case of both side-movement mode aforementioned in reference to FIG. 14 and the sorting operation will be explained with the aspect of shifting the tray 12.

Figure 46:
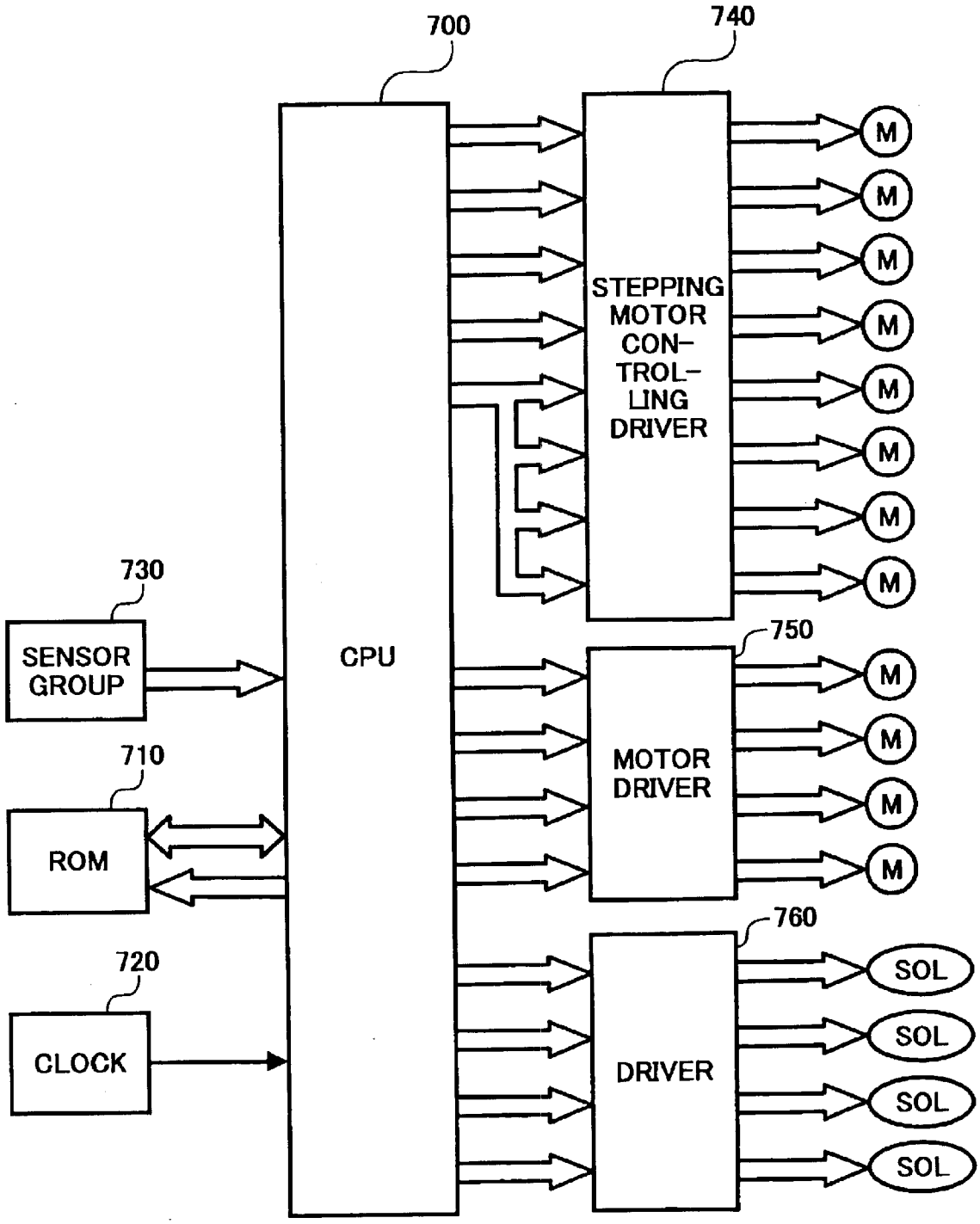
FIG. 46 is a block diagram of a control system.

Referring to FIG. 46 showing a control circuit of control means, CPU 700 exchanges information with ROM 710 in which a control program is stored, and implements the control indicated in each of flowchart to be explained below by inputting a clock signal from a clock 720.

For that purpose, a CPU 700 exchanges signals with the image forming apparatus 50 and is adapted to output information to a step motor control driver 740, a motor driver 750 and a driver 760 by inputting information from a group of sensors 730.

The group of sensors 730 generically expresses various sensors used in the sheet-shaped medium after-treatment apparatus 51 and sheet-shaped medium aligning apparatus according to the present invention, and various sensors appeared during the control based on the flowcharts to be explained below correspond to them.

The stepping motor control driver 740 controls various stepping motors used in the sheet-shaped medium after-treatment apparatus 61 and sheet-shaped medium aligning apparatus according to the present invention, and in particular various stepping motors appeared in the flowchart to be explained below correspond to them. In FIG. 46, they are illustrated by a symbol M.

The motor driver 750 controls various DC motors used in the sheet-shaped medium after-treatment apparatus 51 and sheet-shaped medium aligning apparatus according to the present invention, and in particular various motors appeared in the flowchart to be explained below correspond to them. In FIG. 46, they are illustrated by a symbol M.

The driver 760 controls various solenoids used in the sheet-shaped medium after-treatment apparatus 51 and sheet-shaped medium aligning apparatus according to the present invention, and in particular various solenoids appeared in the flowchart to be explained below correspond to them. In FIG. 46, they are illustrated by a symbol SOL. a CPU 700 in FIG. 46 is a main part for performing the flow to be explained below and forms the core of control means in the present invention.

When a shift mode for sorting sheets is selected in the sheet-shaped medium after-treatment apparatus 51, a paper conveyed from a discharging roller 560 of the image forming apparatus 50 is received by the pair of inlet rollers 1, passed through the pair of conveyance rollers 2*a* and the pair of conveyance rollers 2*b*, and discharged to the tray 12 by the discharging roller 3 which is final conveyance means. At that time, the branch claws 8*a*, 8*b* continuously maintain a default position and sheets are sequentially passed one by one through a same conveyance passage and discharged onto the tray 12.

Following flowcharts show only the parts related to the present invention in the sheet-shaped medium after-treatment apparatus. If the main switch, which generally controls the image forming apparatus 50 and sheet-shaped medium after-treatment apparatus 51 of FIGS. 1 and 2, is turned to ON and thus the sorting mode is selected, the following control is performed.

Figure 47:
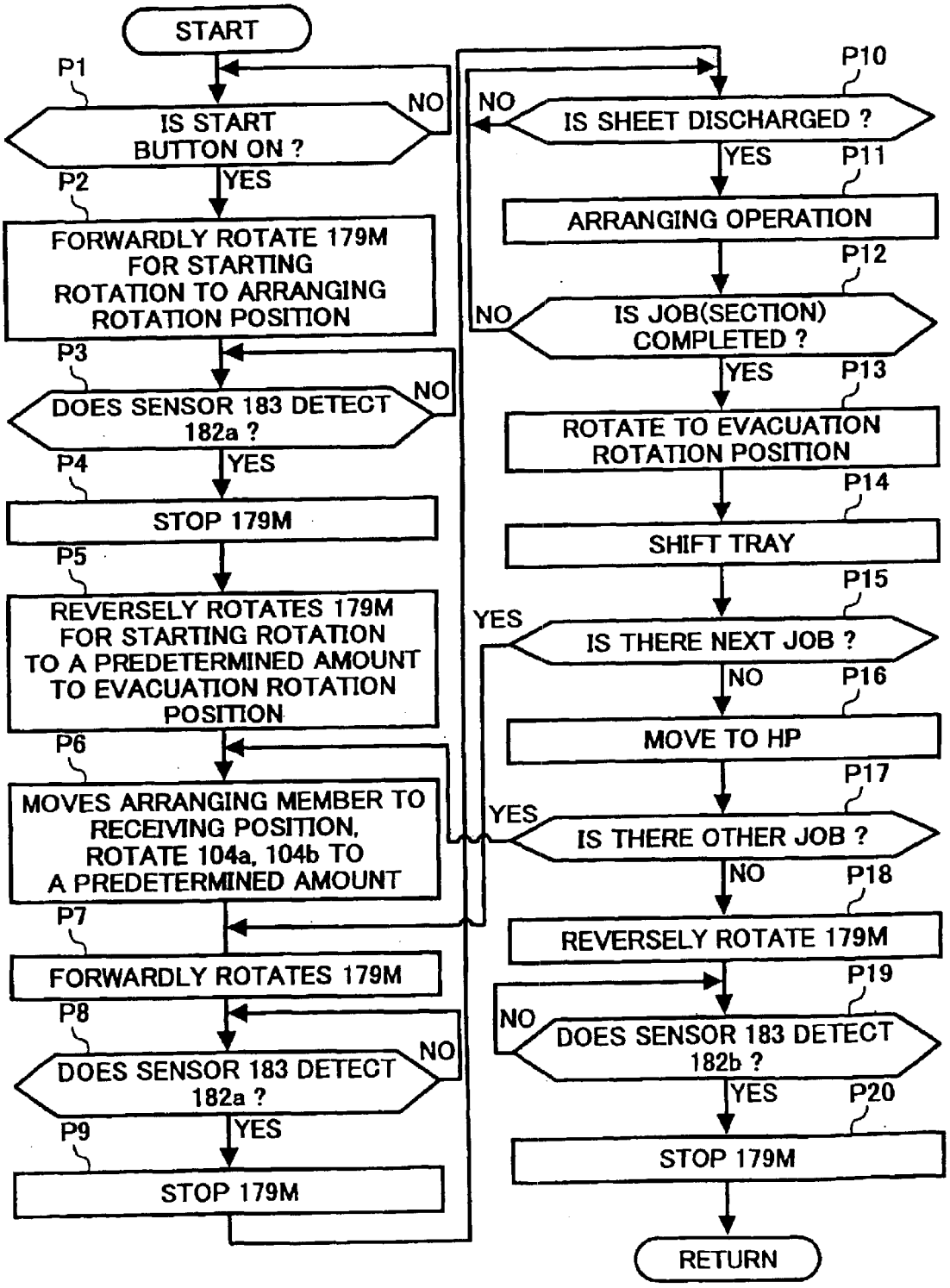
FIG. 47 is a flowchart for shift arranging of paper.

In FIG. 47, if the start button of image forming apparatus 50 is turned to ON (STEP P1), the stepping motor 179M is forwardly rotated in order to send out the arranging member 102*a* received in the receiving rotation position (FIG. 18(*b*)) (STEP P2). As shown in FIG. 18(*a*), if the sensor 183 detects a slit 182*a* (STEP P3), the stepping motor 179M is stopped (STEP P4). At this time, because the arranging members 102*a*, 102*b* are in the arranging rotation position (see FIG. 18(*a*)) and the sensor 183 detected the slit 182*a*, the stepping motor 179 reversely rotates by a predetermined amount allowing the arranging members 102*a*, 102*b* to rotate to the evacuation-rotation position (STEP P5), in order to lay the arranging members 102*a*, 102*b* in the evacuation-rotation position (see FIG. 20) in reference to the arranging rotation position.

The stepping motors 104*a*, 104*b* is rotated to a predetermined amount toward a direction that respective arranging members approach and the arranging members 102*a*, 102*b* in the evacuation-rotation position is moved to the receiving position (see FIG. 11) suitable to a paper size.

Because the arranging members 102*a*, 102*b* are still in the evacuation-rotation position although they have been moved to the receiving position, the stepping motor 179M is forwardly rotated until the sensor detects the slit 182*a* as shown in FIG. 18(*a*) (STEP P7 and STEP P8) and then stopped (STEP P9). In this way, the arranging members 102*a*, 102*b* are in the receiving position shown in FIG. 11 on the shift direction and are in the arranging rotation position on the rotation direction shown in FIG. 19, whereby they are in the state of the standing by the discharging of sheet.

Herein after, a control is performed in the following manner.

A discharged and coming paper may carry a shift command signal or not. A paper carrying a shift command signal is a leading paper of job (section), and it is adapted to be recognized whether a paper carries the shift command or not at the time when the paper passes through the discharging sensor 38 by control means.

If the control means does not recognize the shift command signal, it means the termination of the job. Therefore, the tray 12 is not shifted and returned to its home position (see FIG. 10) after the arranging members 102*a*, 102*b* is lifted to the evacuation-rotation position. If the control means recognize the shift command signal, the paper is the leading one of next job, and during the interval to the time that the paper arrives at the tray 12, the arranging members 102*a*, 102*b* are lifted to the evacuation-rotation position in advance, the tray 12 is shifted for the next job and the arranging members 102*a*, 102*b* return to the arranging rotation position to stand by the discharging of sheet.

And, if the sensor 38 detects the discharging of paper while standing by the discharging in STEP P10, the arranging operation is performed in STEP P11. This arranging operation is same with that illustrated in FIG. 14(*a*). In STEP P12, it is judged whether the job is terminated or not. If the job is not terminated, it returns to the STEP P10 and then it is repeated until the job is terminated. If the job is judged as terminated in STEP 12, it proceeds to STEP P13 as a preparation step for performing the arranging operation for the next job.

In STEP P13, as advance preparations for shifting the tray 12, the stepping motor 179M is driven and the arranging members 102*a*, 102*b* is rotated by a required amount toward the evacuation-rotation position, thereby positioning in the evacuation-rotation position. In STEP P14, the tray 12 is shifted.

In STEP P15, it is judged whether the next job is present or not. If judged as present, it proceeds to STEP P7 for performing the job (next job), and if judged as not present, the arranging members 102*a*, 102*b* are moved to the home positions shown in FIG. 10 because other task is expected.

In STEP P17, it is judged whether other job is present or not. If judged as present, it proceeds to STEP P6 and turns to a process such as moving the arranging members to the receiving position suitable to the other job, and if judged as not present, as the task is terminated, the stepping motor reversely rotates (STEP P18), the sensor 183 detects the slit 182*b* (STEP P19), and the stepping motor 179M is stopped and returned if the arranging members 102*a*, 102*b* arrive at the receiving rotation position (FIG. 18(*b*)).

[2] Example Applied to Image Forming Apparatus

The example relates to an image forming apparatus having image forming means for forming image on a paper and conveyance means for conveying the image-formed sheet. The image forming apparatus 50' shown in FIG. 48 includes image forming means which is common to the image forming apparatus 50 in FIGS. 1 and 2. The image forming apparatus 50' comprises arranging members 102*a*, 102*b*, driving means for driving the arranging members, receiving spaces 180*a*, 180*b*, a returning roller 121 and its displacement means. In the image forming apparatus 50', there are some members common to constituent parts of the sheet-shaped after-treatment apparatus 51 explained hitherto, and those members are indicated by referential numerals identical to those used hitherto and description thereof will be omitted.

Figure 48:
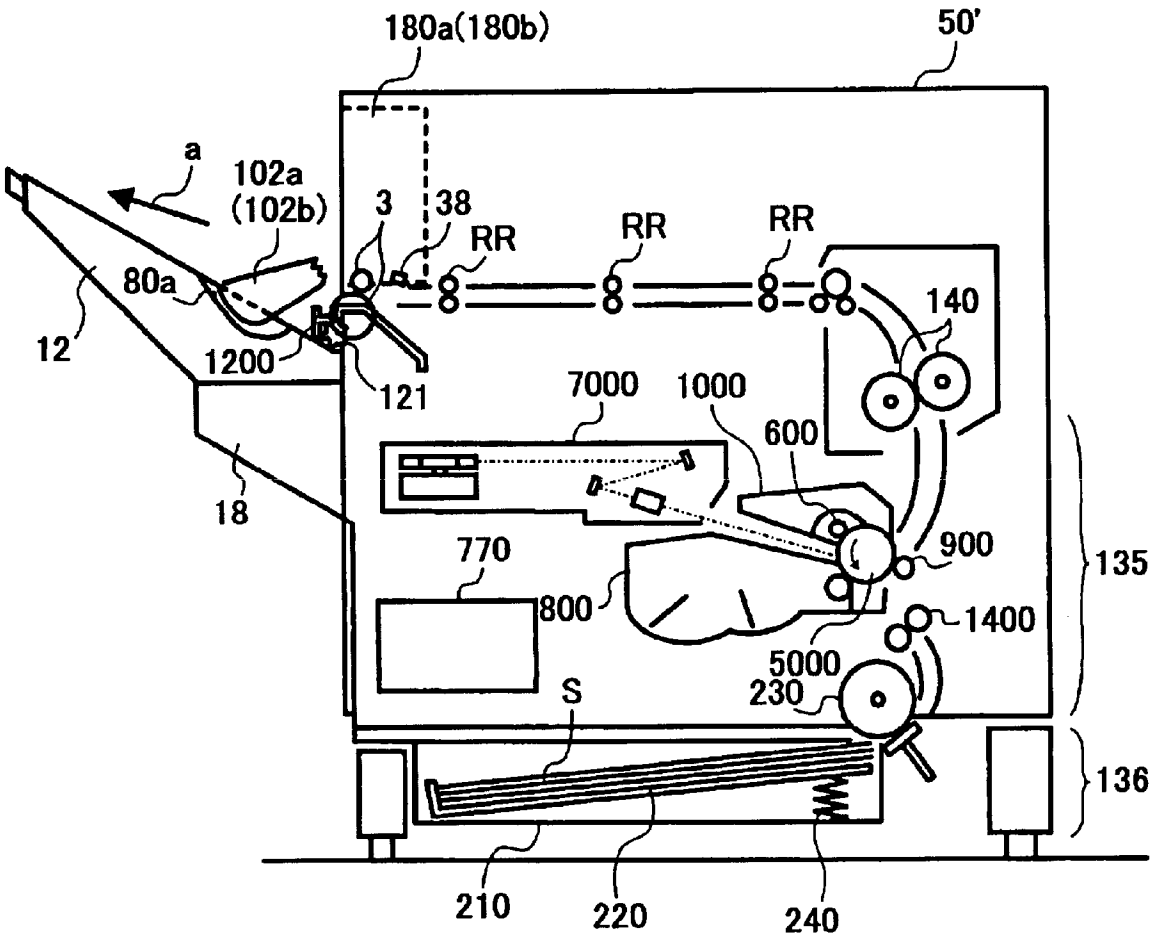
FIG. 48 is a schematic diagram of an image forming apparatus with the sheet-shaped medium aligning apparatus having arranging member receiving function.

In FIG. 48, a image forming part 135 is located substantially in the center portion of main body of apparatus and a paper feeding part 136 is located just below the image forming part 135. The paper feeding part 136 includes a sheet-feeding cassette 210.

It is possible to provide a manuscript reading apparatus (not shown) in the upper part of the image forming apparatus 50' as required. The upper part of the image forming part 135 is provided with a roller RR, a guide plate, and the like as means for conveying an image-formed sheet.

The image forming part 135 is provided with an electric equipment unit Q for electrically driving or controlling the apparatus. Furthermore, a drum-shaped photo conductor 5000 is located therein. In the circumference of this photo conductor, there are provided with an electrifying device 600 for electrifying the surface of the photo conductor 5000, an exposure device 7000 for illuminating the surface of photo conductor with laser light, a development device 800 for visualizing an electrostatic latent image illuminated and formed on the surface of the photo conductor 5000, a transfer device for transferring the visualized toner image visualized on the photo conductor 5000, a cleaning device 1000 for removing and recovering toner remained on the surface of the photo conductor after transferring, and the like, respectively.

The photo conductor 5000, the electrifying device 600, an exposure device 7000, a development device 800, a transferring device 900, the cleaning device 1000 and the like forms main parts of the image forming means. A firing device 140 is located approximately upper side of the photo conductor 6000 and downstream of the photo conductor 5000 in the paper conveyance passage.

If the image forming apparatus functions as a printer, an image signal is inputted when forming an image. The photo conductor 5000 is uniformly electrified by the electrifying device 600 in the dark Exposure light is illuminated on the uniformly electrified photo conductor 5000 by the light-emission of a laser diode LD (not shown) of the exposure device 7000 and arrives at the photo conductor via a well-known polygonal mirror on the basis of the image signal, whereby an electrostatic latent image is formed on the surface of photo conductor. This electrostatic latent image is moved with the rotation of the photo conductor 5000, turned to a visualized image by the development device 800, and then additionally moved and directed toward the transfer device 900.

Meanwhile, unused sheets are received in the sheet-feeding cassette of a sheet-feeding part 136 and a bottom plate 220 pivotally supported is adapted to be urged by a spring 240 so that the paper S placed on the bottom plate 220 is compressed against a sheet-feeding roller 230.

When a paper is fed for transfer, the sheet-feeding roller 230 rotates, thereby the paper S is fed out from the sheet-feeding cassette 210 and conveyed to a pair of resist rollers 1400.

The conveyance of paper sent to the resist rollers 1400 is temporally stopped here. The resist rollers 1400 start conveyance of sheets after timing is performed so that the positional relation between the toner image on the surface of the photo conductor 5000 and the leading end of the paper S is set to be suitable for the image transfer in the transfer position on which the transfer device 900 is installed.

The image-transferred paper is fixed with a toner image while it passes through a fixing device 140. The paper that passed through the fixing device 140 is conveyed by the roller RR, which is a conveyance means, passed by the discharging sensor 38, and then discharged from the discharging roller 3 to the tray.

Because the constructions and functions of the arranging members 102*a*, 102*b* and receiving spaces 80*a*, 180*b* hereinafter are same with those explained in the aforementioned examples, description will be omitted.

In the image forming apparatus of this example, conformation by the arranging member 102*a*, 102*b* and the like and sorting by the sorting means are also performed to the sheets S piled on the tray and means for securing safety is also provided.

[3] Application to After-treatment Apparatus of the Type that Sheet Piling Means Moves Up and Down through Discharging Means Recently, digitalization of image forming apparatus such as copying machine has been progressed and complex type image forming apparatus having a plurality of functions such as printer function, copying function, and facsimile function are increased.

Under this background, since necessity hoping to perform sorting for every function rises to its flood mark, tray-pluralization is also progressed in the sheet-shaped medium after-treatment apparatus and the like. Because there are two trays as sheet piling means in the sheet-shaped medium after-treatment apparatus of the type illustrated in FIG. 4 as a whole, it is possible to immediately perform the interrupt of copying, for example, during the discharging of printer sheets. However, because the proof tray 14 is the one used only for simply discharging sheets one by one without performing batch treatment, substantially one tray can enjoy added value (batch treatment) and the like as a sheet-shaped medium after-treatment apparatus.

Under this background, a sheet-shaped medium of the type installed to be able to receive a plurality of trays in one discharging port has been developed.

Figure 49:
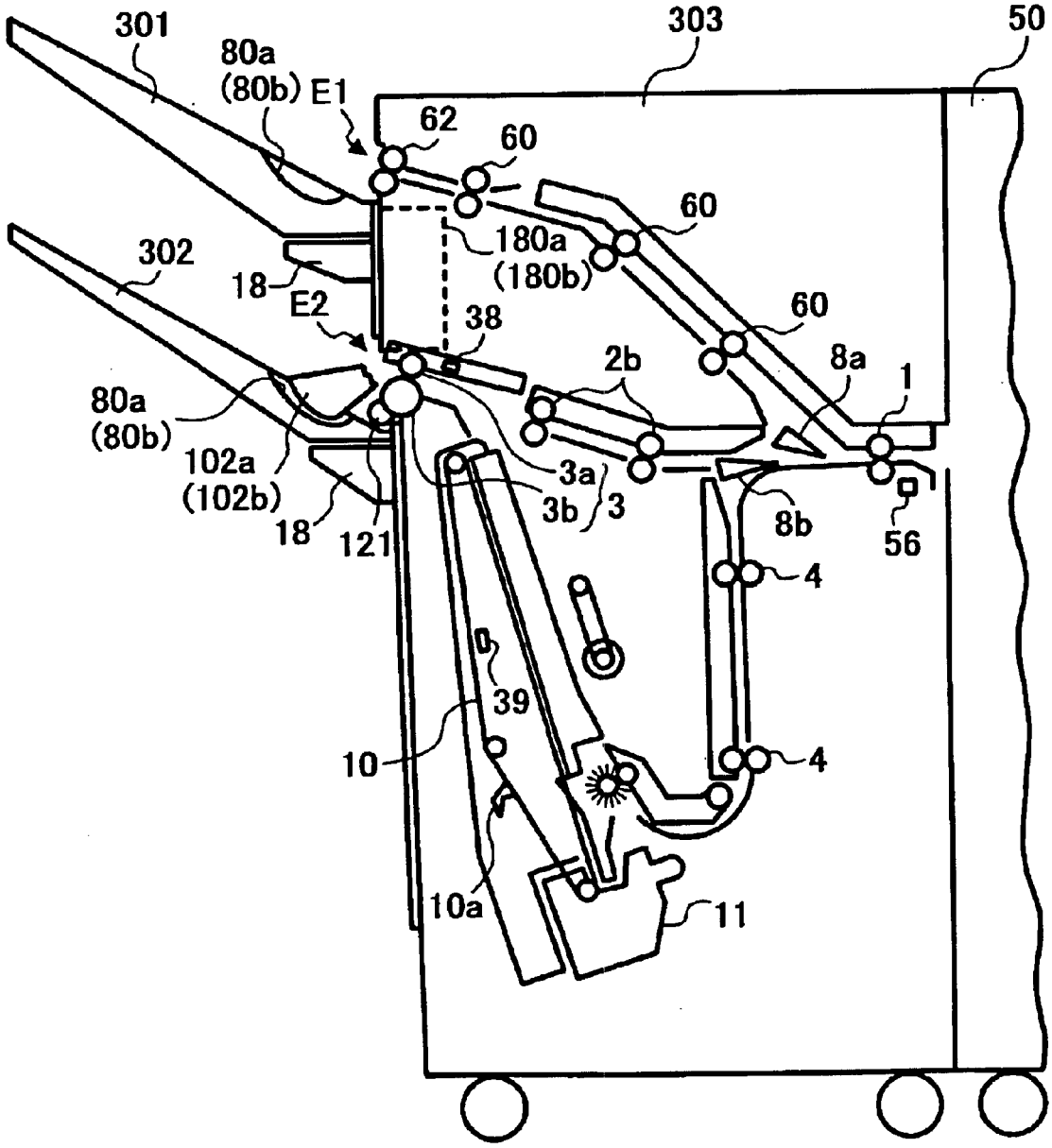
FIG. 49 is a schematic diagram of the sheet-shaped medium after-treatment apparatus having a plurality of tray movable up and down, with the sheet-shaped medium aligning apparatus having arranging member receiving function.
Figure 50:
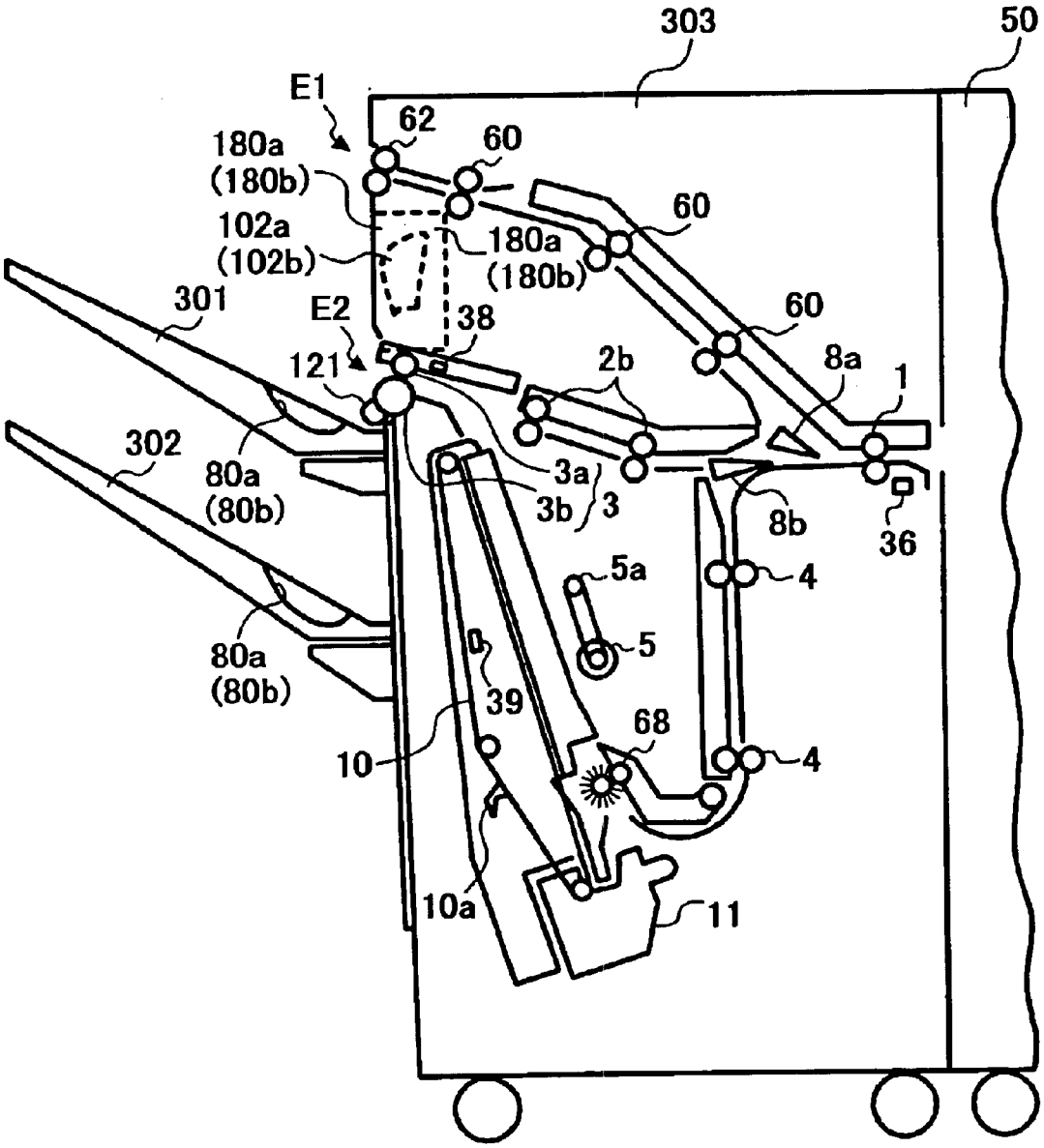
FIG. 50 is a schematic diagram of the sheet-shaped medium after-treatment apparatus having a plurality of tray movable up and down, with the sheet-shaped medium aligning apparatus having arranging member receiving function.
Figure 51:
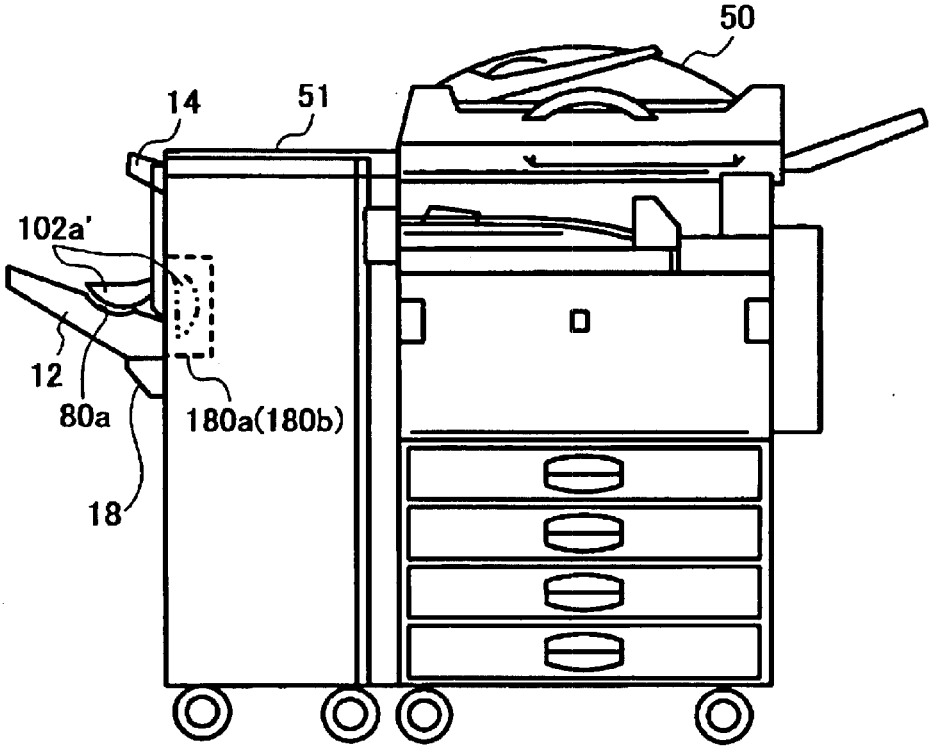
FIG. 51 is a front view of the image forming apparatus and sheet-shaped medium after-treatment apparatus.
Figure 52:
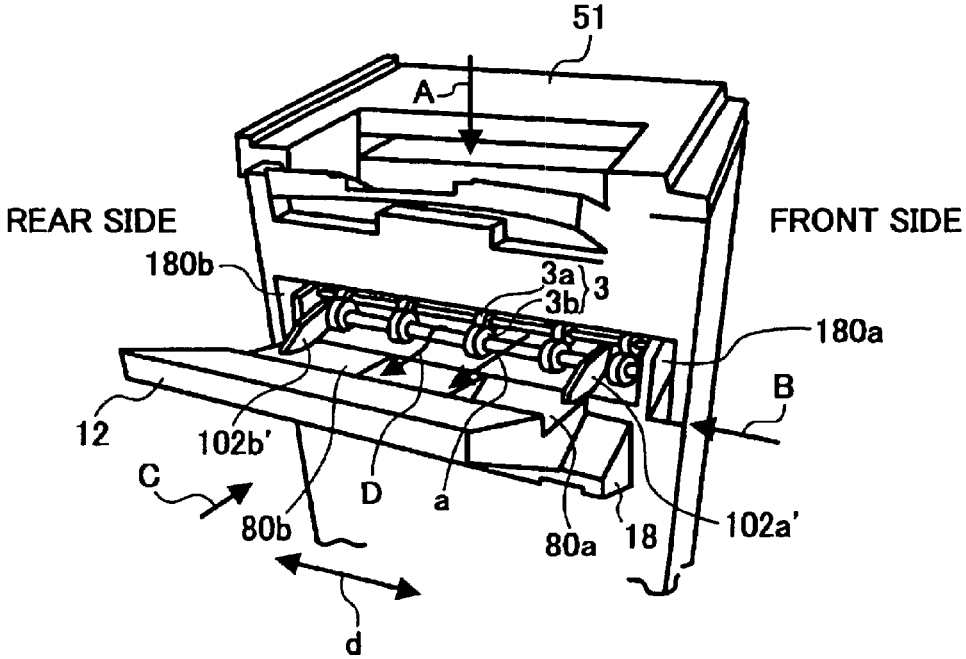
FIG. 52 is a partial perspective view of the sheet-shaped medium after-treatment apparatus seen from upper oblique position.
Figure 53:
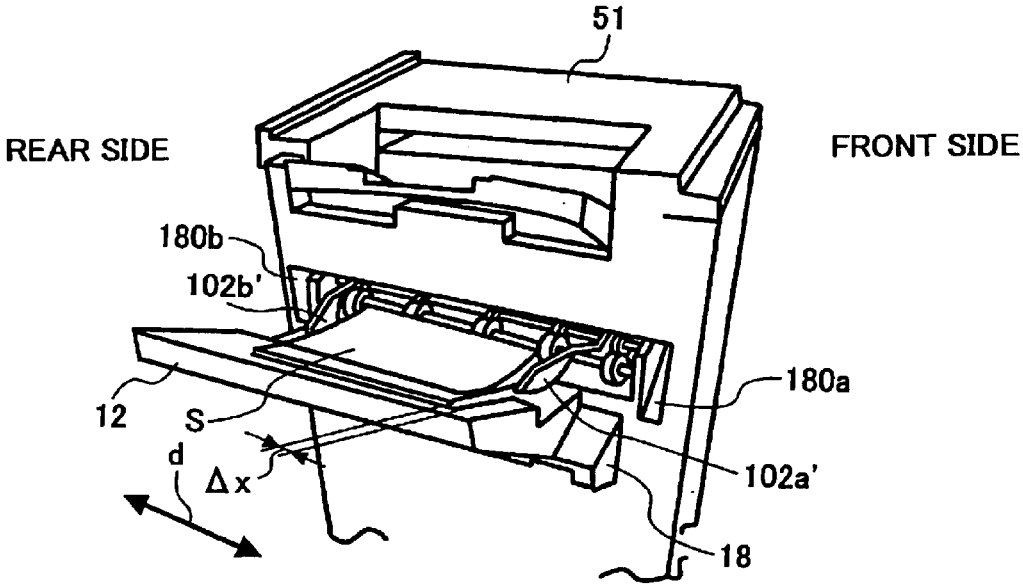
FIG. 53 is a partial perspective view of the sheet-shaped medium after-treatment apparatus seen from upper oblique position.
Figure 54:
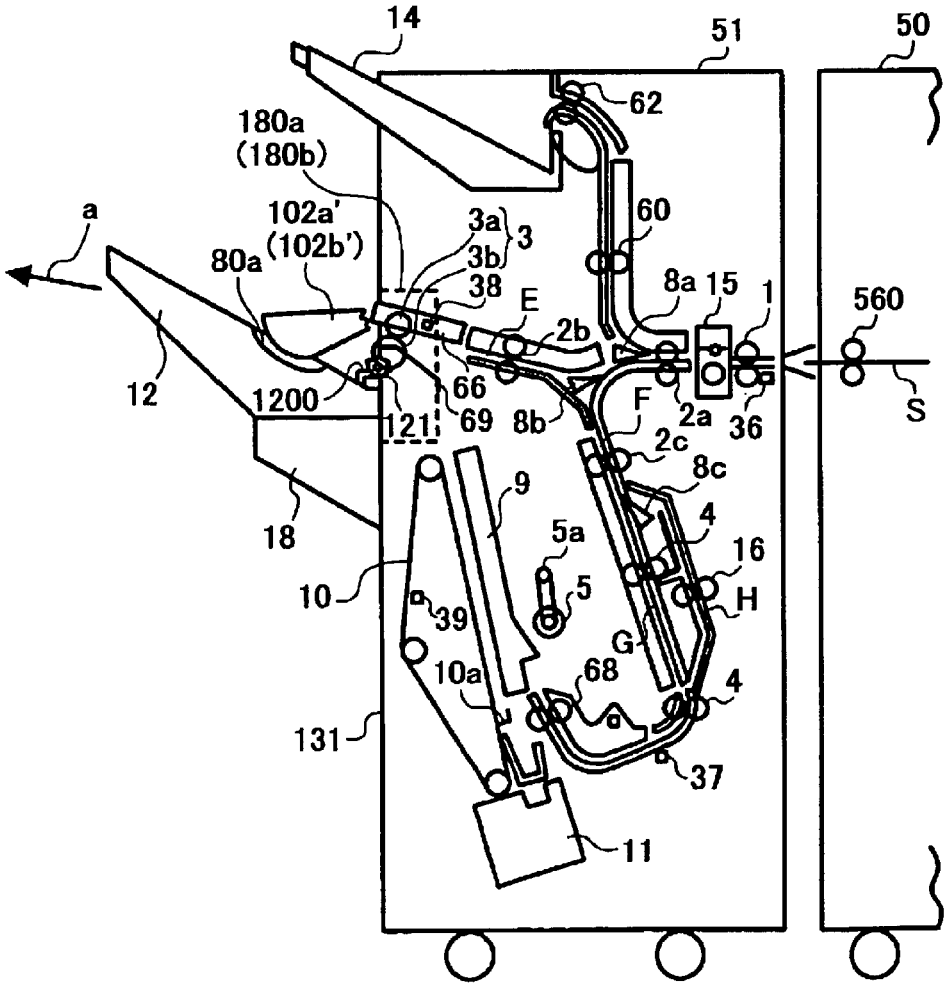
FIG. 54 is a schematic diagram for the sheet-shaped medium after-treatment apparatus and image forming apparatus.
Figure 55:
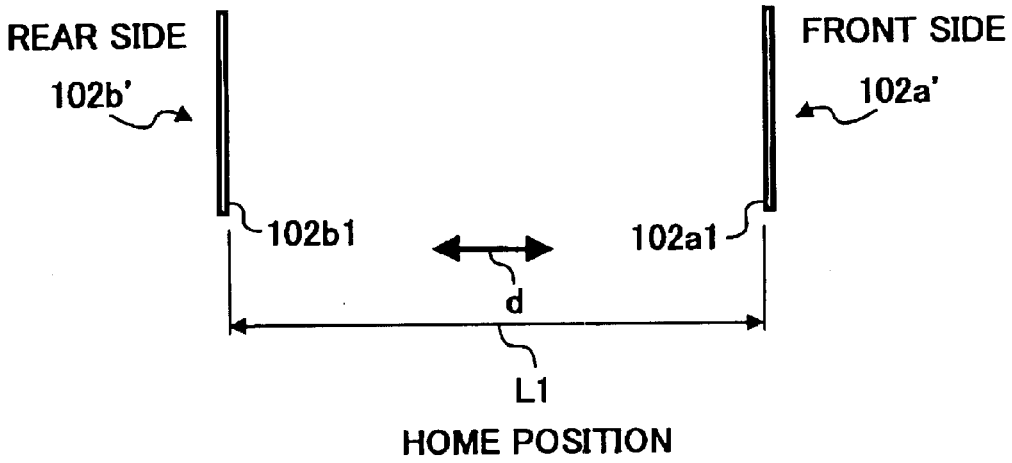
FIG. 55 is a schematic front view of the arranging members and means for arranging member seen from downstream of discharge direction.
Figure 56:
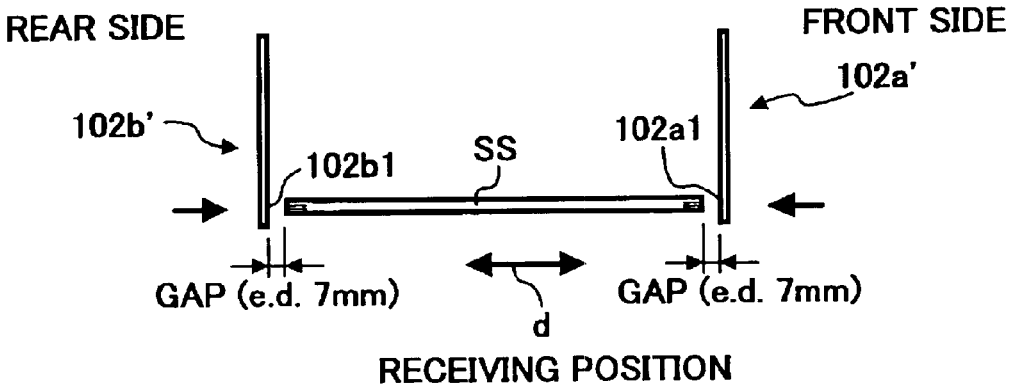
FIG. 56 is a schematic front view of the arranging members and means for arranging member seen from downstream of discharge direction.
Figure 57:
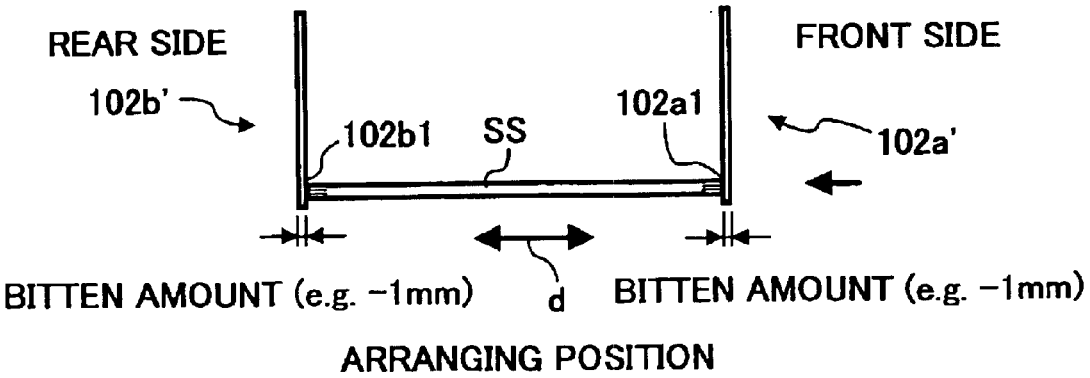
FIG. 57 is a schematic front view of the arranging members and means for moving arranging member seen from downstream of discharge direction.

One example of such a sheet-shaped medium after-treatment apparatus 303 is shown in FIGS. 49 and 50.

Referring to FIG. 49, an upper tray 301 is being stood by in the discharging port El and a lower tray 302 is positioned in the lower discharging port E2, and referring to FIG. 50, the upper tray 301 is positioned in the lower discharging port E2.

While the internal construction of the sheet-shaped medium after-treatment apparatus 303 is not identical that of the sheet-shaped medium after-treatment apparatus 50 shown in FIG. 4 at all, there are many common parts except that the former includes two trays movable up and down.

Therefore, constituent members, which are functionally common to the internal constituent members of the sheet-shaped medium after-treatment apparatus in connection with the internal construction, are indicated by like referential numerals used in FIGS. 49 and 50 and description will be omitted.

Not-batch-treated sheets are discharged to the discharging port E1, while a bundle of batch-treated sheets or not-batch-treated sheets are discharged to the discharging port E2. Under the state that the tray 302 is positioned to be able to receive sheets discharged from the lower discharging port E2 as shown in FIG. 49, the arranging members 102*a*, 102*b* form an obstacle although the tray 301 may pass through the discharging port E2 which is a discharging means, when the tray 301 is adapted to be lowered from the position that it is placed on the tray 302 as shown in FIG. 49 so that it can receive sheets from the discharging port E2 as shown in FIG. 50.

Therefore, the arranging members 102*a*, 102*b* are constructed to be in accord with the description for each of above examples, so that they can be received in the receiving spaces 108*a*, 108*b*, whereby the trays 301, 302 can pass through the discharging port E which is a discharging means, without any problem.

The trays 301, 302 are fitted to be slidable along separated guides that individually guide in the up and down directions, and able to be independently moved up and down by separated tray lifting means as illustrated in FIG. 5(*a*).

This sheet-shaped medium after-treatment apparatus 803 comprises image forming means common to the sheet-shaped medium after-treatment apparatus as shown in FIG. 4. For example, it comprises the arranging members 102*a*, 102*b* and means for driving them, the receiving spaces 180*a*, 180*b*, the returning roller 121 and means for displacing it, and the like.

(The Second Invention)

[1] Sheet-shaped Medium After-treatment Apparatus a. Summary of the Sheet-shaped Medium After-treatment Apparatus b. Tray and Tray Moving Means as Sorting Means c. Arranging Operation (1) One-side Movement Mode

[First Job], [Second Job], [Third Job]

(2) Both Side Movement Mode

[First Job], [Second Job],[Third Job]

The above items are same with those of the first aspect of the present invention. Furthermore, FIGS. 1 to 4 and 10 to 14 of the first aspect of the present invention are almost corresponding to FIGS. 51 to 64 and 55 to 59. Therefore, they may be properly applied in substitution each other.

d. Example of Construction for Rotationally Displacing Arranging Means

In the following description, the surrounding construction and action of the front side arranging means, the arranging member 102*a*' will be explained and the explanation as to the surrounding construction and action of the rear side arranging means, the description as to the arranging member 102*b*' will be omitted because they are in accord with the description as to the surrounding members of the arranging member 102*a*'.

Description corresponding to claim 28

Figure 59A:
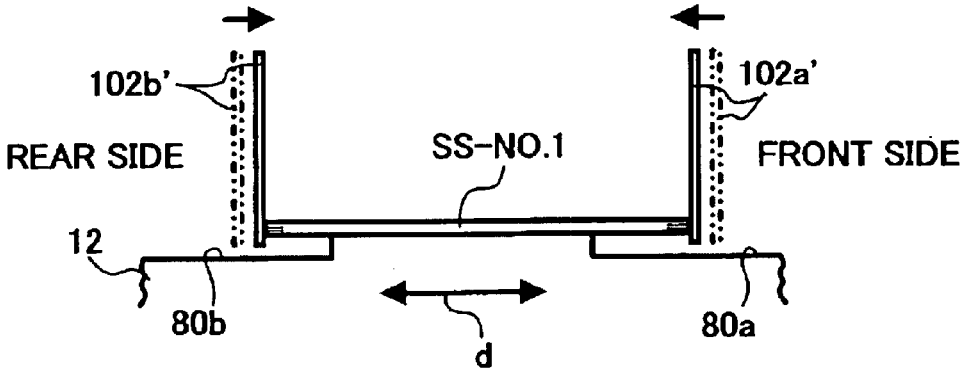
FIGS. 59(*a*), (*b*) and (*c*) sequentially show sorting arranging operations by both sides movement mode.
Figure 59B:
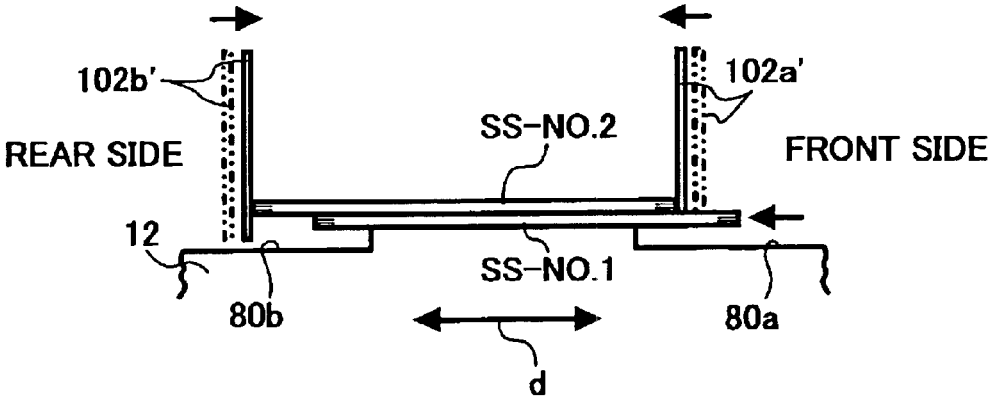
Figure 59C:
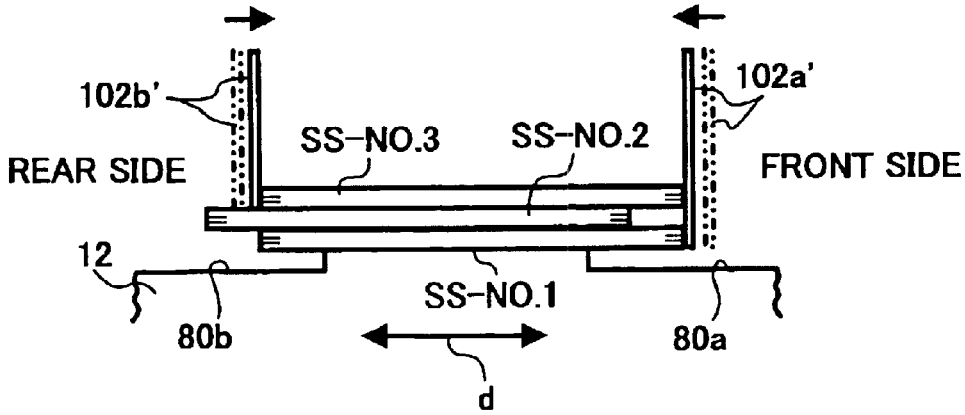
Figure 60:
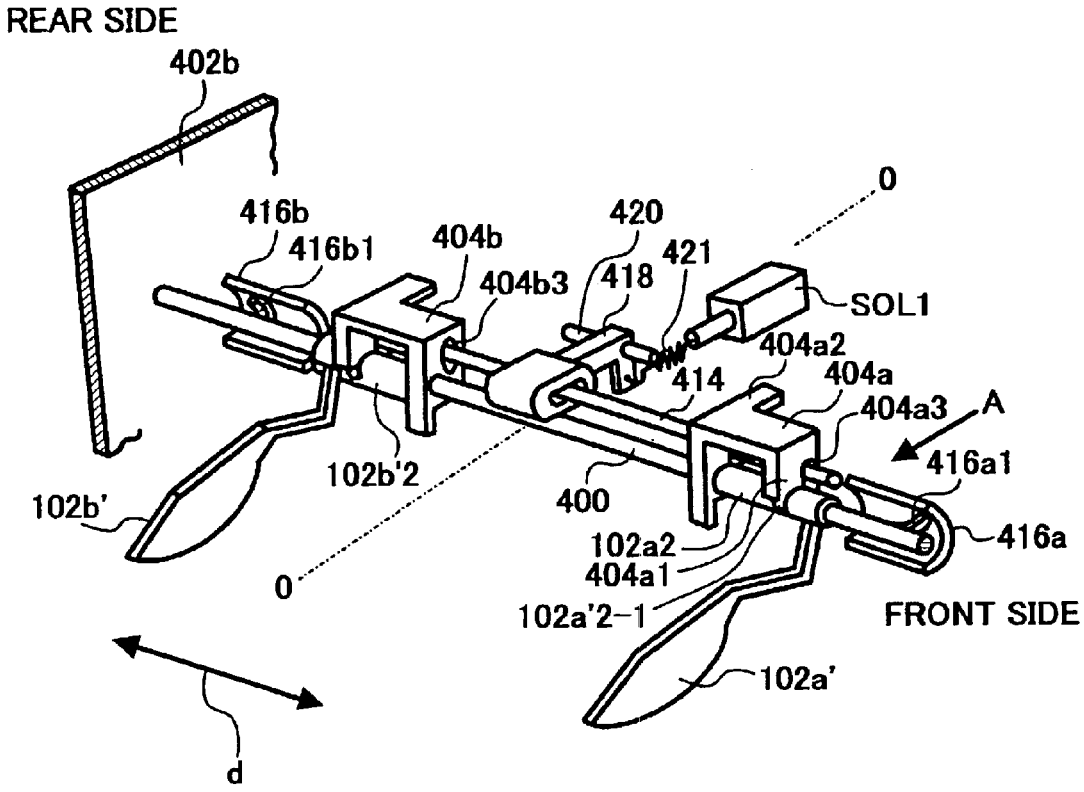
FIG. 60 is a perspective view showing main elements of the arranging means and means for moving the arranging means.

FIG. 60 is a perspective view showing main parts of the sheet-shaped medium after-treatment apparatus shown in FIGS. 51 to 69. Referring to FIG. 60, the mechanism for driving the front side arranging member 102*a*' and the mechanism for driving the rear side arranging member 102*b*' are separated with the paper conveyance centerline O-O being positioned between them and have an identical construction. Therefore, as to the mechanism for driving the arranging member 102*a*', constituent members will be indicated by reference numerals suffixed with "a" and the construction thereof will be described, but as to the arranging member 104*b*, like constituent members will be indicated by like reference numerals suffixed with "b" and description will be omitted.

A guide shaft 400 having a length in the shift direction d is fixed to a side plate 402*b* (rear side) and a side plate 402*a* (front side). However, the front side plate 402*a* is not shown. A guide cylinder 102*a*'2 formed on the base end of the arranging member 102*a*' is engaged to the guide shaft 400 to be slidable and rotatable. By employing this construction, if the arranging member 102*a*' is reciprocated in the shift direction, it is possible to arrange the sheets, and if the arranging member 102*a*' is rotated about the guide shaft 400, it is possible to evacuate the arranging member 102*a*' to the receiving position in which an operator's hand does not interfere at the time of discharging sheets.

Description Corresponding to Claim 29

Figure 61:
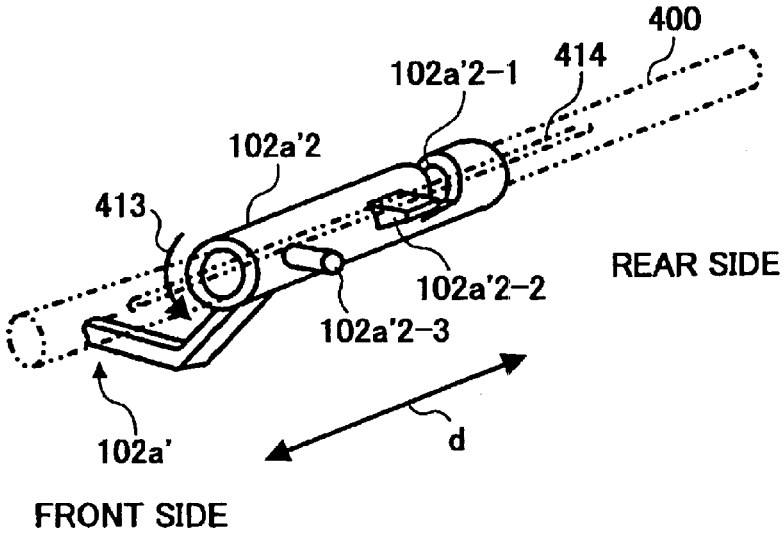
FIG. 61 is a perspective view of a guide pipe and peripheral elements thereof.

Referring to FIG. 61, the guide cylinder 102*a*'2 is formed with an engaging groove 102*a*'2-1 having a depth in the direction perpendicular to the guide shaft 400. In FIG. 60, a plate part 404*a*1 which is a part of a driving block 404*a* is engaged in the engaging groove 102*a*'2-1 to be slidable, wherein the driving block is supplied with a driving force that freely reciprocates in the shift direction d. Here, the term, "slidable" means that the plate part 404*a*1 can rotate about the guide shaft 400 in the state that it engaged in the engaging groove 102*a*'2-1. Due to this, the engaging groove 102*a*'2-1 is cut in the form of "⊐" and the plate part 404*a*1 is engaged in the engaging groove perpendicularly to the axis.

Figure 66:
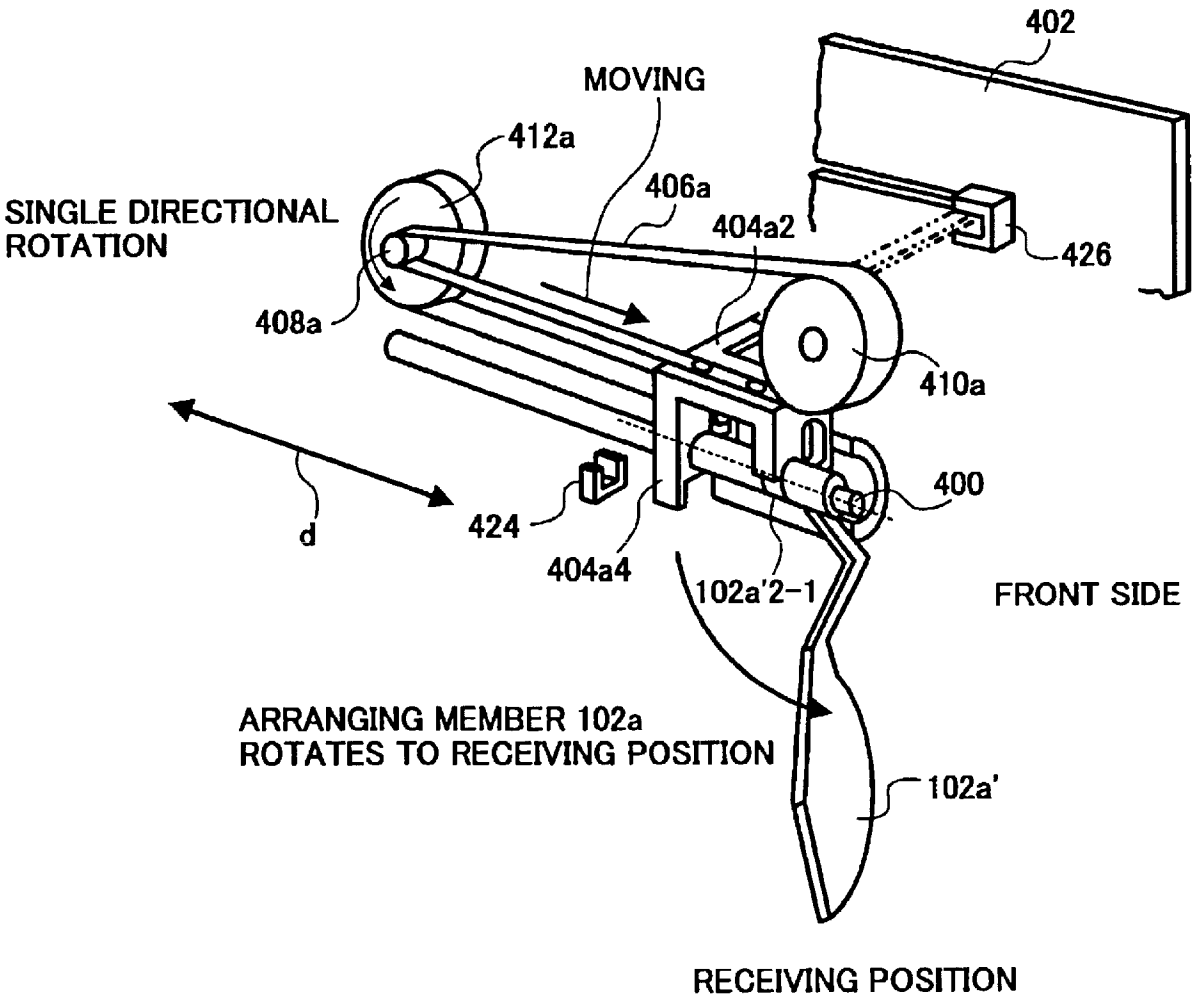
FIG. 66 is a perspective view showing received state of the arranging member.

The depth of the engaging groove 102*a*'2-1 is dimensioned so that the plate part 404*a*1 will not be released from the engaging groove 102*a*'2-1 even if the guide cylinder 102*a*'2 rotates, and the guide cylinder 102*a*'2 rotates about the guide shaft 400 within the limits the engagement state is not released to enable rotation-evacuation to the receiving position of the upstream side in the conveyance direction a on the tray 12 as indicate by the arrow in FIG. 66.

With this engaging relation, the arranging member 102*a*' can be moved to the shift direction by the driving block 404*a*, thereby being able to perform the arranging operation as well as to rotate about the guide shaft 400 and to be displaced to the receiving position by such a rotation, and it is possible to perform the arranging operation, rotating operation to the receiving position and the like by the power transfer from the driving block because the engaged relation with the driving block is maintained even if it performs rotating operation to the receiving position.

Figure 62:
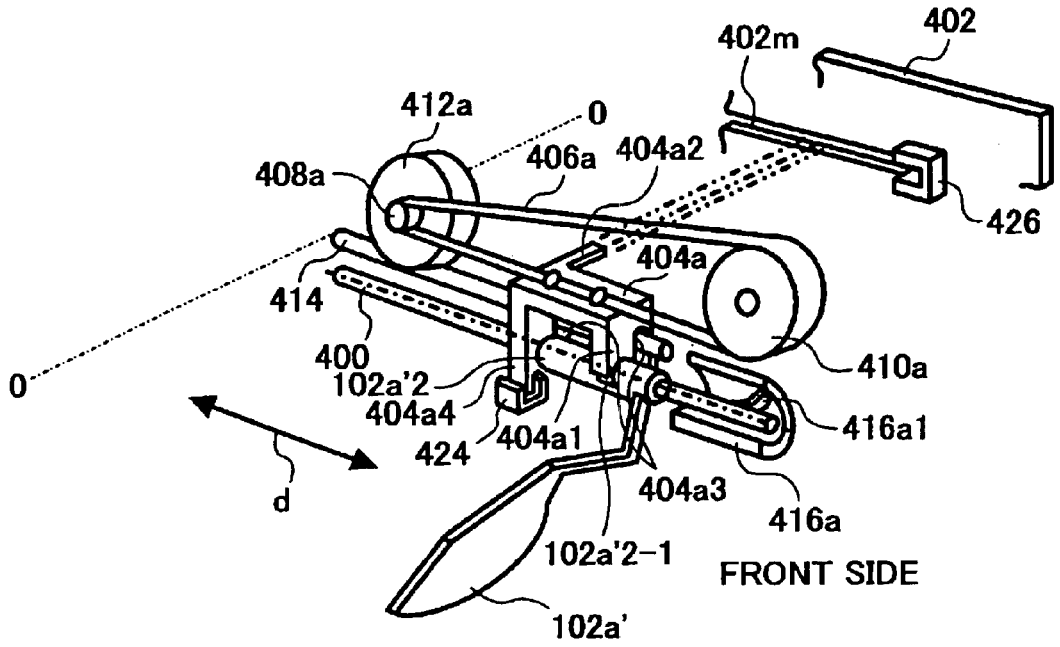
FIG. 62 is an exploded perspective view of a driving device for the arranging member.

As shown in FIG. 62, the upper part of driving block 404*a* is fixed on the belt 406*a*. The belt 404*a* is wound between pulleys 408*a*, 410*a* which are spaced in the shift direction d, the upper part of driving block is fixed on the part of belt 402*a* extended parallel to the guide shaft 400. Although rotation axis of each pulley 408*a*, 410*a* may be optional, it is extended parallel to the centerline of paper conveyance O-O in this example.

The pulley 408*a* is directly connected to the stepping motor 412*a* that can perform forward and reverse rotations, and this stepping motor 412*a* is fixed on an immovable member not shown. The pulley 410*a* is pivotally supported on an immovable member not shown.

The stepping motor 412*a* is positioned adjacent to the conveyance centerline O-O and the pulley 410*a* is positioned outwardly beyond the width of tray 12 on the shift direction d, wherein if the driving block 404*a* is moved as the belt 406*a* is rotated by the driving of the stepping motor 412*a*, the arranging member 102*a*' also moves to the shift direction with the guide cylinder 102*a*'2 because the plate part 404*a*1 is engaged in the 102*a*'2-1. Therefore, by driving the stepping motor 412*a* in the forward and reverse directions, the arranging operation can be performed.

Because the movement of the driving block 404*a* is not stable if the driving block 404*a* is fixed only by the belt 406*a*, an arm 404*a*2 is extended in the direction of conveyance centerline O-O and connected to the guide groove 402*m* formed in the side plate 402 of main body in order to reinforce the stability of movement as shown in FIG. 62.

Description Corresponding Claims 23 and 26

As shown in FIGS. 51 to 54, a box-shaped receiving regions 108*a*, 108*b* for receiving the arranging member 102*a*' within the main body in the outside of the discharging roller 3 forming a discharging means on the shift direction d.

Figure 58A:
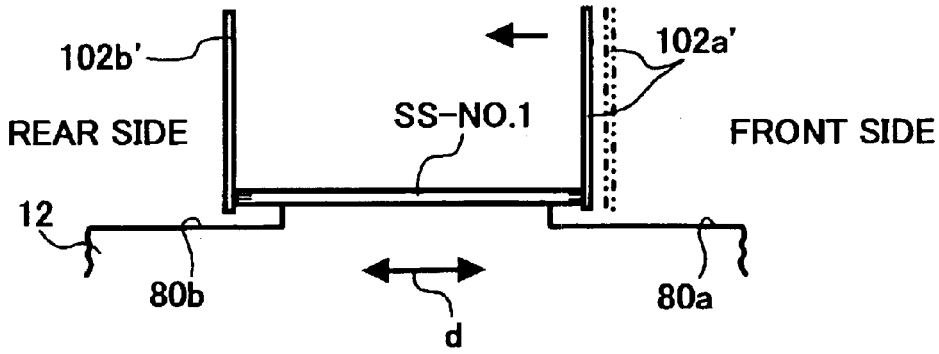
FIGS. 58(*a*), (*b*) and (*c*) sequentially show sorting arranging operations by one side movement mode.
Figure 58B:
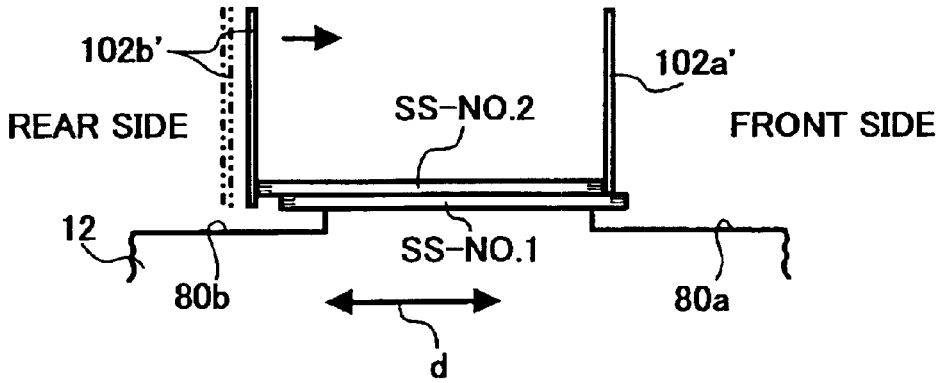
Figure 58C:
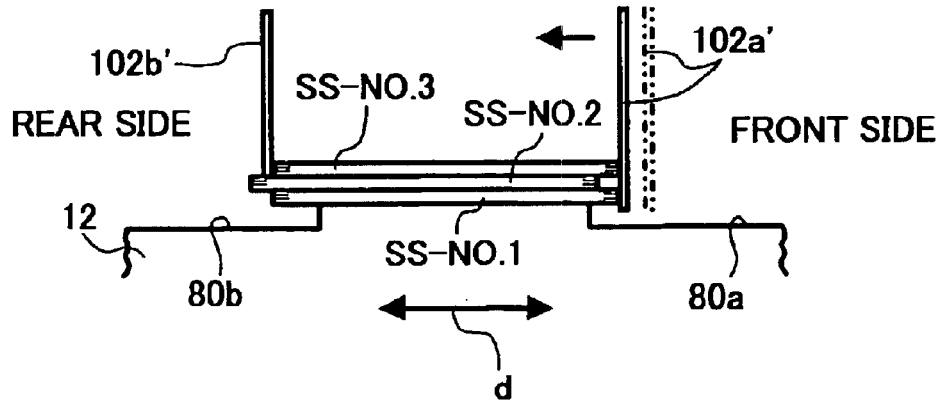

Because the receiving regions 180*a*, 180*b* are formed in the outside of the discharging roller 3, after the termination of arranging operation, it is possible to receive the arranging members 102*a*' 102*b*' in a safe place in the outside of arranging operation region that the arranging members 102*a*', 102*b*' occupy when they perform the arranging operation as illustrated in FIGS. 58 and 50, and the arranging members 102*a*', 102*b*' do not interfere with the driving shaft of discharging roller 3 even if they are evacuated and received on the tray across the discharging roller 3. The outside of arranging operation region has an advantage that it is easy to provide with a receiving region because various members and mechanisms required for the discharging of paper or arranging operation.

Description Corresponding to Claim 24

Here, the space between the receiving regions 180*a*, 180*b* is positioned in the outside of maximum width of sheets, and because the receiving position on the shift direction becomes an operation-starting point of the arranging members 102*a*', 102*b*' if a position on the shift direction corresponding to these receiving regions is set to a home position on the driving operation of the arranging members 102*a*', 102*b*', it is possible to move the arranging members to a receiving position (see FIG. 56) suitable for sheets of different sizes by a simple control.

Description Corresponding to Claim 26

Because the receiving regions 180*a*, 180*b* are provided in the outside of the tray 12 on the shift direction d as shown in FIGS. 51 to 54, the up and down movements of the tray 12 are not disturbed.

Description Corresponding to Claim 27

The tray 12 is shifted between two set-up positions as illustrated in sorting and arranging operations of FIGS. 6 to 9, 58 and 59. The receiving regions 180*a*, 180*b* are located on positions equally spaced from the conveyance centerline O-O. Therefore, when receiving the arranging members 102*a*', 102*b*', the arranging members 102*a*', 102*b*' are adapted to be received in the receiving regions 180*a*, 180*b* after the tray 12 is moved into an optional position between these two set-up positions in order to preclude interference with sorted and arranged sheets. Preferably, the arranging members may be received in the receiving regions 180*a*, 180*b* after the tray 12 is moved to the center position between the two set-up positions.

Description Corresponding to Claim 30

Figure 65:
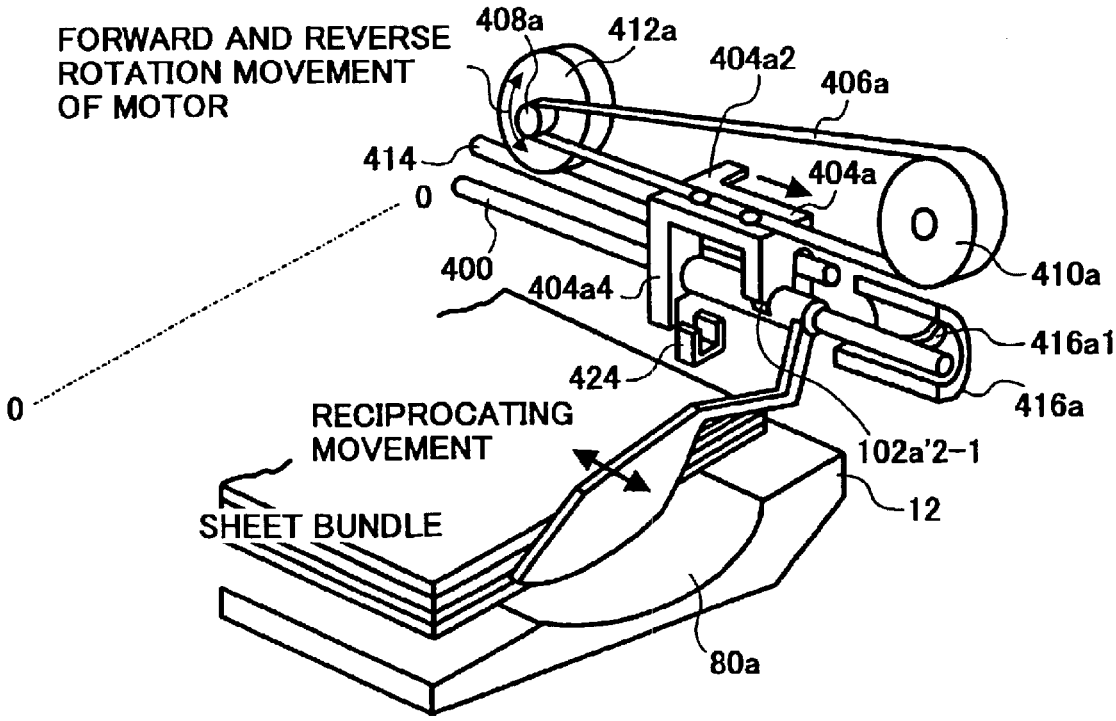
FIG. 65 is a perspective view illustrating arranging operation.

In the arranging operation regions of arranging members 102*a*', 102*b*', the arranging members 102*a*', 102*b*' are rotated about the guide shaft 400 and positioned in arranging rotation positions as shown in FIGS. 58, 59 and 65 or in evacuation positions shown in FIG. 163(*b*), and in the outside of arranging operation regions placed in the positions they are received in the receiving regions 180*a*, 180*b* shown in FIG. 66.

Like this, this example provided the regulating means for regulating the rotating positions of the arranging members 102*a*', 102*b*' in the periphery of the guide cylinder 102*a*'2 in order to obtain a constant rotation state centering around the guide shaft 400.

Description Corresponding to Claims 22 and 31

Said regulating means comprises a fist projection which is a part of means for regulating the rotation of arranging members by self-weight moment in order to lay the posture of the arranging members 102*a*', 102*b*' in the arranging operation regions, in which the arranging members perform the arranging operation, and a second projection engageable to cam grooves (to be explained below) provided in the regions corresponding to the receiving regions 180*a*, 180*b*.

Referring to FIG. 61, said first projection is indicated by symbol 102*a*'2-2 and said second projection is indicated by symbol 102*a*'2-3. All of these first and second projections are formed as pieces or shaft-shaped bodies integrally formed with the guide cylinder 102*a*'2 and projected outwardly from the periphery of the guide cylinder.

Of these two projections, the first projection 102*a*'2-2 is a part of the means for regulating the rotation of arranging member 102*a*' around the guide shaft 400 by self-weight moment. In FIG. 61, the first projection 102*a*'2-2 is positioned upstream of the rotating direction shown by the arrow 413 as the rotating direction of arranging member 102*a*' by self-weight moment and the second projection 102*a*'2-3 is positioned somewhat downstream of the first projection.

In FIGS. 60 and 61, because the first projection 102*a*'-2 run against a weight rod 414, the rotation of the arranging member 102*a*' by self-weight moment is blocked. The weight rod 414 is fitted like a brochette into bores 404*a*3, 404*b*8 formed in the driving blocks 404*a*, 404*b* extended in the vertical direction.

Under the condition that no external force is applied to the weight rod 414, the weight rod 414 is upwardly pushed to and stopped in the upper limit via the first and second projections 102*a*'-2, 102*b*'-2 by the self-weight moment of arranging members 102*a*', 102*b*', and the guide cylinder 102*a*'2 regulates the downward rotation of arranging member 102*a*', thereby taking the arranging rotation position. This is the case with the arranging member 102*b*'. In addition, if the weight rod 414 is downwardly pushed by an external force which is stronger than the self-weight moment of the arranging member 102*a*', it is possible to locate the arranging member 102*a*' in the evacuation-rotation position in the lower limit of bore 404*a*3.

The weight rod 414 provided with a collar-shaped member (not shown) for preventing the positional mismatch so that its position will not be offset in relation to the shift direction d. The weight rod has only a length of the extent that it can be supported by the respective bores 404*a*3, 404*b*3 of the driving block 404*a*, 404*b* when the arranging members 102*a*', 102*b*' are in the arranging rotation position on the shift direction d. This region corresponds to the arranging rotation region and the outside thereof corresponds to the receiving region in position, wherein cam cylinders 416*a*, 416*b* having cam grooves 416*a*1 and 416*b*1 are located in the position corresponding to the receiving region.

When the driving block 404*a* moves to the front side, the first projection 102*a*'-2 is detached from the weight rod 414 and the second projection 102*a*'2-3 is engaged to the cam groove 416*a*1.

By providing the regulating means formed by these two projections, the arranging member 102*a*' can take the arranging rotation position or evacuation- rotation position in the arranging rotation region, and it is possible to rotate the arranging member 102*a*' in the receiving region to introduce it into the receiving regions 180*a*, 180*b*.

The switching of rotational position of the arranging member 102*a*' can be automatically performed merely by moving the driving block 404*a* in the shift direction. Additionally speaking, because the driving block 404*a* is driven by the stepping motor 412*a*, the arranging member 102*a*' can be moved from the arranging operation region to the receiving region by the stepping motor 412*a*. Furthermore, because the stepping motor 412*a* can move the arranging member 102*a*' in the shift direction, i.e., to perform the arranging operation, it is possible to move the arranging member from the arranging region to the receiving region using the driving means that causes the arranging operation to be performed, whereby constructional simplification can be envisaged by using the driving means in common.

In addition, it is possible to automatically realize the arranging rotation position in the arranging rotation region and the received condition in the receiving region.

Description corresponding to claims 32, 33, 36 and 37

Figure 63:
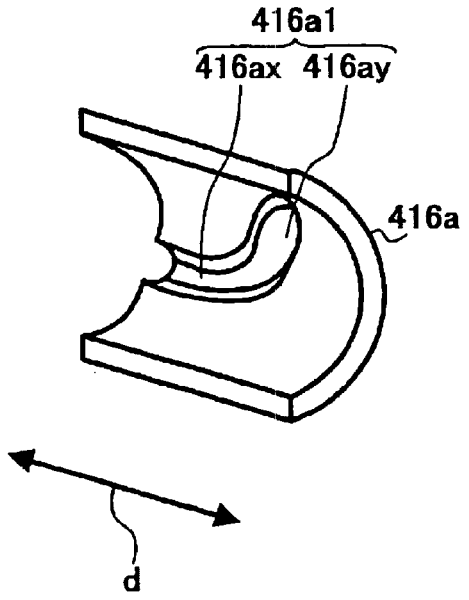
FIG. 63 is a perspective view of a cam pipe.
Figure 64:
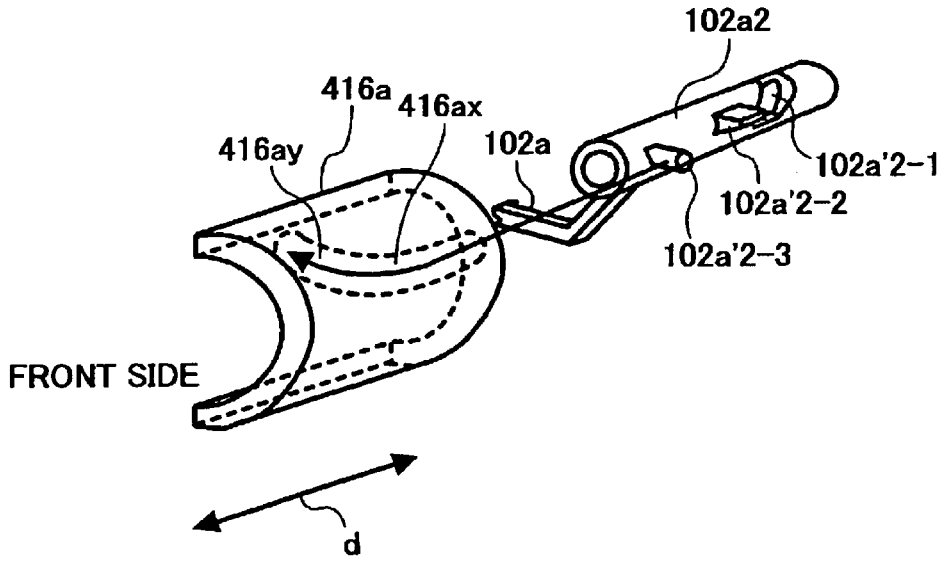
FIG. 64 is an exploded perspective view illustrating connecting relation between the cam pipe and guide pipe.

As shown in FIG. 63, the cam groove 416*a* consists of a straight part 416*ax* extended in the shift direction and a curved S part 416*ay* for rotating the free end side of the arranging member, i.e. arranging part 102*a*'1 toward the receiving region 180*a*.

The arranging member 102*a*', of which the first projection 102*a*'2-2 upwardly pushes the weight rod 414 to take the arranging rotation position when the arranging member performs the arranging operation in the arranging rotation region, takes the evacuation-rotation position after the termination of arranging operation as the weight rod 414 is downwardly pushed by an external force, as shown in FIG. 65, its guide cylinder 102*a*'2 moves toward the front side as the arranging member is driven by the driving block 404*a* which is not shown, and the external force applied to the weight rod is released in the second position just before the cam cylinder 416.

Due to this, the position of the second projection 102*a*'2-3 is determined as the weight rod 414 is upwardly pushed to the upper limit of the bore 404*a*3 by the self-weight moment of arranging member 102*a*'. The second projection 102*a*'2-3 is introduced into the straight part 416*ax*, the first projection 102*a*'2 is separated from the weight rod 414 while the second projection 102*a*'2-3 is still in the straight part as the first projection is additionally moved in the shift direction, then the second projection 102*a*'3 is caught in the curved part 416*ay*, the guide cylinder 102*a*'2 is rotated along the curved cam groove, and the arranging member 102*a*' is rotated to the receiving region.

Because the cam groove 416*a*1 consists of the straight part 414*ax* and the curved part 416*ay*, the first projection 102*a*' can smoothly introduce the second projection 102*a*'3 to the straight part 416*ax* under the condition that the first projection 102*a*'2-2 is regulated by the weight rod 414.

As the premise, the second projection 102*a*'2-3 provided in the guide cylinder 102*a*'2-2 which is integral with the arranging member 102*a*' is adjusted to be in the position that it is consentient with the opening end of the straight part 416*ax* which is the entry part of cam groove 416*a*1, when the solenoid SOL1 which is the urging means for the weight rod 414 is set in OFF state. That is to say, their positional relationship of coupling is determined so that the second projection 102*a*'2-3 comes to the position equal to the opening end of straight part 416*ax* which is the entry part of the cam groove when the weight rod 414 is upwardly pushed to the upper limit of long hole 404*a*3 by the self-weight moment of arranging member 102*a*'. In this manner, the second projection 102*a*'2-3 is smoothly introduced into the cam groove 416*a*1.

In FIG. 60, the weight rod 414 is fitted in the long hole part of lever 418 in the position corresponding to the paper conveyance centerline O-O. The middle part of lever 418 is supported on a fulcrum shaft 420 pivotally supported on an immovable member, thereby freely rotating.

To the free end of lever 418, the plunger of solenoid SOL1 is connected through a spring 421. When the solenoid SOL1 is set to OFF (non-excited), the external force is not substantially applied to the weight rod 414 and the weight rod is lifted to the upper limit of the long hole 404*b*3, because the self-weight moment of arranging member 102*a*' is larger than the weight of weight rod 414. In this situation, the arranging member 102*a*' is in the arranging rotation position.

If the solenoid SOL1 is ON (excited), the weight rod 414 is downwardly pushed to the lower limit of the long hole 404*b*3 because the plunger pulls the free end side of a lever 418, and the arranging member 102*a*' rotates to the evacuation-rotation position because the weight rod downwardly pushes the first projection 102*a*'2-2.

By the urging means using the solenoid like this, the arranging member 102*a*' can be simply and positively switched between the arranging rotation position and evacuation-rotation position.

Description Corresponding to Claim 34

In FIG. 62, the weight rod 414 does not arrives at the region corresponding to the receiving region as the arranging member 102*a*' is mounted in the region corresponding to the arranging operation region, and a sensor 424 is provided to switch the urging means formed by the solenoid to OFF state in the position (second position) just before the guide cylinder 102*a*'2 is introduced into the cam groove 416*a*1.

The driving block 404*a* is provided with a projection 404*a*4, and if the sensor 424 detects this projection 404*a*4, the solenoid SOL1 is turned to OFF.

By automatically displacing the arranging member 102*a*' to the evacuation-rotation position, it is possible to smoothly introduce the second projection 102*a*'2-3 into the cam groove 416*a*1.

Description Corresponding to Claim 35

Referring to FIG. 61, it is possible to positively urge the first projection 102*a*'2-2 by the weight rod. 414 and to certainly locate the arranging member 102*a*'to the arranging rotation position or evacuation-rotation position because the first projection 102*a*'2-2 is located higher than the second projection 102*n*'2-3 and the weight rod 414 and the first projection 102*a*'2-2 are firstly engaged in the arranging operation region at which the weight rod arrives.

Description Corresponding to Claim 38

Because the arranging member 102*a*' is displaced to the receiving region while rotating, it is difficult to directly and certainly detect the displacement to the received position. Therefore, in this example, the condition that the second projection 102*a*'2-3 arrives at the curved part 416*ay* is indirectly considered as the condition that the arranging member 102*a*' is in the receiving region. Due to this, the arm 404*a*2 protruded from the driving block 404*a* is used and the sensor is adapted to detect the arm 404*a*2 as shown in FIG. 62, and the time when the second protrusion 102*a*'2-3 arrives at a proper position in the curved part 416*ay* and the arranging member 102*a*' arrives at a desired receiving region and the time when the arm 404*a*2 is detected by the sensor 426 are made to be conformed. By this, although indirect, it is possible to electrically detect whether the arranging member 102*a*' arrives at the receiving region, e. Specific Example of Sorting Operation and Receiving Operation of Arranging Member e-1. Sorting Operation When the sorting and arranging operations are performed in the both side-movement mode illustrated in FIG. 69, the stepping motors 412*a* and 412*b* (stepping motor for rear side which is not shown) rotate in the forward and reverse directions relative to the sheets discharged from the discharging roller S and piled on the tray 12 under the OFF state of solenoid SOL1 so that the arranging members 102*a*', 102*b*' will jog in the shift direction of sheets, as shown in FIG. 65, whereby the so called crosswise arranging of sheets are performed (corresponding to FIG. 59(*a*)).

Next, the tray 12 is shifted toward the front side in direction indicated by the arrow on the shift direction d so that the positions in which discharged sheets are piled are to be inconsistent before the sheets of next job are discharged. At this time, however, the arranging members 102*a*', 102*b*' are rotated to be in the evacuation position in the upward rotating direction and then evacuated from the sheet-shaped surface by setting the solenoid in the ON state so that the arranging members 102*a*', 102*b*' and a bundle of sheets piled on the tray 12 are not touched with each other.

After the tray 12 is shifted, the arranging members 102*a*', 102*b*' which were in the evacuation rotation position are returned to the arranging rotation position that they arrange sheets, in order to arrange the sheets of next job by setting the solenoid to the OFF state.

By this, it is possible to lay the arranging member 102*a*', which is in the Bide of tray 12 already piled with sheets, on the top surface of a bundle of sheets, and to position the other arranging member 102*b*' on a side surface of said bundle of paper (corresponding to FIG. 59(*b*)).

This is possible because the rotation of arranging member 102*a*' is not regulated in the direction that the first projection 102*a*'2-2 is released from the weight rod 414 in FIG. 61. In this position, if the arranging members 102*a*', 102*b*' are jogged in the shift direction d, it is possible to perform the arranging operation in relation to the discharged sheets of next job in the direction perpendicular to the paper conveyance direction. By repeating a series of these operations, arranging operation in the sorting mode is performed (corresponding to FIG. 59(*b*)).

e-2. Receiving Operation

If the printing for sheets, the number of which were designated by the user, are terminated, the arranging members 102*a*', 102*b*' are moved away each other on the shift direction as shown in FIG. 66, and if the arm 402*a*2 moves to the sensor 426 for detecting the home positions of respective arranging members 102*a*, 102*b*, and is detected by the sensor 426, the rotation of stepping motor 412*a* is stopped. By this time, the arranging members are displaced into the receiving region 180*a* as shown in FIG. 66.

Although the case that the arranging members 102*a*', 102*b*' are downwardly rotated for receiving was disclosed in the above examples, it is possible to implement in the type that the arranging members are upwardly rotated for receiving.

g. Example of Control Using Control Means

Because this corresponds to that shown FIG. 46 in the first invention, description will be omitted in part.

Following flowchart shows only the parts related to the present invention in the sheet-shaped medium after-treatment apparatus. Also herein, the arranging member 102*a*' of front side will be described and the description regarding to the arranging member 102*b*' of rear side will be omitted because the latter corresponds to the former. By setting the main switch, which colligates the image forming apparatus 50 and the sheet-shaped medium after-treatment apparatus 61 of FIGS. 61 and 62, to ON and thus selecting the sorting mode, the following control is performed.

Figure 67A:
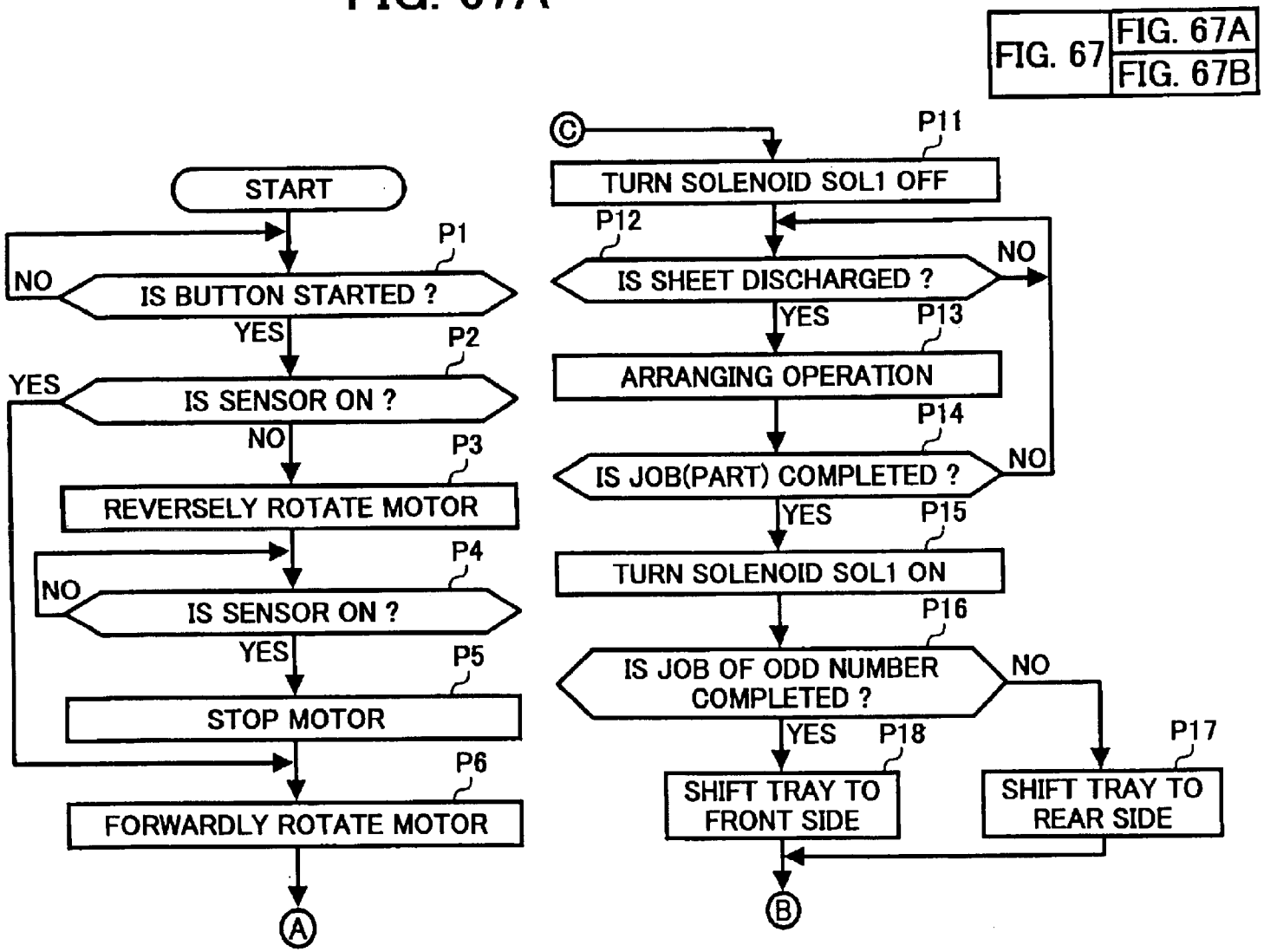
FIG. 67 is a flowchart for shift arranging of paper.
Figure 67B:
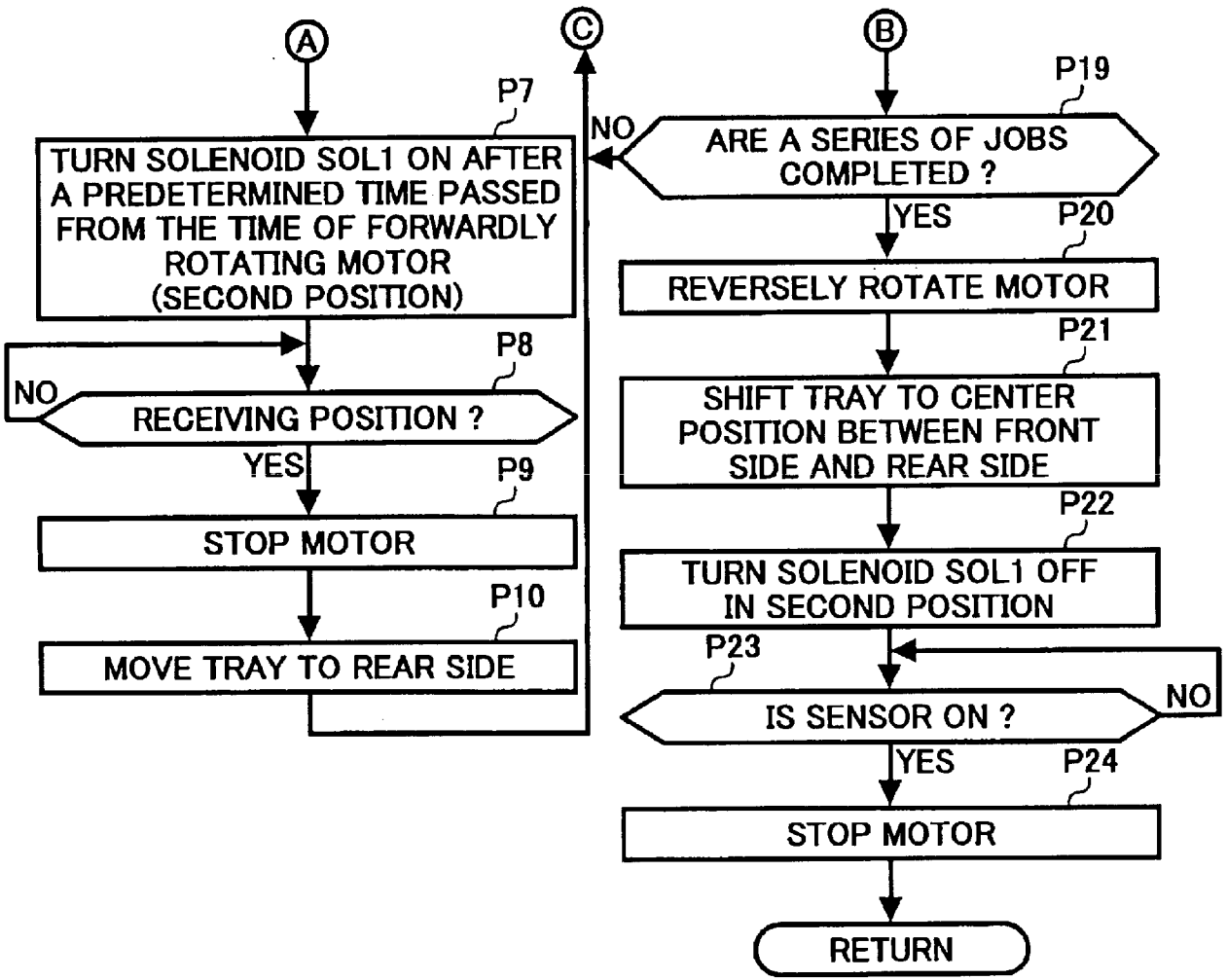

In FIG. 67, if the start button of image forming apparatus 50 is turned to ON (STEP P1), it is judged whether the arranging member 102*a*' is received as shown in FIG. 66 in the receiving region 180*a* on the basis of whether the sensor 426 is turned to ON or not (STEP P2).

If the arranging member 102*a*' is in the receiving region, it proceeds to STEP P3. If the arranging member 102*a*' is not in the receiving region, the stepping motor 412*a* is reversely rotates in the STEP PS and stopped at the time when the sensor 426 is turned to ON for detecting the home position (STEP P4, STEP P5).

If the arranging member 102*a*' comes to the home position in this way, the stepping motor 412*a* forwardly rotates, thereby moving the driving block 404*a* toward the conveyance centerline O—O of sheets (STEP P6).

At a desired time (second position) after stepping motor 412*a* started the forward rotation, i.e., at a point of time that the sensor 424 detects the projection 404*a*4, the solenoid SOL1 is turned to ON. In this manner, the arranging member 102*a*' is rotated to the evacuation-rotation position and can avoid the interference with the sheets piled on the tray.

If the arranging member 102*a*' arrives at the receiving position (see FIG. 56) by pulse count of stepping motor 412*a* (STEP P8), the motor is stopped (STEP P9).

Here, the tray 12 is shifted to the rear side (STEP P10). This is to make it easy to take out the sheets on the tray in the after-treatment of the type that the operator is positioned in the front side.

In STEP P11, the solenoid SOL1 is turned to OFF to lay the arranging member 102*a*' in the arranging rotation position, the arranging operation is performed by forwardly and reversely rotating the stepping motor 412*a* each time a paper is discharged after standing by the discharging of sheets and these processes are repeated until the job is terminated. (STEP P12, STEP 13, STEP 14, FIG. 65).

When the job was terminated, the solenoid SOL1 is turned to ON to lay the arranging member 102*a*' in the evacuation-rotation position, then the tray 12 is shifted to the front side for the sorting and arranging operations of next job if an odd number job was completed (STEP P18) whereas the tray 12 is shifted to the rear side in STEP 17 if an even number job was completed.

In STEP P18, it is checked whether a series of jobs were completed or not. If a series of jobs were not completed it proceeds to STEP P11 for arranging next sheets, and if a series of jobs were completed, the stepping motor 412*a* is reversely rotated to move the arranging member 102*a*' to the front side (receiving region side) in STEP 20 and the tray is moved to the middle position, preferably to the center (point) position in STEP P21. This is to avoid the interference between the end of tray 12 in the shift direction and the arranging member 102*a*' when the arranging member 102*a*' is lowered from the second position.

In the second position that the sensor detects the projection 404*a*4, the solenoid SOL1 is turned to OFF (STEP P22) to lower the arranging member 102*a*' to the arranging rotation position and also to move it to the front side, the second projection 102*a*'2-3 is introduced to the straight part 416*ax*, and furthermore if the second projection arrives at the curved part 416*ay* and thus the arranging member 102*a*' arrives at the receiving region (STEP P23), the stepping motor 412*a* is stopped (STEP P24) and retracted to return.

[2] Example Applied to Image Forming Apparatus

Figure 68:
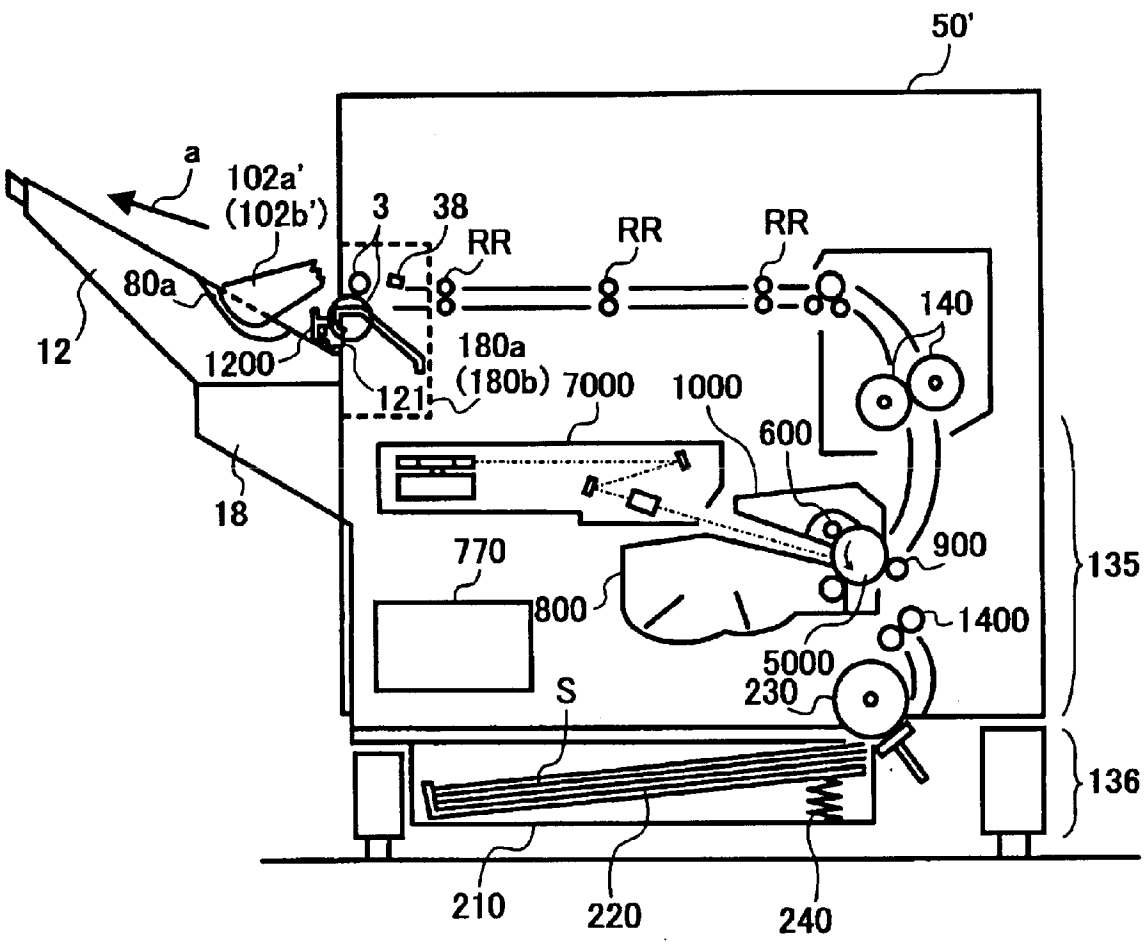
FIG. 68 is a schematic diagram of the image forming apparatus with the sheet-shaped medium aligning apparatus having arranging member receiving function.

FIG. 68 shows the image forming apparatus related to the second aspect of the present invention, and because it corresponds to that shown in FIG. 48 in the first aspect of the present invention, description will be omitted.

Figure 69:
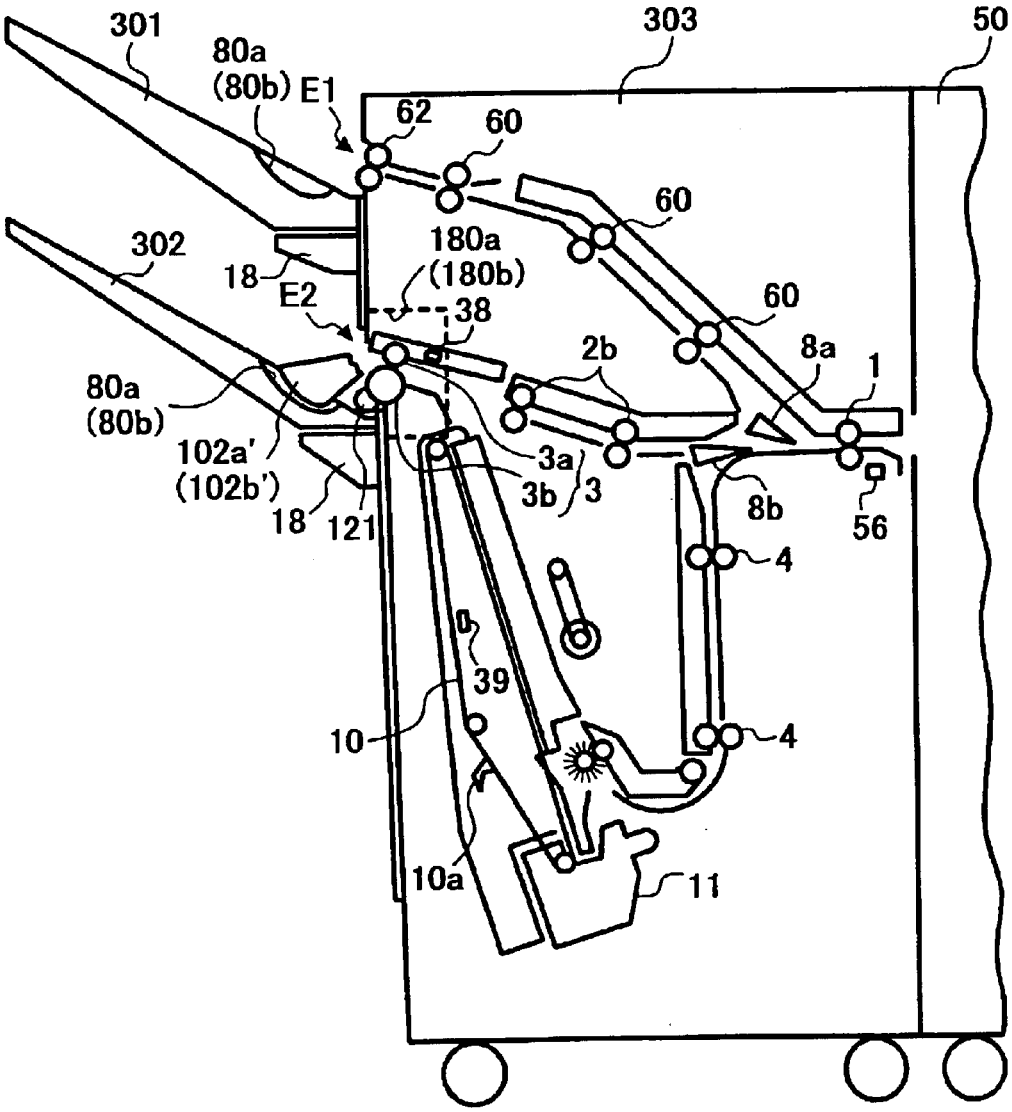
FIG. 69 is a schematic diagram of the sheet-shaped medium after-treatment apparatus having a plurality of tray movable up and down, with the sheet-shaped medium aligning apparatus having arranging member receiving function.
Figure 70:
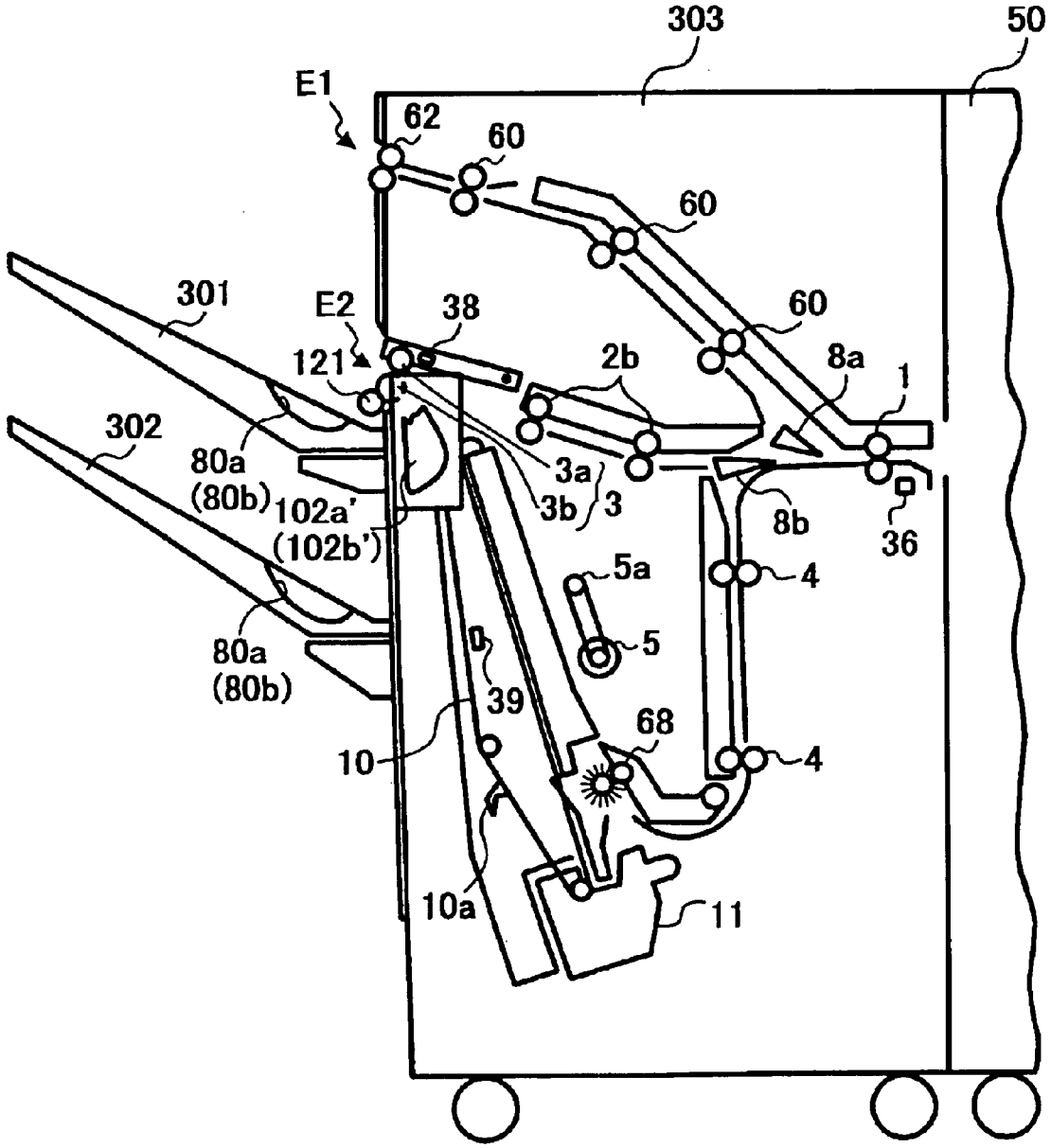
FIG. 70 is a schematic diagram of the sheet-shaped medium after-treatment apparatus having a plurality of tray movable up and down, with the sheet-shaped medium aligning apparatus having arranging member receiving function.
Figure 71:
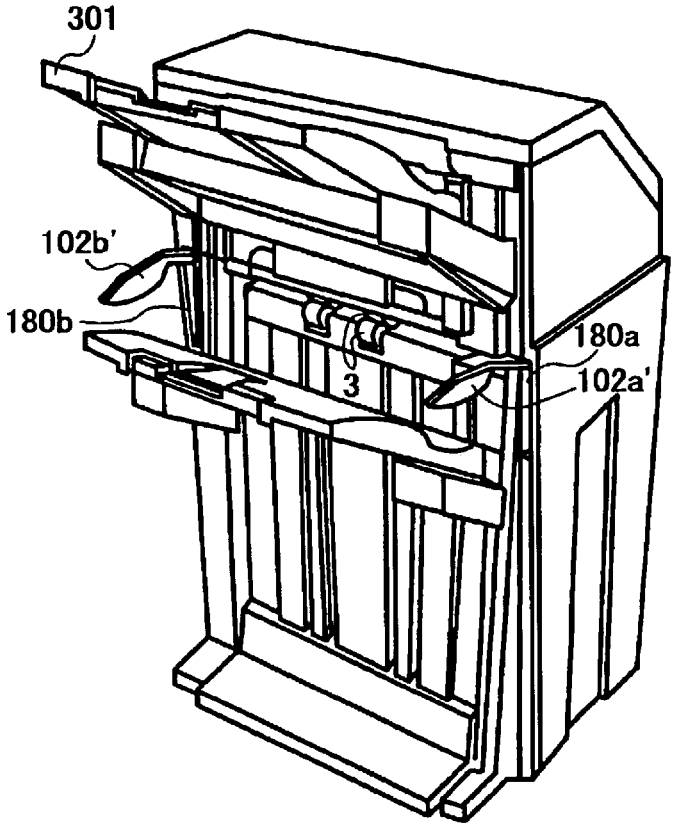
FIG. 71 is a perspective view of the sheet-shaped medium after-treatment apparatus having a plurality of tray movable up and down, with the sheet-shaped medium aligning apparatus having arranging member receiving function.

[3] Application to After-treatment Apparatus of the Type that Piling Means Moves Up and Down Through Discharging Means FIGS. 69 to 71 show the after-treatment apparatus related to the second aspect of the present invention, and because it corresponds to that shown in FIGS. 49 and 50 in the first aspect of the present invention, description will be omitted.

Figure 72:
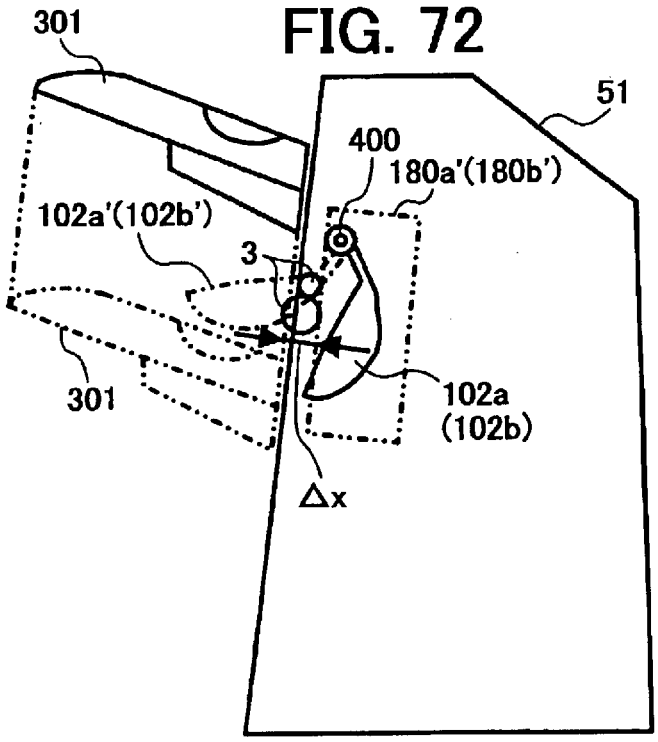
FIG. 72 shows position of the arranging means in the sheet-shaped medium after-treatment apparatus having a plurality of tray movable up and down, with the sheet-shaped medium aligning apparatus having arranging member receiving function.

Referring to FIG. 72, in the type that the tray 301 moves up and down through the discharging roller 3, there is no problem in the type that the receiving regions for receiving the arranging members 102*a*', 102*b*' and the like are provided on the outside of the width of tray in view of shift direction, but if the receiving regions are provided in the inside of the width of tray, it is intended that the receiving regions 180*a*, 108*b* for arranging members 102*a*', 102*b*' are to be provided in the inside of body more inwardly than the distance ΔX which must be secured as a path for up and down movements of tray 301.

(The Third Invention)

[1] Sheet-shaped Medium After-treatment Apparatus a. Summary of Sheet-shaped Medium After-treatment Apparatus In connection with the first aspect of the present invention, a simple piling mode is prepared for merely piling without sorting sheets.

b. Tray and Tray-moving Means as Sorting Means

It is intended to extensively apply the normal mode of first aspect of the present invention to the sorting mode and simple piling mode.

Furthermore, following is added to the first aspect of the present invention.

In the simple piling mode, sorting mode, staple mode, and the all of other modes related to after-treatment, sheets 2 each discharged from the discharging roller 3 in a proper reference height are discharged onto the tray 12, and the tray 12 is lowered as the sheets are accumulated and eventually its position of lower limit is detected by a lower limit sensor. In addition, when lifting the tray 12, it is lifted to the reference height on the basis of paper information detected by positioning means such as paper sensors 130*a*, 130*b*, a paper surface lever 1200 and the like.

In order to perform the sorting operation, the tray 12 is supported to be slidable on the die pedestal 18 so that it moves to one end side of shift direction depicted by the symbol b in FIG. 5(*a*), then to the other end side, and it moves from the one end to the other end side again.

Herein below, the tray-moving means 98 will be explained.

Referring to FIG. 5, in order to perform the sorting operation, the tray 12 goes to one side in the shift direction d, then returns to the other side, and is further shifted to move from the other side to the one side. If the operation unit at the time when a predetermined number of sheets forming a job, which is a sorting unit, are treated is assumed as one job, the tray 12 is not shifted in the shift direction d in a same job, and the tray 12 is moved in the shift direction d every time one job is terminated and receives the discharged sheets included in the next job at the moved end of one direction.

Every time a paper is discharged and piled on the tray, paper returning operation and arranging operation by the arranging member 102*a*, 102*b* are performed. Furthermore, in the sorting mode, if the final paper of a job is piled, the sorting operation by the movement of tray 12 in the shift direction d is performed.

c. Arranging Operation

Following is added to the first aspect of the present invention.

The pair of arranging member 102*a*, 102*b* forming the arranging means are formed from a plate-shaped body, the arranging parts 102*a*1, 102*b*1 provided in the free end sides are positioned in the lowermost parts of free end sides in the arranging members 102*a*, 102*b*, and their opposite sides are formed in flat surfaces perpendicular to said shift direction d.

In the front arranging member 102*a*, the upper part of arranging part 102*a*1 is bent to the front side and expanded, thereby forming a relief part 102*a*2, and likewise in the rear arranging member 102*b*, the upper part of the arranging part 102*b*1 is bent to the rear side and expanded, thereby forming a relief part 102*b*2. The distance between these opposite relief parts 102*a*2 and 102*b*2 are larger than the distance between the arranging parts 102*a*1 and 102*b*1, thereby preventing the sheets discharged from the discharging roller 3 from running against arranging members 102*a*, 102*b*.

(1) One Side Movement Mode

[First Job], [Second Job], [Third Job]

(2) Both Side Movement Mode

[First Job], [Second Job], [Third Job]

Figure 75:
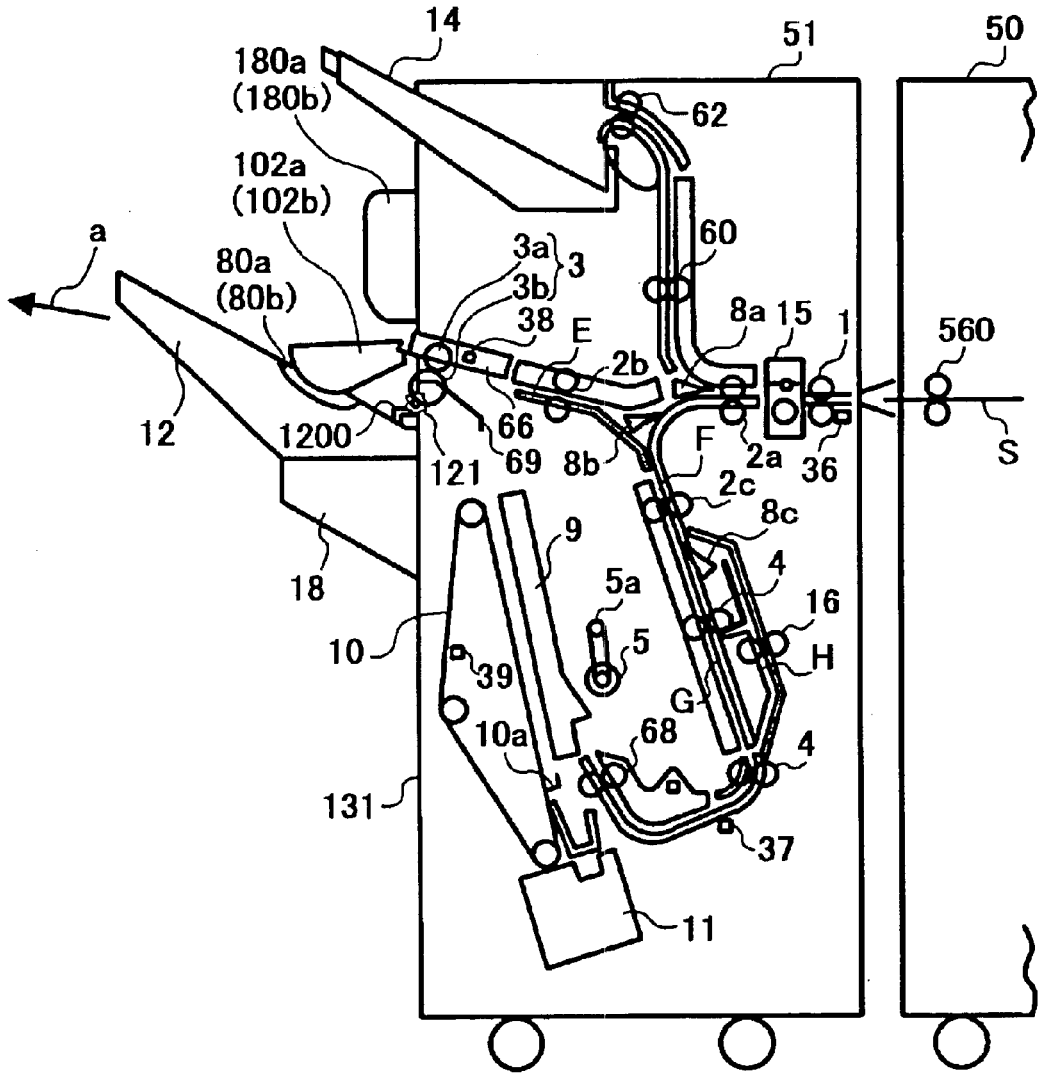
FIG. 75 is a schematic perspective view of the sheet-shaped medium after-treatment apparatus and image forming apparatus.

The above items are substantially identical to the first aspect of the present invention except the above. Furthermore, FIGS. 1 to 4 in the first aspect of the present invention substantially corresponds to FIGS. 78 to 75 in the third aspect of the present invention. Therefore, it is intended that the former may be properly applied in substitution to the latter.

d. Example of Construction for Rotationally Displacing Arranging Members

Figure 74:
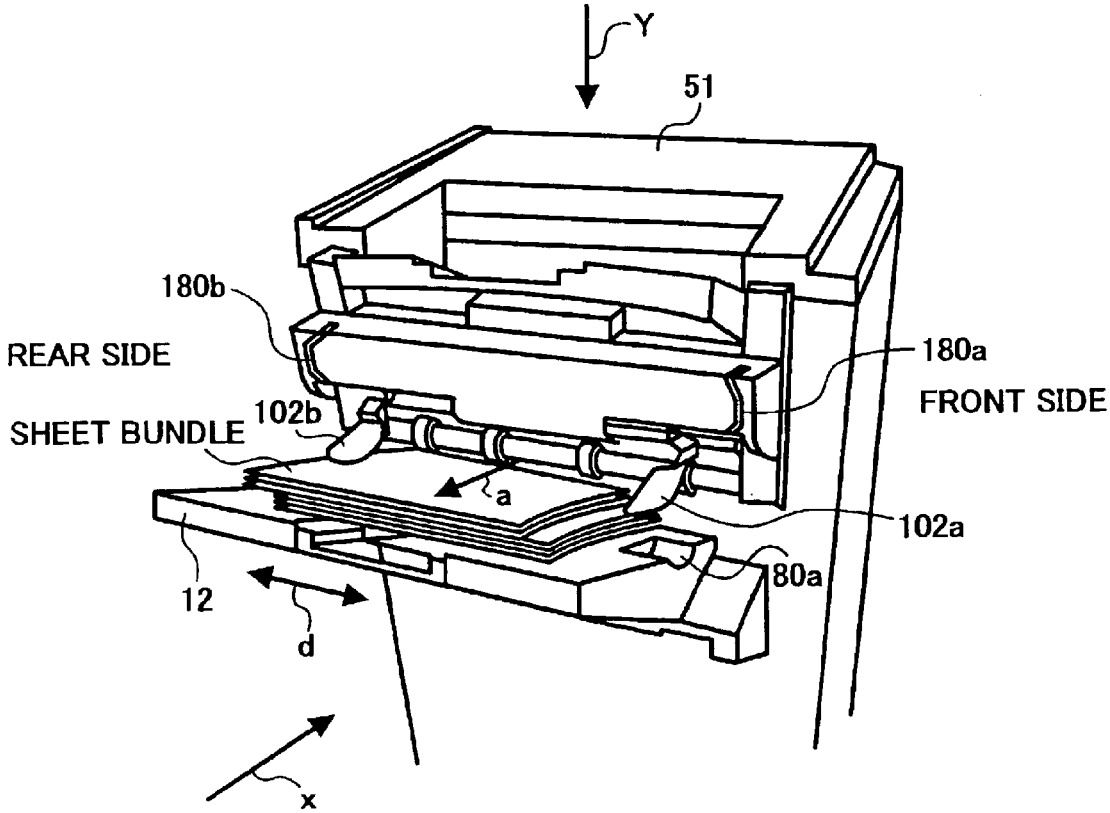
FIG. 74 is a partial perspective view of the sheet-shaped medium after-treatment apparatus seen from upper oblique position.
Figure 76:
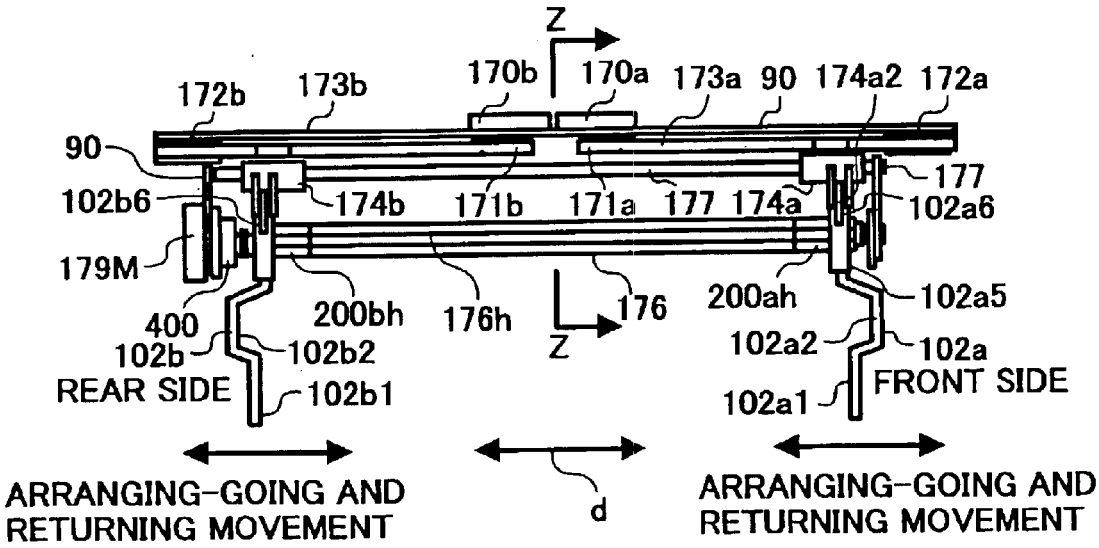
FIG. 76 is a front view of means for moving the arranging member.
Figure 77:
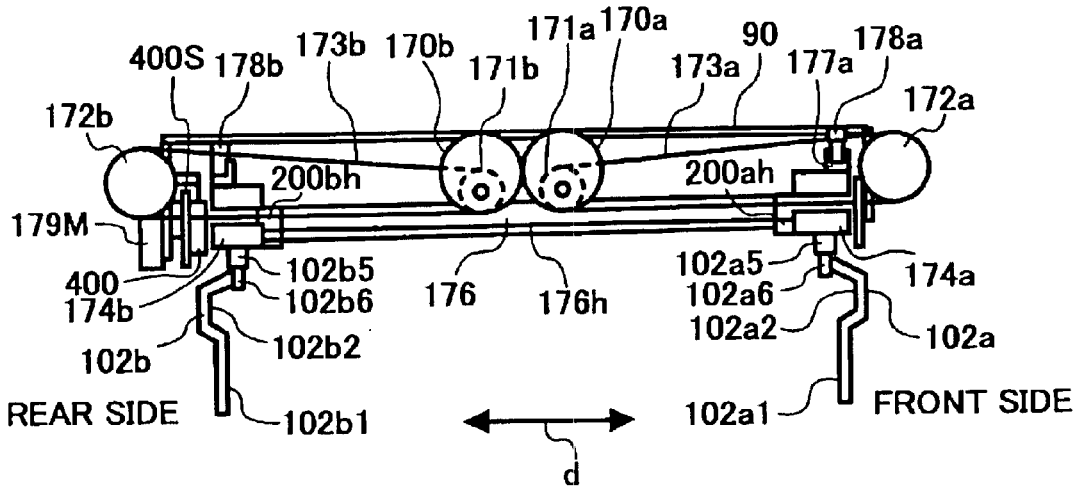
FIG. 77 is a top view of means for moving the arranging member.
Figure 78:
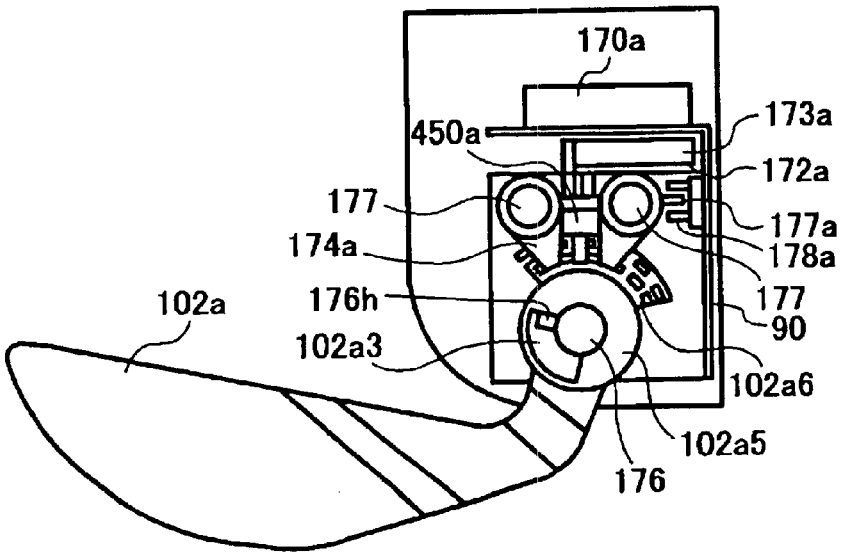
FIG. 78 is a sectional view of means for moving the arranging member.

FIG. 76 is a view showing the driving means for the central arranging member of sheet-shaped medium after-treatment apparatus shown in FIG. 74 depicted in the direction of arrow X, i.e., in the downstream side of discharging direction a, FIG. 77 is a view of the same depicted in the direction of arrow Y, and FIG. 78 is a cross-sectional view of the driving means for the arranging member depicted in the direction of arrow Z.

Following description is substantially identical to the first aspect of the present invention except those added to the first aspect of the present invention.

The arranging member 102*b* is also likely provided with encoders 102*a*6, 102*b*6, wherein a plurality number of slits are formed in each of the encoders 102*a*6, 102*b*6. In connection with the arranging member 102*a*, these slits can be detected by a posture detecting sensor 460*a* mounted on an abutment 174*a*, and in connection with the arranging member 174*b*, they can be detected by a posture detecting sensor 450*b* (not shown) mounted on an abutment 174*b*, whereby each the arranging members 102*a*, 102*b* are adapted to be independently detected in their postures.

Figure 79B:
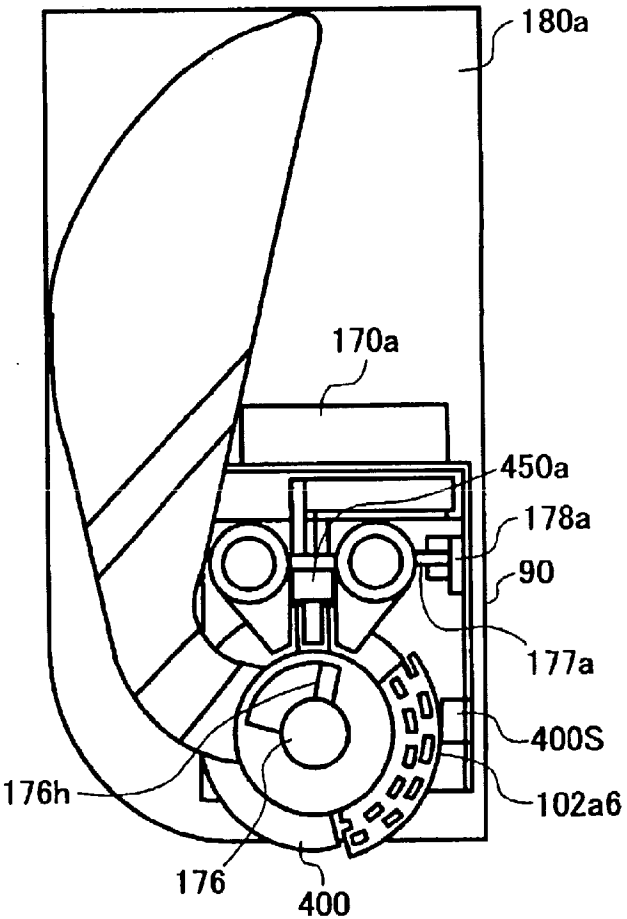
FIG. 79(*a*) shows a status where the arranging member is in rotating position for arrangement, and FIG. 79(*b*) shows a status where the arranging member is in rotating position for receiving.
Figure 79A:
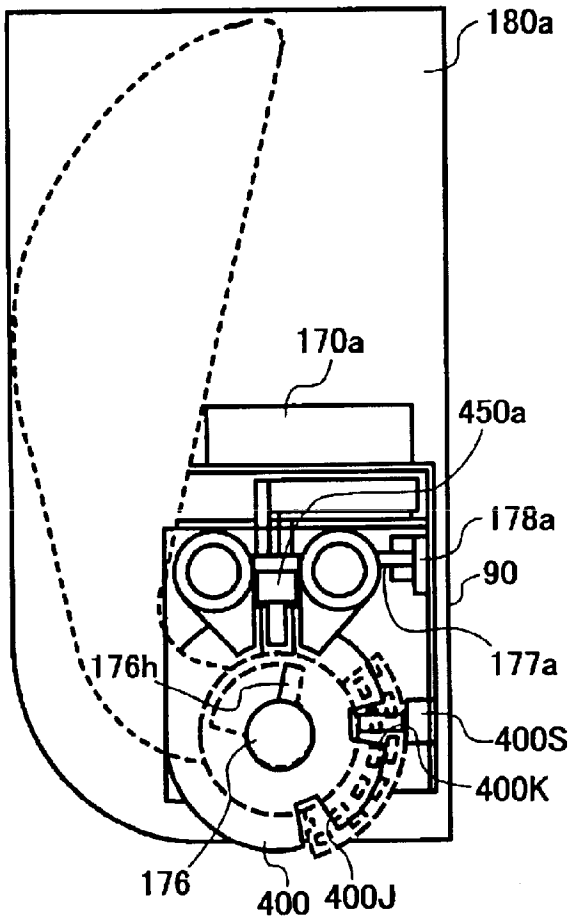
Figure 80A:
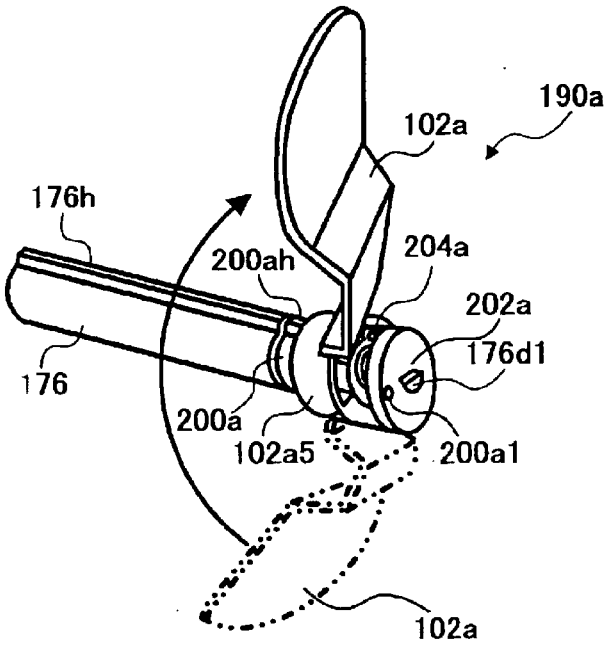
FIG. 80(*a*) is a partial sectional view showing the arranging member in rotating position for arrangement with relation to a convex plate, and FIG. 80(*b*) is a partial sectional view showing the arranging member in rotating position for arrangement with relation to reception a detecting encoder.
Figure 80B:
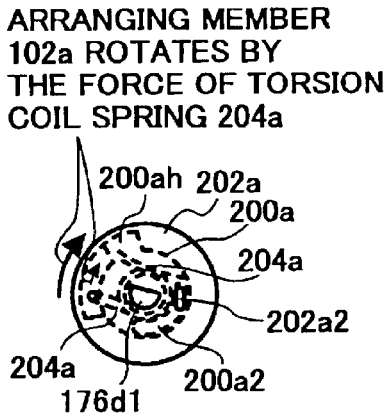

In FIGS. 76, 77, 79 and 80, the sliding shaft 176 is provided with a disc-shaped reception-detecting encoder 400 at the rear side axial end and the axial end is directly connected to the shaft of stepping motor 179M. The reception-detecting encoder 400 is formed with two slits 400J, 400K on its circumference, and the sensor 400*s* mounted on the bracket 90 detects these slits to control the rotating amount of rotating-sliding shaft 176 by the stepping motor 179M, and on the condition that the arranging member is in the home position, the home sensor 178*a* detects the actuator 177*a*, whereby it is possible to rotate the arranging member 102*a* to the receiving rotation position provided within the receiving space 180*a* in the main body as shown in FIG. 79. It is also possible to lay the arranging member in the arranging rotation position as shown in FIG. 80.

Furthermore, it is possible to set the position of the arranging members 102*a*, 102*b* to an optional rotation position by counting the rotating direction and amount of the stepping motor 179M on the basis of receiving rotation position or arranging rotation position of arranging members. For example, according to the curl condition of sheets, it is possible to set the position to the evacuation-rotation position that the arranging members cannot be lowered to the sheets. As shown in FIGS. 79 and 80, the slit 400K is used for detecting the receiving rotation position and the slit 400J is used for detecting the receiving rotation position.

In addition, the arranging members are rotated by 90° in the clockwise direction in the receiving rotation position in FIG. 79 as compared to the arranging rotation position shown in FIG. 80 and received in the receiving spaces 180*a*, 180*b* in the main body. Here, the main body as an object, in which the receiving spaces 180*a*, 180*b* are provided, means the sheet-shaped medium aligning apparatus, and because it is integrally constructed with the sheet-shaped medium after-treatment apparatus 51 in this example, it can be said that it is formed in the sheet-shaped medium apparatus 51 (see FIGS. 78 to 75).

Like this, by driving the stepping motor 179M, the rotating-sliding shaft 176 rotates and the rotating positions (postures) of arranging members 102*a*, 102*b* are varied. That is, if the convex part 176*h* rotates in the clockwise direction together with the rotating-sliding shaft 176 in FIG. 78, it is possible to realize the evacuation-rotation position corresponding to FIG. 163(*b*) and the other rotation position by rotating the arranging member 102*a* in the clockwise direction in the form of urged rotation under the condition that the convex part 176*h* is contacted to the abutting part in the gap part 102*a*3.

Like this, the rotating-sliding shaft 176 serves as the center axis for the rotating movements of arranging members 102*a*, 102*b*, has a function for transferring rotating movements in the arranging rotation position, evacuation-rotation position, receiving rotation position and the like to these arranging members 102*a*, 102*b*, and also serves as a guide for moving these arranging members 102*a*, 102*b* in the shift direction d.

By driving the stepping motors 104*a*, 104*b*, it is possible to move the arranging members 102*a*, 102*b* to each position such as the home position shown in FIGS. 10 and 11, receiving position shown in FIG. 12 and arranging position shown in FIG. 12 using the guide function of the rotating-sliding shaft 176.

e. Safety Mechanism

Because this corresponds that shown in FIG. 1 of the first aspect of the present invention, description will be omitted in part.

In this third aspect of the present invention, the height of sheets discharged onto the tray 12 is detected by the positioning means 96, and the height of tray is controlled by the tray lifting means 95, so that it is to be in a predetermined position, i.e. the distance from the discharging means to a sheet-shaped surface is to be in a range suitable for discharging sheets. In a simple piling mode, the stepping motors 170*a*, 170*b* are driven each time a paper is discharged, whereby the arranging operation by the arranging members 102*a*, 102*b* is performed. Furthermore, in the sorting mode, the tray moving means 98 is further driven by the motor 44 and the evacuating operation by the stepping motor 179M is also performed, whereby sorting and arranging operations illustrated in FIGS. 10 to 14 are performed.

[2] Embodied Aspect of each Claim a. Embodiment Corresponding to Claim 42

At the time of arranging operation, if the posture of arranging member 102*a* (102*b*) in the arranging rotation position is always constant as shown in FIG. 163(*a*), it may be occasionally impossible to perform the arranging operation because the arranging part 102*a*1 (102*b*1) of the arranging member 102*a* (102*b*) may not contact with the end of paper depending on a direction and dimension of a curl of paper piled on the tray 12.

Figure 81A:
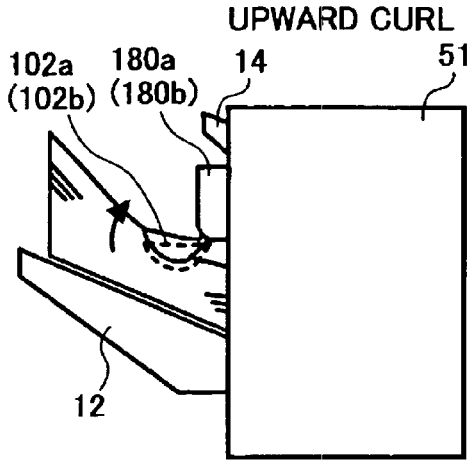
FIG. 81(*a*) shows a state when the arranging member incurs arrangement defection when upward curling occurs, and FIG. 81(*b*) shows a state when the arranging member incurs arrangement defection when downward curling occurs.
Figure 81B:
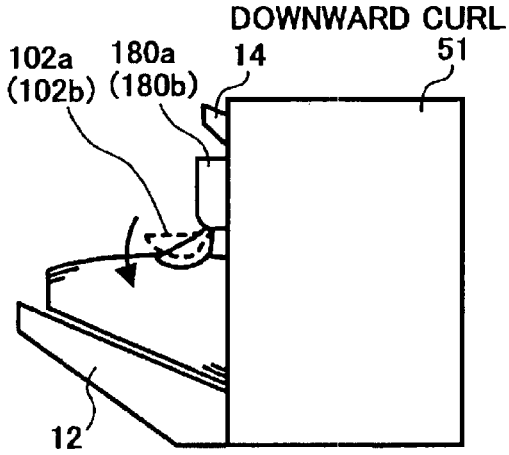

That is, although the positioning means 96 (see FIG. 5) controls the height of top surface of paper to a certain range, if the curl of paper is large, the position detected by the paper surface lever 1200 and the position of arrangement member 102*a* (102*b*) are discrepant, whereby the arranging operation cannot be performed if the paper is downwardly curled as shown in FIG. 81(*b*) because the arranging member 102*a* (102*b*) passes past the end of paper as it is, and if the paper is upwardly curled as shown in FIG. 81(*a*) because the relief part 102*a*2 (102*b*2) (see FIG. 10) corresponds to the end of paper to be arranged.

Therefore, according to the present invention, the rotation is transferred to the rotating-sliding shaft 176 by the driving of stepping motor 179M as already illustrated in FIGS. 76, 77 and 78, thereby rotating the arranging members 102*a*, 102*b* on the shaft 176 so that the posture is made to be displaceable. By controlling the driving amount of stepping motor 179, it is possible to optionally control the rotation position, and to adjust the posture of arranging members.

That is, it is possible to rotate the arranging members 102*a*, 102*b* together with the rotating-sliding shaft 176, and if the arranging members 102*a*, 102*b* is made to jog (reciprocating movement in the shift direction d) by driving the stepping motors 170*a*, 170*b* in the state that the rotating-sliding shaft 176 is stopped in an optional position, it is possible to perform the arranging operation while maintaining said optional posture.

For example, when the paper discharged onto the tray 12 is upwardly curled as shown in FIG. 81(*a*), the arranging part 102*a*1 (102*b*1) can be contact to the end of paper by rotating the rotating-sliding shaft 176 so that the arranging members are to be upwardly directed from the default position indicated by the dashed line, stopping it in the rotation position that the relief part 102*a*2 (102*b*2) is apart from the end of paper to be arranged and the arranging part 102*a*1 (102*b*1) is positioned on the end of paper to be arranged, and then allowing the arranging member 102*a* (102*b*) to jog.

In addition, when the paper discharged on the tray 12 is downwardly curled as shown in FIG. 81(*b*), the arranging part 102*a*1 (102*b*1) can be contacted to the end of sheet, by rotating the rotating-sliding shaft 176 so that the arranging members are to be downwardly directed from the default position indicated by the dashed line, stopping it in the rotation position that the arranging part 102*a*1 (102*b*1) is positioned on the end of paper to be arranged, and then allowing the arranging member 102*a* (102*b*) to jog.

In this way, it is possible to perform the arranging operation by the arranging members regardless of curled state of paper because the posture can be adjusted to the arranging position that the end of paper can be caught.

b. Embodiment Corresponding to Claim 43

Figure 82:
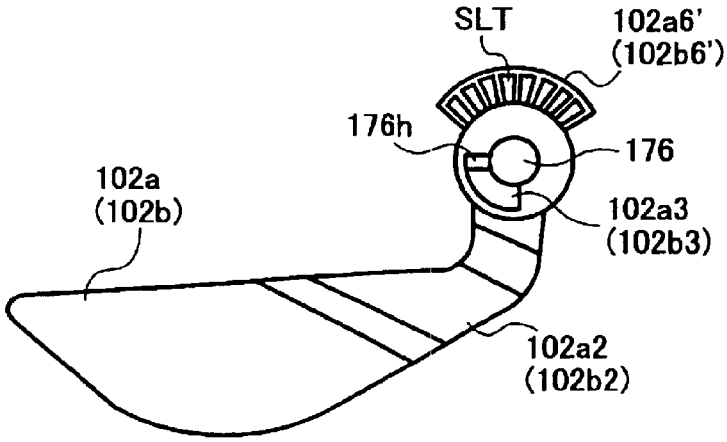
FIG. 82 shows a convex plate for detecting posture of the arranging member.
Figure 83:
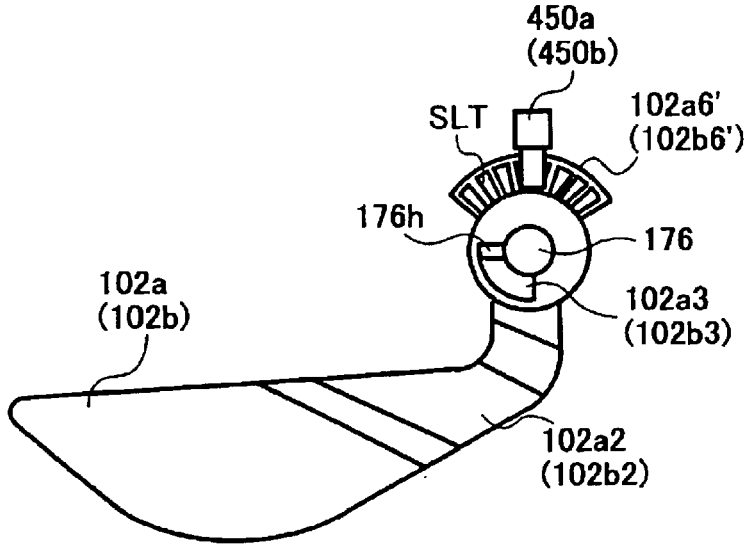
FIG. 83 shows the convex plate for detecting posture of the arranging member and posture detecting sensor.

The specific method for controlling the postures of arranging members in claim 42 will be illustrated herein below. In FIGS. 76 and 78, in the part the abutment 174*a* (174*b*) catches the arranging member 102*a* (102*b*), the convex plate 102*a*6' (102*b*6') is provided in the form of mane as shown in FIG. 82, and in the convex plate 102*a*6' (102*b*6') a plurality of slits SLT for detecting the posture of arranging member are formed.

Figure 84A:
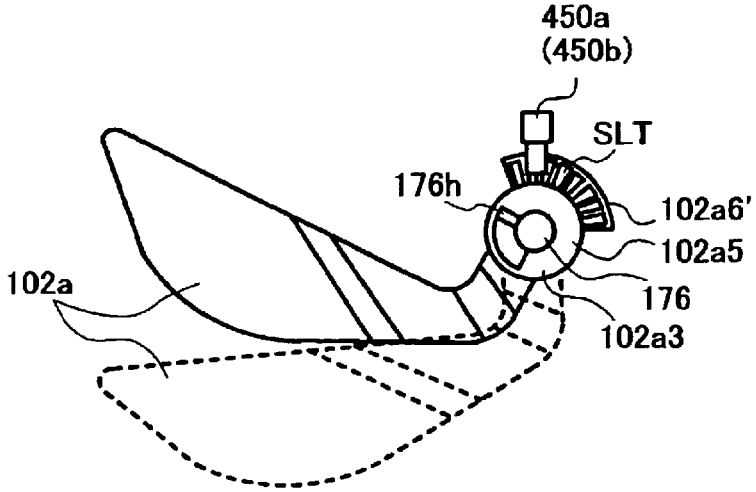
FIG. 84(*a*) is a front view showing posture change of the arranging member, and FIG. 84(*b*) shows output waveform of posture detecting sensor according to posture change of the arranging member.
Figure 84B:
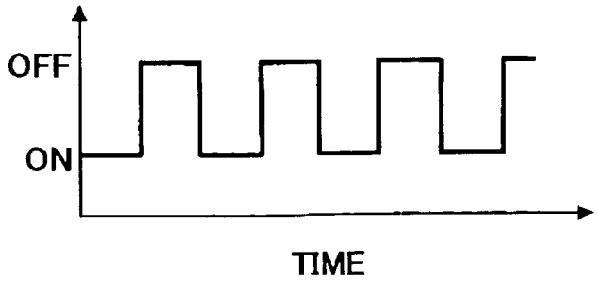

As shown in FIGS. 78 to 80 and FIG. 83, a pose detecting sensor 450*a*' (450*b*') is provided in the reception stool 174*a* (174*b*) to be inserted into these slits SLT from both sides thereof. Here, for example, assuming that the pose detecting sensor 450*a*' outputs an OFF signal when there is nothing in the readout portion and outputs an ON signal when the readout portion is intercepted. If the rotational slide shaft 176 is rotated and thus the arranging member 102*a* (102*b*) is rotated as shown in FIG. 84(*a*), the pose detecting slits SLT pass through each center of the pose detecting sensor 450*a*' (450*b*') and the CPU (see FIG. 46) alternately outputs ON and OFF signals as shown in FIG. 84(*b*).

Figure 85:
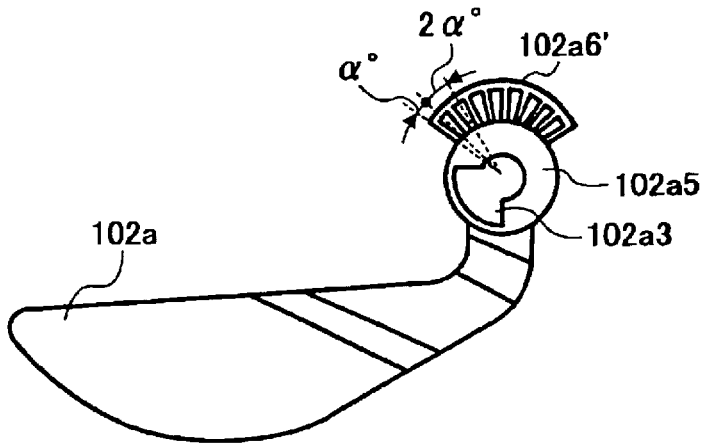
FIG. 85 is a front view of the arranging member showing slits defined in the convex plate.

For example, if the slits SLT are arranged with respect to the arranging member 102*a* as shown in FIG. 85, the pose (rotating angle) of the arranging member can be detected by computing $2\alpha°\times$ON numbers with respect to the arranging member 102*a*, The same thing is available for the arranging member 102*b*.

Also, when arrangement is carried out in the sorting mode, the front and back arranging members 102*a*, 102*b* are evacuated upside after a part of arrangement is completed, a tray 12 is shifted in a shift direction d during it, and then the arrangement members 102*a*, 102*b* get down.

By this, as shown in FIG. 74, one arranging member 102*b* is placed on a bundle of papers and the other arranging member 102*a* is placed to oppose ends of the bundle of papers.

Figure 86:
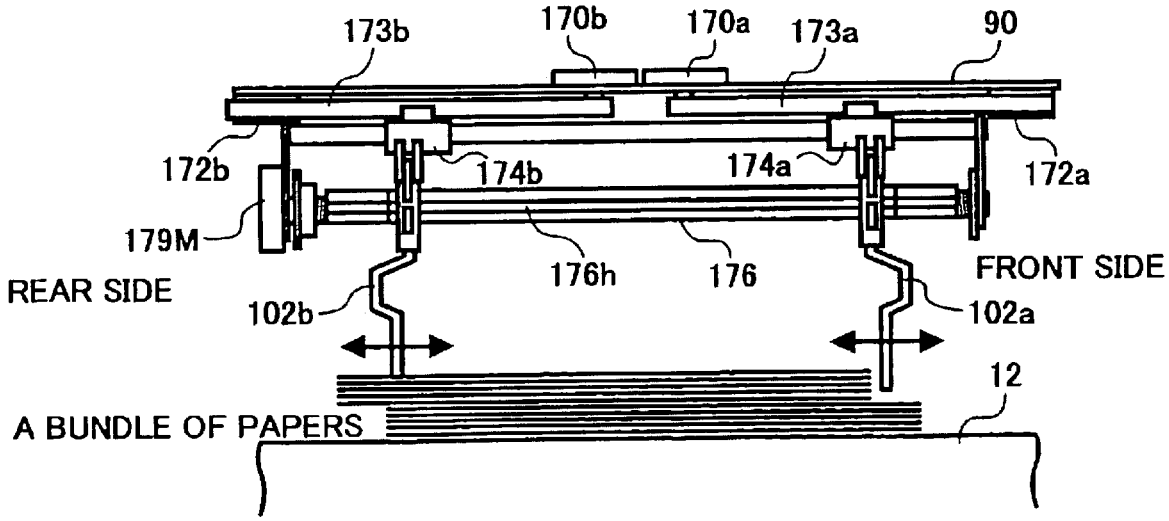
FIG. 86 is a view showing position relationship of the arranging member with paper when performing arranging operation of a bundle of papers.
Figure 87A:
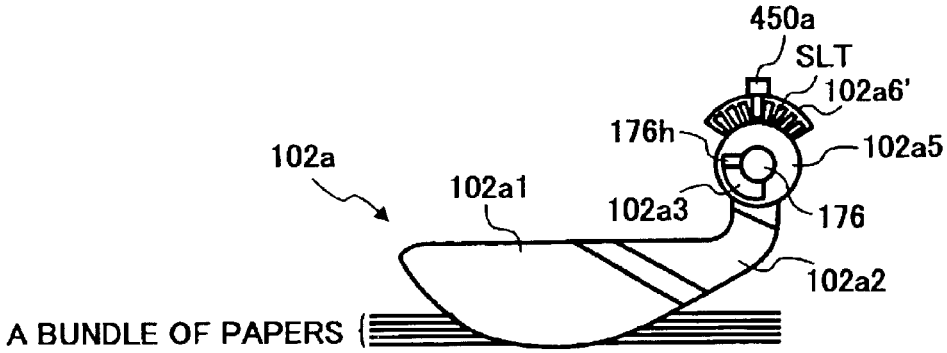
FIG. 87(*a*) is a front view showing the arranging member opposed with ends of papers, and FIG. 87(*b*) shows output waveform of posture detecting sensor.
Figure 87B:
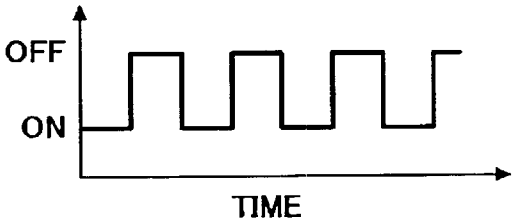
Figure 88A:
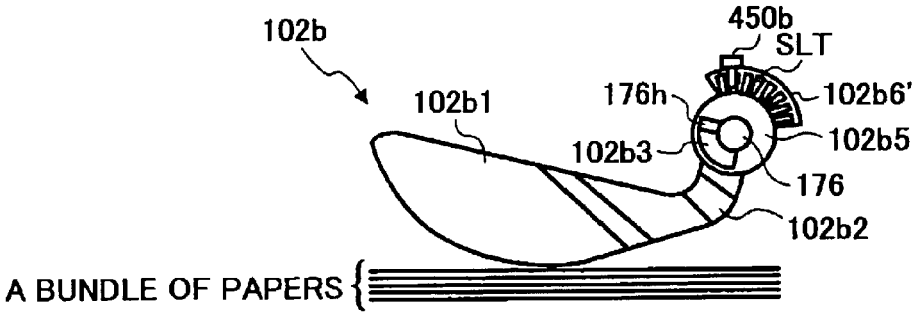
FIG. 88(*a*) is a front view showing the arranging member riding on top of papers, and FIG. 88(*b*) shows output waveform of posture detecting sensor.
Figure 88B:
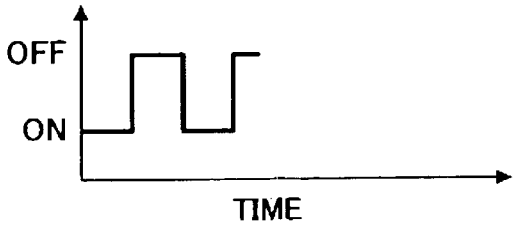

For example, before a state shown in FIGS. 74 and 86, if when the arranging members 102*a*, 102*b* are evacuated upward and then get down onto the bundle of papers, the arranging member 102*a* is placed at an end of a part of the bundle of papers and the arranging member 102*b* is placed on the bundle of papers, the pose of arranging member 102*a* is as shown in FIG. 87(*a*) and the pose of arranging member 102*b* is as shown in FIG. 88(*a*).

At that time, when ON and OFF signals of the pose detecting sensor 450*a*' and the pose detecting sensor 450*b*' are counted from a point of time that the arranging member 102*a* and the arranging member 102*b* are evacuated upward by means of rotation of the rotational slide shaft 176 (here, the evacuating rotational positions of both arranging members are equal to each other), signals having waveforms as shown in FIG. 87(*b*) and FIG. 88(*b*) are output from the pose detecting sensor 450*a*' and the pose detecting sensor 450*b*', respectively. At this time, the rotational angle of the arranging member 102*a* is a $\alpha°+2\alpha°\times4$ (4 times of ON signals) and the rotational angle of the arranging member 102*b* is $\alpha°+2\alpha°\times2$ (2 times of ON signals), and since the rotational angle of one arranging member placed on the bundle of papers is smaller than that of the other arranging member placed at the end of the bundle of papers, it can be determined that a $\alpha°+2\alpha°\times4>\alpha°+2\alpha°\times2$, thus the arranging member 102*a* is said the other arranging member placed at the end of the bundle of papers and the arranging member 102*b* is said one arranging member placed on the bundle of papers.

Like this, if the evacuating rotational position is known, an arranging member placed on the bundle of papers can be specified and in addition, a position from the rotated angle of the arranging member placed at the end of the bundle of papers can be known. Here, when papers on the tray 12 are curled, heights of the curled papers are usually equal in the shift direction d.

Here, based on the pose (the rotational angle from the evacuating rotational position) of arranging member placed on the bundle of papers, the rotational angle from the evacuating rotational position to a position where the arranging member is placed at an end of the bundle of papers can be obtained through computation with respect to the opposite arranging member and control to the position can be carried out.

In the above embodiment, since the arranging member 102*b* in FIG. 88 is the arranging member placed on the bundle of papers, on the basis of rotational angle thereof, the rotational angle of the arranging portion 102*a*1 of the arranging member 102*a* placed at an end of the bundle of papers is obtained by adding or abstracting a predetermined angel experimentally determined to or from the rotational angle of the arranging member 102*b*.

Also, the predetermined angle is varied in accordance with it whether the papers are curled upward or downward. However, since the orientation of curl is set to a constant orientation by means of the kinds of papers, a paper after-treatment apparatus or an image forming apparatus, the amount to be adjusted may be Bet to an experienced value according to the orientation.

Figure 94B:
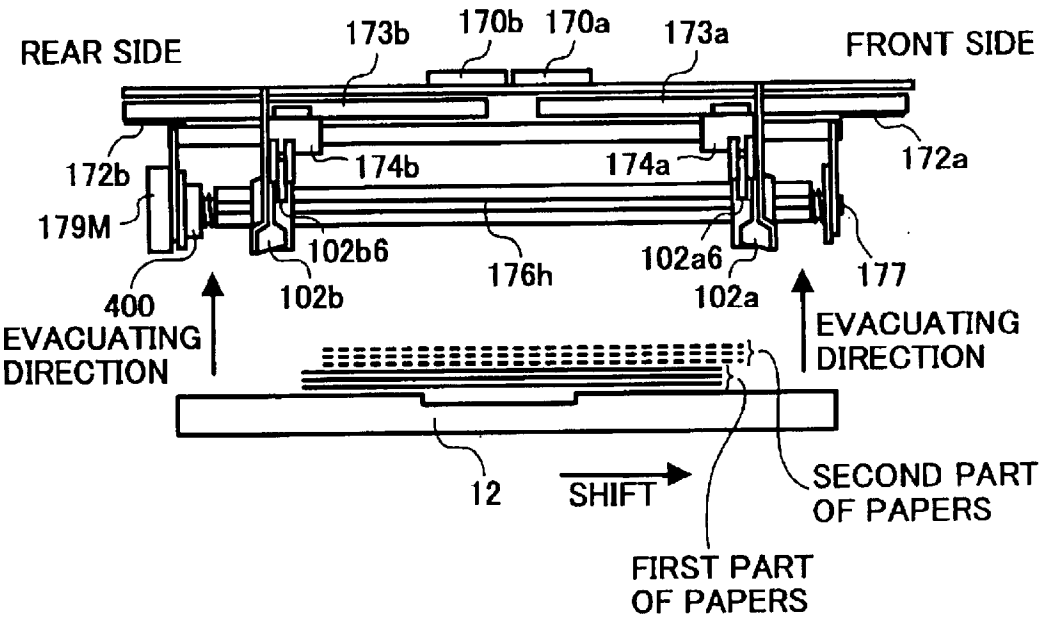
FIG. 94(*a*) is a partial sectional view of means for moving the arranging member seen from the left side, FIG. 94(*b*) is a front view of means for moving the arranging member, and FIG. 94(*c*) is a partial sectional view of means for moving the arranging member seen from the right side.
Figure 94A:
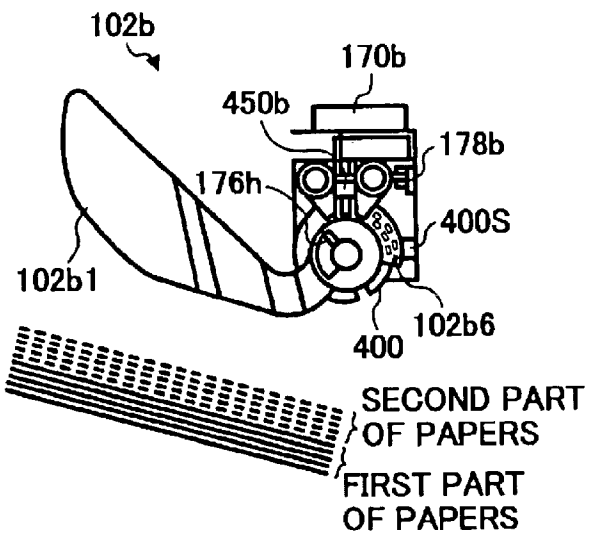
Figure 95A:
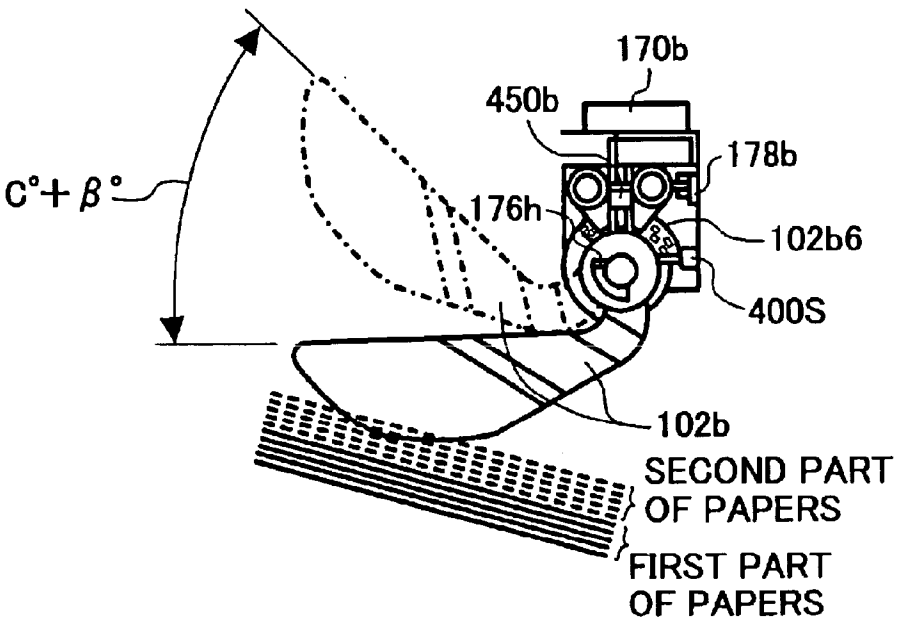
FIG. 95(*a*) is a partial sectional view of means for moving the arranging member seen from the left side, FIG. 96(*b*) is a front view of means for moving the arranging member, and FIG. 95(*c*) is a partial sectional view of means for moving the arranging member seen from the right side.
Figure 94C:
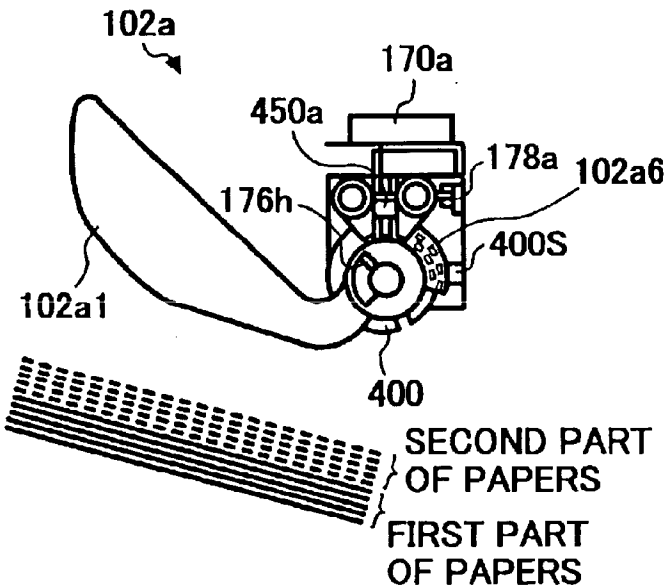
Figure 95C:
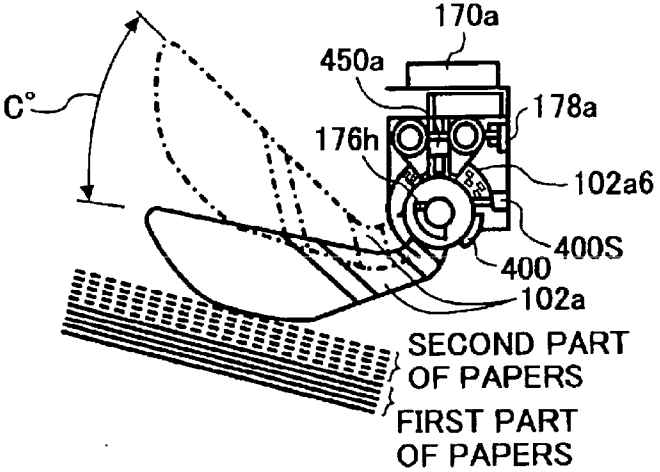
Figure 95B:
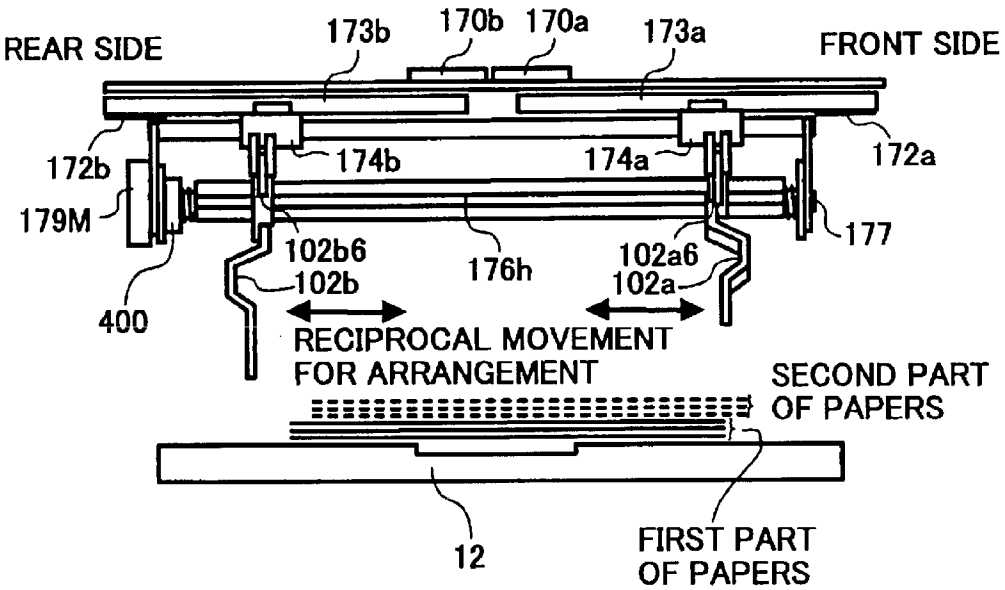

A specific embodiment will be described. In a sorting mode, in performing arrangement of n-th part (n is a natural number) after first part as shown in FIG. 95, if rotational angles of the respective arranging members 102*a*, 102*b* from the evacuating rotational position of the arranging member placed at a side of the bundle of papers shown in FIG. 94 is made greater by an angle β than the rotational angle &° of the arranging member placed on n-th part of the bundle of papers from the evacuating rotational position, the arranging portion 102*b*1 for carrying out arrangement is certainly set to an end of papers of n-th part.

By repeating a series of these arranging operations on later parts, papers can be suitably arranged by the arranging members regardless of the kind of image forming apparatus, curled direction of papers, curl amount and the number of papers piled on the discharging tray.

c. Embodiment Corresponding to Claim 47

When the above arranging members 102*a*, 102*b* are rotated upward and down ward about the rotational slide shaft 176, only by counting the number that slits SLT formed in the convex plate 102*a*6' (102*b*6') provided on the sliding portions of these arranging members pass through the pose detecting sensor 450*a*' (450*b*'), it way not be known whether the arranging member is rotated upward or downward about the rotational sliding shaft 176.

Figure 89:
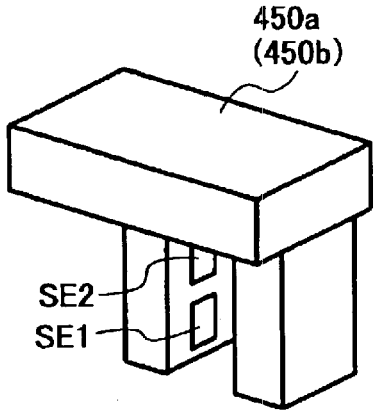
FIG. 89 is a perspective view of posture detecting sensor.

Here, in place of monitoring the slits SLT by means of the pose detecting sensor 450*a*' (450*b*') as shown in FIGS. 82 to 88, the pose detecting sensor 450*a* (450*b*) is used as shown in FIG. 89. The pose detecting sensor 450*a* (450*b*) has two detecting portion of first detecting portion SE1 and second detecting portion SE2 at different positions on the same sensor.

Figure 90:
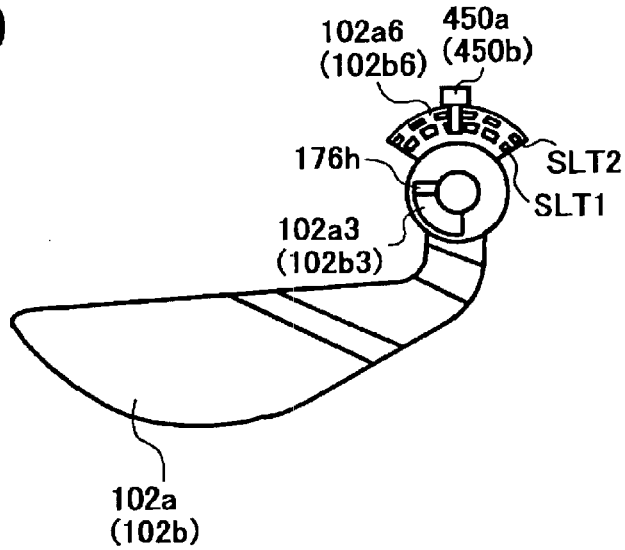
FIG. 90 shows posture the detecting sensor and convex plate in which slits are arranged on two concentric circles in two rows.

Slits SLT1, SLT2 in two columns are disposed on two concentric circles as shown in FIG. 90, such that phase of timing for detecting slits should not match each other correspondingly to these detecting portion.

Figure 91:
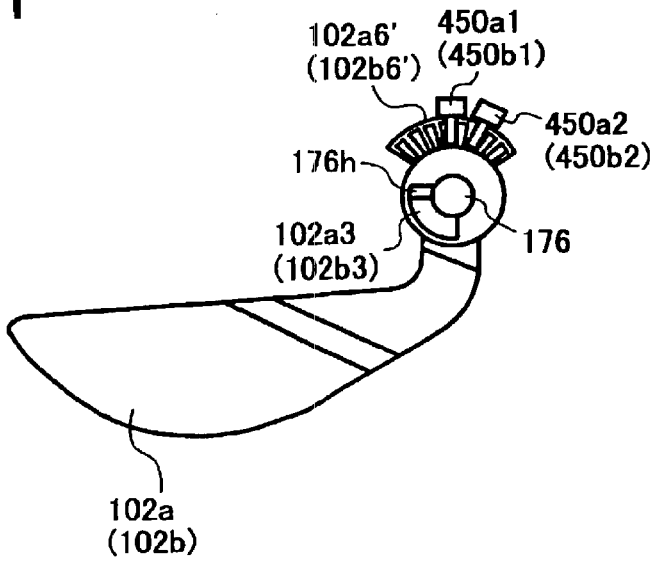
FIG. 91 shows an example of combination of the convex plate having a row of slits and two posture detecting sensors.

Or, as shown in FIG. 91, in the convex plate 102*a*6' (102*b*6'), two positions on a circle about which the slits are disposed are provided with sensors 450*a*1(450*b*1) and 450*a*2(450*b*2) having one detecting portion such that phase of timing for detecting the slits should not match each other.

Figure 92A:
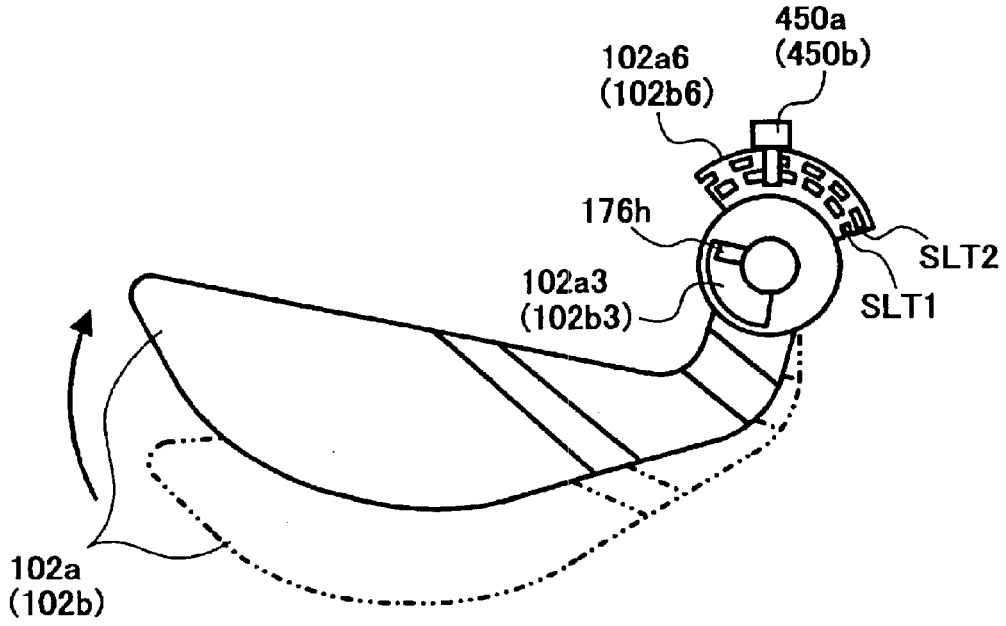
FIG. 92(*a*) shows an example of combination of the convex plate having two rows of slits and two posture detecting sensors, and FIG. 92(*b*) shows output waveform of posture detecting sensor.
Figure 92B:
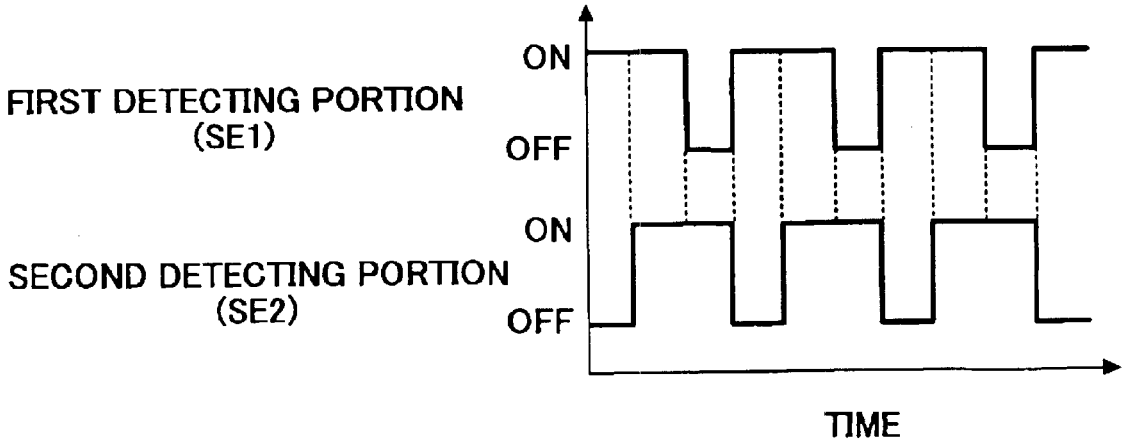
Figure 93A:
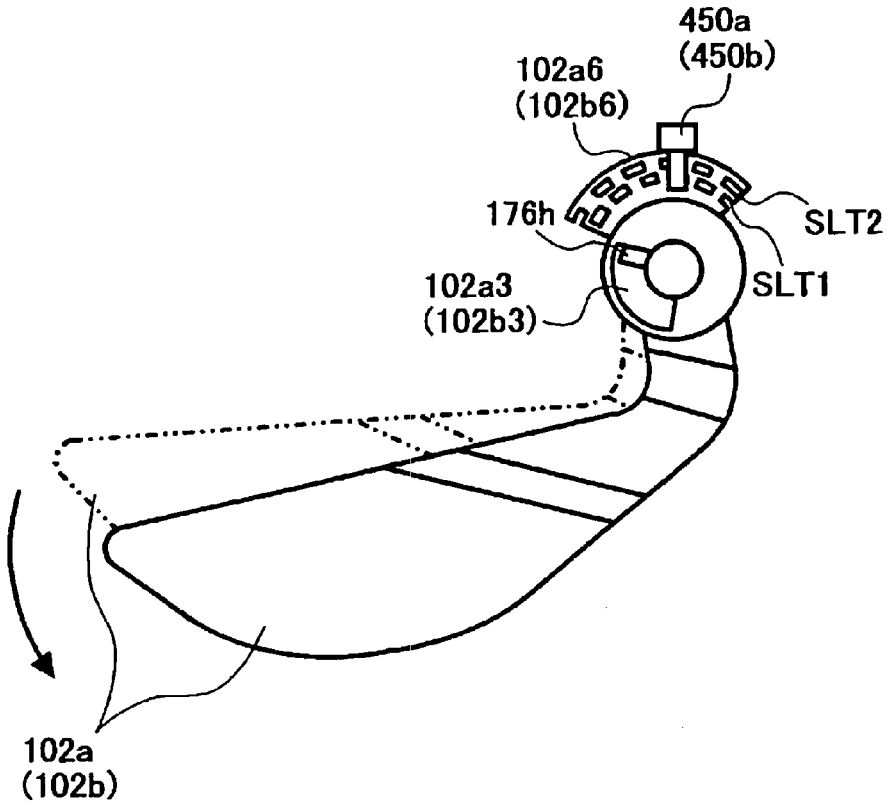
FIG. 93(*a*) shows an example of combination of convex plate having two rows of slits and two posture detecting sensors, and FIG. 93(*b*) shows output waveform of posture detecting sensor.
Figure 93B:
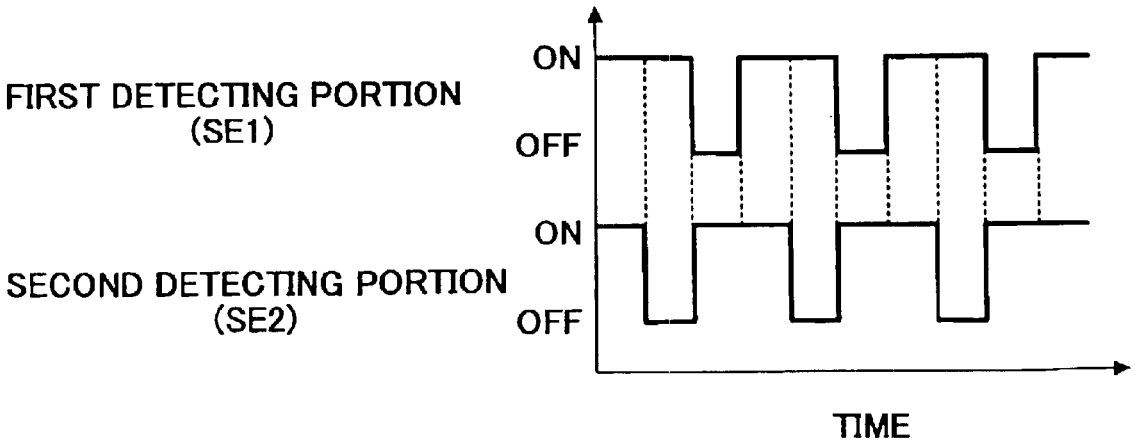

By doing so, if the convex plate 102*a*6 (102*b*6) is rotated as shown by an arrow in FIG. 92(*a*) and the first detecting portion SE1 and the second detecting portion SE2 of the pose detecting sensor 450*a* (450*b*) output signals such as those shown in FIG. 92(*b*), respectively, in a case shown in FIG. 93(*b*) that the arranging members are rotated in a direction opposite to the arrow shown in FIG. 92(*a*), signals such as those shown in FIG. 93(*b*) can be output.

As a result, in the rotating direction shown in FIG. 92(*a*), after signal of the first detecting portion SE1 gets ON and then a given time elapses, signal of the second detecting portion SE2 gets ON as shown in FIG. 92(*b*), while in the rotating direction shown in FIG. 93(*a*) opposite to the above case, after signal of the first detecting portion SE1 gets ON and then a given time elapses, signal of the second detecting portion SE2 gets OFF as shown in FIG. 93(*b*).

Like this, by means of timing difference of ON, OFF signals of the first detecting portion SE1 and the second detecting portion SE2, variation in the rotating direction of the convex plate 102*a*6 (102*b*6), that is, the arranging member 102*a* (102*b*) can be detected.

Although in the above description, a combination of two rows of slits and a sensor having two detecting portions as shown in FIG. 90 are exemplified by FIGS. 92 and 93, the rotating direction of the arranging member 102*a* (102*b*) may be detected in a case of combination of one row of slits and two sensors as shown in FIG. 91, similarly.

By doing so, when the arranging members are rotated upward and downward about the rotational sliding shaft, whether the arranging members are rotated upward or downward can be detected and posing positions of the arranging members can be suitably set.

d. Embodiment Corresponding to Claim 48

When the pose of the arranging member 102*a* (102*b*) is detected by the pose detecting sensor 450*a*' (450*b*') or by the pose detecting sensor 450*a* (450*b*), or when height of the papers on the tray 12 is detected by means of rotational angle of the arranging members, there may be a case that if position of the pose detecting sensor is fixed to a certain position, pose of the arranging member of which position varies according to size of papers cannot be detected through the pose detecting sensor.

The related problems will be solved by this embodiment.

In FIGS. 77 and 78, the pose detecting sensor 450*a* is provided at a reception stool 174*a* moving together with the arranging member 102*a*. Although description of usage is omitted, the pose detecting sensor 450*b* is provided at a reception stool 174*b* moving together with the arranging member 102*b*, similarly.

According to this construction, when the reception stools 174*a*, 174*b* in order to move the arranging member 102*a*, 102*b* in the shift direction d, the pose detecting sensor 450*a*, 450*b* provided at each reception stool 174*a*, 174*h* are moved together and the convex plates 102*a*6, 102*b*6 provided, respectively, at the arranging members 102*a*, 102*b* can always be detected.

In disposing the pose detecting sensors 450*a*1, 450*a*2 (450*b*1, 450*b*2) in an embodiment shown in FIG. 91, by providing the pose detecting sensor 450*a*1, 450*a*2 at the reception stool 174*a* and the pose detecting sensor 450*b*1, 450*b*2 at the reception stool 174*b* similarly to the above embodiment, the same effect can be obtained. In this embodiment, even when the position of the arranging members is varied according to size of papers, the poses of the arranging members can be detected through the sensors.

e. Embodiment Corresponding to Claim 49

Curl orientations of papers piled on the tray are varied with types of the image forming apparatus. Thus, if position and pose of the arranging members is always constant in arrangement by means of the arranging members, the arranging portion 102*a*1, 102*b*1 of arranging members 102*a*, 102*b* do not match ends of papers piled on the tray and thus the arrangement can not be carried out.

Here, the construction is as following.

Figure 96B:
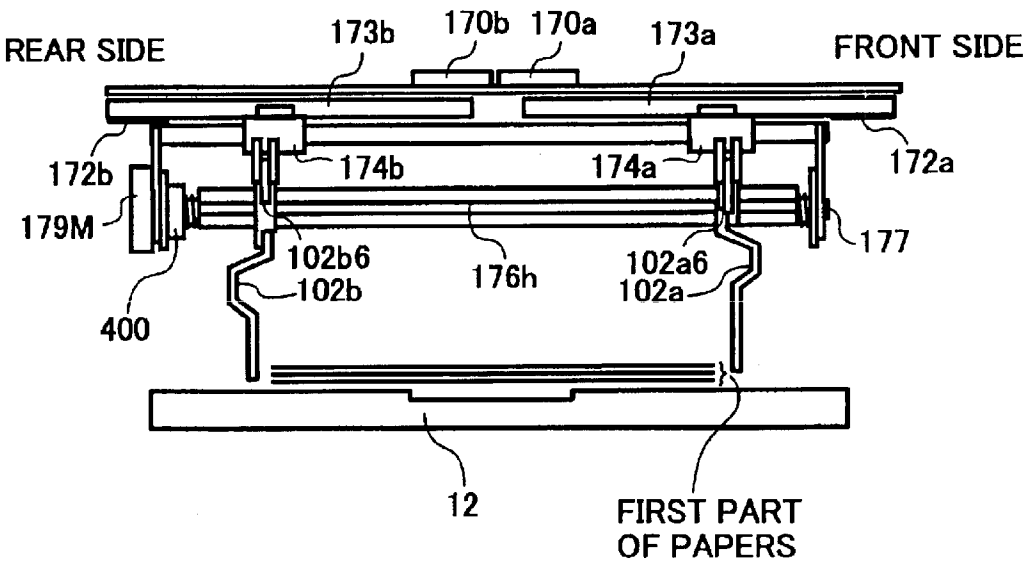
FIG. 96(*a*) is a partial sectional view of means for moving the arranging member seen from the left side, FIG. 96(*b*) is a front view of means for moving the arranging member, and FIG. 96(*c*) is a partial sectional view of means for moving the arranging member seen from the right side.
Figure 96A:
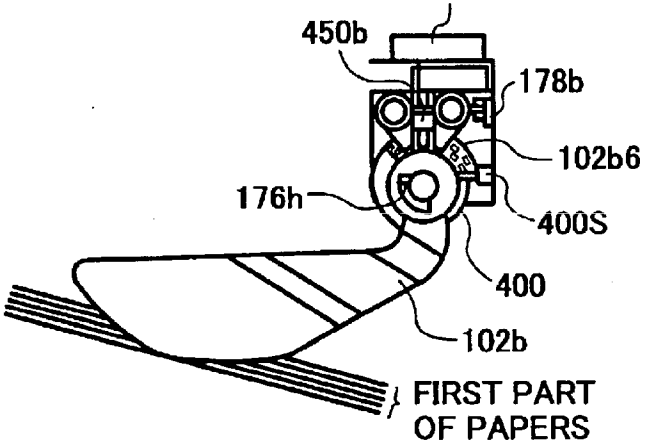
Figure 97A:
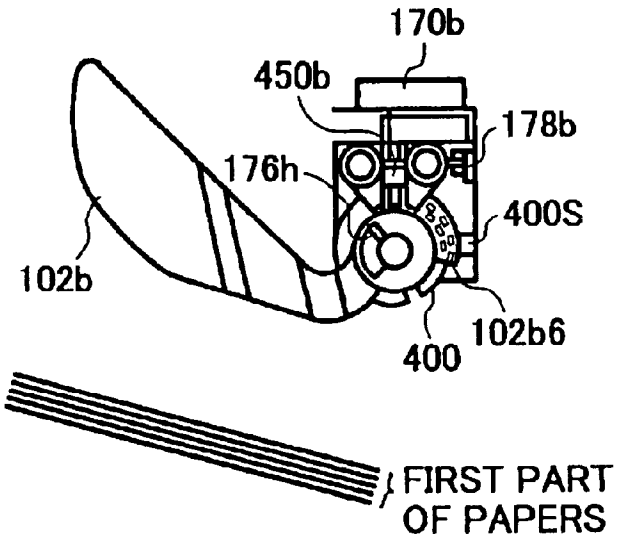
FIG. 97(*a*) is a partial sectional view of means for moving the arranging member seen from the left side, FIG. 97(*b*) is a front view of means for moving the arranging member, and FIG. 97(*c*) is a partial sectional view of means for moving the arranging member seen from the right side.
Figure 96C:
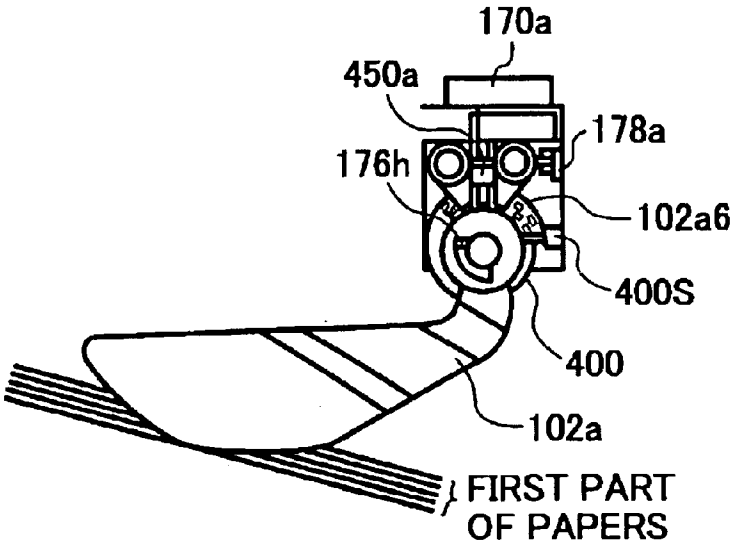
Figure 97C:
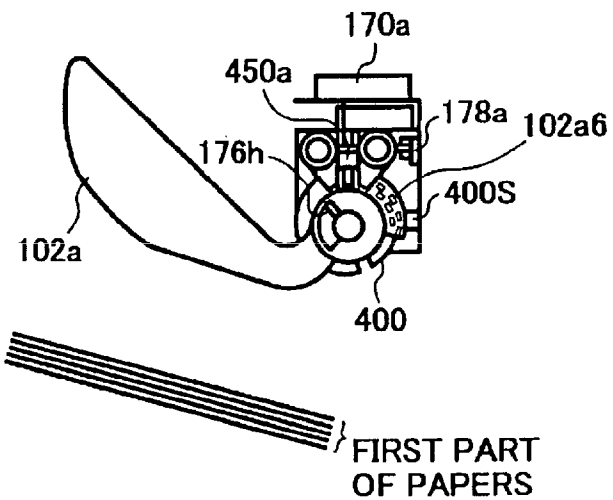
Figure 97B:
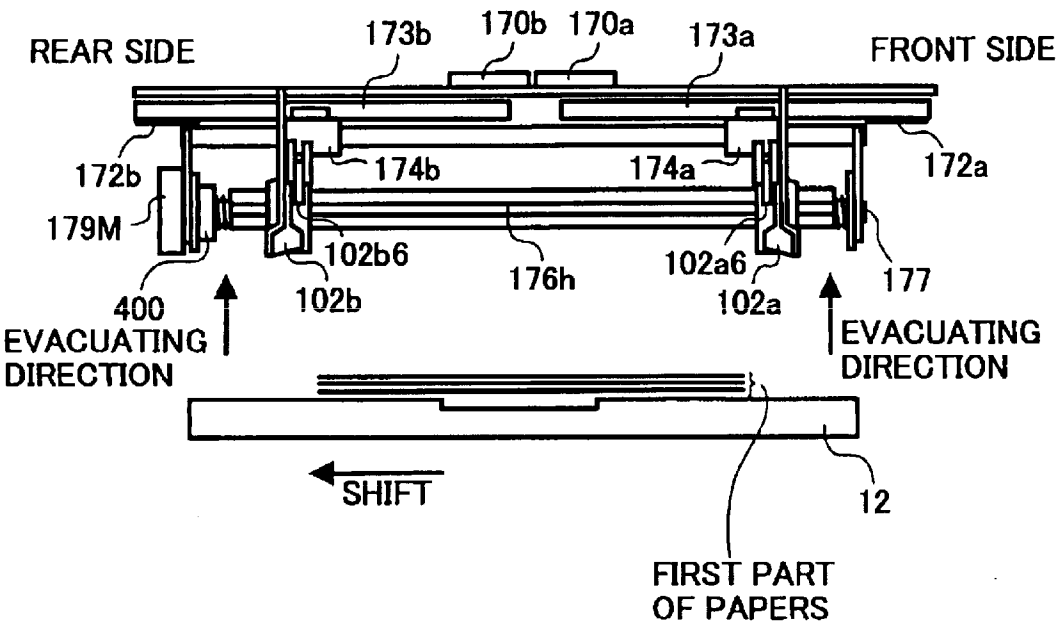

When arrangements of the respective parts of papers are carried out by means of the arranging members 102*a*, 102*b* in the sorting mode, arrangement of a first part of paper bundle is carried out as shown in FIG. 96 and then, the arranging members 102*a*, 102*b* are once evacuated upward as shown in FIG. 97 and meanwhile, the tray 12 is shifted in the shift direction (width direction).

Figure 98B:
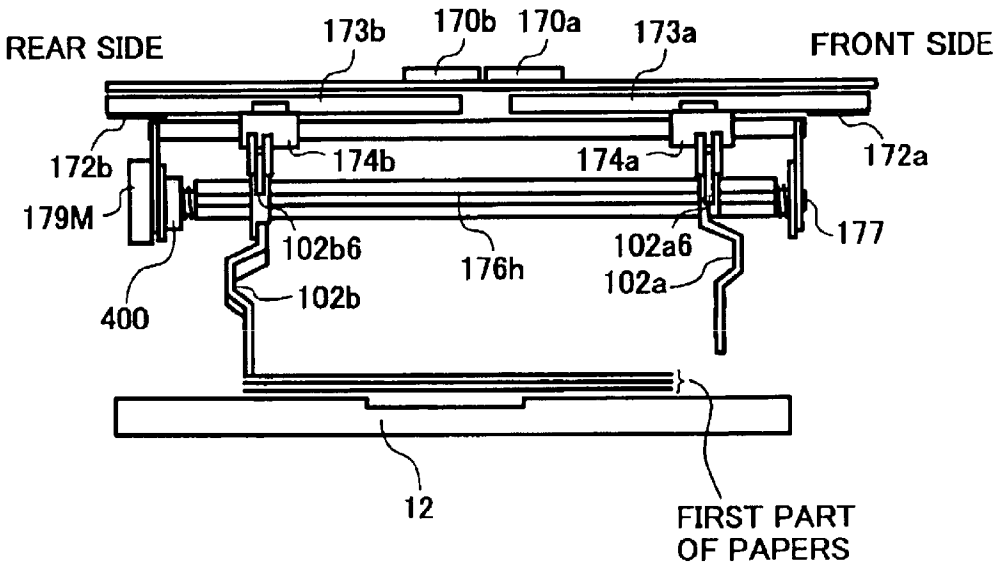
FIG. 98(*a*) is a partial sectional view of means for moving the arranging member seen from the left side, FIG. 98(*b*) is a front view of means for moving the arranging member, and FIG. 98(*c*) is a partial sectional view of means for moving the arranging member seen from the right side.
Figure 98A:
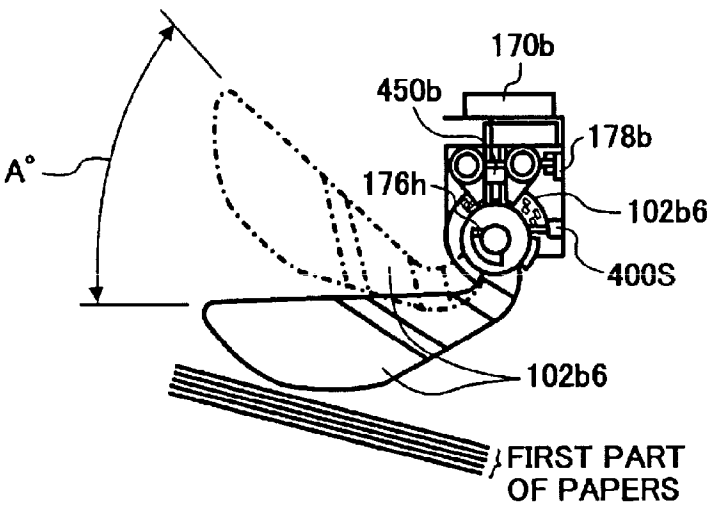
Figure 98C:
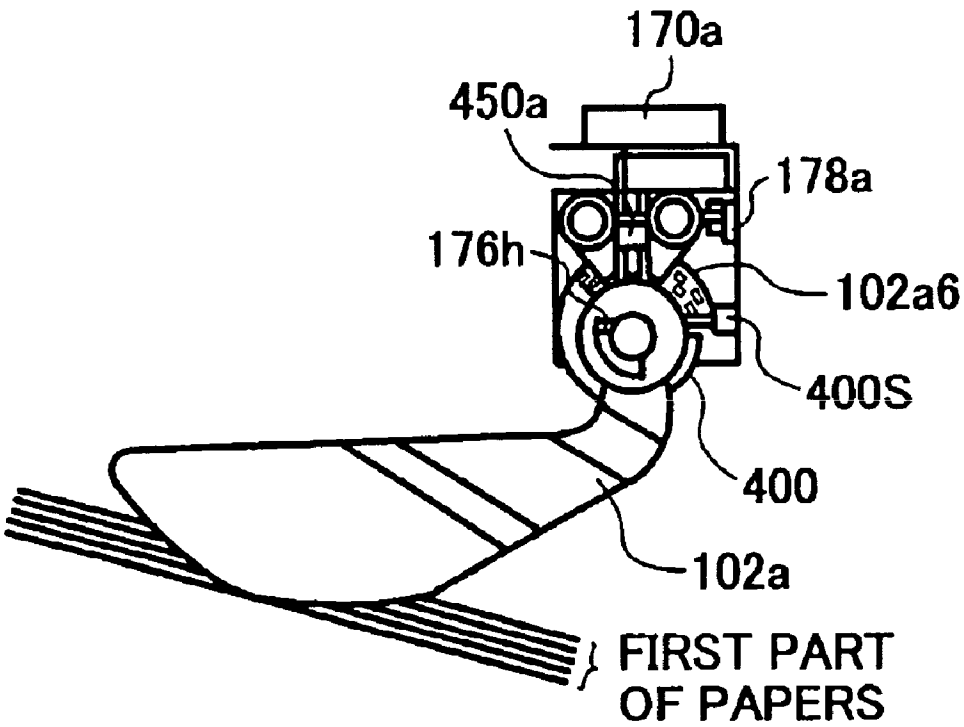

Then, by rotating the arranging members 102*a*, 102*b* evacuated upward to a lower default position as shown in FIG. 98 to carry out arrangement of a second part, one arranging member 102*b* is placed on the first part of papers piled on the tray 12 and the other arranging member 102*a* is placed opposing end of the first part of papers, while waiting for discharge of the second part of papers.

Figure 99B:
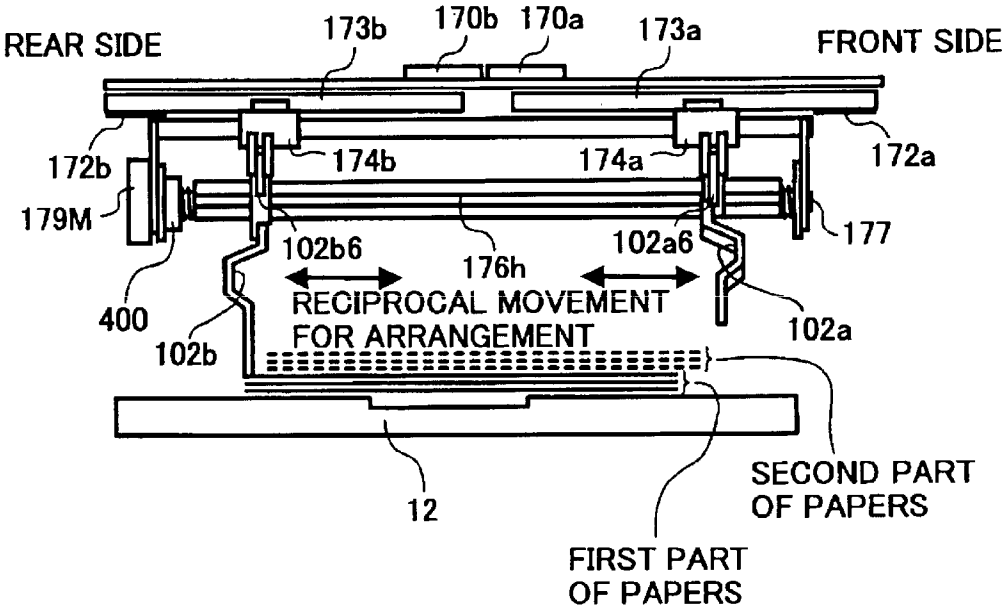
FIG. 99(*a*) is a partial sectional view of means for moving the arranging member seen from the left side, FIG. 99(*b*) is a front view for means for moving the arranging member, and FIG. 99(*c*) is a partial sectional view of means for moving the arranging member seen from the right side.
Figure 99A:
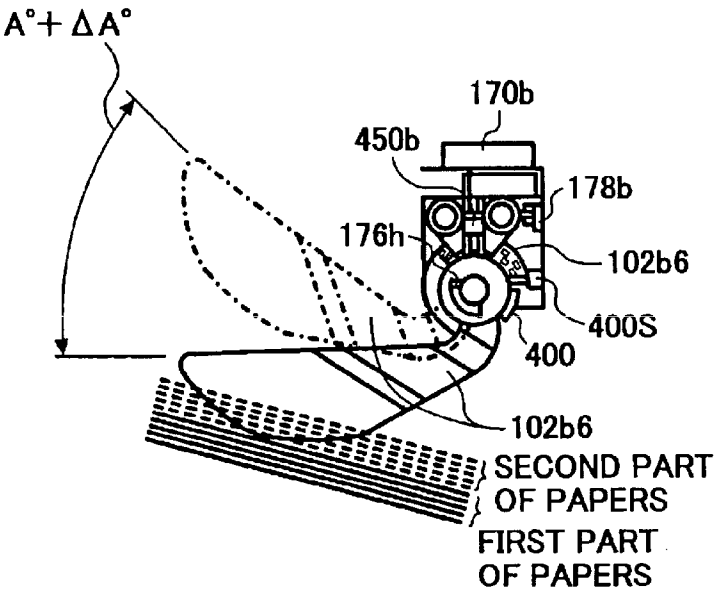
Figure 99C:
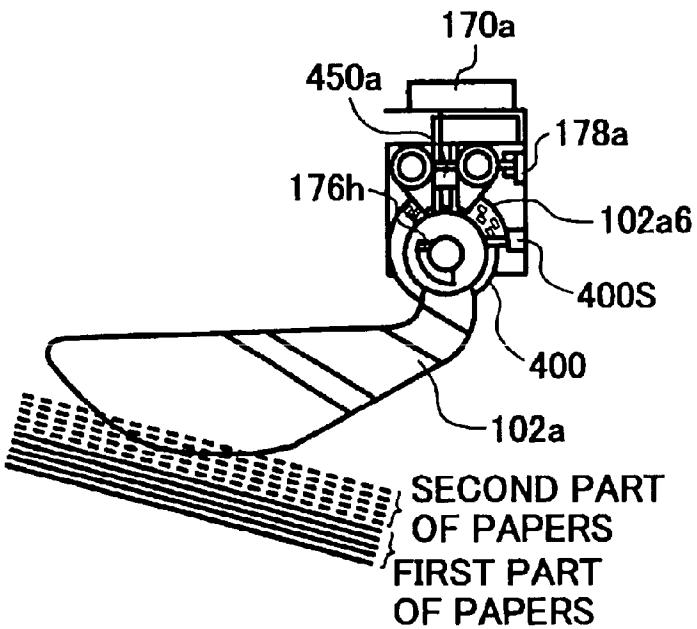

In a case of arrangement according to an aspect of both side movement shown in FIG. 14, when the second part of papers are is conveyed between the arranging members 102*a*, 102*b* in FIG. 99, the arranging member 102*a* and the arranging member 102*b* are reciprocally moved, thereby arranging the second part of papers. By repeating a series of these operations, arrangement in the sorting mode can be carried out.

However, in default positions of the respective parts of papers in arrangement through the arranging members, arrangement cannot be carried out depending on curled state of papers to be arranged. For example, when papers conveyed from the image forming apparatus are curled upward, position of the arranging member 102*a* (102*b*) is fixed constantly and height detection is carried out at an end part of lower stream in the conveying direction of papers separated from the arranging portions by means of a positioning means 96. Therefore, since the papers are placed at an escaping portions 102*a*2, 102*b*2 higher than the arranging portions 102*a*1, 102*b*1 of the arranging members 102*a*, 102*b* sequentially, that is, end of the paper placed at the top of the bundle of papers below curl is sequentially placed up as the number of papers piled on the tray 12 increases in order shown in FIGS. 103, 104 and 105, the end of paper is placed at the escaping portions 102*a*2, 102*b*2 of the arranging members and thus, the papers cannot be arranged by means of the arranging members 102*a*, 102*b*.

Figure 106B:
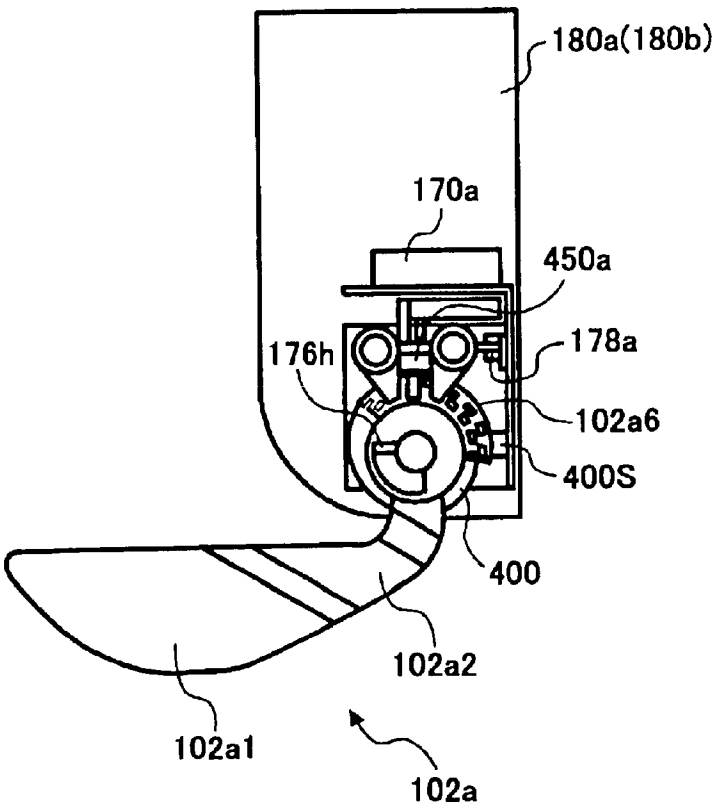
FIG. 106(*a*) is a side view showing condition in which a small number of papers which are curled downwardly are plied on tray, and FIG. 106(*b*) is an enlarged view showing posture of arranging member under the condition of FIG. 106(*a*).
Figure 106A:
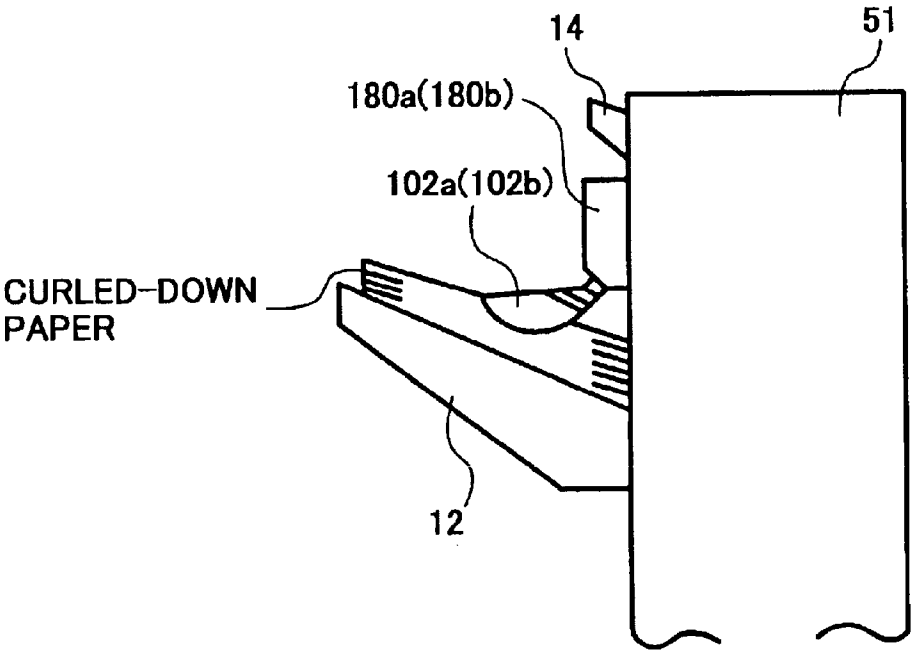
Figure 107B:
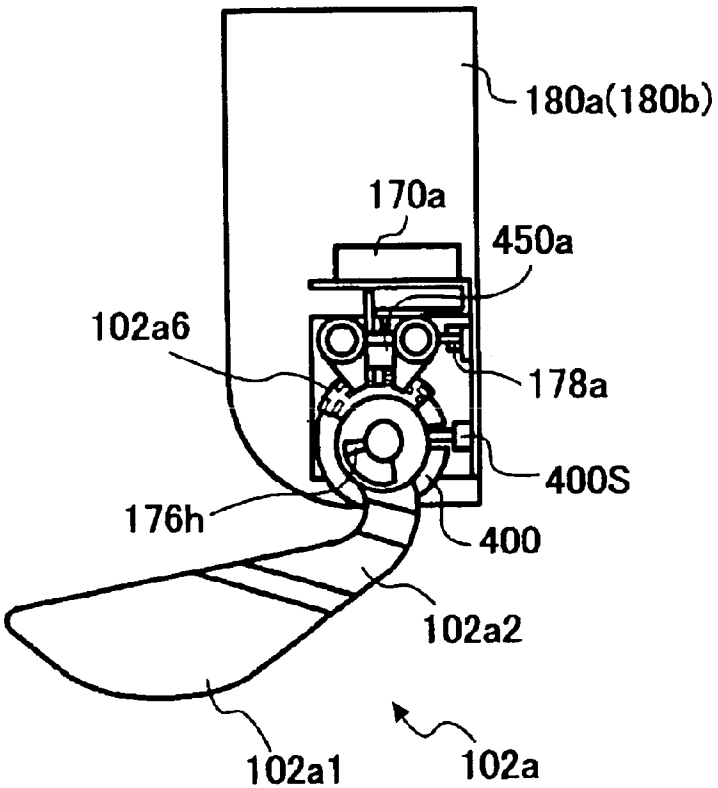
FIG. 107(*a*) is a side view showing condition in which a larger number of papers than in FIG. 106(*a*) which are downwardly curled are plied on tray, and FIG. 107(*b*) is an enlarged view showing posture of arranging member under the condition of FIG. 107(*a*).
Figure 107A:
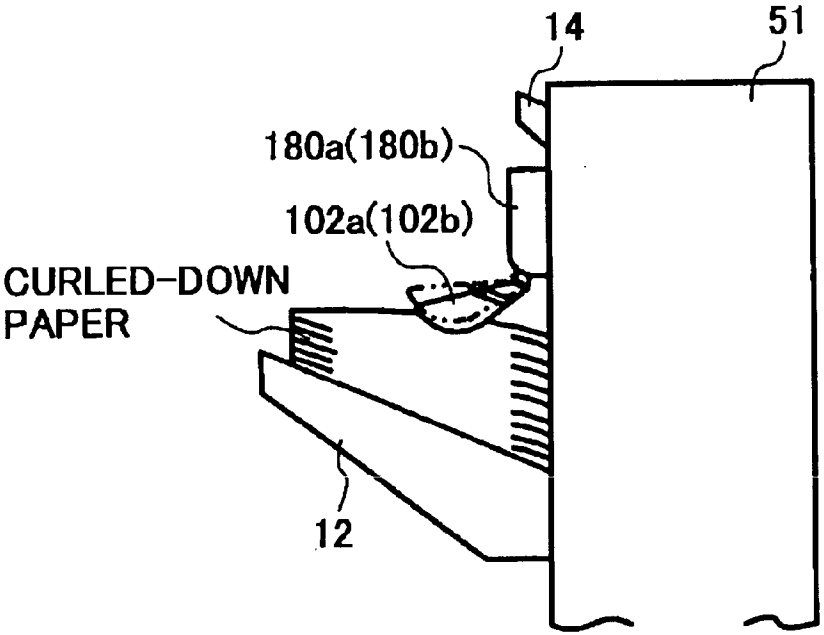
Figure 108B:
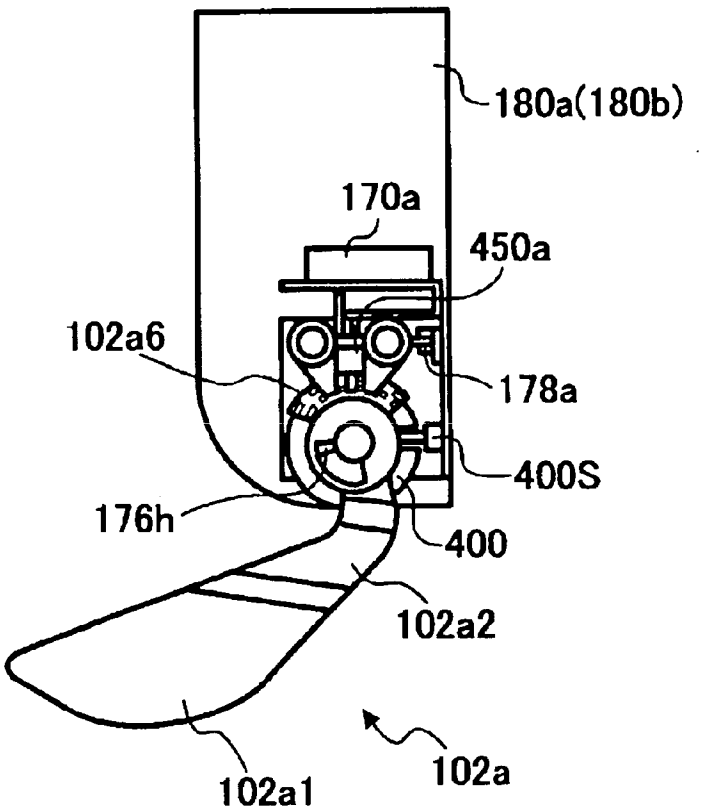
FIG. 108(*a*) is a side view showing condition in which the a larger number of papers than in FIG. 107(*a*) which are downwardly curled are plied on tray, and FIG. 108(*b*) is an enlarged view showing posture of arranging member under the condition of FIG. 108(*a*).
Figure 108A:
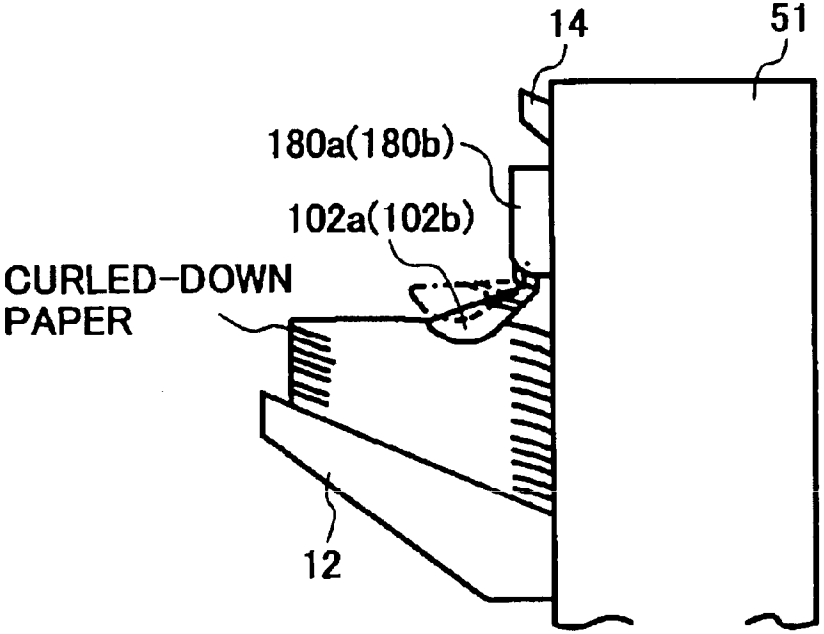

On the contrary, when papers conveyed from the image forming apparatus are curled downward, as the number of papers piled on the tray 12 increases in order shown in FIGS. 106, 107 and 108; the papers are piled at lower side than the arranging portions 102*a*1, 102*b*1 on the contrary to the above case. Therefore, overlap of the arranging portion 102*a*1 and ends of the papers gets gradually small as shown by the dotted line in FIG. 107(*a*) and as a result, the papers is not in contact with the arranging portions, so that the arrangement cannot be carried out.

Figure 103B:
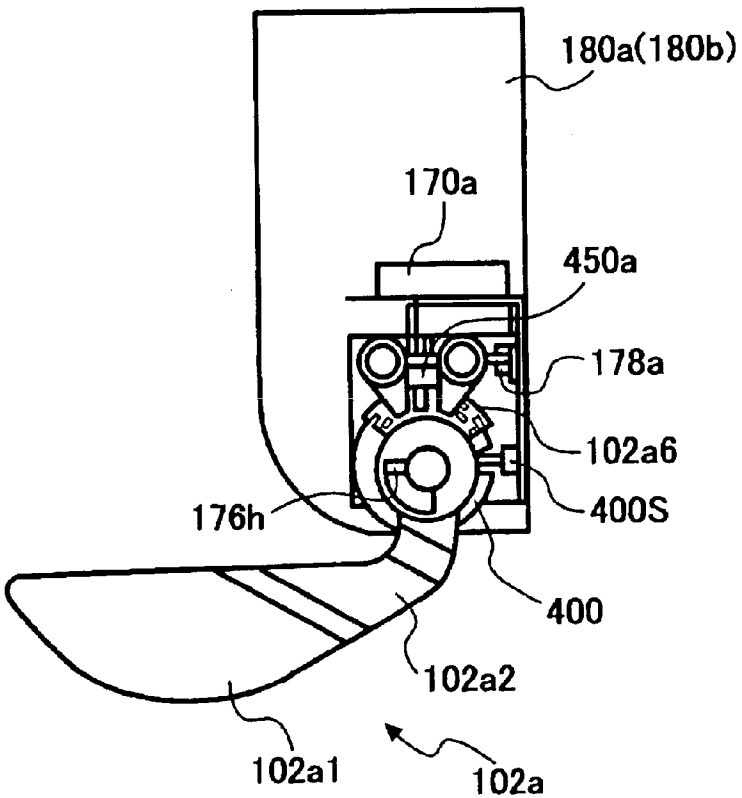
FIG. 103(*a*) is a side view illustrating the condition in which a small number of papers which are curled upwardly are plied on tray, and FIG. 103(*b*) is an enlarged view showing posture of arranging member under the condition of FIG. 103(*a*).
Figure 103A:
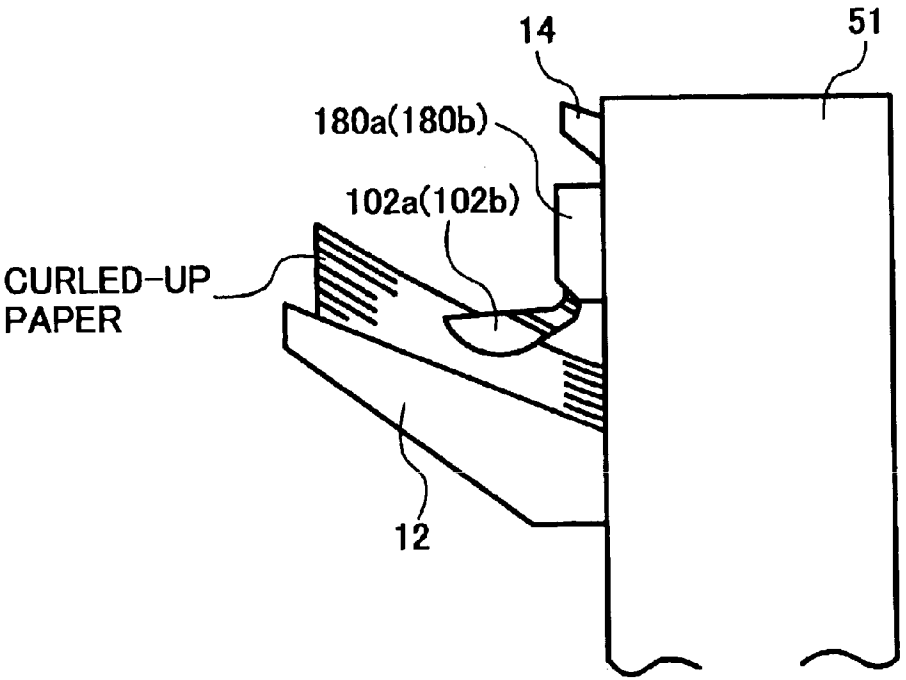
Figure 104B:
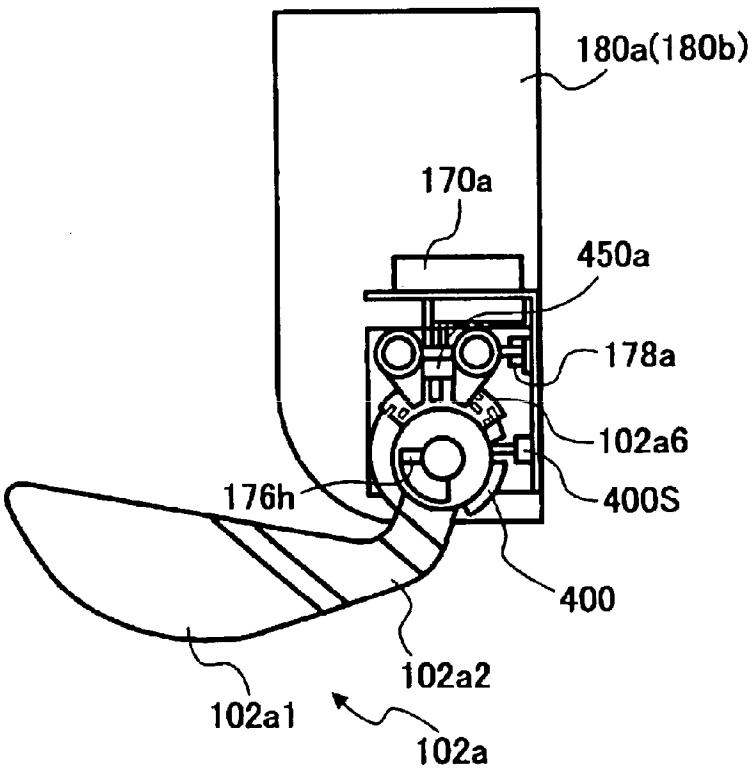
FIG. 104(*a*) is a side view showing condition in which a larger number of papers than in FIG. 103(*a*) which are upwardly curled are plied on tray, and FIG. 104(*b*) is an enlarged view showing posture of arranging member under the condition of FIG. 104(*a*).
Figure 104A:
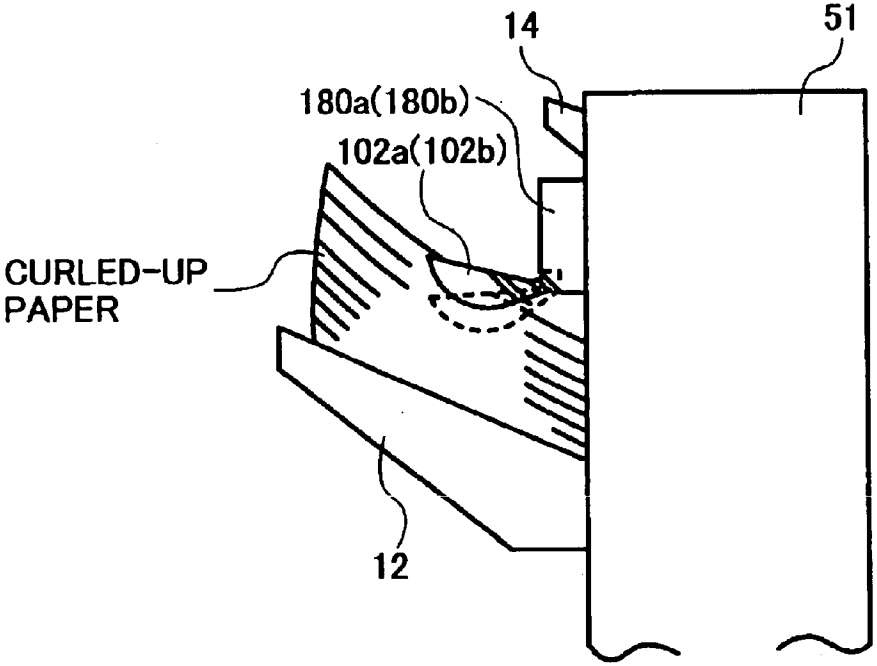
Figure 105B:
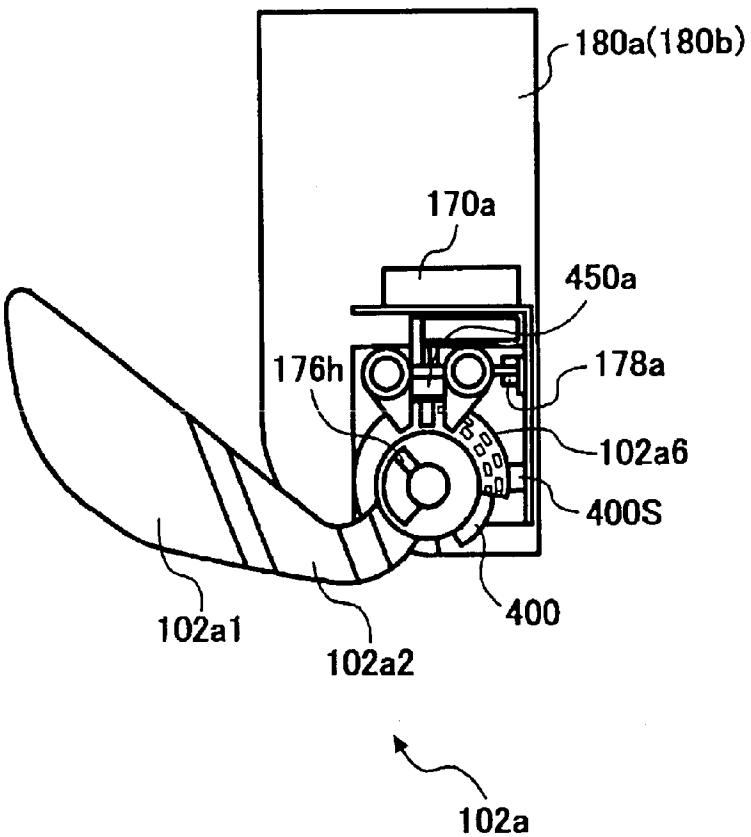
FIG. 105(*a*) is a side view showing condition in which a larger number of papers than in FIG. 103(*b*) which are upwardly curled are plied on tray, and FIG. 106(*b*) is an enlarged view showing posture of arranging member under the condition of FIG. 105(*a*).
Figure 105A:
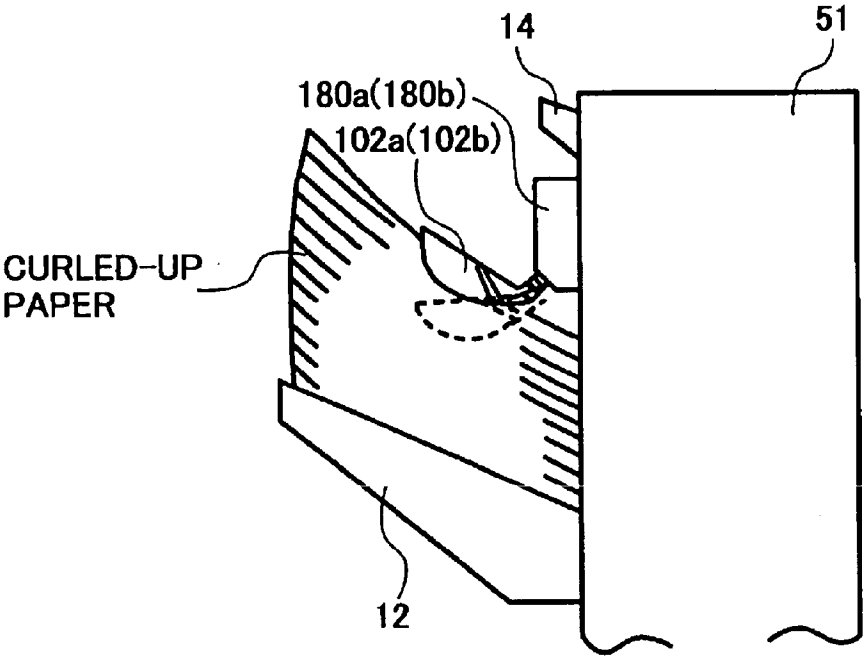

Here, curl direction of papers is determined on the basis of internal structure of the image forming apparatus. Therefore, if the paper after-treatment apparatus can determine a type of the image forming apparatus by means of signals sent from the image forming apparatus, the curl direction of papers conveyed from the image forming apparatus can be known. When it is determined that papers curled upward are conveyed from the image forming apparatus, as the number of papers piled on the tray 12 increases as shown in FIGS. 103 to 105, the arranging members 102*a*, 102*b* are controlled to vary their positions to an upper position than the default position by means of a stepping motor 179M shown in FIG. 76.

On the contrary, when it is determined that papers curled downward are conveyed from the image forming apparatus, as the number of papers piled on the tray 12 increases as shown in FIGS. 106 to 108, the arranging members 102*a*, 102*b* are controlled to vary their positions to a lower position than the default position by means of a stepping motor 179M shown in FIG. 76.

By controlling the arranging members to take the arranging poses depending on the number of papers piled on the tray 12, the arranging portions 102*a*1, 102*b*1 of the arranging members 102*a*, 102*b* is fitted to ends of papers to be arranged and thus, the arrangement can be accurately carried out regardless of the curl direction.

f. Embodiment Corresponding to Claim 44

Curl direction and curl amount of papers piled on the tray 12 are varied with the type of papers. Thus, unless the arranging portion for arranging papers with respect to the other arranging member detects the curl direction and curl amount of papers and controls position and pose of the arranging means in arrangement in the sorting mode on the basis of the pose of the arranging member placed on the bundle of papers piled on the tray, the arranging portion of arranging member placed at end of the bundle of papers do not match the papers and the arrangement may not be carried out.

In the present embodiment, a sheet-shaped medium aligning apparatus capable of accurately making the arranging portion of the arranging member match the end of papers.

When arrangement of the respective parts of papers are carried out by means of the arranging members 102*a*, 102*b* in the sorting mode, arrangement of a first part of paper bundle is carried out as shown in FIG. 94 and then, the arranging members 102*a*, 102*b* are once evacuated upward as shown in FIG. 97 and meanwhile, the tray 12 is shifted in the shift direction (width direction). At this time, downstream in the shift direction of the tray 12 can be known by means of detection output from the home sensor 48 detecting movement of the encoder 47 shown in FIGS. 7 to 9, and also, it can be known that the arranging member on a side (downstream in the shift direction) to which the tray 12 is shifted, that is, the arranging member 102*b* as shown in FIG. 98, is placed on the first part of papers in arrangement of the next second part of papers.

Then, when the arranging members 102*a*, 102*b* evacuated upward as shown in FIG. 97 are rotated downward to the position in which arrangement of the first part of papers as shown in FIG. 96 in order to carry out arrangement of a second part of papers, the rotational angle of the arranging member 102*a* placed on the next second part of papers can be detected by means of each slit SLT1, SLT2 and the pose detecting sensor 450*a* (450*b*) of the convex plates 102*a*6, 102*b*6 provided at the respective arranging members 102*a*, 102*b* in FIG. 78 and thus, it can be detected to what extent the arranging members 102*a*, 102*b* are rotated downward, respectively.

Here, as shown in FIG. 98(*a*), assuming that the rotational angle of the arranging member 102*b* placed on the end of the first part of papers from the evacuating rotational position is A°. Since the tray 12 is raised slowly when arrangement of the second part of papers is carried out as shown in FIGS. 98 to 99, when arrangement of the second part of papers is completed as shown in FIG. 99, the final rotational angle of the arranging member 102*b*placed on the first part of papers from the evacuating rotational position is A°+ΔA°.

Figure 100A:
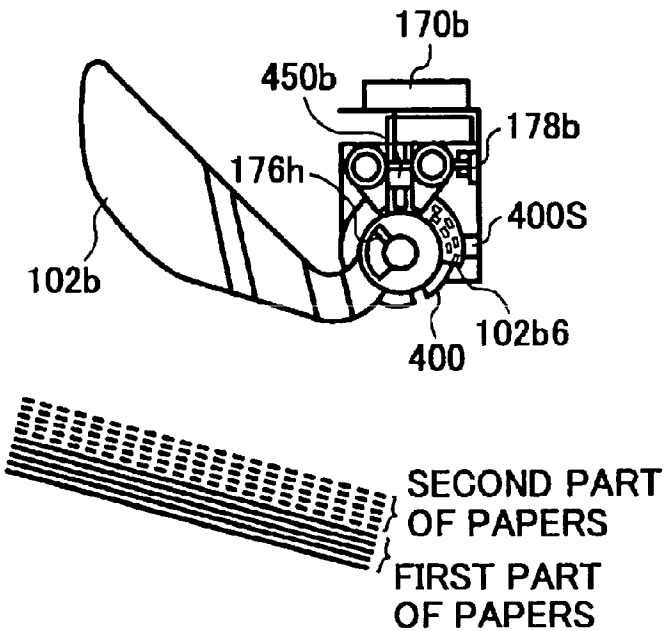
FIG. 100(*a*) is a partial sectional view of means for moving the arranging member seen from the left side, FIG. 100(*b*) is a front view of means for moving the arranging member, and FIG. 100(*c*) is a partial sectional view of means for moving the arranging member seen from the right side.
Figure 100C:
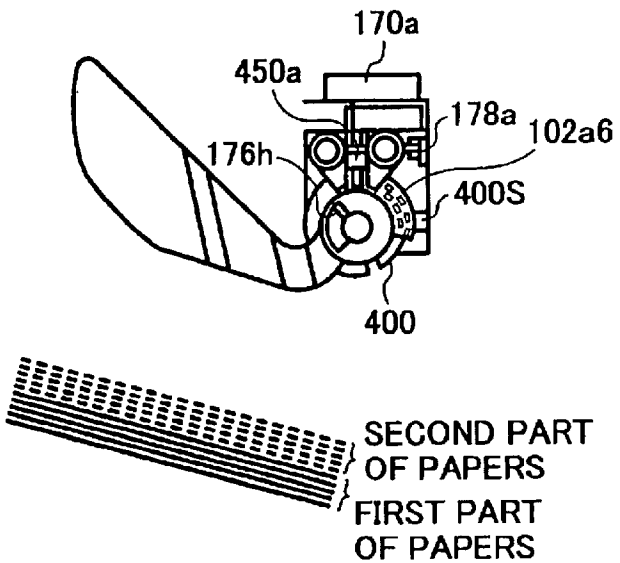
Figure 100B:
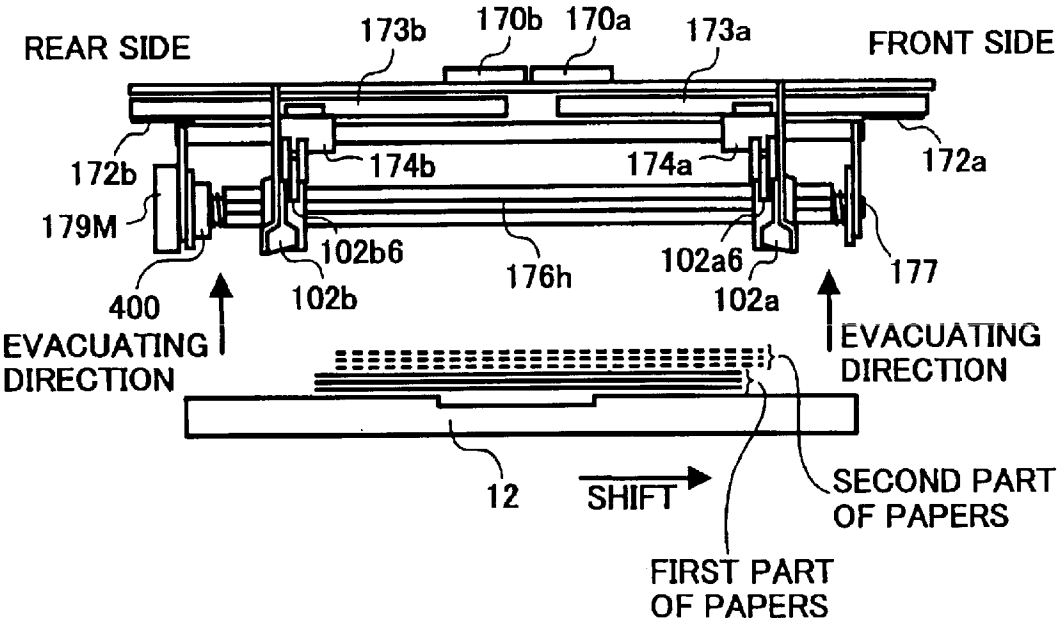

Next, the arranging members 102*a*, 102*b* are evacuated upward again as shown in FIG. 100 in order to carry out arrangement of a third part of papers and the tray 12 is shifted in the shift direction (width direction). Then, since the arranging member 102*b* placed on the first part of papers in arrangement of the second part of papers is placed opposing end of the papers when the arranging members 102*a*, 102*b* evacuated upward are rotated downward as shown in FIG. 101, the arranging portion 102*b*1 of the arranging member 102*b* accurately matches end of the third part of papers by rotating the arranging member 102*b* by A°+ΔA° or more by α° for rotating it slightly downward.

Figure 101B:
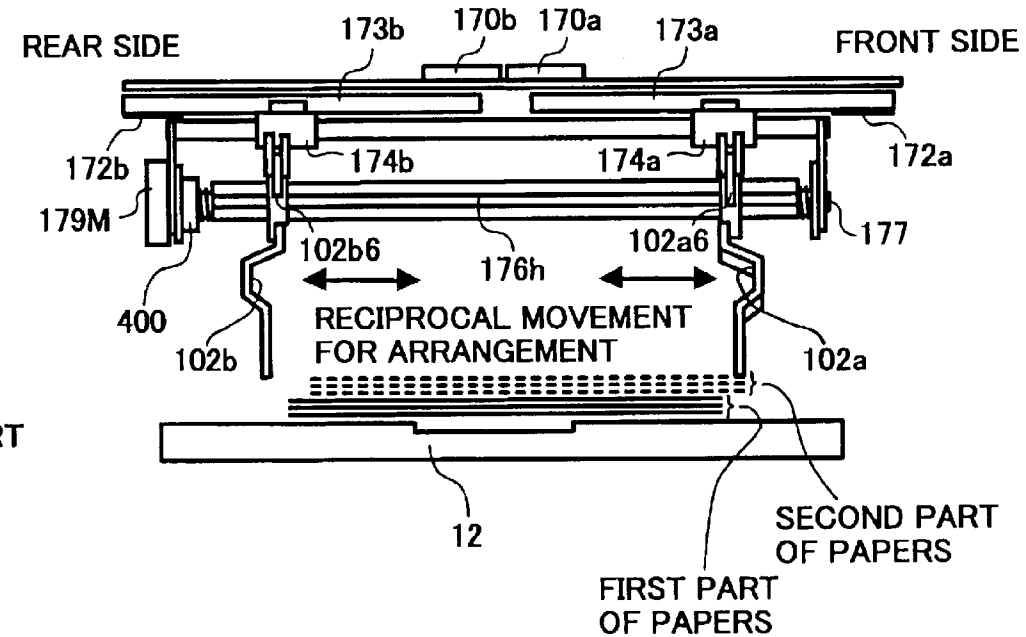
FIG. 101(*a*) is a partial sectional view of means for moving the arranging member seen from the left side, FIG. 101(*b*) is a front view of means for moving the arranging member, and FIG. 101(*c*) is a partial sectional view of means for moving the arranging member seen from the right side.
Figure 101A:
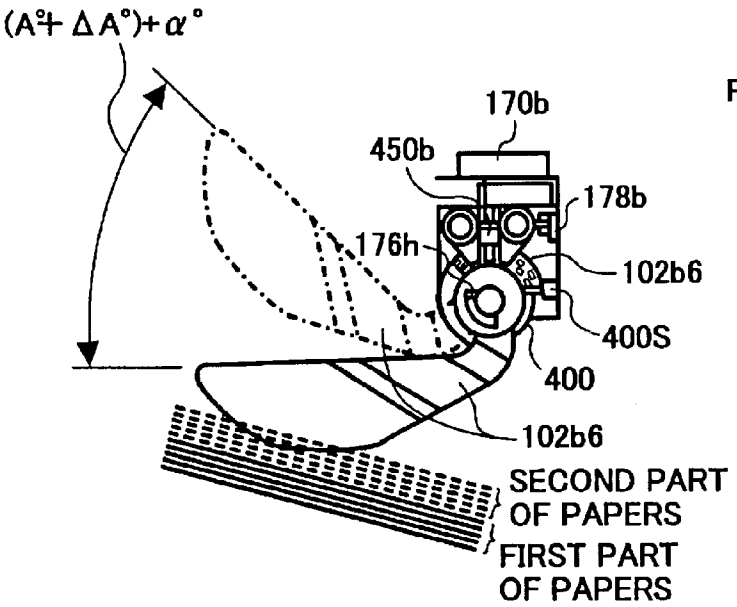
Figure 102A:
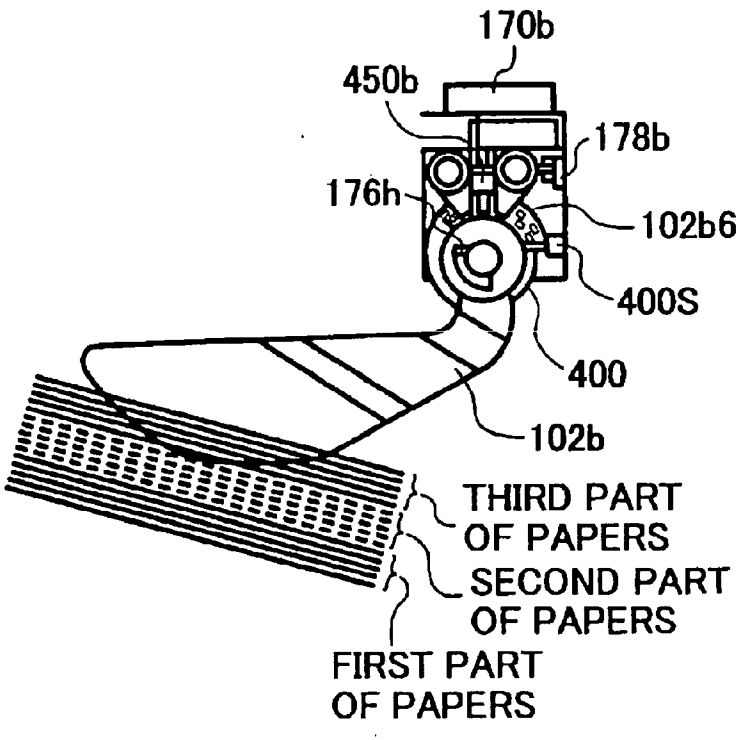
FIG. 102(*a*) is a partial sectional view of means for moving the arranging member seen from the left side, FIG. 102(*b*) is a front view of means for moving the arranging member, and FIG. 102(*c*) is a partial sectional view of means for moving the arranging member seen from the right side.
Figure 101C:
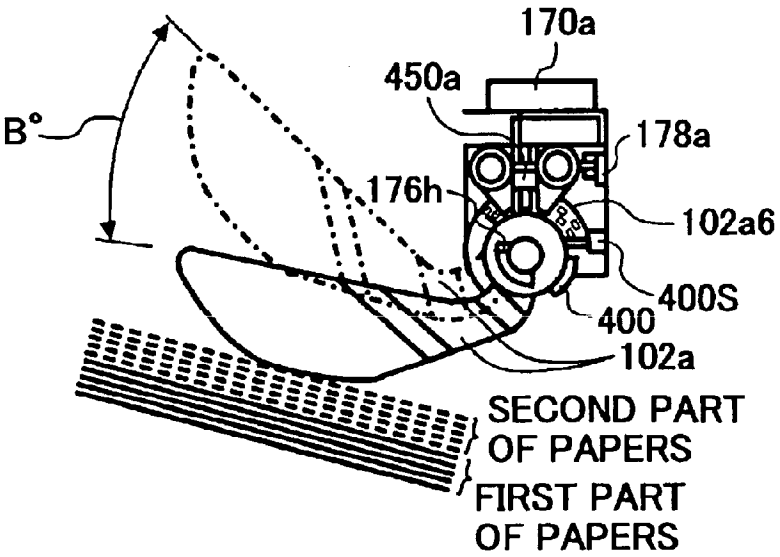
Figure 102C:
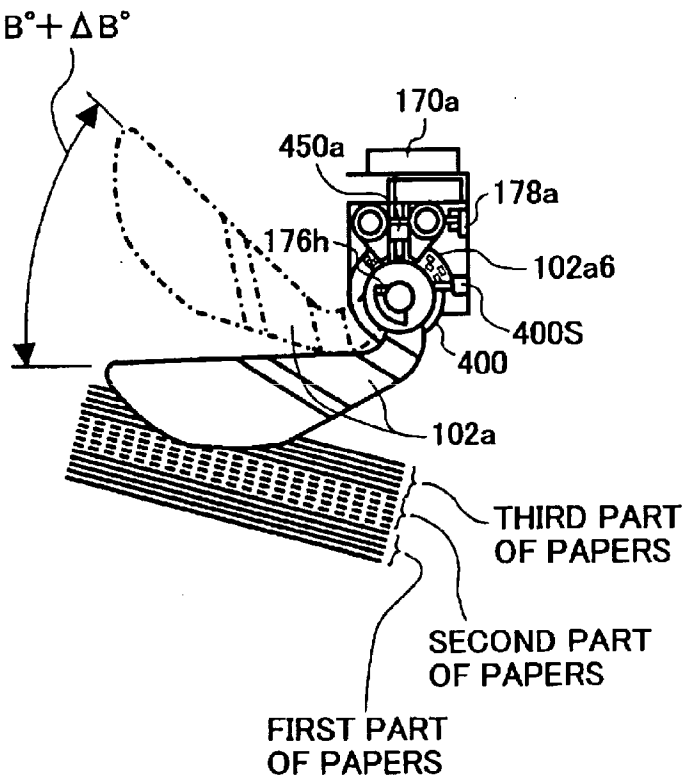
Figure 102B:
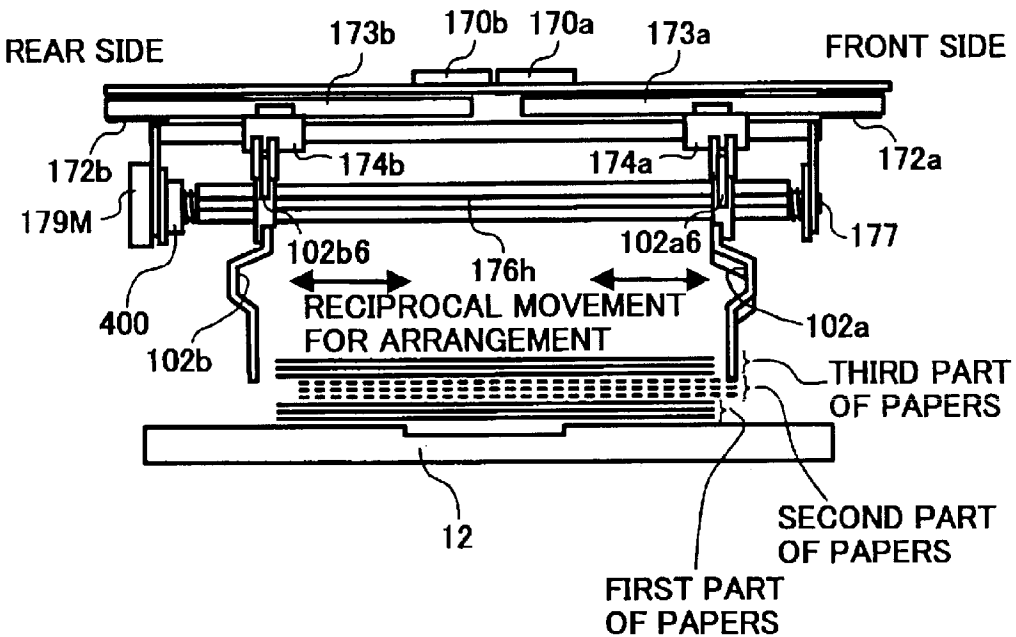

Also, when the evacuated arranging members 102*a*, 102*b* shown in FIG. 100 proceeds to the position for arrangement of the third part of papers shown in FIG. 101, the rotational angle of the arranging member 102*a* placed on the second part of papers is detected in arrangement of the third part of papers. For example, assuming that the rotational angle is B° as shown in FIG. 101(*b*). Then, since the tray 12 is raised during arrangement of the third part of papers, when the arrangement of the third part of papers is completed as shown in FIG. 102, the final rotational angle of the arranging member 102*a* placed on the second part of papers from the evacuating rotational position is B°+ΔB°.

Also, when arrangement of a fourth part of papers is carried out, the arranging portion 102*b*1 of the arranging member 102*a* accurately matches end of the fourth part of papers by rotating the arranging member 102*a* by B°+ΔB° or more by α° of margin for rotating it slightly downward.

Like this, by repeating a series of these arranging operations on later parts of papers, papers can be accurately arranged by means of the arranging members 102*a*, 102*b* regardless of the kind of image forming apparatus, curl direction of papers, curl amount and the number of papers piled on the discharging tray.

g. Embodiment Corresponding to Claim 45

The present embodiment is to solve the same problems as those in claim 44. When arrangement of the respective parts of papers are carried out by means of the arranging members 102*a*, 102*b* in the sorting mode, arrangement of a first part of papers is carried out as shown in FIG. 96 and then, the arranging members 102*a*, 102*b* are once evacuated upward as shown in FIG. 97 and meanwhile, the tray 12 is shifted in the shift direction (width direction). Then, when the arranging members 102*a*, 102*b* evacuated upward as shown in FIG. 97 are rotated downward to the position in which arrangement of the first part of papers as shown in FIG. 98 in order to carry out arrangement of a second part of papers, the rotational angle of the arranging member 102*b* placed on the next second part of papers can be detected by means of each slit SLT1, SLT2 and the pose detecting sensor 450*a* (450*b*) of the convex plates 102*a*6, 102*b*6 provided at the respective arranging members 102*a*, 102*b* in FIG. 78 and thus, it can be detected to what extent the arranging members 102*a*, 102*b* are rotated downward, respectively.

Because by comparing the rotational angles of the respective arranging members 102*a*, 102*b* from the evacuating rotational position with each other, it can be found that the arranging member placed on the second part of papers is smaller in rotational angle and that two arranging members 102*a*, 102*b* are placed on different parts of papers, in arrangement of other parts of papers next to the second part of papers, the arranging portion 102*a*1 (102*b*1) of the arranging member 102*a* (102*b*) accurately matches the end of the n-th part of papers by rotating the arranging member placed opposing the end of papers in arrangement of n-th (n is a natural number) part of papers by the final rotational angle of the arranging member placed on the n−1-th part of papers in arrangement of the n−1-th part of papers from the evacuating rotational position or more by α°.

Like this, by repeating a series of these arranging operations on later parts of papers, papers can be accurately arranged by means of the arranging members 102*a*, 102*b* regardless of the kind of image forming apparatus, curl direction of papers, curl amount and the number of papers piled on the discharging tray.

h. Embodiment Corresponding to Claim 46

Figure 109B:
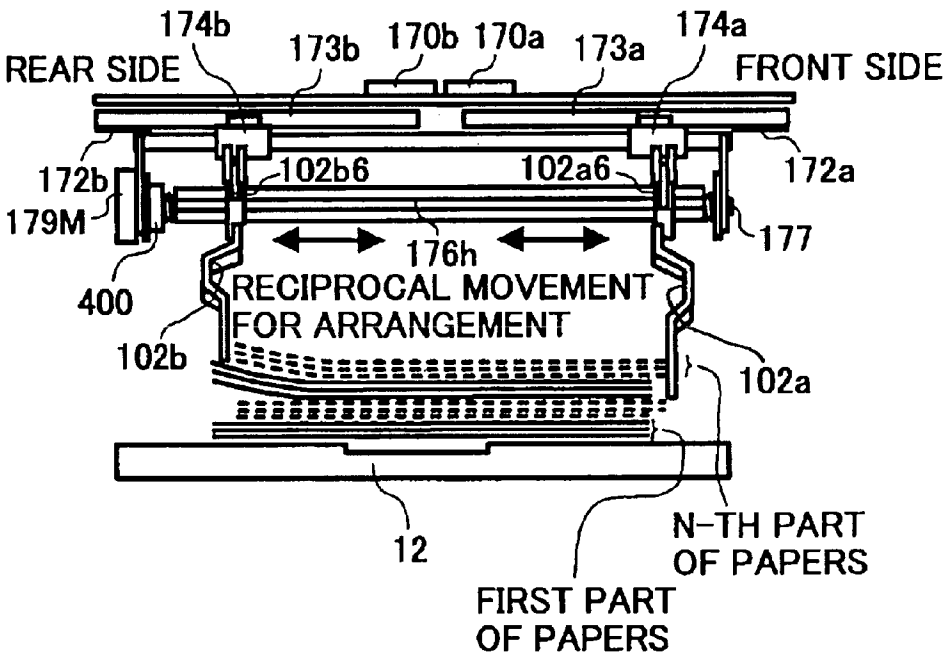
FIG. 109(*a*) shows means for moving the arranging member seen from the left side, FIG. 109(*b*) is a front view of means for moving the arranging member, and FIG. 109(*c*) shows means for moving the arranging member seen from the right side.
Figure 109A:
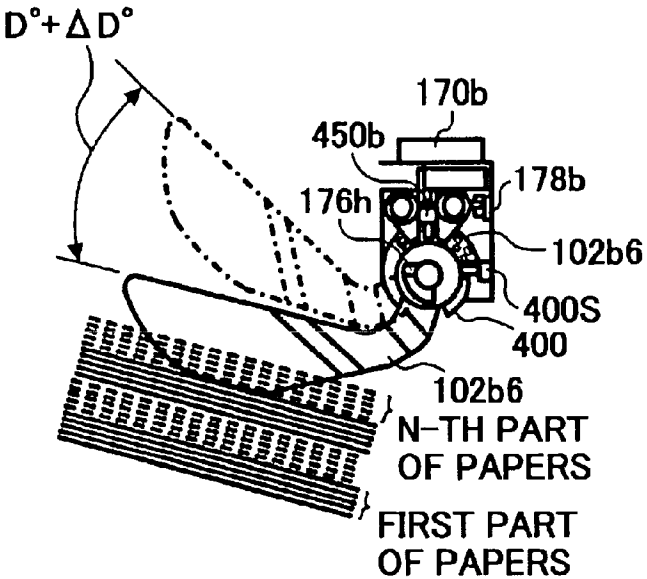
Figure 110A:
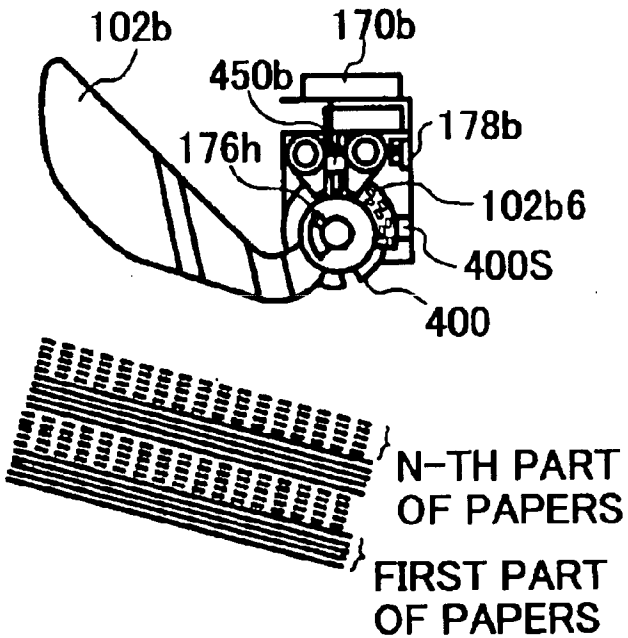
FIG. 110(*a*) shows means for moving the arranging member seen from the right and left side, FIG. 110(*b*) is a front view of means for moving the arranging member, and FIG. 110(*c*) shows means for moving the arranging member seen from the right side.
Figure 109C:
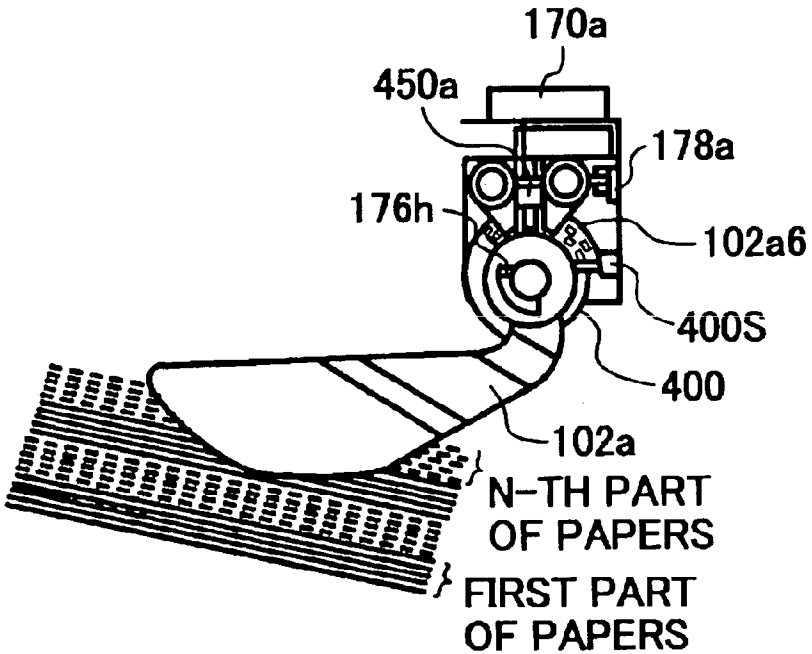
Figure 110C:
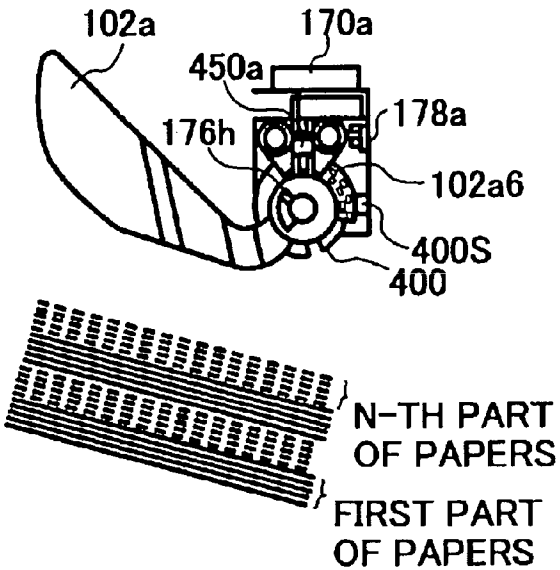
Figure 110B:
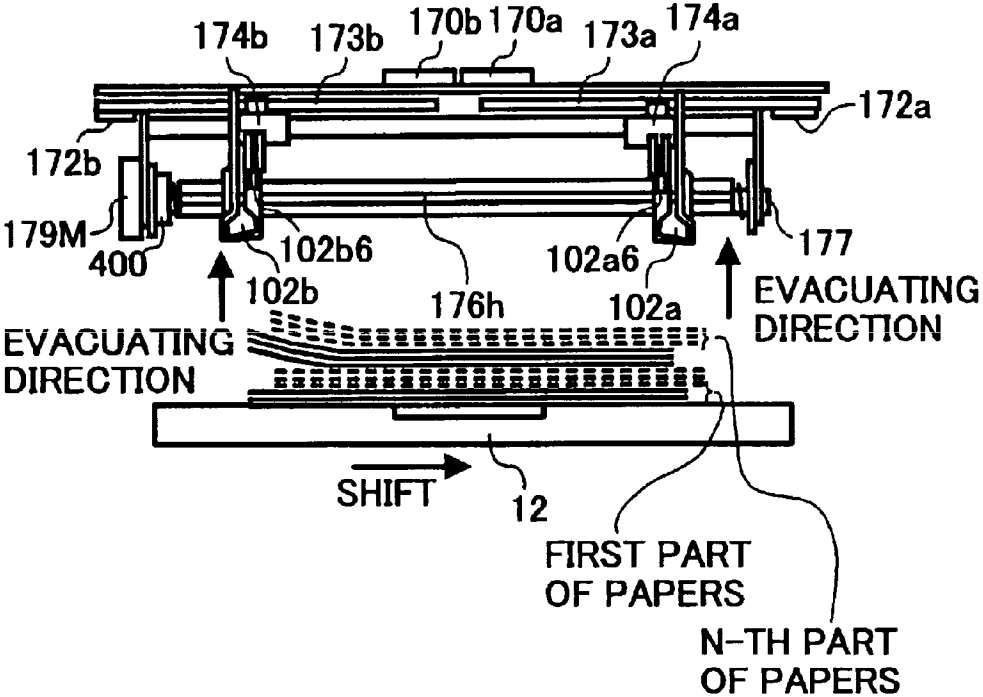
Figure 111B:
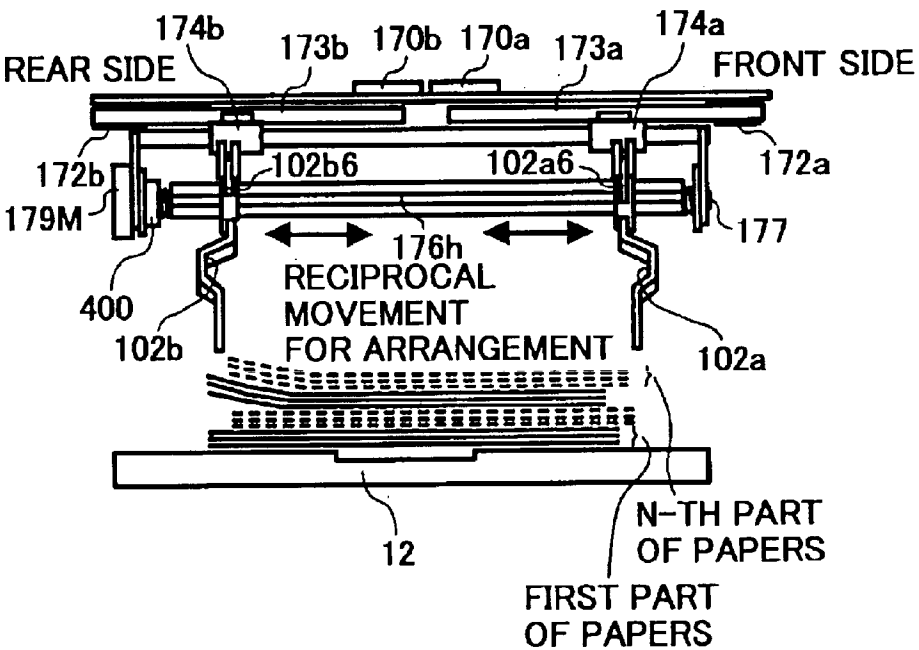
FIG. 111(*a*) shows means for moving the arranging member seen from the left side, FIG. 111(*b*) is a front view of means for moving the arranging member, and FIG. 111(*c*) shows means for moving the arranging member seen from the right side.
Figure 111A:
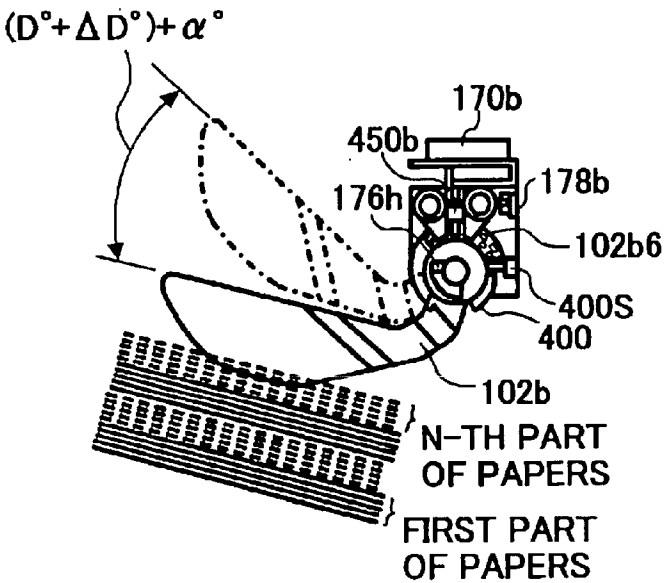
Figure 111C:
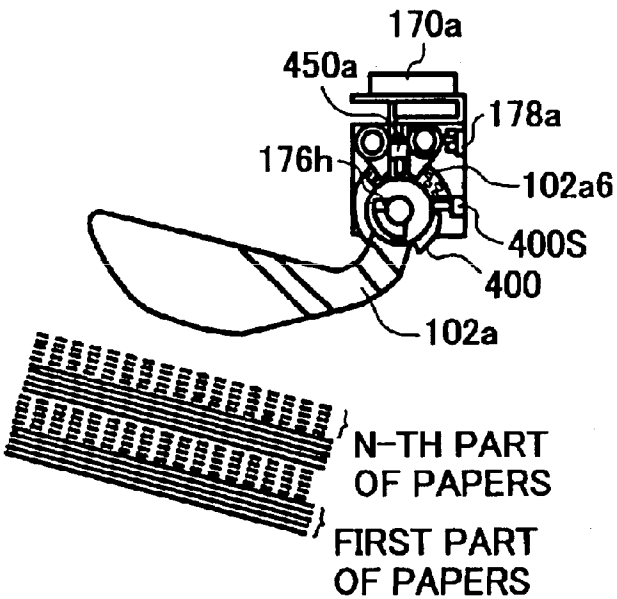

In the sorting mode, when curl amounts in the discharging direction and in a direction perpendicular to the direction are different in the plane containing the discharging direction of papers, the arranging members 102*a*, 102*b* are evacuated upward as shown in FIG. 110, in order to carry out arrangement of n+1-th part of papers after carrying out arrangement of the n-th part of papers later than first part of papers as shown in FIG. 109. Then, the tray 12 is shifted and then arrangement of the n+1-th part of papers is started as shown in FIG. 111. Assuming that the rotational angle of the arranging member 102*b* placed on the n-th part of papers from the evacuating rotational position in FIG. 109 is D°+Δ'°. When the rotational angle of the arranging member 102*b* placed opposing the end of the n+1-th part of papers from the evacuating rotational position is '°+Δ'°+α° in arrangement of the n+1-th part of papers as shown in FIG. 111, the arranging member 102*a* to be placed on the end of papers in arrangement of the n+1-th part of papers is floated, so that the arrangement cannot be carried out.

Here, when difference between the rotational angle of the arranging member 102*a* opposing the end of the n-th part of papers from the evacuating rotational position in arrangement of the n-th part of papers and the rotational angle of the arranging member 102*b* placed on the papers from the evacuating rotational position in arrangement of the n-th part of papers is greater than α°, the arranging operation on the n+1-th part of papers cannot be carried out. Therefore, at that time, a warning is output from the image forming apparatus or from the paper after-treatment apparatus and an operator stops discharging papers on the basis of the warning. After a user removes papers, the arranging operation is started on the remaining part of papers.

By doing so, arrangement of the whole papers can be carried out.

According to the present embodiment, even when curl of papers occurs such that the arranging operation in the sorting mode cannot be carried out on the way, the arranging operation can be prevented from being continuously carried out without any measures and arrangement of the whole parts of papers can be carried.

i. Embodiment Corresponding to Claim 50

In the conventional paper after-treatment apparatus, since the direction or size of curl is different according to types of paper to be piled on the tray 12, height of papers piled on the tray 12 and height in which arrangement is carried out by the arranging members 102*a*, 102*b*, detected by means of the paper detecting lever 1200 provided in the paper after-treatment apparatus, may be different from each other and the arranging portions 102*a*1, 102*b*1 of the arranging members 102*a*, 102*b* for arranging papers may not be fitted to the end of papers, so that arrangement may not be carried out.

For example, in a case of an apparatus having a property that a curl that end of a paper at downstream in the paper conveying direction is lifted takes place as shown in FIG. 81(*a*), even when the arranging members are placed at the arranging rotational position set as if there does not occur such curl, the arranging portions are separated from the end of papers. The same thing is available for a case that a curl that end of a paper at downstream in the paper conveying direction is bended downward takes place as shown in FIG. 81(*b*).

Here, on the basis of a property of this curl, that is, a fact that the height of papers are equal to each other at a front and a back part in a width direction (front-back direction) of paper, both arranging rotational positions of the arranging members are determined with reference to height of papers detected by means of the arranging member at a predetermined side.

Figure 112A:
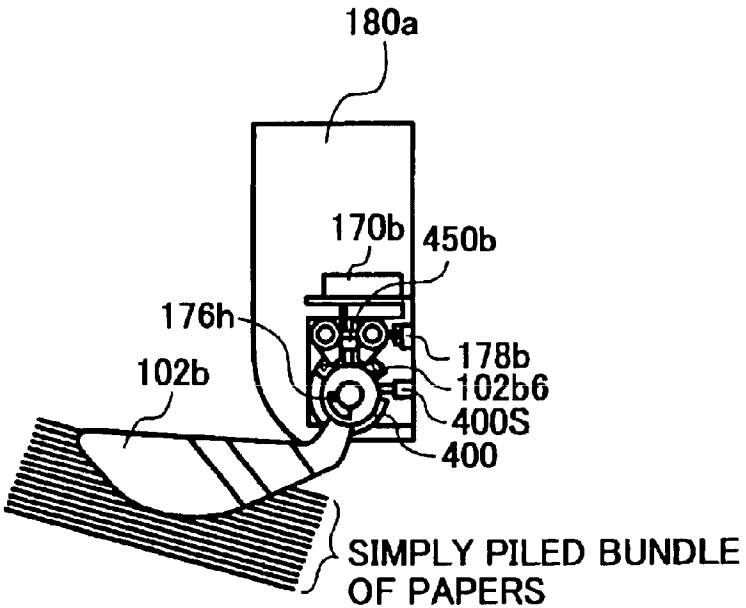
FIG. 112(*a*) shows means for moving the arranging member seen from the left side, FIG. 112(*b*) is a front view of means for moving the arranging member, and FIG. 112(*c*) shows means for moving the arranging member seen from the right side.
Figure 112C:
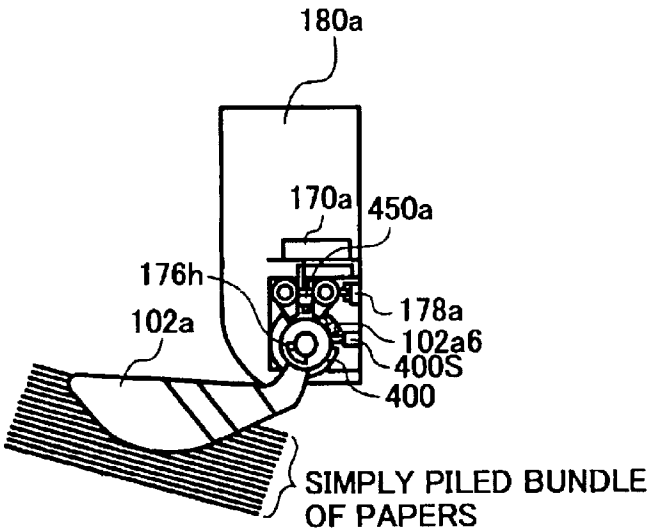
Figure 112B:
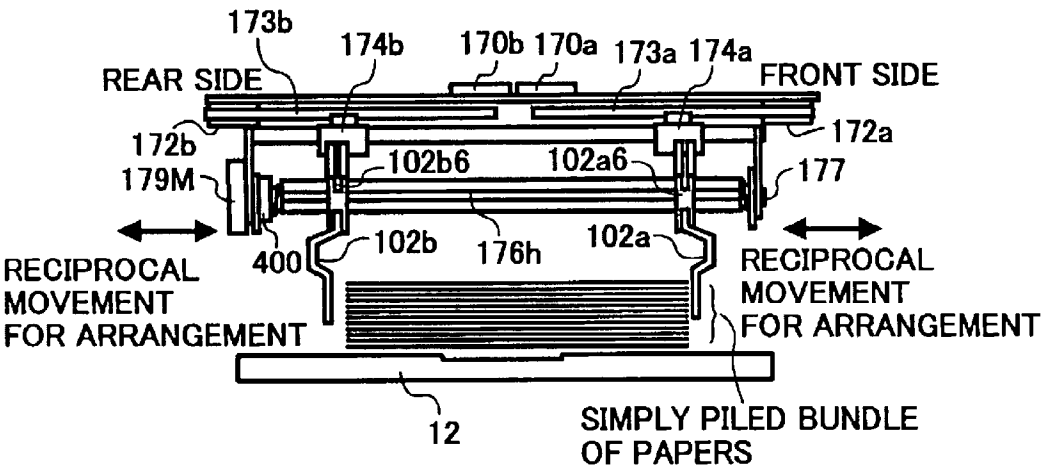
Figure 113B:
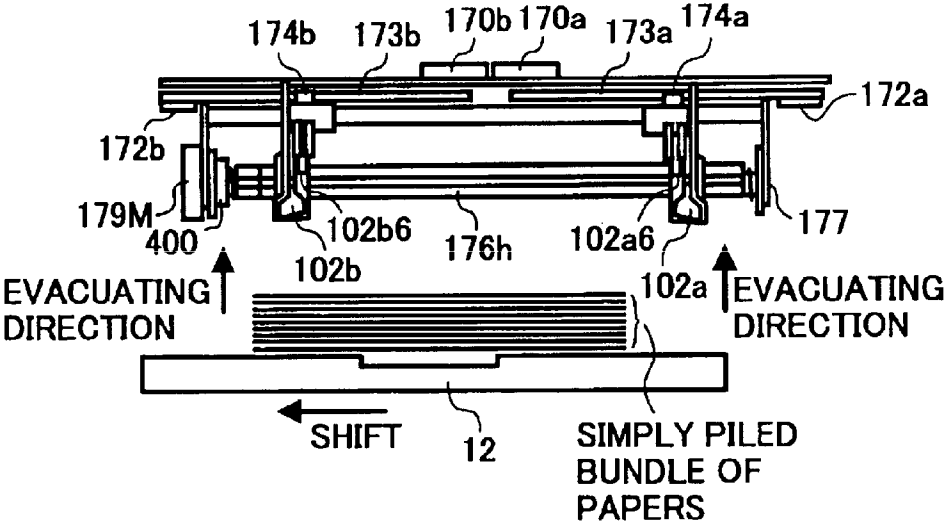
FIG. 113(*a*) shows means for moving the arranging member seen from the left side, FIG. 113(*b*) is a front view of means for moving the arranging member, and FIG. 113(*c*) shows means for moving the arranging member seen from the right side.
Figure 113A:
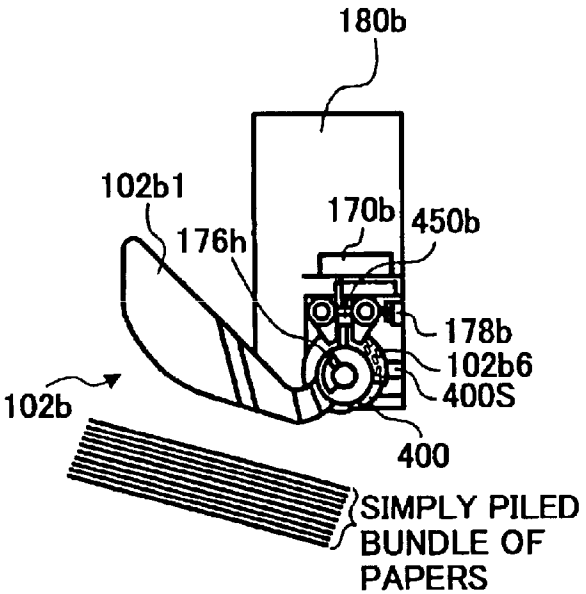
Figure 113C:
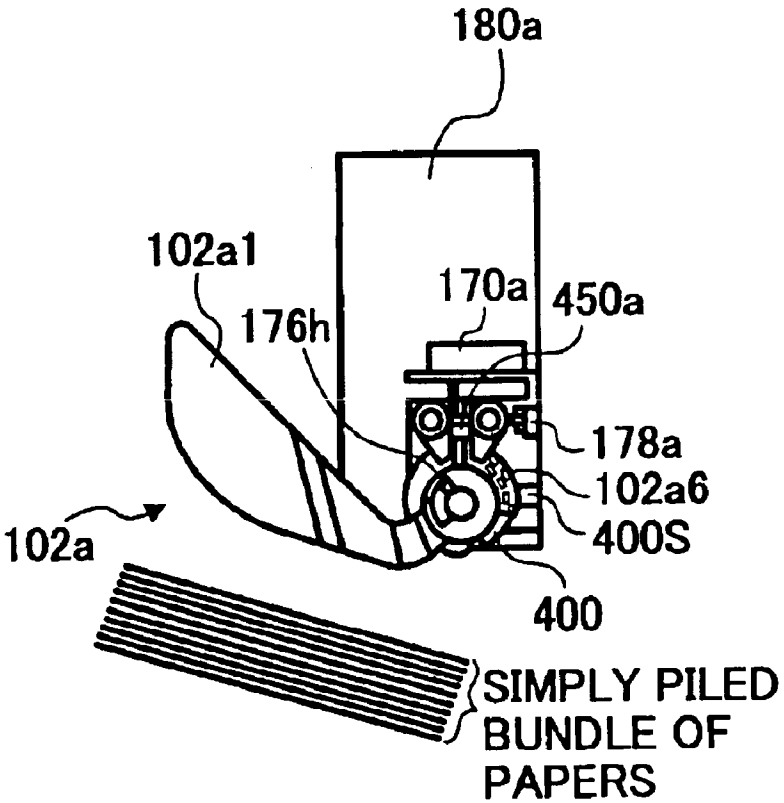

In arranging operation in a simple piling mode for simply piling and arranging papers on the tray 12, not in the sorting mode, papers are piled on the tray 12 until the number of papers piled is a predetermined number, as shown in FIG. 112. At the time that the number of papers reaches the predetermined number (the minimum number in which influence due to curl appears) in which height of papers is abnormal, the arranging members 102*a*, 102*b* are evacuated upward as shown in FIG. 113 and the arranging member at one side is moved in the width direction of papers, so that a gap between both arranging members gets narrower than width of paper.

Figure 114B:
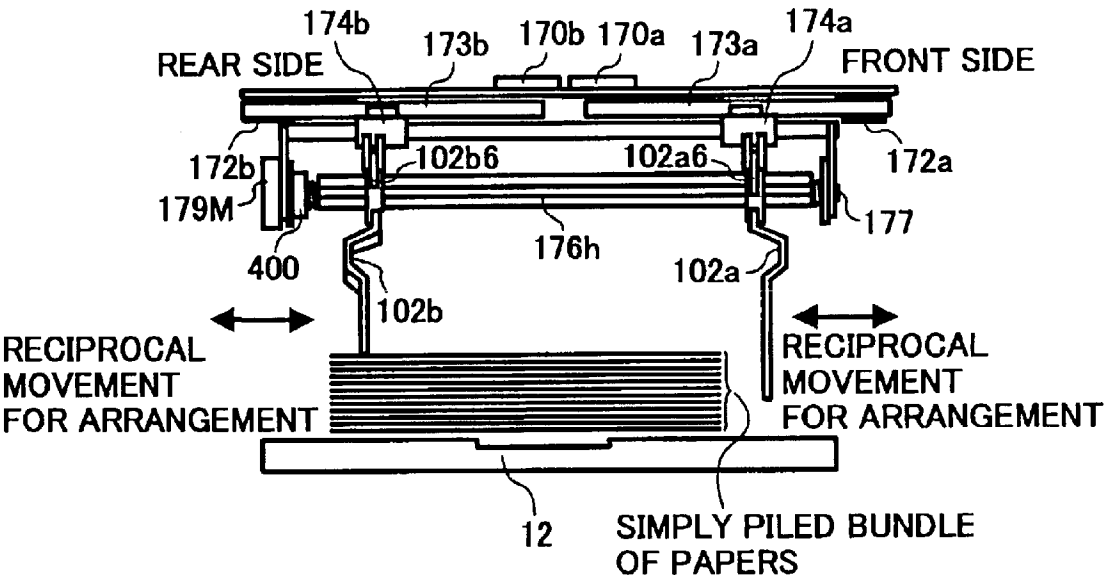
FIG. 114(*a*) shows means for moving the arranging member seen from the left side, FIG. 114(*b*) is a front view of means for moving the arranging member, and FIG. 114(*c*) shows means for moving the arranging member seen from the right side.
Figure 114A:
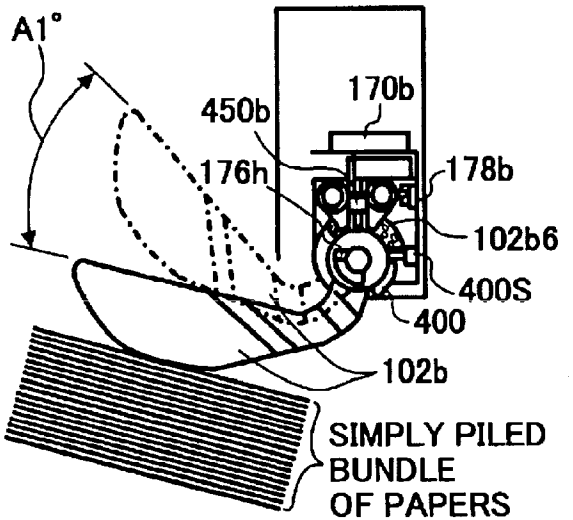
Figure 114C:
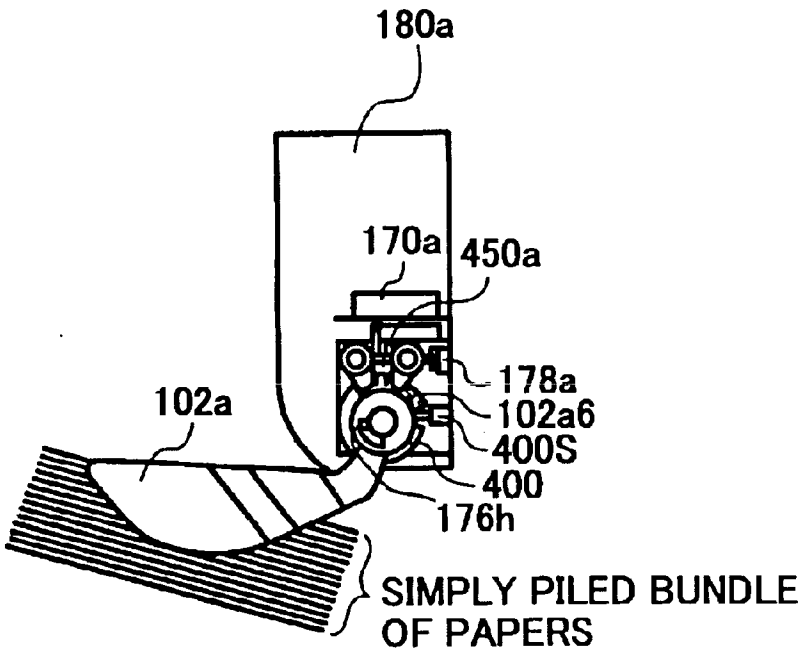

Next, as shown in FIG. 114, both arranging members are rotated toward the arranging rotational positions. At that time, the arranging member that is moved in the width direction of papers, for example, the arranging member 102*b* is placed on the bundle of papers on which the arrangement has been carried out. Here, when the rotational angle of the arranging member from the evacuating rotational position is detected by means of the pose detecting sensor 450*b* and the slits SLT1, SLT2 of the convex plate 102*b*6, it can be detected to what extent the arranging member 102*b* is rotated downward from the evacuating rotational position to contact with a top surface of papers.

Figure 115A:
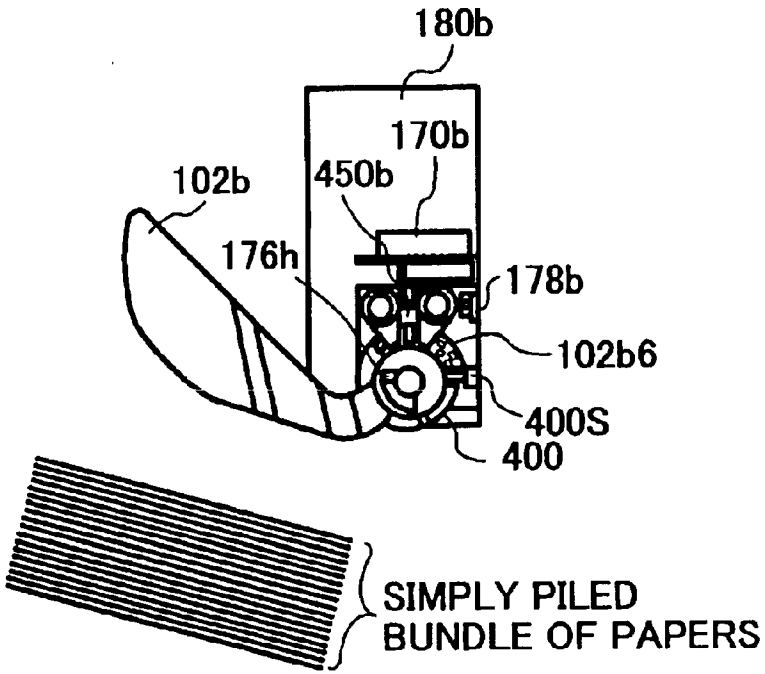
FIG. 115(*a*) shows means for moving the arranging member seen from the left side, FIG. 115(*b*) is a front view of means for moving the arranging member, and FIG. 115(*c*) shows means for moving the arranging member seen from the right side.
Figure 115C:
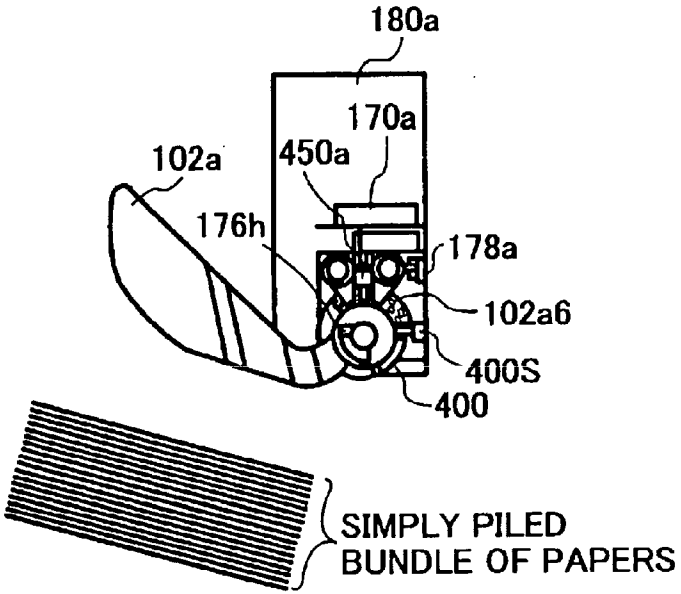
Figure 115B:
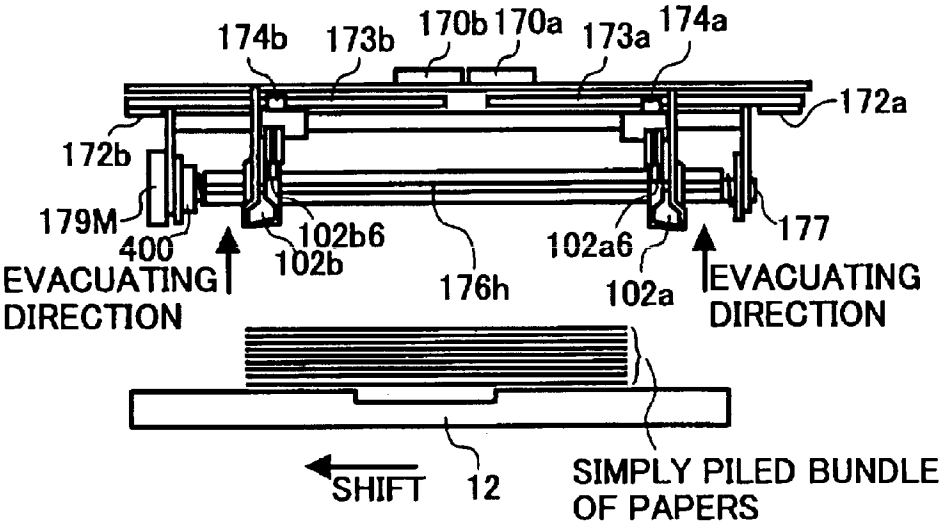
Figure 116B:
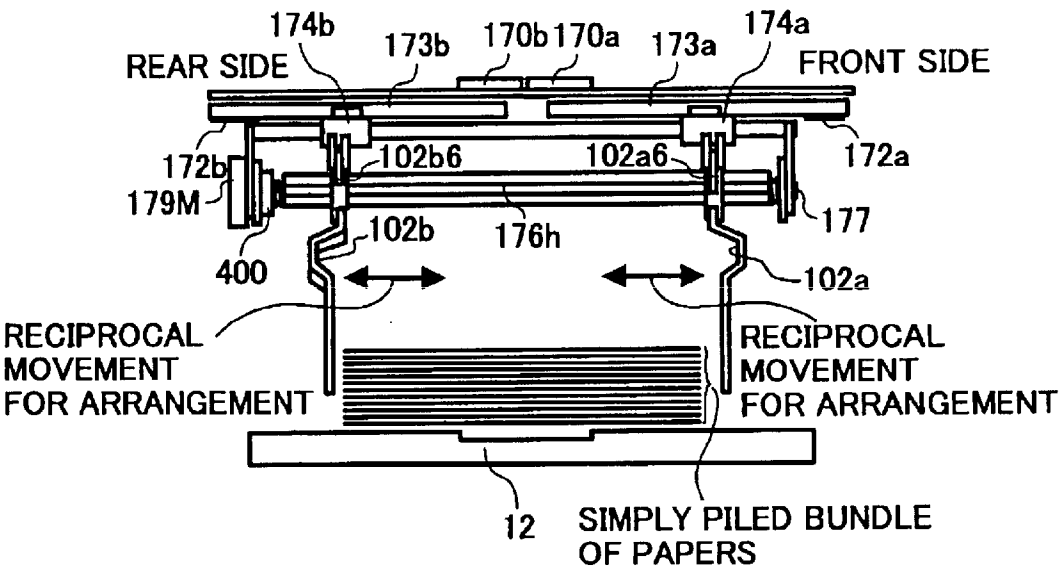
FIG. 116(*a*) shows means for moving the arranging member seen from the left side, FIG. 116(*b*) is a front view of means for moving the arranging member, and FIG. 116(*c*) shows means for moving the arranging member seen from the right side.
Figure 116A:
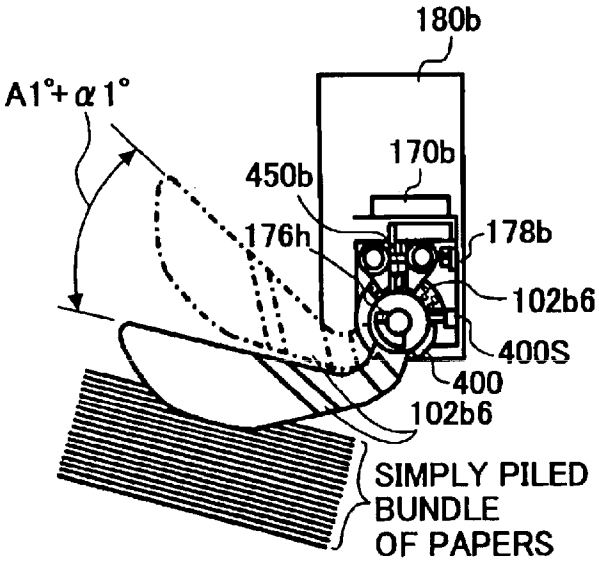

As shown in FIG. 115, the arranging members 102*a*, 102*b* are evacuated upward and the arranging member 102*b* at one side is moved to restore a gap between both arranging members to a gap in arrangement, a paper input position. Then, when the arranging members 102*a*, 102*b* are rotated downward to place them at positions in arrangement, by rotating the arranging members 102*a*, 102*b* downward more by $\alpha 1°$ than the rotational angle A1° of the arranging member 102*b* detected in going from FIG. 113 to FIG. 114, the respective arranging portion 102*a*1, 102*b*1 of the arranging members 102*a*, 102*b* is accessed to end of papers to be arranged. Therefore, arrangement can be carried out without affecting the curl direction or the curl amount of papers to be piled on the tray 12.

j. Embodiment Corresponding to Claims 51 and 52

The present embodiment is to solve the same problems as in claim 50.

The present embodiment will be described.

Figure 117A:
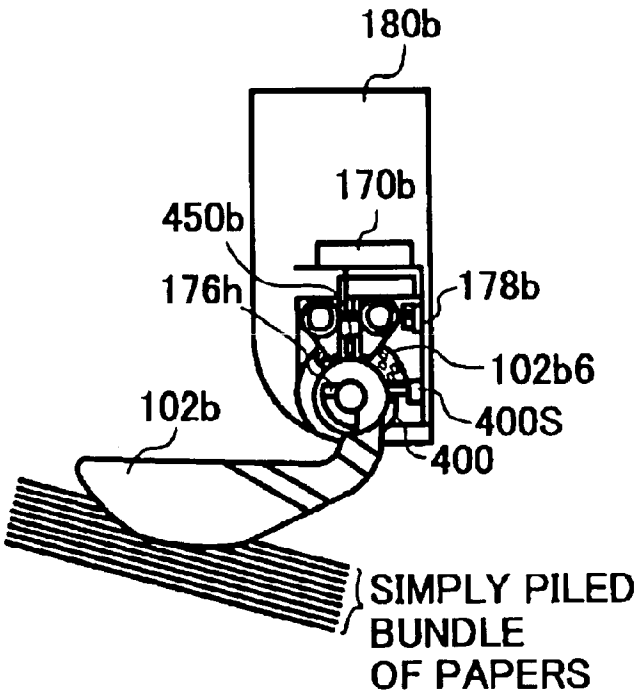
FIG. 117(*a*) shows means for moving the arranging member seen from the left side, FIG. 117(*b*) is a front view of means for moving the arranging member, and FIG. 117(*c*) shows means for moving the arranging member seen from the right side.
Figure 116C:
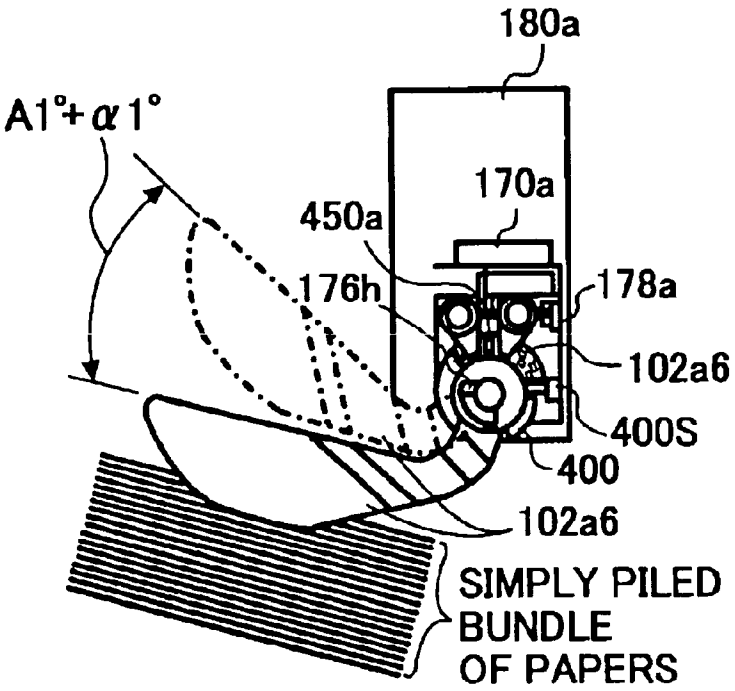
Figure 117C:
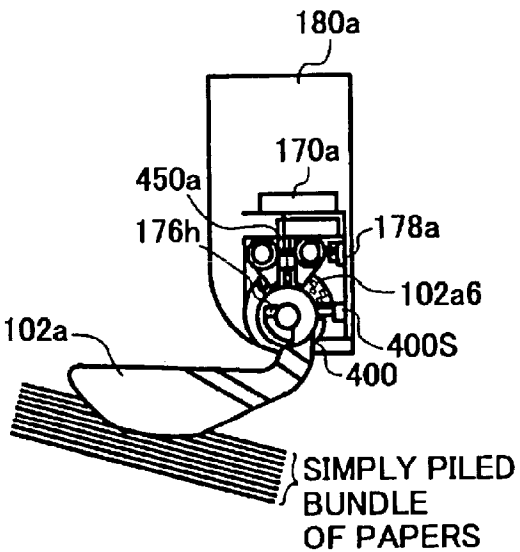
Figure 117B:
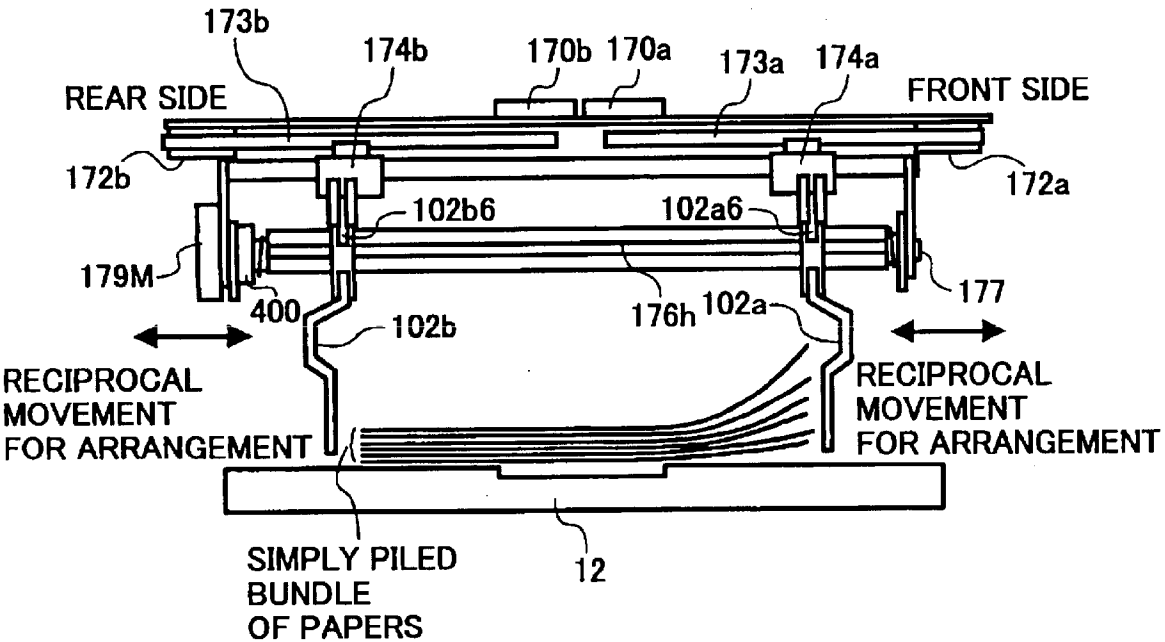
Figure 118B:
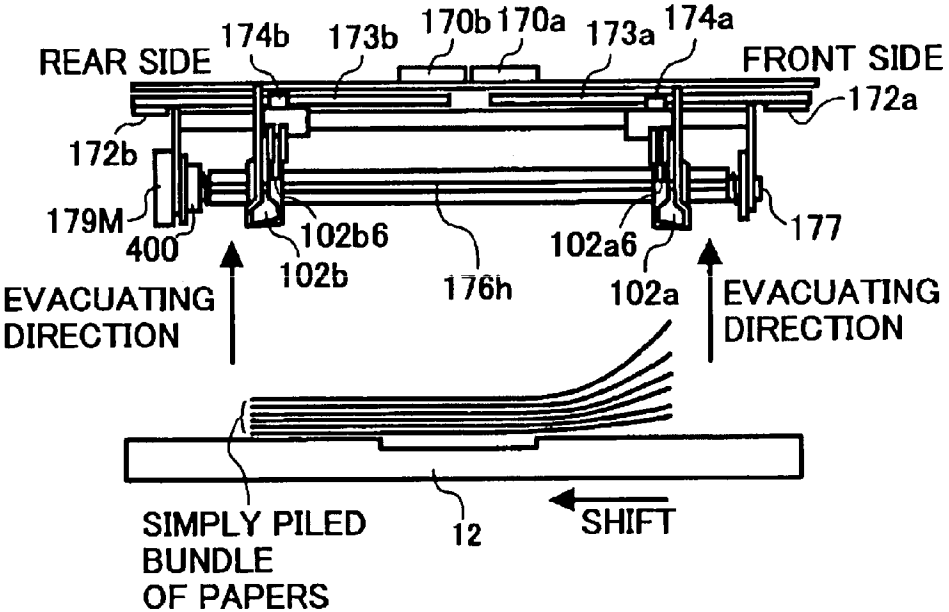
FIG. 118(*a*) shows means for moving the arranging members seen from the left side, FIG. 118(*b*) is a front view of means for moving the arranging member, and FIG. 118(*c*) shows means for moving the arranging member seen from the right side.
Figure 118A:
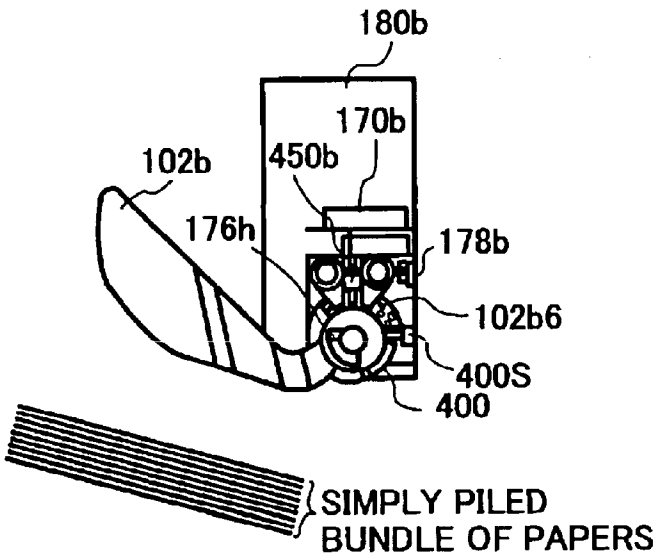
Figure 118C:
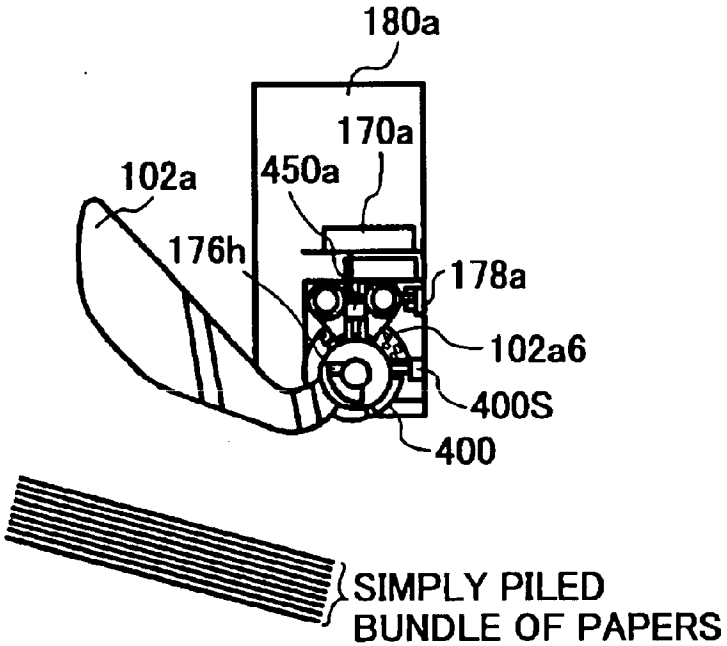

In arranging operation in a simple piling mode, papers are piled on the tray 12 until the number of papers piled is a predetermined number, as shown in FIG. 117. At the time that the number of papers reaches the predetermined, the arranging members 102*a*, 102*b* are evacuated upward to the evacuating rotational position as shown in FIG. 118 and also, both arranging members are uniformly moved, so that a gap between both arranging members gets narrower than width of paper.

Figure 119A:
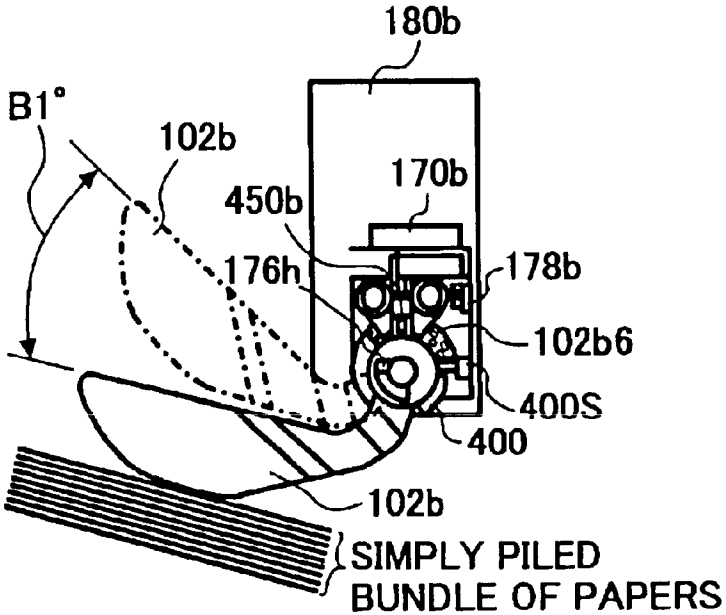
FIG. 119(*a*) shows means for moving the arranging members seen from the left side, FIG. 119(*b*) is a front view of means for moving the arranging member, and FIG. 119(*c*) shows means for moving the arranging member seen from the right side.
Figure 119C:
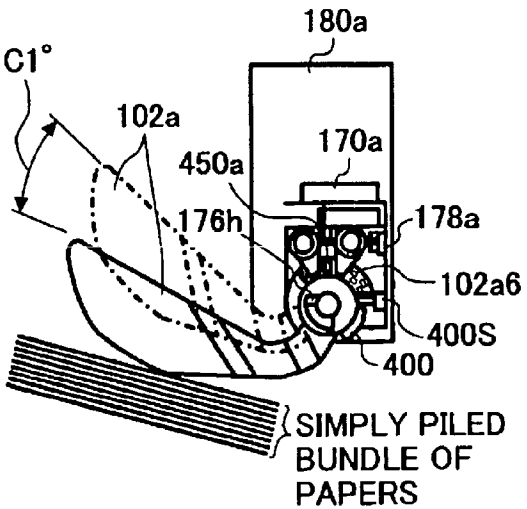
Figure 119B:
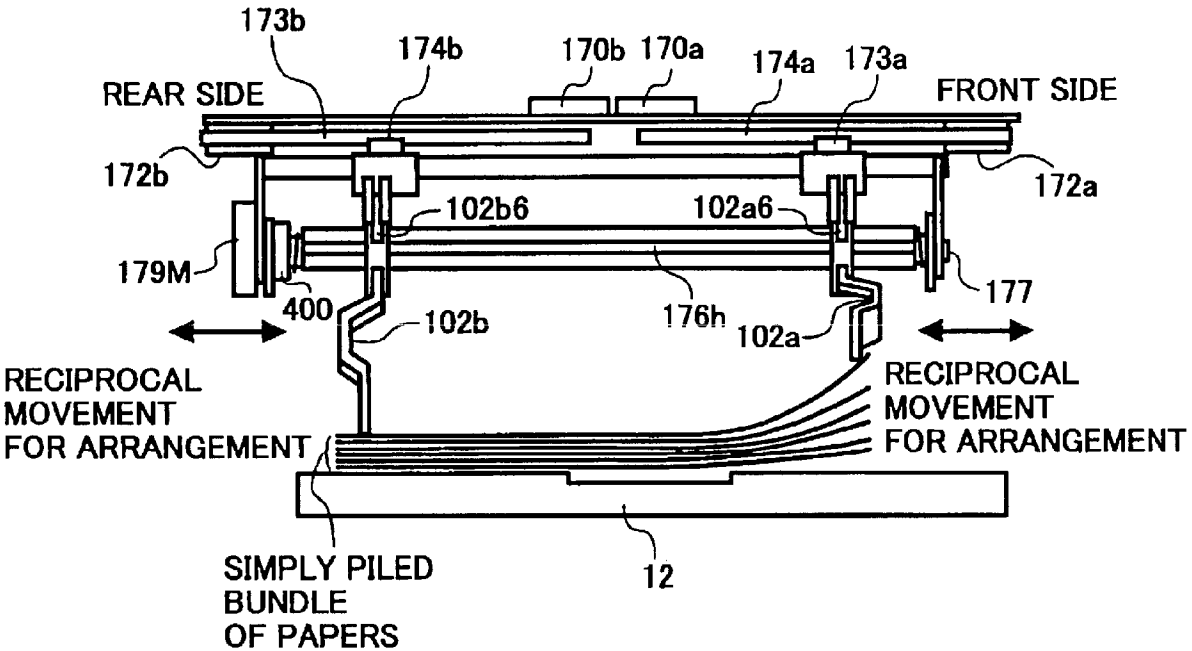

Next, both arranging members 102*a*, 102*b* are rotated downward to the arranging rotational positions. By doing so, the respective arranging members 102*a*, 102*b* is placed on the bundle of papers on which the arrangement has been carried out as shown in FIG. 119. Here, when detected by means of the pose detecting sensor 450*a* (460*b*) and the slits SLT1, SLT2 of the convex plate 102*a*6, 102*b*6 provided in the respective arranging members 102*a*, 102*b* in FIG. 78, it can be detected to what extent the arranging members 102*a*, 102*b* is rotated downward to be placed on the top surface of papers.

Figure 120B:
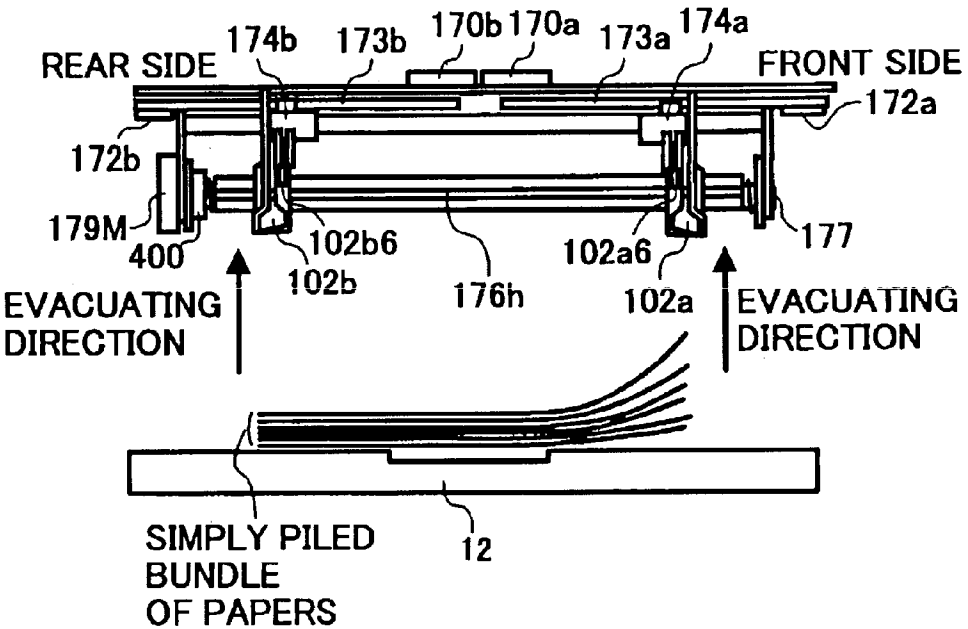
Figure 120A:
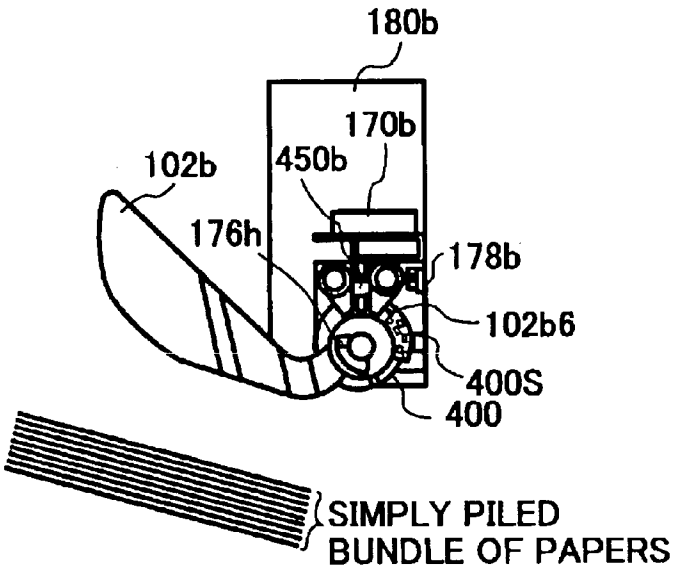
Figure 121A:
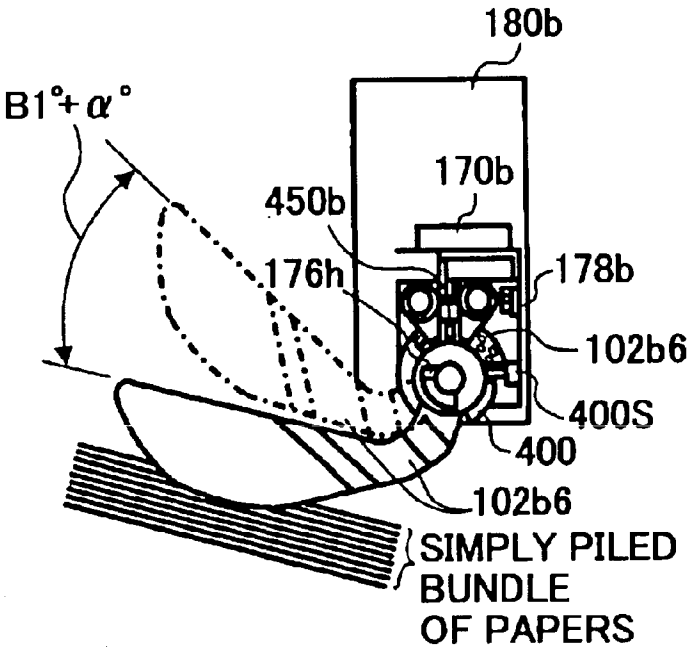
Figure 120C:
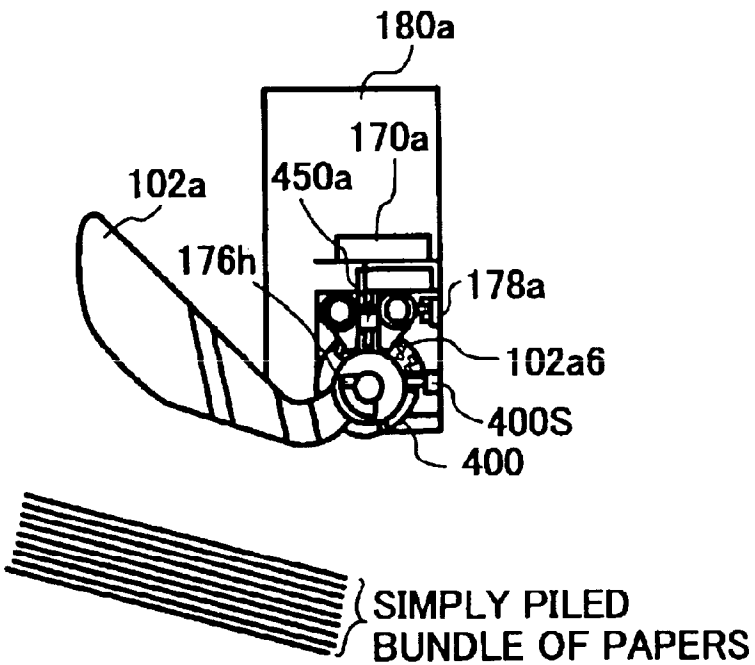
Figure 121C:
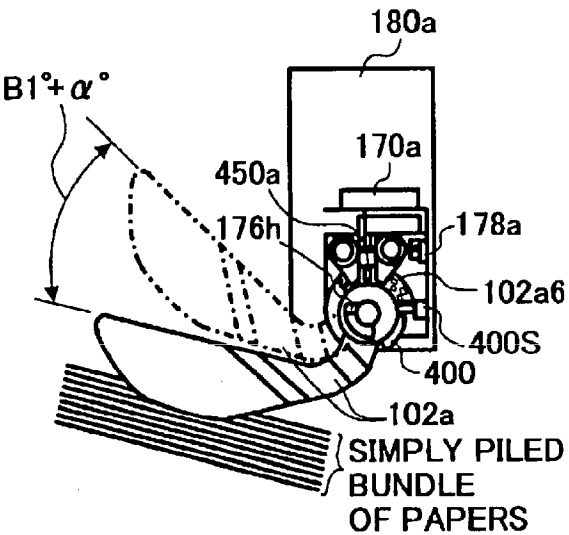
Figure 121B:
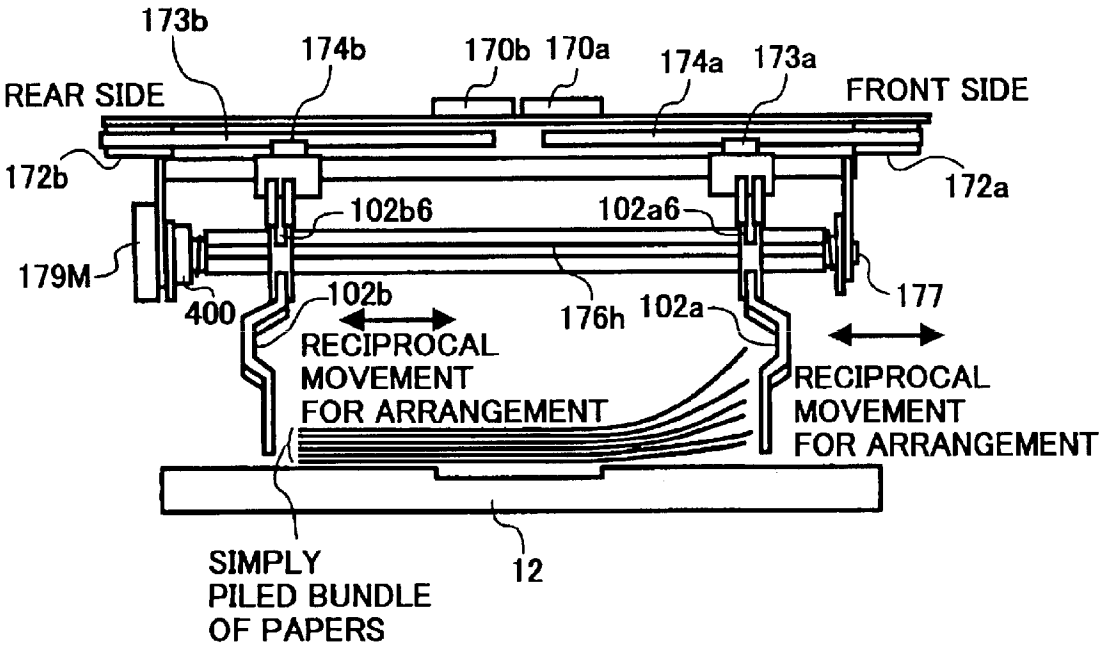

For example, assuming that the rotational angle of the arranging member 102*b* is B1° and the rotational angle of the other arranging member 102*a* is C1°. Then, there is one relationship between them, out of B1°>C1°, B1°=C1° and B1°<C1°. In order to carry out the arranging operation again, the arranging members 102*a*, 102*b* are evacuated upward as shown in FIG. 120 and both arranging members 102*a*, 102*b* are moved to restore a gap between both arranging members to a gap in arrangement. Then, the arranging members 102*a*, 102*b* are rotated downward to place them opposing end of the bundle of papers to be arranged. At that time, when B1°>C1° or B1°<C1° on the basis of the rotational angle detected in FIG. 119, the respective arranging members 102*a*, 102*b* are rotated from the evacuating rotational position, downward more by a given angle $\alpha°$ than the greater rotation angle (the rotation angle B1° of the arranging member 102*b* in FIG. 119). That is, with respect to the arranging member of two arranging members whose a free end (arranging portion) is in lower position, their poses are adjusted to the arranging position for sandwiching the ends of papers.

Also, when B1°=C1°, the respective arranging members 102*a*, 102*b* are rotated from the evacuating rotational position to be in a lower position by a given angle $\alpha°$ than B1° or C1°.

By this, the respective arranging portions 102*a*1, 102*b*1 of the arranging members 102*a*, 102*b* are accurately fitted to the end of papers and thus, arrangement can be carried out without affecting the curl direction or the curl amount of papers to be piled on the tray 12.

k. Embodiment Corresponding to Claims 53, 54

When adjustment of the curl direction or amount of papers piled on the tray is carried out by means of detection (detection of pose) or adjustment (adjustment of pose) of the rotational angle of arranging members 102*a*, 102*b* provided in the paper after-treatment apparatus, a predetermined time is required for those detection or adjustment. Therefore, when the discharging speed of papers in the image forming apparatus is great, detection of the curl direction or amount of papers through the arranging members may not be possible.

Construction of this embodiment is as following.

In arranging operation in a simple piling mode, a predetermined number of papers are piled on the tray 12 by means of the arranging members 102*a*, 102*b* as shown in FIGS. 109 to 116 and then, detection of the curl direction or amount by means of the arranging members 102*a*, 102*b* requires time.

Therefore, when the discharging speed of papers from the image forming apparatus 50 connected to the sheet-shaped medium after-treatment apparatus 51 is great, the discharging interval time of papers can be made long to slow down the discharging timing, by making the paper-discharging speed from the discharging means (paper-discharging roller 3) of the sheet-shaped medium after-treatment apparatus small. Meanwhile, the curl direction or amount of papers can be detected by means of the arranging members 102*a*, 102*b* and the pose control can be carried out on the basis of the detection result.

In arranging operation in a simple piling mode, a predetermined number of papers are piled on the tray 12 by means of the plurality of arranging members 102*a*, 102*b* as shown in FIGS. 117 to 121 and then, detection of the curl direction or amount of papers by means of the arranging members 102*a*, 102*b* requires time. Therefore, even in this case, when, the paper-discharging speed of the image forming apparatus 50 provided in the sheet-shaped medium after-treatment apparatus 51 is great, the paper-discharging interval time can be made long to slow delay the discharging timing, by making the paper-discharging speed from the discharging means of the paper after-treatment apparatus small. Meanwhile, the curl direction or amount of papers can be detected by means of the arranging members 102*a*, 102*b* and the pose control can be carried out on the basis of the detection result.

l. Embodiment Corresponding to Claim 55

When curl not-uniformly occurs in papers piled on the tray 12 by means of the arranging members 102*a*, 102*b* provided in the sheet-shaped medium after-treatment apparatus, arrangement through the arranging members may not be carried out even by means of the pose control of the arranging members in arrangement. Measures in this case will be described.

Figure 122B:
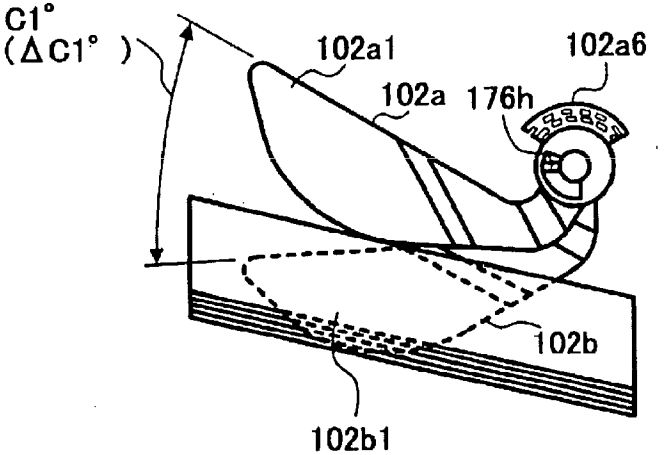
Figure 122A:
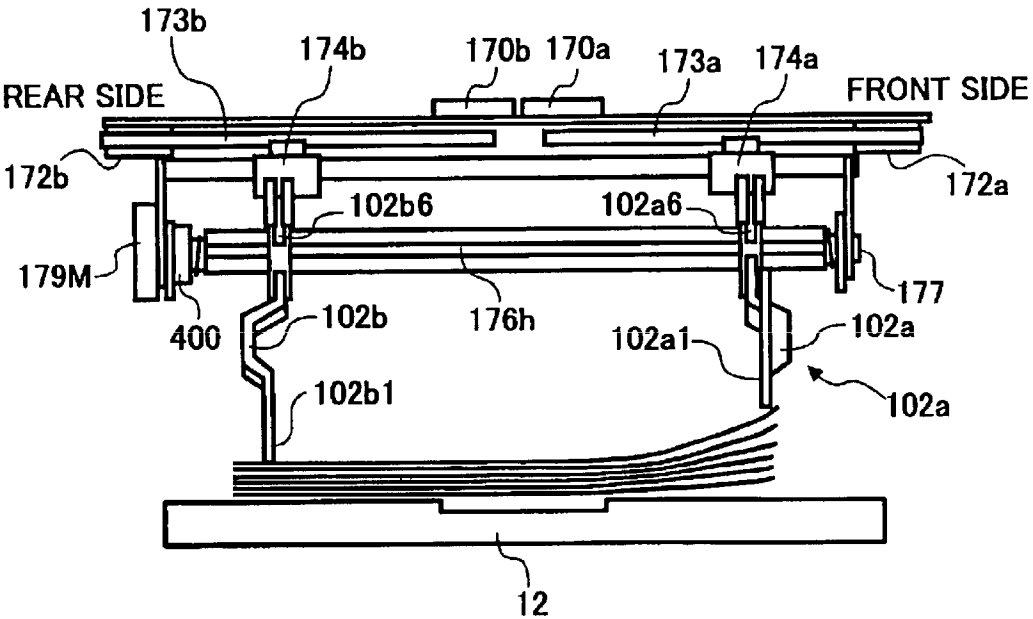
Figure 123B:
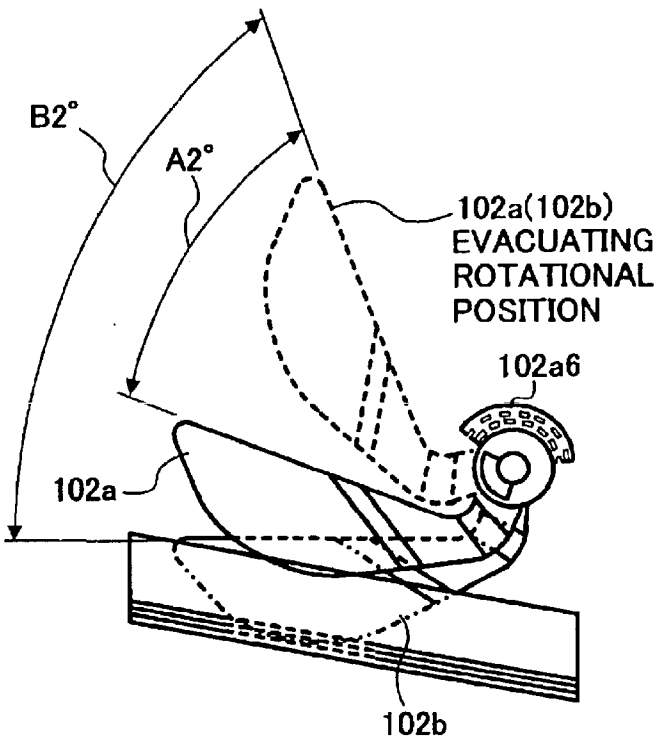
Figure 123A:
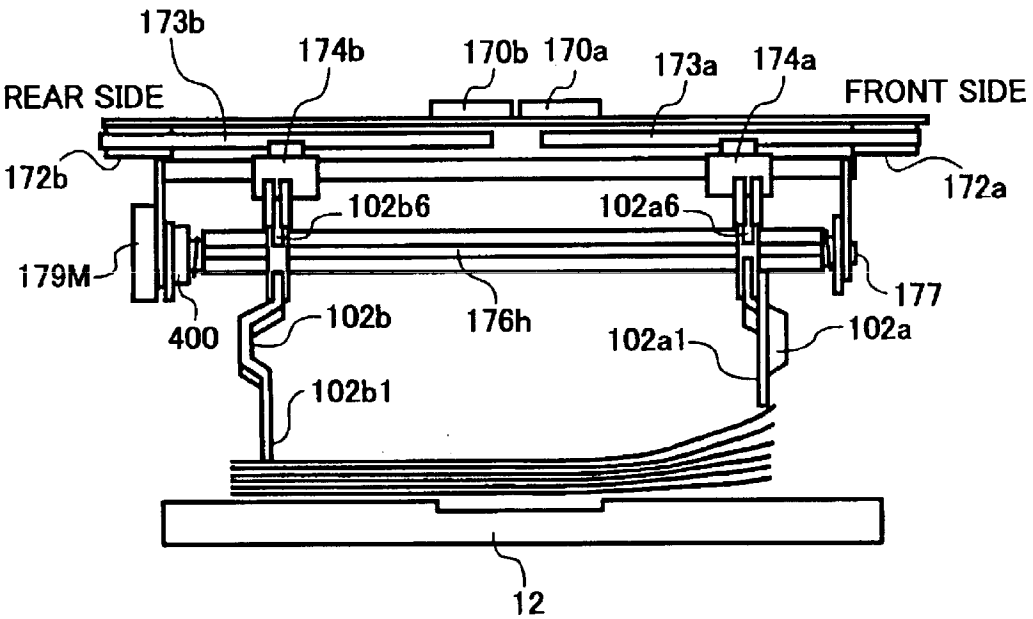
Figure 124B:
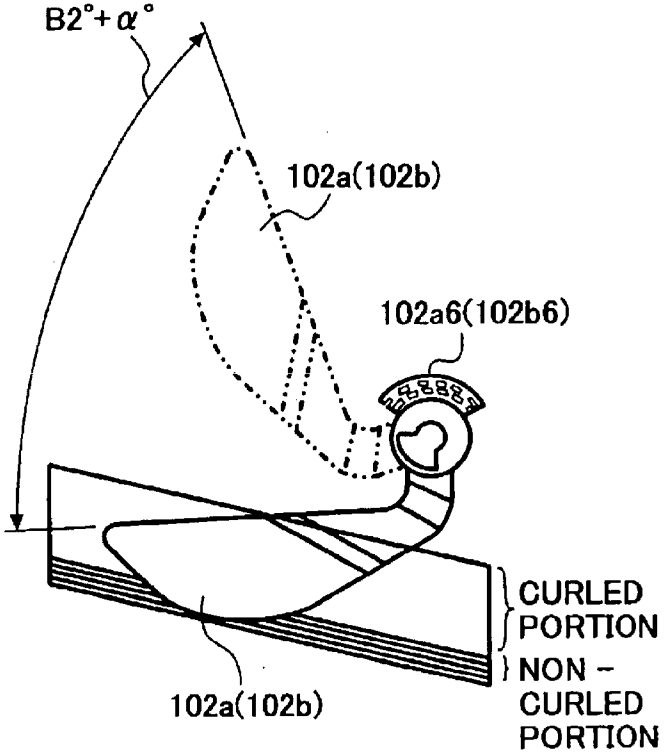
Figure 124A:
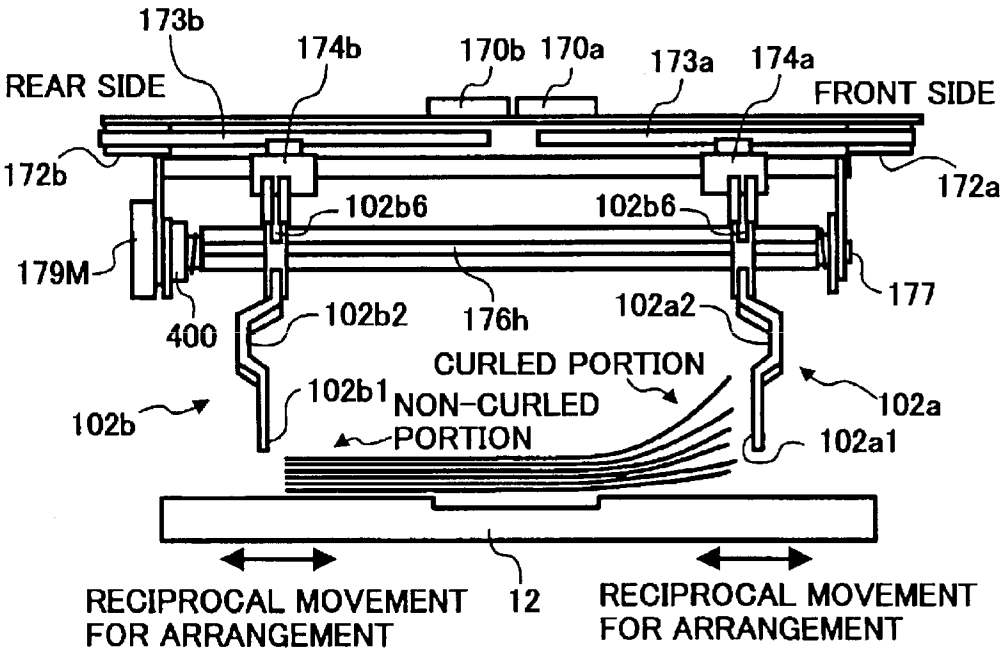

In arranging operation in a simple piling mode, when the curl direction or amount of papers on the tray 12 is detected by means of the arranging members 102*a*, 102*b* and the arranging portion 102*a*1 departs upward (or downward) from the arranging portion 102*b*1 of the other arranging member 102*b* one arranging member 102*a* as shown in FIG. 122, the curl direction or amount of papers on the tray 12 can be detected by comparing poses of the arranging members 102*a*, 102*b* with each other as shown in FIG. 123.

For example, if in FIG. 123, the rotational angle of one arranging member 102*a* from the evacuating rotational position is A2° and the rotation angle of the other arranging member 102*b* from the evacuating rotational position is B2°, then A2° <B2°. Therefore, although the arranging member 102*b* is rotated by B2° +α° from the evacuating rotational position to control it to oppose end of papers, the arranging portion 102*a*1 of the arranging member 102*a* is placed below the end of papers to be newly disposed and the escaping portion 102*a*6 thereof is placed at end of papers to be newly disposed, so that arrangement cannot be carried out.

In FIG. 122, assuming that angle of the arranging portion 102*a*1 right before the arranging portion 102*a*1 of one arranging member 102*a* for carrying out arrangement departs upward (or downward) from the arranging portion 102*b*1 of the other arranging member 102*b* for carrying out arrangement is ΔC1° (predetermined value). When A2°−B2°>ΔC1° in FIG. 123, conveyance of papers from the image forming apparatus 50 or from the sheet-shaped medium after-treatment apparatus 51 is once stopped and this transient stop of arranging operation is made to inform users through a lamp or appropriate warning else, By doing so, piling papers on the tray 12 to which arrangement cannot be applied can be prevented by means of measures of the operator.

m. Embodiment Corresponding to Claim 56

In arrangement in the sorting mode, with the sheet-shaped medium after-treatment apparatus, since the tray 12 is shifted in a direction perpendicular to the paper-discharging direction, the arranging members 102*a*, 102*b* are required to be evacuated upward lest it contact the bundle of papers piled on the tray 12.

Figure 125B:
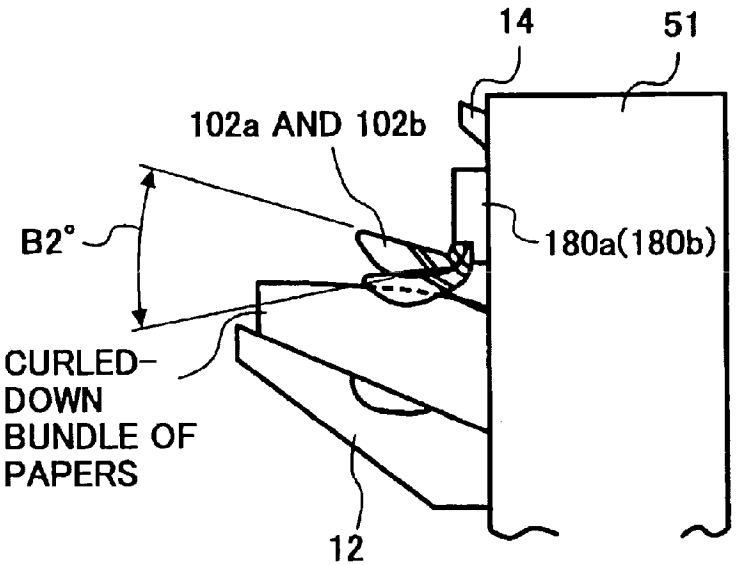
Figure 125A:
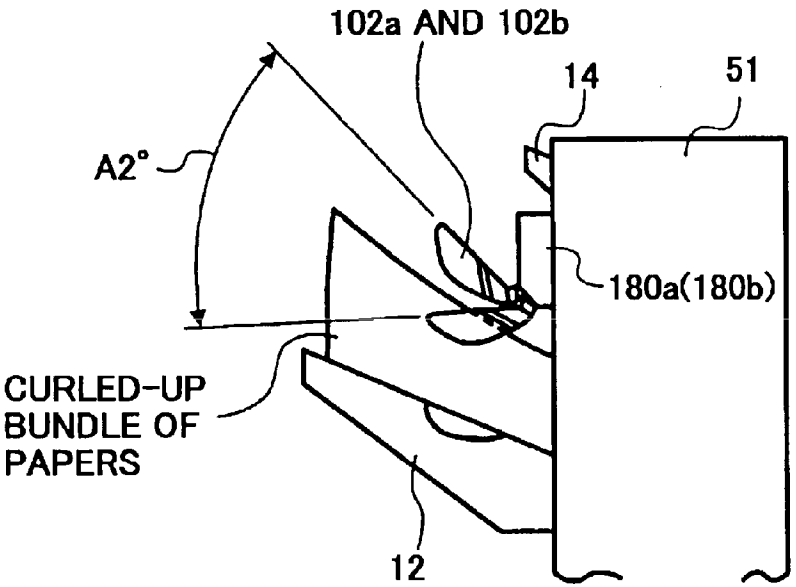

However, since height of the bundle of papers piled on the tray 12 is varied depending on the curl direction such as upward curl or downward curl as shown in FIGS. 125(*a*) and (*b*), the evacuating amount of the arranging members is required to be varied, accordingly.

For example, if the evacuating angle required for the upward curl as shown in FIG. 125(*a*) is A2° and the evacuating angle required for the downward curl as shown in FIG. 125(*b*) is B2°, A2°>B2° and the evacuating amount required for the upward curled paper is necessary to be greater than the evacuating amount required for the downward curled paper.

Here, when the curl direction or amount of papers to be discharged is previously known, the evacuating rotational position can he set such that the arranging members 102*a*, 102*b* sufficiently avoid the bundle of papers piled on the tray 12, thereby complete evacuation being possible.

Figure 126B:
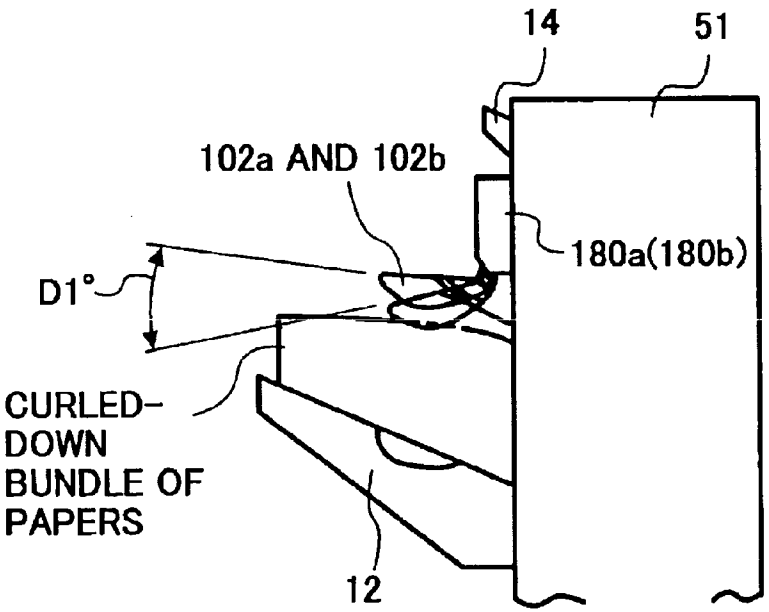
Figure 126A:
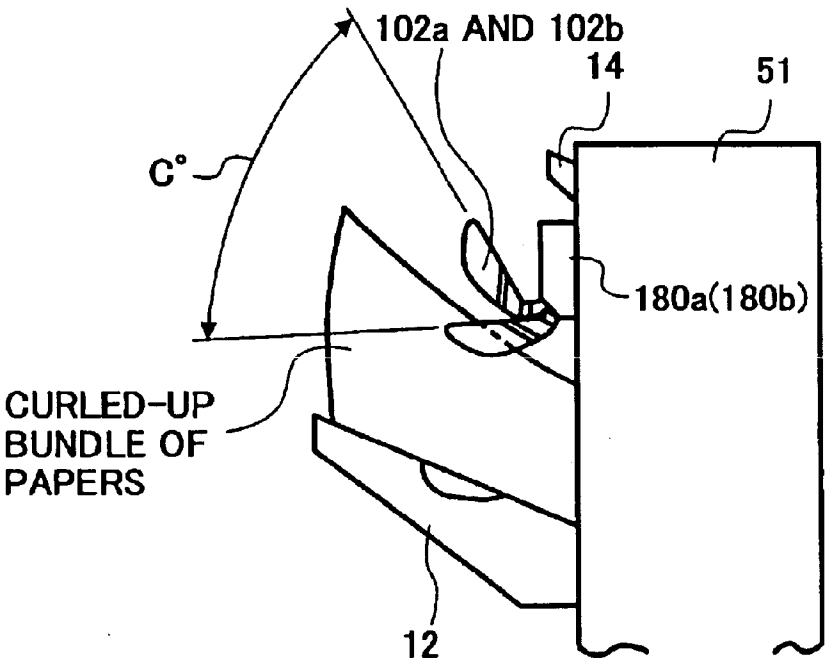

Also, in a case of upward curl as shown in FIG. 126(*a*), the much evacuating amount is required with increase in the number of papers piled on the tray 12 (A2°<C°) and on the contrary, in a case of downward curl as shown in FIG. 126(*b*), the little evacuating amount is required with increase in the number of papers piled on the tray 12 (B2°<D1°).

Like this, if the evacuating amount of the arranging members is set according to the curl direction of papers and the number of papers piled, the arranging members 102*a*, 102*b* can avoid completely and efficiently the bundle of papers piled, on the tray 12 in shift of the tray 12.

In shift operation of the sheet piling means, the arranging means can be evacuated completely and efficiently without affecting the curl direction of papers piled on the sheet piling means.

n. Embodiment Corresponding to Claim 57

Since the curl amount of papers gets greater with increase in the number of papers piled on the tray 12 in the sheet-shaped medium after-treatment apparatus 51, the required evacuating amount of the arranging members 102*a*, 102*b* may be varied. Also, if the evacuating amount of the arranging members 102*a*, 102*b* since too much time is required for the evacuating operation, the interval time in the arranging operation after the shift operation of the tray 12 may not be satisfied.

The present embodiment is constructed as following.

Figure 127B:
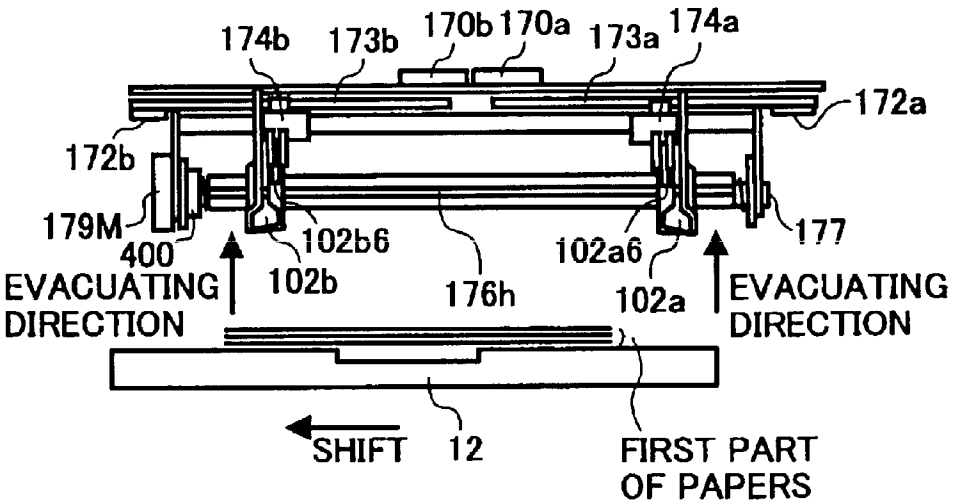
Figure 127A:
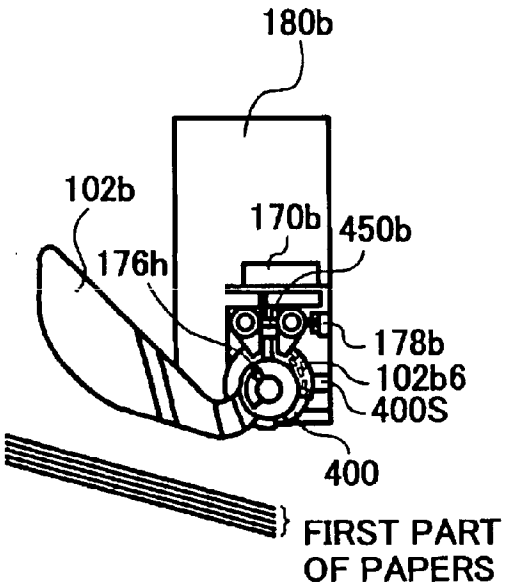
Figure 127C:
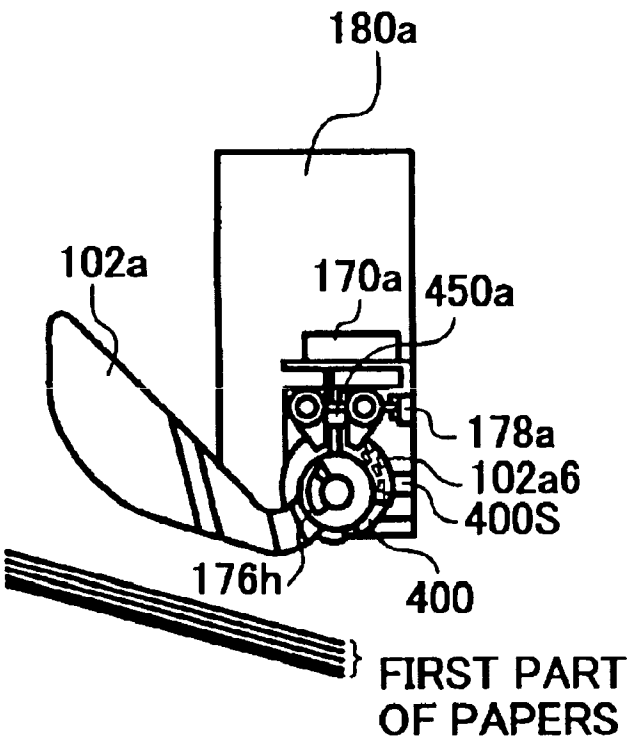

In the sorting mode, when arrangement of each part of papers is carried out by means of the arranging members 102*a*, 102*b*, arrangement of the first -part of papers is carried out as shown in FIG. 127, then the arranging members 102*a*, 102*b* are once evacuated upward and meanwhile, the tray 12 is shifted horizontally. At that time, the shift direction of the tray can be known and it can be also known that the arranging member at downstream in the shift direction of the tray 12, that is, the arranging member 102*b* in FIG. 127 is placed on the first part of papers in arrangement of the next part of papers.

Figure 128A:
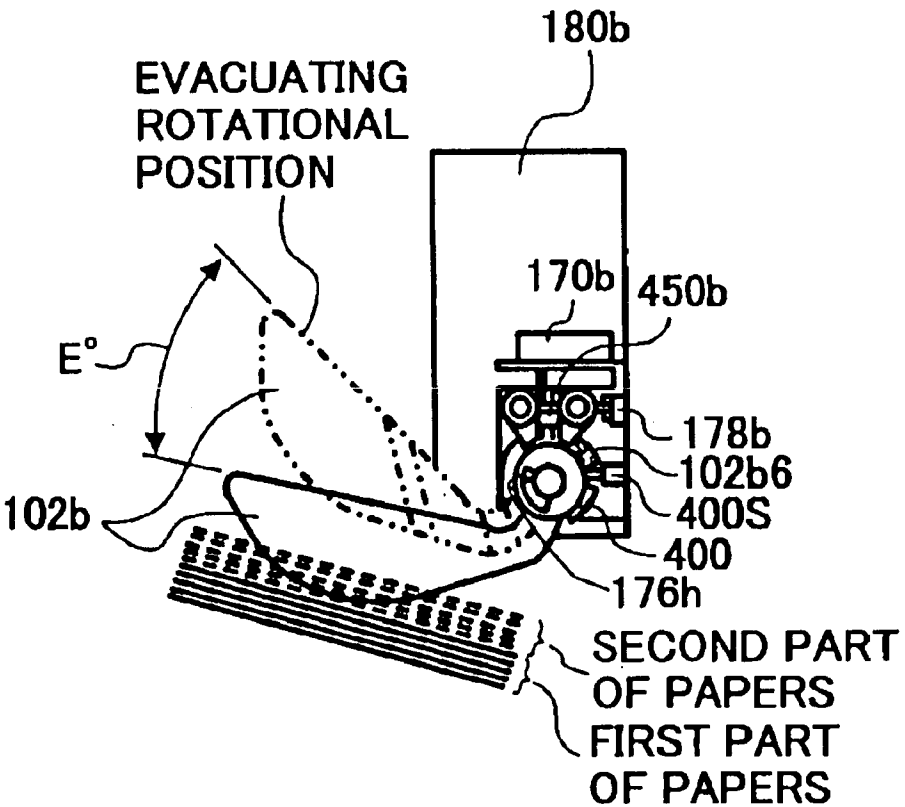
Figure 128C:
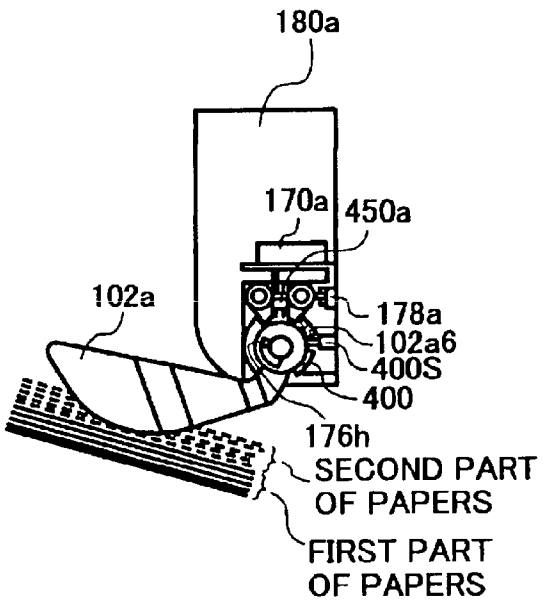
Figure 128B:
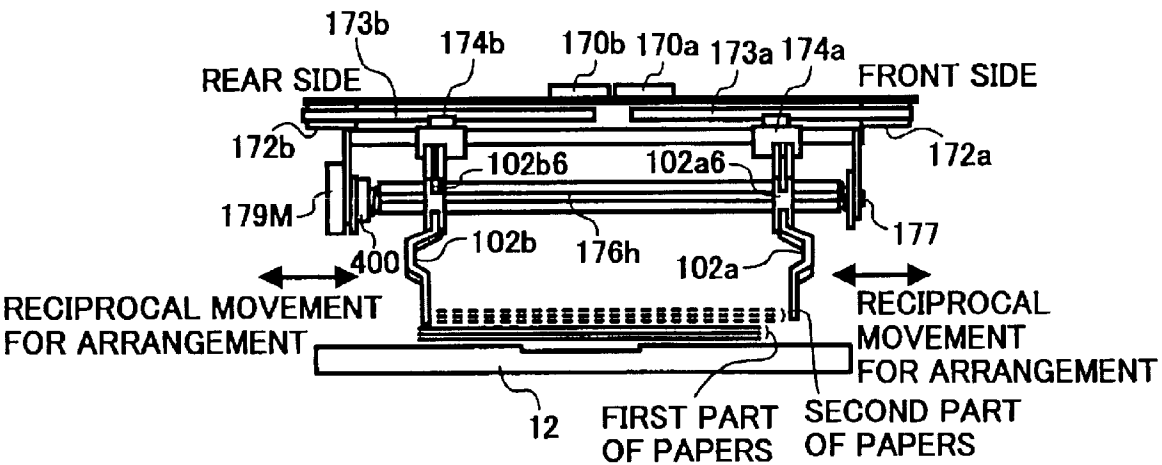

Next, when the arranging members 102*a*, 102*b* evacuated upward are rotated downward in order to carry out arrangement of the second part of paper as shown in FIG. 128, the rotational angle of the arranging member 102*b* placed on the first part of papers can be known as following.

By sensing through the respective slits SLT1, SLT2 and the pose detecting sensor 450*a* (450*b*) of the convex plate 102*a*6, 102*b*6 provided at the respective arranging members 102*a*, 102*b* in FIG. 78, it can be detected to what extent the arranging members 102*a*, 102*b* are rotated from the evacuating rotational position.

Figure 129B:
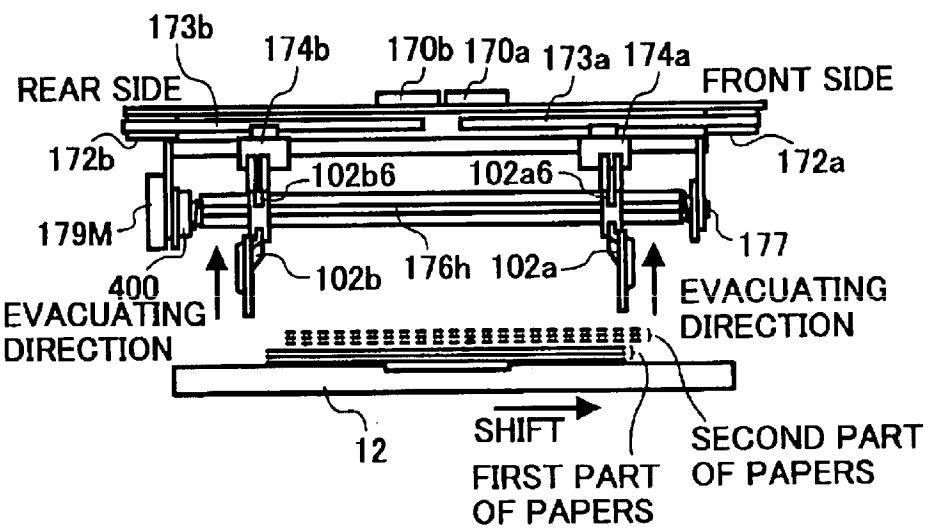
Figure 129A:
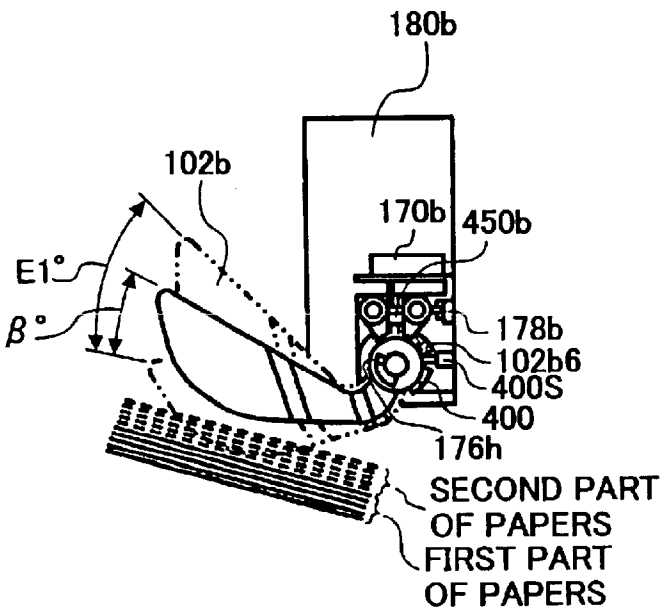
Figure 129C:
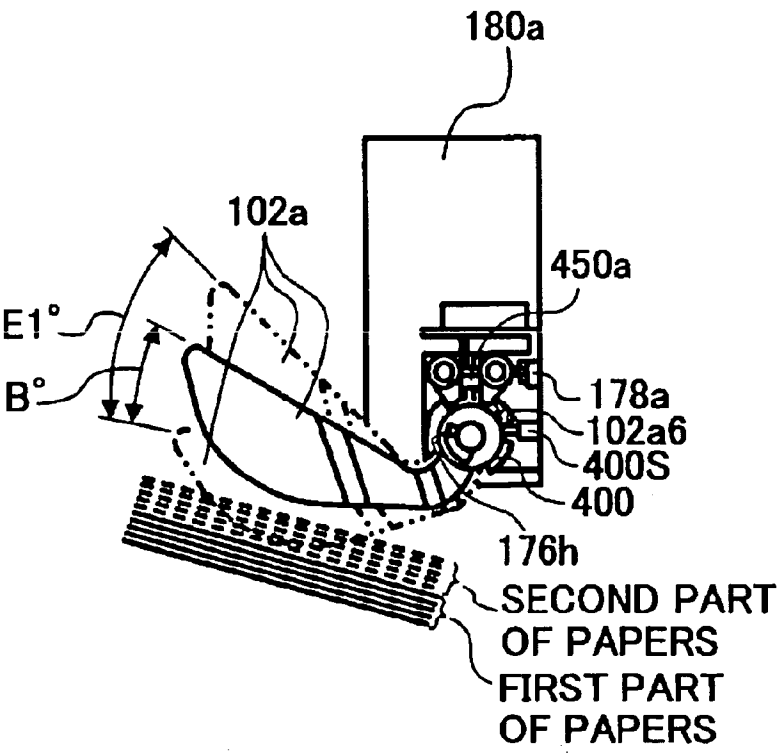

By doing so, the rotational angle, from the evacuating rotational position, of the arranging member 102*b* placed on the first part of papers piled on the tray 12 can be known. Here, for example, assuming that the rotational angle, from the evacuating rotational position, of the arranging member 102*b* placed on the first part of papers is E°. When arrangement of the second part of papers is completed and then the arranging members 102*a*, 102*b* are evacuated upward again as shown in FIG. 129, by setting the evacuating angle of the arranging members 102*a*, 102*b* such that the evacuating rotational position is a position where the arranging members are rotated more upward by a margin angle β° than the rotational angle E°, from the evacuating rotational position, of the arranging member 102*b* placed on the first part of papers, the papers piled on the tray 12 can be avoided. In other words, the new evacuating rotational position is set to a position more downward by E°−β° than the evacuating rotational position.

Figure 130A:
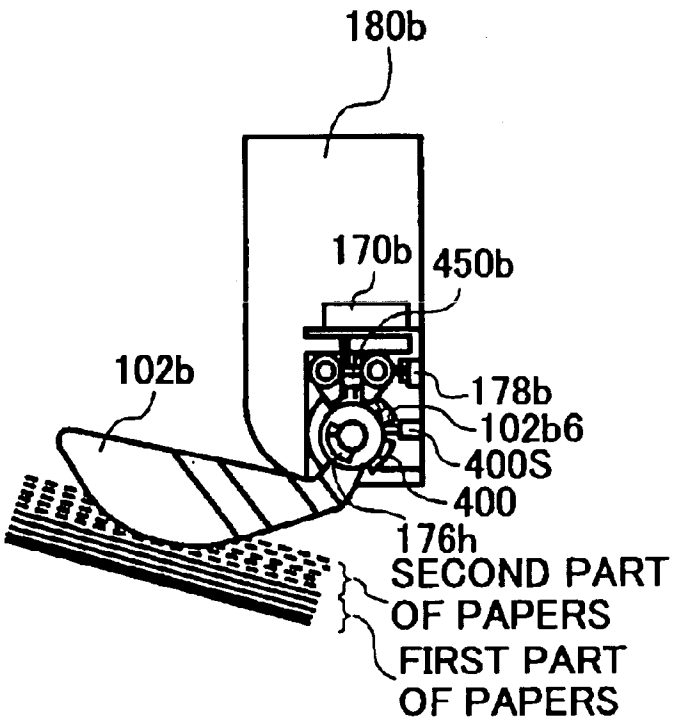
Figure 130C:
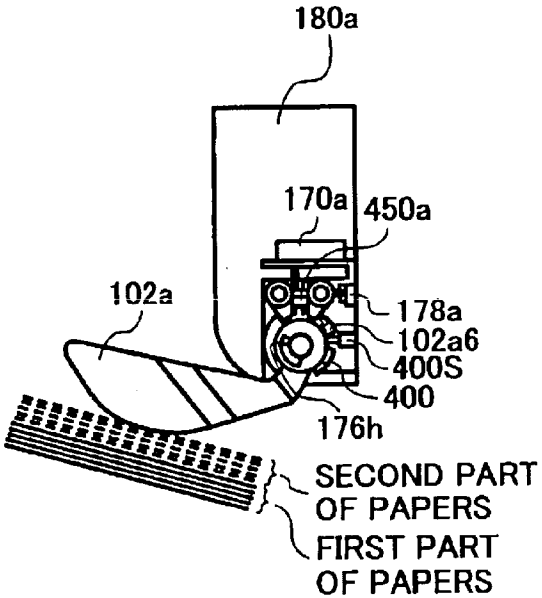
Figure 130B:
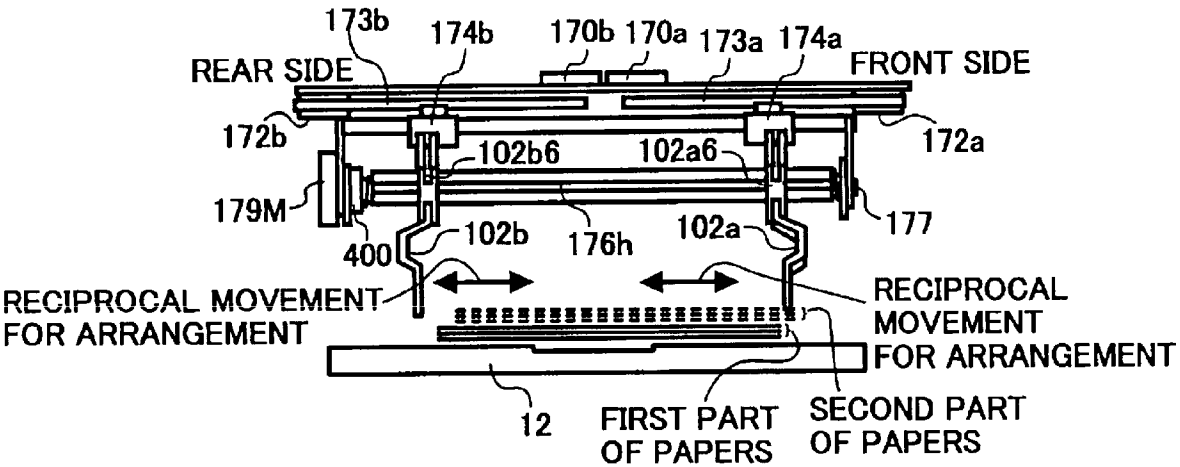

On the basis of the related evacuating state, the tray 12 is shifted as shown in FIG. 129 and the arranging members 102*a*, 102*b* are rotated downward from the evacuating rotational position as shown in FIG. 130, then waiting for discharge of the third part of papers.

By repeating a series of these operations, the arranging members can be evacuated completely and rapidly, regardless of the curl direction or amount of papers. β° of the margin angle is minimum amount for preventing interference with papers and can be substantially determined for substantial apparatuses.

By doing so, the arranging means can be evacuated completely and rapidly without affecting the curl direction and amount of papers piled on the sheet piling means in shifting the sheet piling means.

o. Embodiment Corresponding to Claim 58

There is a case that the curl amount of papers piled on the tray 12 in the sheet-shaped medium after-treatment apparatus is varied at four corners of a paper or at both ends of the paper in the shift direction. For this reason, unless the arranging members are evacuated corresponding to the curl amount, the arranging members 102*a*, 102*b* may contact with the bundle of papers piled on the tray 12 and if the evacuating amount of the arranging members 102*a*, 102*b* is too large, too much time is required for the evacuation and thus, the time interval in arrangement after shifting the tray 12 may not be satisfied.

The present embodiment is constructed as following.

In the sorting modes as shown in FIGS. 131 to 135, there is a case that a curl having different sized in the shift direction occurs such as a curl that front end of papers is lifted or the like. Also, this curl is constant apparatus by apparatus such as the image forming apparatus.

Figure 131:
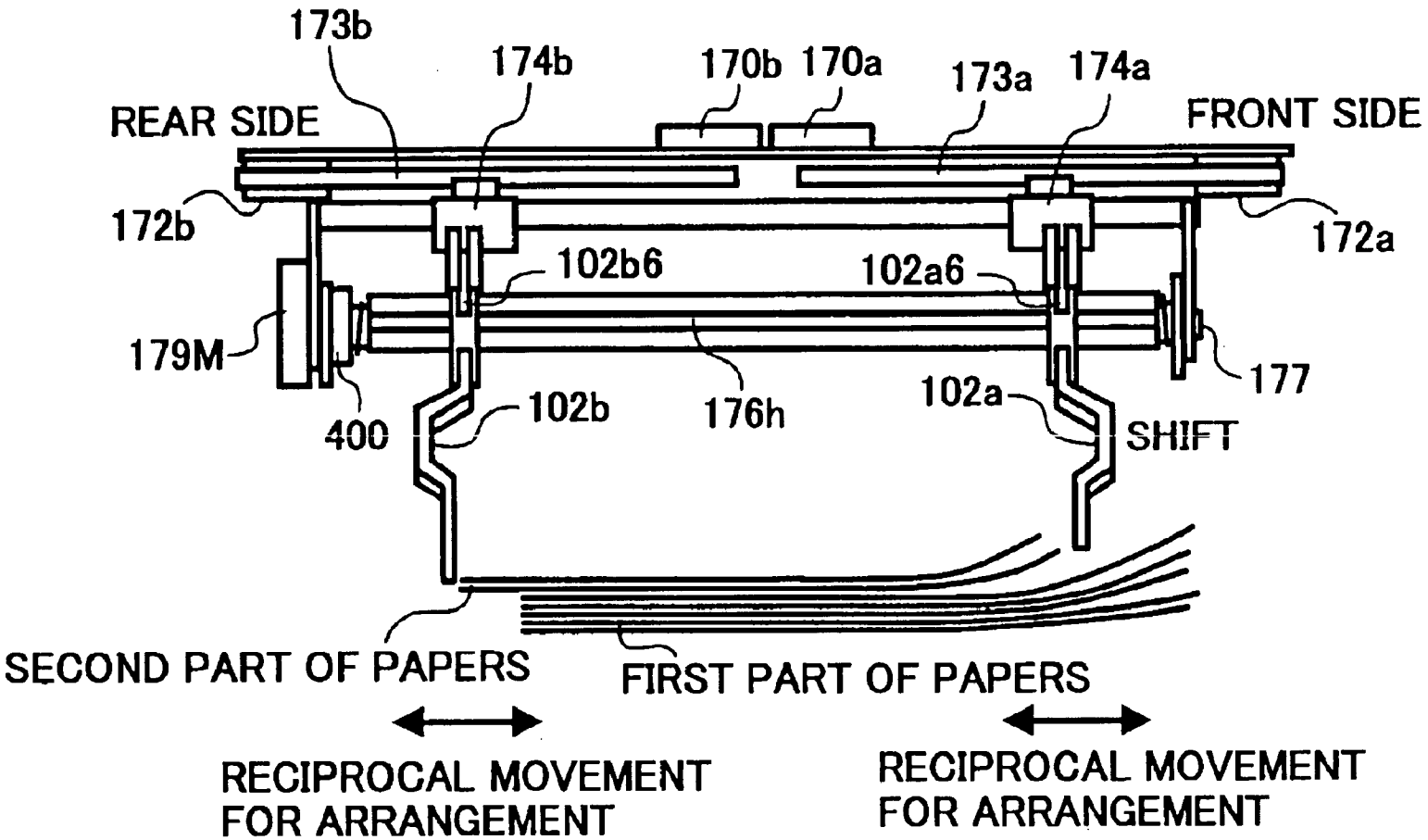

In FIG. 131, the second part of papers is arranged. In previous arrangement of the first part of papers, all the arranging members 102*a*, 102*b* are placed outside the ends of papers and no arranging member is placed on the papers. Since one arranging member is placed on the top surface of papers from the second part of papers, curl of papers can be detected. The detection is carried out by means of the respective slits SLT1, SLT2 and the pose detecting sensor 450*a* (450*b*) of the convex plates 102*a*6, 102*b*6 provided in the respective arranging members 102*a*, 102*b* in FIG. 78.

Although a state prior to the state shown in FIG. 131 is not shown, arrangement is first carried out on the first part of papers and the arranging members 102*a*, 102*b* is rotated to a maximum default evacuating position which is determined as a rotational position for not interfering papers and evacuated in order to sort the second part of papers, on the basis of any curl amount to be considered, and then the tray 12 is shifted. Then, the arranging members 102*a*, 102*b* are rotated downward.

As shown in FIG. 131, the arranging member 102*b* is rotated to the arranging rotational position in which the sensor 400S detects the arranging position-detecting slits 400J (see FIG. 80), and the arranging member 102*a* is placed and stopped on the first part of papers before reaching the same arranging rotational position. The rotational angle of the arranging member 102*a* from the default evacuating position to the top surface of the first part of papers is detected by means of the pose detecting sensor 450*a*. This rotational angle is F°.

Whenever papers in the second part are discharged, the arranging members 102*a*, 102*b* are reciprocally moved to carry out arrangement. When discharge and arrangement of all the second part of papers are completed, the arranging members 102*a*, 102*b* are rotated upward to the default evacuating position as shown in FIG. 132 in order to carrying out sorting of the third part of papers and the tray 12 is shifted backward.

Next, the arranging members 102*a*, 102*b* are rotated downward.

As shown in FIG. 133, the arranging member 102*a* is rotated to the arranging rotational position in which the sensor 400S detects the arranging position-detecting slits 400J (see FIG. 80), and the arranging member 102*b* is placed and stopped on the top surface of the second part of papers before reaching the same arranging rotational position. The rotational angle of the arranging member 102*b* from the default evacuating position to the top surface of the second part of papers is detected by means of the pose detecting sensor 450*b*. This rotational angle is G°.

In FIG. 133, whenever papers in the third part are discharged, the arranging members 102*a*, 102*b* are reciprocally moved to carry out arrangement. When discharge and arrangement of all the third part of papers are completed, the arranging members 102*a*, 102*b* are rotated upward and evacuated as shown in FIG. 134 in order to carrying out sorting of the fourth part of papers and the tray 12 is shifted frontward.

In order that the evacuating amount shown in FIG. 134 is set as small as possible and in addition, interference with papers cannot occur, in the present embodiment, the detected rotational angles F° and G° are used. Here, there exists one relation out of F°>G°,F°<G° and F°=G°.

If F°>G°, an angle F°−G°+α° obtained by abstracting the small G° from the large F° and then adding a given margin value α° to it is set to the new evacuating rotational position of the arranging member 102*b* in rotating upward the arranging member 102*b* form the top surface of papers. In other words, both arranging members 102*a*, 102*b* are evacuated by the new evacuating angle rotated downward by G°−α° from the evacuating rotational position in detection. If F°<G°, an angle G°−F°+α° obtained by abstracting the small F° from the large G° and then adding a given margin value α° to it is set to the new evacuating rotational position of the arranging member 102*a* in rotating upward the arranging member 102*a* form the top surface of papers. In other words, both arranging members 102*a*, 102*b* are evacuated by the new evacuating angle rotated downward by F°−α° from the evacuating rotational position in detection. If F°=G°, it is considered that both are not affected by curl of papers, an angle obtained by abstracting a given value from the angle F° or G° from the evacuating rotational position in detection, that is, an angle rotated downward from the evacuating rotational position in detection is set to the evacuating angle of the new evacuating rotational position and both arranging members 102*a*, 102*b* are evacuated. There may be a case that curl occurs on both side, but it is not a problem here. If so, adjustment that the given value α° is taken is carried out.

By doing so, papers piled on the tray 12 can be completely avoided. In FIG. 135, whenever papers in the fourth part are discharged, the arranging members 102*a*, 102*b* are reciprocally moved to arrange. Moreover, when discharge of all the fourth part of papers are completed and the tray 12 is shifted in order to arranging the fifth part of papers, the given value α° is added to a larger angle of the rotational angle of the arranging member 102*a* in FIG. 135 and the rotational angle of the arranging member 102*b* and the angle is set to the evacuating angle.

Now, by repeating a series of these operations, the arranging members can be evacuated completely and rapidly, regardless of the curl direction and the curl amount of papers.

By doing so, by setting the evacuating angle with reference to position of the arranging member, out of two arranging members, of which a free end is placed at a lower position, that is, of which the rotational angle from the default evacuating position is larger, time loss due to restoring to the default evacuating position can be removed and the arranging members can be evacuated completely and rapidly, regardless of the curl direction and amount of papers.

p. Embodiment Corresponding to Claim 59

The curl direction of papers to be piled on the tray in the sheet-shaped medium after-treatment apparatus 51 is determined depending on the type of image forming apparatus. Therefore, unless the evacuating amount of the arranging members 102*a*, 102*b* is varied depending on the type of image forming apparatus, the arranging members 102*a*, 102*b* may contact with the bundle of papers piled on the tray 12 in shifting the tray 12. Also, since the evacuating time is too lengthened if the evacuating amount of the arranging members 102*a*, 102*b*, the time interval in arrangement after shifting the tray 12 may not be satisfied.

In arrangement in the sorting mode, when arrangement of the previous part of papers is completed and then arrangement of the next part of papers is carried out, the arranging members 102*a*, 102*b* are required to be evacuated such that the arranging members do not collide with the bundle of papers piled on the tray 12. The evacuating amount is varied depending on the curl direction of papers discharged onto the tray 12, or piled on the tray 12.

Because the curl direction of papers discharged is almost determined depending on the internal structure of image forming apparatus 50 connected to the sheet-shaped medium after-treatment apparatus, by sending a signal for determining the type of image forming apparatus 50 to a control means, for example, a CPU 700 shown in FIG. 46, of the sheet-shaped medium after-treatment apparatus 61, the curl direction of papers piled on the tray 12 of the sheet-shaped medium after-treatment apparatus is determined and the evacuating amount is set on the basis of the curl.

When the papers to be piled are curled upward, the evacuating amount of the arranging member 102*a* is set to be larger than that in a default state when not curled. On the contrary, when the papers to be piled are curled downward, it is set to be smaller than the evacuating amount in the default state.

When discharging a hit part of papers is completed, the tray 12 is shifted, and the number of papers constructing a part is different job by job. In the present embodiment, the specific evacuating amount is determined depending on the number of papers constructing a part. By storing a map of appropriate evacuating amount depending on the number of papers in memory of CPU 700 and inputting the number of papers constructing a part, the evacuating amount of the arranging members 102*a*, 102*b* can be properly set. Also, even when the paper-discharging speed in the image forming apparatus is large, the evacuating time of the arranging members gets small and thus arrangement after shifting the tray can be processed rapidly. By doing so, even in any image forming apparatus, the arranging members can be evacuated completely and rapidly in shifting the sheet piling means.

[3] Example of Control

Corresponding to the example of control in FIG. 46 according to the first invention, explanation of this example will be omitted.

Figure 73:
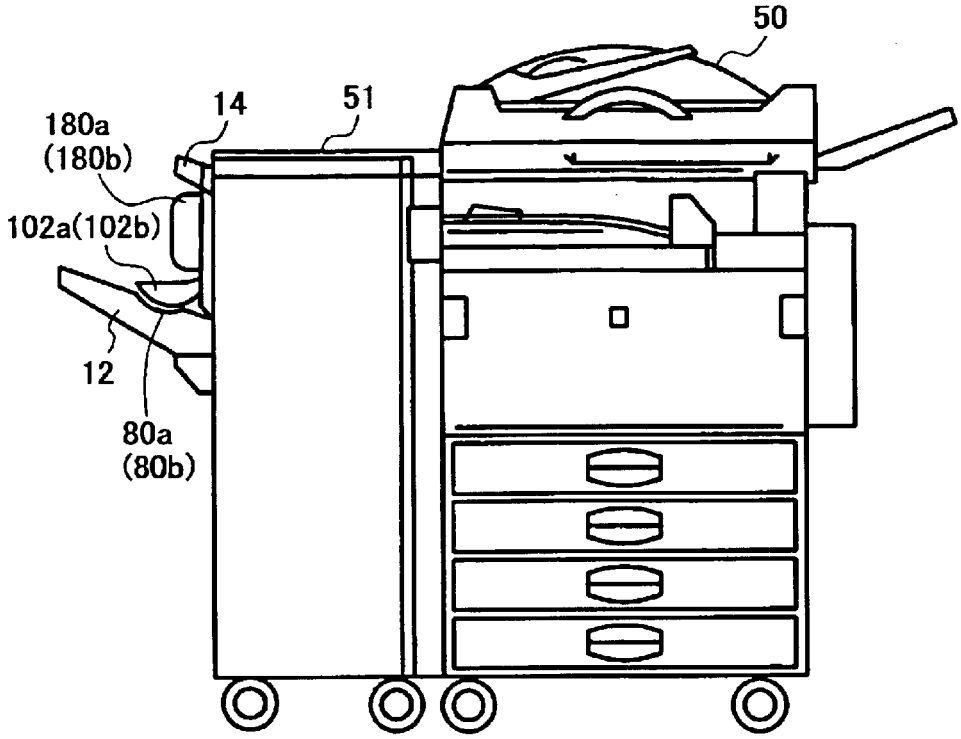
FIG. 73 is a front view of the image forming apparatus and sheet-shaped medium after-treatment apparatus.

Following flow shows only the part relevant to the present invention in the sheet-shaped medium after-treatment apparatus. By turning on the main switch trusting the image forming apparatuses in FIGS. 73 and 76 and the sheet-shaped medium after-treatment apparatus and selecting the sorting mode, following control is carried out.

a. Initializing Control of Arranging Members

Initializing operation of the arranging members 102*a*, 102*b* when the power source is on in FIG. 136 will be described, In FIG. 136, the power source of the image forming apparatus 50 is turned on (step P1), ON check in the home sensor 178*a*, 178*b* is carried out, and then, if in ON, since the position in shift direction is in the position (home position, see FIGS. 10 and 77) corresponding to the receiving space 180*a*, 180*b*, the stepping motor 179M is driven in step P6 to rotate the arranging members 102*a*, 102*b* to the receiving rotational position (see FIG. 79). By detecting the receiving position detecting slit 400K with the sensor 400S, the stepping motor 179M is stopped.

When in step P2, it is determined that the arranging members 102*a*, 102*b* is not in the home position, the stepping motors 170*a*, 170*b* are driven until the arranging members 102*a*, 102*b* is moved to the home position (step P3, P4).

b. Arranging Control b-1. Control Example 1: Corresponding to Claims 48, 44 and 46

Explanation will be described with reference to FIGS. 137 to 140. These figures show a part of a flow chart and by connecting the flows through the same reference numerals attached with * in each figure, the figures construct one flow chart.

Initializing of the arranging members is carried out in step P10. The operation of this initializing is as described above with reference to FIG. 136, and when step P10 is completed, the arranging members 102*a*, 102*b* is received in the receiving space 180*a*, 180*b*.

When modes for carrying out arrangement such as sorting mode, simple piling mode or the like are set, arranging mode is determined in step P11 to go step P12 and the stepping motor 179M is forwardly rotated to rotate the arranging members 102*a*, 102*b* from the receiving rotational position to the evacuating rotational position. If modes for not carrying out the arrangement are selected, it is "End".

Movement to the evacuating rotational position is carried out by a predetermined amount by means of the stepping motor 179M and if the predetermined amount of rotation is obtained, rotation of the stepping motor 179M stops (step P14).

On the basis of a state that the arranging members 102*a*, 102*b* is placed in the evacuating rotational position, by rotating the stepping motor 170*a*, 170*b* by a predetermined amount, the arranging members 102*a*, 102*b* is moved toward the entrance position (see FIG. 11) and if it reaches the entrance position depending on the number of steps in motor, rotation of the motor stops (step P15 to P17).

Next, the arranging members 102*a*, 102*b* are rotated to the arranging rotational position (see FIG. 80) (step P18 to P20) for waiting for discharge of papers onto the tray 12 (step P21).

In a case of the first part of papers, whenever a paper is discharged, a process for carrying out the arranging operation (see FIG. 14) of, for example, backward and forward moving the arranging members 102*a*, 102*b* is carried out till arrangement of the part of papers is completed (step P22, P23, P24).

When arrangement of the first part of papers is completed, the arranging members 102*a*, 102*b* have to be evacuated before shifting the tray 12 for sorting. Therefore, the stepping motor 179M is reverse rotated (step P35) and when the arranging members 102*a*, 102*b* reach the evacuating rotational position (step P36), the tray 12 is shifted (step P37).

If the assigned number of parts is 1, the process is completed, but if a new part is assigned, the process goes from step P38 to step P39 and the stepping motor 179M is forward rotated to place the arranging members 102*a*, 102*b* at the arranging rotational position below the evacuating rotational position (step P40). Here, since the second part of papers is considered, if papers are discharged (step P21), the arranging operation is carried out by means of the arranging members 102*a*, 102*b* through step P22 and P25 (step P26).

Whether the tray 12 is placed at a front side or at a backside is determined in step P27. The arranging member at present position after moving from the position of the tray 12 prior to shift is the arranging member placed on the papers. Since the position of the tray 12 is detected from readout data of the encoder 47 by the home sensor 48 when shifted in step 37, by detecting the position of the tray 12 in step P27, the arranging member placed on the papers can be specified and by detecting the rotational angle thereof, a pose for sandwiching ends of papers in arranging operation on next part (third part) of papers is taken and accordingly, the pose of the arranging member is controlled.

Specifically, when in step P27, it is determined that the tray 12 is placed at the back side, the arranging member 102*b* at the back side as shown in FIG. 99 is placed on the papers and the arranging member 102*a* at the front side is opposed to the end of papers. In this case, the rotational position of the arranging member at back is stored as reference data in step P28. Moreover, the rotational position of the arranging member at the front side is stored as position-comparing data in step P29.

Or, when in step P27, it is determined that the tray 12 is placed at the front side, the arranging member 102*a* at the front side as shown in FIG. 14(*b*) is placed on the first part of papers and the arranging member 102*b* at the back side is opposed to end of the second part of papers. In this case, the rotational position of the arranging member 102*a* at the front side is stored as reference data in step P33. Moreover, the rotational position of the arranging member at the backside is stored as position-comparing data in step P34.

Here, assuming that in step P27, it is determined that the tray 12 is placed at back. Then, the position reference data of the arranging member 102*b* is A°+ΔA° that is an angle rotated from the evacuating position, as described in [2] f in step P24.

In a case of arrangement of the third part of papers, in step P35 to step P40, the arranging members are rotated to the evacuating rotational position for discharge of the third part of papers, the tray 12 is shifted, and the arranging members are in the arranging rotational position and wait for discharge of papers. If the third part of papers is discharged, the process goes to step P30, and difference between the reference data and the comparing data stored after arranging the second part of papers is detected.

When this detected value is greater than a predetermined value N1 for unable adjustment, it is meant that the end of the first part of papers is much raised due to curl. Under the relevant curl, the arranging portion 102*b*1 of the arranging member 102*b* departs from the short side of the third part of papers and thus the arrangement cannot be completed. Therefore, a warning is represented in step P31 and the operator takes measures such as stopping discharge of papers according to this warning.

When this detected value is not greater than a predetermined value N1 in step P80, adjustment is possible. So the arranging rotational position of the arranging member 102*b* is rotated more downward by a margin value α° than the position reference data A°+ΔA° which is a rotational angle from the evacuating rotational position (step P32). By doing so, the arranging portion 102*b*1 of the arranging member 102*b* gets in contact with end of the third part of papers, thereby carrying out the arranging operation. This is available for the fourth or later and when arrangement of the assigned parts of papers is completed (step P38), the arranging control ends.

Like above, in this example, on the basis of the detection result of the arranging member placed on the papers, the other arranging member is controlled to take a pose for sandwiching ends of the papers.

b-2. Control Example 2: Corresponding to Claim 43, 44, 45 and 46

Explanation with reference to FIGS. 137 to 141 will be described. In the flow chart as this control example, step P27 of FIG. 139 in the control example of b-1 is replaced with step P2700 in FIG. 141.

That is, although in the example of b-1, the arranging member placed on the papers associated with the position reference data is determined on the basis of the position of the tray 12, in this example, it is determined on the basis of up-and-down relation between two arranging members as shown in step P2700 of FIG. 140.

It is determined whether the arranging rotational position of the arranging member 102*b* at back is higher than the arranging rotational position of the arranging member 102*a* at front side or not. If the arranging rotational position of the arranging member 102*b* at back side is higher than the arranging rotational position of the arranging member 102*a* at front side, the arranging member 102*b* at back is the arranging member placed on the papers and thus, the position of the arranging member 102*b* is stored as the position reference data. At that time, the other arranging member 102*a* is opposed to end of the papers and thus, arranging rotational position thereof is stored as comparing data.

That the arranging rotational position of one is higher than that of the other means that the rotational angle from the evacuating rotational position in common for both arranging members is smaller and that the arranging member of which the rotational angle from the evacuating rotational position is smaller is the arranging member placed on the top surface of papers, and by detecting the up-and-down relation between two arranging members, arranging control as in the above example can be carried out.

b-3. Control Example 3: Corresponding to Claim 50

Explanation with reference to FIGS. 142 to 146 will be described. Each of these figures represents a part of a flow chart and by connecting the flows through the same reference numerals attached with * in each figure, the figures construct one flow chart. The step PP1 in FIG. 142 has the same contents as those of step P10 to step P17 in FIG. 137.

This example relates to a simple piling mode, and in step P11 of PP1, Yes is selected to go to step P18.

In FIG. 142, the arranging members 102*a*, 102*b* are rotated to the arranging rotational position (see FIG. 80) (step P18 to P20) and wait for discharge of papers onto the tray 12 (step P21).

If papers are discharged, the arranging operation is carried out by means of the arranging members in step P41. It is determined whether arrangement of the assigned number of papers is completed or not in step P42. The assigned number of papers is the number of papers for completing the image forming required by a user.

If the assigned number is reached in step P42, the control ends and if the assigned number is not reached, it is determined whether a predetermined number of papers are discharged or not in step P43. The predetermined number of papers is a minimum number in which curl in the conveying direction affects fitness of the arranging portions to end of papers, and the discharge and arranging operation are repeated until the number is reached (step P21, P41 and P42). A counter counts the predetermined number of papers.

If the predetermined number is reached in step P43, the arranging members are rotated to the evacuating rotational position (step P44, P45 and P46) and then, any arranging member, for example, the arranging member 102*b* is rotated forward by a predetermined amount until it is placed on the papers (step P47).

In step P48, both arranging members are rotated toward the arranging rotational position (step P48, P49 and P50). During rotation, the arranging member 102*b* contacts with top surface of papers and is stopped, and the rotational position of the arranging member 102*b* from the evacuating rotational position is stored as position data (step P51). For example, the position data is A1° shown in FIG. 116.

By doing so, height of top surface of papers of which height is varied due to curl at end of downstream in the conveying direction can be detected by means of one arranging member 102*b*. In a case of curl taking place at downstream in the conveying direction, since height of top surface of papers at place corresponding to the arranging member is equal in the width direction of papers. Therefore, if information on height of top surface of papers can be obtained by means of one side arranging member, both arranging members are rotated by use of this information to fit the arranging portion of the arranging member to end of papers.

After both arranging members are rotated to the evacuating rotational position to be in the evacuated state (step P52, P53 and P54), the arranging member moved in step P47, that is, the arranging member 102*b* in this example is moved to the entrance position of papers (step P55, P56 and P57). Since the other side arranging member 102*a* is already at the entrance position of papers, it is not necessary for moving.

Both arranging members at the evacuating rotational position are rotated on the basis of the position data (A1°) stored in step P51, using the angle obtained by adding a given value α1° to A1° as the rotational angle from the evacuating rotational position and the rotated position is set to a new arranging rotational position (step P58, P59 and P60). By this, the arranging portions 102*a*1, 102*b*1 of both arranging members can be made to directly oppose the end of papers and thus to serve for arrangement.

Next, the counted value in step P62 is reset to that in step P43 (step P46) and discharge of papers is waited for (step P21).

b-4. Control Example 4: Corresponding to Claims 51, 52 and 53

Explanation with reference to FIGS. 147 to 150 will be described. Each of these figures represents a part of a flow chart and by connecting the flows through the same reference numerals attached with * in each figure, the figures construct one flow chart.

The step PP2 in FIG. 147 has the same contents as those of step P10 to step P17 in FIG. 141. This example relates to a simple piling mode, and in step P11 of PP1, Yes is selected to go to step P70.

The arranging members 102*a*, 102*b* are rotated to the arranging rotational position (see FIG. 80) (step P70 to P72) and wait for discharge of papers onto the tray 12 (step P73). If papers are discharged, the arranging operation (see FIG. 14) is carried out by, for example, forward and backward moving the arranging members 102*a*, 102*b* (step P74).

It is determined whether arrangement of the assigned number of papers is completed or not in step P75. The assigned number of papers is the number of papers for completing the image forming required by a user. If the assigned number is reached in step P75, the control ends and if the assigned number is not reached, it is determined whether a predetermined number of papers are discharged or not in step P76. The predetermined number of papers is a minimum number in which curl in the conveying direction affects fitness of the arranging portions to end of papers, and the discharging operation and the arranging operation are repeated until the number is reached (step P73, P74 and P76). A counter counts the predetermined number of papers.

If the predetermined number is reached in step P76, the arranging members are rotated to the evacuating rotational position (step P77, P78 and P79) and then, are moved by a predetermined amount to a position in which the gap between these arranging members 102*a* and 102*b* is narrower than the width of papers until both arranging members 102*a*, 102*b* are placed on the papers (step P80).

In step P48, both arranging members are rotated toward the arranging rotational position (step P81, P82 and P83). During this rotation, the arranging members 102*a*, 102*b* contact with top surface of papers and is stopped, and the rotational angles of the arranging members 102*a*, 102*b* from the evacuating rotational position are stored as position data, respectively (step P84).

By doing so, variation of curl size in the width direction is determined such as, for example, upward curl in the width direction of papers as if at the front side as shown in FIG. 122.

By comparing the position data relating to the arranging member 102*a* at the front side and the position data relating to the arranging member 102*b* in step P85, difference in angle of both arranging members is determined. When this difference in angle greater than the predetermined value C1° described in the above [2] l, it is meant that opening angle of both arranging members is so large that the arrangement cannot be carried out, and a warning is displayed in step 96.

When it is determined that the difference in both position data is not larger than the predetermined value than C1° in step P85, both arranging members 102*a*, 102*b* are rotated to the evacuating rotational position (step P86, P87 and P88) and in addition, both arranging members 102*a*, 102*b* are moved to the entrance position of papers (step P89, P90 and P91).

Next, both arranging members are moved to new arranging rotational positions in step P92, on the basis of position data stored in step P84. The now arranging rotational positions are determined as following. Position data (rotational angle from the evacuating rotational position) of the respective arranging members are detected in step P84. Assuming that the position data of the arranging member 102*a* is B1° and the position data of the arranging member 102*b* is C1° as described in the above [2] j. Then, if B1°=C1°, a position (position rotated from the evacuating rotational position) corresponding to an angle obtained by adding a given angle α°, to B1° (or C1°) with respect to the respective arranging members 102*a*, 102*b* is set to be a new arranging rotational position.

Also, if B1°>C1° or B1°<C1°, with reference to the rotational angle of the arranging member of which angle is greater, that is, the arranging member of which a free end is placed lower, an angle obtained by adding a given angle α° to that rotational angle is set to the angle of both arranging members 102*a*, 102*b* from the evacuating rotational position and set to the new arranging rotational position.

The specific value of the α is determined in consideration of the physical shape of the arranging members, the curl or the like.

When whether the respective arranging members 102*a*, 102*b* are moved to the new arranging rotational position are found by means of the detection signals of the pose detecting sensor 450*a*, 450*b* (step P93), the stepping motor 179M is stopped and discharge of papers is waited for (step P73).

b-5. Control Example 5: Corresponding to Claim 49

Explanation with reference to FIGS. 151 to 153 will be described. Each of these figures represents parts of a flow chart and by connecting the flows through the same reference numerals attached with a mark * in each figure, the figures construct one flow chart.

The step PP1 in FIG. 151 has the same contents as those of step P10 to step P17 in FIG. 141. This example relates to a simple piling mode, and in step P11 of PP1, Yes is selected to go to step P100.

The arranging members 102*a*, 102*b* are rotated to the arranging rotational position (see FIG. 80) (step P100 to P102) and wait for discharge of papers onto the tray 12 (step P103). If papers are discharged, the arranging operation (see FIG. 14) is carried out by, for example, forward and backward moving the arranging members 102*a*, 102*b* (step P104).

It is determined whether arrangement of the assigned number of papers is completed without affection of curl on the arranging function or not in step P105. If arrangement of the assigned number of papers is not completed, the process goes to steps after step P111. If arrangement of the assigned number of papers is completed, since variation in pose of the arranging members is required to remove affection due to curl, properties of the curl are determined in step P106.

In step P106, it is determined whether the discharged papers are curled upward or downward. This determination is carried out according to the types of image forming apparatus. Since the image forming apparatus in use is known, properties of the curl can be found.

When it is determined that papers are curled upward, the escaping portions 102*a*2, 102*b*2 of the arranging members is opposed to the end of papers as shown by a dotted line in FIG. 104(*a*) or FIG. 105(*a*) and thus, the arrangement cannot be carried out. Therefore, the arranging rotational position is moved upward by a predetermined amount from the present arranging position, so that the end of papers to be arranged is opposed to the arranging portions 102*a*1, 102*b*1, not to the escaping portions 102*a*2, 102*b*2 (step P107), and then, the process goes to step P111.

Also, when papers are curled downward, the papers is not in contact with the arranging members as shown by the dotted line in FIG. 108(*a*), so that the arrangement cannot be carried out. Therefore, the process goes from step P106 via step P108 to step P109 and accordingly, the arranging rotational position is moved downward by a predetermined amount from the present arranging position, so that the end of papers to be arranged is opposed to the arranging portions 102*a*1, 102*b*1. Then, the process goes to step P111. On the other hand, when papers are not curled, the process goes to step P111 not via step P107 or step P109.

It is determined whether being in the shift mode or not in step P111. If it is in a simple piling mode, the process goes to step P112. If arrangement of the assigned number of papers is completed, the process ends and if arrangement of the assigned number of papers is not completed, discharge of papers is waited for in step P103.

If it is in the sorting mode, the process goes from step P111 to step P113 and it is determined whether arrangement of the loaded part of papers is completed or not. If arrangement of the loaded part of papers is not completed, discharge of papers is waited for in step P103.

In step P113, if it is determined that arrangement of the loaded part of papers is completed, the process goes to step P114 and then, it is determined whether arrangement of the assigned number of papers is completed or not.

In step P114, if it is determined that arrangement of the assigned number of papers is completed, the process ends. If arrangement of the assigned number of papers is not completed in step P114, the process goes to step P115 to carry out arrangement of the next part of papers.

In sorting, the arranging members 102*a*, 102*b* are moved to the evacuated rotational position (step P115 and P116), then, the tray 12 is shifted (step P117), the arranging members 102*a*, 102*b* are moved to the previous arranging rotational position (step P118 and P119) and discharge of papers is waited for (step P103), b-6. Control Example 6: Corresponding to Claim 56 and 57

Explanation with reference to FIGS. 154 to 156 will be described. Each of these figures represents parts of a flow chart and by connecting the flows through the same reference numerals attached with * in each figure, the figures construct one flow chart.

The step PP1 in FIG. 154 has the same contents as those of step P10 to step P17 in FIG. 137. This example relates to a sorting mode, and in step P11 of PP1, Yes is selected to go to step P120.

The arranging members 102*a*, 102*b* are rotated to the arranging rotational position (see FIG. 80) (step P120 to P122) and discharge of papers onto the tray 12 is waited for (step P123). If papers are discharged, it is determined whether it is for the first part of papers or not (step P124).

The reason is that if is for the first part of papers, since it is not the front part the evacuating rotational position at the time of shift is taken at a default position as it is, and if not for the first of papers (second part or later), since it is possible to obtain the positional information on the top surface of the paper bundle at the front part, by using this information the evacuating rotational position is set.

When it is determined that it is not for the first part of papers, arrangement through the arranging members 102*a*,

102*b* is not carried out (step P125) and it is determined whether the tray 12 is placed at the front side or at back. Depending on position of the tray 12, it is determined whether the arranging member in contact with the top surface of papers is the arranging member at the front side or the arranging member at back.

When it is determined that the tray 12 is placed at the front side in step P126, the arranging member 102*a* at the front side is in contact with the top surface of papers and thus, the rotational angle of the front arranging member 102*a* from the evacuating rotational position is stored as the position data.

Or, when it is determined that the tray 12 is placed at back in step P126, the arranging member 102*b* at back is in contact with the top surface of papers and thus, the rotational angle of the back arranging member 102*b* from the evacuating rotational position is stored as the position data. The rotational angle E° in the above [2] n corresponds to it.

If arrangement of the loaded part of papers is not completed in a state that the position data is stored, discharge of papers is waited for in step P128 and if arrangement of the loaded part of papers is completed, the process goes from step P129 to step P133. The evacuating rotational positions of both arranging members 102*a*, 102*b* are determined on the basis of the stored data in step P127 or step P128 provided in shifting the tray 12. When in the above [2] n, the evacuating angle of the arranging members 102*a*, 102*b* is determined such that the evacuating rotational position is set to the position upward by a margin value β° from the rotational angle E°, from the evacuating rotational position, of the arranging member 102*b* placed on the previous part of papers (step P183). In other words, the position that is rotated downward by E°−β° from the previous evacuating rotational position is set to the new evacuating rotational position.

The new evacuating rotational position of the arranging members 102*a*, 102*b* is determined to be the above value (step P134 and P135) and then, the tray 12 is shifted (step P136). In this shift, the arranging members 102*a*, 102*b* is not interfered with the top surface of papers.

On the other hand, when it is determined that it is the first part of papers in step P124, arrangement by the arranging members is not carried out (step P130) and it is determined whether arrangement of the loaded part of papers is completed or not. If it is not completed, discharge of papers is waited for (step P123) and if it is completed, the evacuating rotational position of the arranging members 102*a*, 102*b* is set to the default position as it is (step P132). The arranging members 102*a*, 102*b* is moved to the default position as it is (step P134 and P185) and the tray 12 is shifted (step P136).

It is checked whether arrangement of the assigned number and the loaded part of papers is completed in step P137, and discharge of papers is waited for (step P123) if it is not completed, and the process ends if it is completed.

b-7. Control Example 7: Corresponding to Claims 56 and 57

Explanation with reference to FIGS. 157 to 159 will be described. Each of these figures represents parts of a flow chart and by connecting the flows through the same reference numerals attached with * in each figure, the figures construct one flow chart.

The step PP1 in FIG. 157 has the same contents as those of step P10 to step P17 in FIG. 137. This example relates to a sorting mode, and in step P11 of PP1, Yes is selected to go to step P140.

The arranging members 102*a*, 102*b* are rotated to the arranging rotational position (see FIG. 80) (step P140 to P142) and discharge of papers onto the tray 12 is waited for (step P143). If papers are discharged, it is determined whether it is for the first part of papers or not (step P144).

If it is for the first part of papers, there is no previous part of papers and thus, the evacuating rotational position of the arranging members is maintained to the default position as it is. If it is not for the first part of papers (second part or later), position information of the top surface of the previous part can be obtained and thus, the evacuating rotational position is determined using the information.

When it is determined that it is not for the first part of papers in step P144, arrangement through the arranging members 102*a*, 102*b* is carried out (step P145) and the rotational angles of the front and back arranging members 102*a*, 102*b* from the evacuating rotational position are detected. If the rotational angle of the arranging member 102*a* is F° and the rotational angle of the arranging member 102*b* is G°, the respective rotational angles are stored as the position data (step P146). Here, depending on position of the tray 12, one of the arranging members 102*a*, 102*b* is placed on the bundle of papers and the other is opposed to end of papers.

Next, it is checked whether arrangement of the loaded part of papers is completed or not. If it is not completed, discharge of papers is waited for (step P148) and if it is completed, the process goes to step P148. If the position of the front arranging member 102*a* is higher than that of the back arranging member 102*b* (F°<G°), the evacuating rotational position is moved on the basis of the position data of the front arranging member (step P149, P164, P165 and P156). This corresponds to the example that in the above [2] o, the position rotated downward by F°−α° from the evacuating rotational position in detection is set to the new evacuating rotational position.

When the position of the front arranging member is not higher than that of the back arranging member in step P148, the process goes to step P168 and if the positions of the front and the back arranging members is equal to each other, the process goes to step P169. Considering margin to the evacuating rotational position in detection, an angle rotated downward by an angle abstracting a given α° from F° or G° from the evacuating rotational position in detection is set to the new evacuating rotational position and thus, the arranging members are moved to the new evacuating rotational position (step P158, P150, P154 and P155).

If the position of the back arranging member 102*b* is higher than that of the front arranging member 102*a* (F°>G°), the evacuating rotational position is moved on the basis of the position data of the back arranging member (step P158, P150, P154, P155 and P156). This corresponds to the example that in the above [2] o, the position rotated downward by F°−α° from the evacuating rotational position in detection is set to the new evacuating rotational position.

Then, the tray 12 is shifted (step P156). In this shifting, the arranging members 102*a*, 102*b* is not interfered with the top surface of papers.

It is checked whether arrangement of the assigned number and the loaded part of papers is completed in step P137. If it is not completed, discharge of papers is waited for (step P123) and if it is completed, the process ends.

b-8. Control Example 8: Corresponding to Claims 56 and 58

Explanation with reference to FIGS. 160 to 162 will be described. Each of these figures represents parts of a flow chart and by connecting the flows through the same reference numerals attached with * in each figure, the figures construct one flow chart.

The step PP1 in FIG. 160 has the same contents as those of step P10 to step P17 in FIG. 137. This example relates to a sorting mode, and in step P11 of PP1 (see FIG. 137), Yes is selected to go to step P160.

The arranging members 102*a*, 102*b* are rotated to the arranging rotational position (see FIG. 80) (step P160 to P162) and discharge of papers onto the tray 12 is waited for (step P163). If papers are discharged, the arranging operation for carrying out arrangement through the arranging members 102*a*, 102*b* (step P164) is repeated and if arrangement of the loaded part of papers is completed, the process goes to step P166.

Whether papers to be piled on the tray are upward curled or downward curled is determined depending on type of the image forming apparatus. In this example, by connecting the image forming apparatus 50 to the sheet-shaped medium after-treatment apparatus 51, information on the style of papers discharged from the image forming apparatus 50 is input to CPU 700 (see FIG. 46).

On the basis of properties of the image forming apparatus connected in step P166, if the curl of discharged papers is a face curl, the process goes to step P167. The evacuating rotational position of the arranging members 102*a*, 102*b* is set to a position higher by the amending amount than the default position without curl and on the basis of this amending amount, an amending amount of size according to the number of papers in which arrangement of the loaded part in step P165 is completed is determined (step P167).

Or, on the basis of properties of the image forming apparatus connected in step P166, if the curl of discharged papers is a back curl, the process goes to step P168. The evacuating rotational position of the arranging members 102*a*, 102*b* is set to a position lower by the amending amount than the default position without curl and on the basis of this amending amount, an amending amount of size according to the number of papers in which arrangement of the loaded part in step P165 is completed is determined (step P169).

Also, when it is determined that it is not a face curl in step P166 or it is determined that it is not a face curl in step P168, the evacuating rotational position of the arranging members 102*a*, 102*b* is maintained at the default position set without curl as it is (step P170).

The arranging members are moved to the evacuating rotational position of the arranging members determined in any of step P167, P169 and P170 (step P171 and P172) and then the tray 12 is shifted (step P173). If arrangement of the assigned number of papers is not completed, discharge of papers is waited for (step P174 and P163) and if arrangement of the assigned number of papers is completed, the process ends.

[4] Example Applied to Image Forming Apparatus

This example corresponds to that in FIG. 48 and thus, explanation thereof will be omitted. Although some embodiments of the present invention have been described, various changes and modifications can be made to the embodiments without departing the scope of claims.

What is claimed is:

1. A sheet-shaped medium aligning apparatus, comprising:

a body;

means for discharging sheet-shaped mediums, said discharging means disposed in said body;

means for piling the sheet-shaped mediums discharged from said discharging means, said piling means being attached to said body;

means for arranging the sheet-shaped mediums piled on said sheet piling means, by contacting the sheet-shaped mediums to sandwich ends of the sheet-shaped mediums parallel to a direction of discharging the sheet-shaped mediums from said discharging means, said arranging means being attached to said body; and means for sorting the sheet-shaped mediums by moving said sheet piling means or said arranging means in a shift direction perpendicular to the direction of discharging the sheet-shaped mediums from said discharging means, wherein said arranging means is configured to be moved from a position predetermined to carry out an arrangement of the sheet-shaped mediums piled on said sheet piling means to a receiving position in said body and to be moved from the receiving position to the position predetermined to carry out the arrangement, said arranging means is disposed outside said body when in said position predetermined to carry out an arrangement, and said arranging means is disposed inside said body when in said receiving position.

2. A sheet-shaped medium aligning apparatus as claimed in claim 1, wherein said arranging means is constructed to be moved between said receiving position (receiving rotational position) and said position predetermined to carry out the arrangement (arranging rotational position) by means of rotation.

3. A sheet-shaped medium aligning apparatus as claimed in claim 2, wherein said arranging means comprises:

a rotating shaft which is a center in the rotation and is configured to be used as a guide configured to slide said arranging means in said shift direction.

4. A sheet-shaped medium aligning apparatus as claimed in claim 3, wherein by rotating said rotating shaft, said arranging means is configured to be moved to said receiving rotational position, thereby to receive said arranging means.

5. A sheet-shaped medium aligning apparatus as claimed in claim 4, wherein said arranging means is configured to be moved, by means of rotation of said rotating shaft, to said arranging rotational position, to said receiving rotational position, and to an evacuating rotational position which is a position between said arranging rotational position and said receiving rotational position and in which a free end of said arranging means is evacuated from the sheet-shaped medium on a tray, and movement to the positions is carried out by a driving source of said rotating shaft.

6. A sheet-shaped medium aligning apparatus as claimed in claim 5, wherein said arranging means has a predetermined amount of free rotation region with respect to said rotating shaft.

7. A sheet-shaped medium aligning apparatus as claimed in claim 6, wherein said free rotation region is formed by a convex portion formed at one of said rotating shaft and said arranging means and by a gap in said rotating direction in an engagement portion with a concave portion formed in the other of said rotating shaft and said arranging means.

8. A sheet-shaped medium aligning apparatus as claimed in claim 7, wherein said arranging means has a pair of arranging members configured to carry out an arrangement such that the arranging members contact and sandwich two ends, parallel to said discharging direction, of the sheet-shaped mediums discharged from said discharging means and piled on said tray and arrange positions of said ends, said arranging means carries out the arrangement such that the sheet-shaped mediums piled after sorting are arranged in order at a position other than the position in which the sheet-shaped mediums are piled before the sorting, and said arranging means is rotated and received in the body at a position which is determined as a home position of said arranging members.

9. A sheet-shaped medium aligning apparatus as claimed in claim 8, wherein after arrangement of a series of jobs are completed, said arranging members are moved to said home position and then are received in said receiving rotational position.

10. A sheet-shaped medium aligning apparatus as claimed in claim 9, wherein if there are succeeding jobs when arrangement of a series of jobs are completed, said arranging members are moved to said home position but are forbidden to be received in said receiving rotational position.

11. A sheet-shaped medium aligning apparatus as claimed in claim 10, wherein when said arranging members are loaded with a predetermined or more load in rotation of said arranging members, said arranging members are forbidden to rotate toward said receiving rotational position.

12. A sheet-shaped medium aligning apparatus as claimed in claim 11, wherein said predetermined or more load is greater than a load configured not to damage a part of human body when the part of human body acts as a load configured to prevent rotation of said arranging members.

13. A sheet-shaped medium aligning apparatus as claimed in claim 12, wherein said arranging members impart an energized force to the rotating direction.

14. A sheet-shaped medium aligning apparatus as claimed in claim 13, wherein said energized force is automatically imparted through movement of said arranging members from said entrance position to said home position.

15. A sheet-shaped medium aligning apparatus as claimed in claim 14, wherein said home position on said rotating shaft is provided with an evacuation shaft having a convex portion or a concave portion capable of engaging with a concave portion or a convex portion formed in said arranging members, said evacuation shaft is energized by an energizing means such that a rotating force acts in a direction equal to the rotating direction in receiving said arranging members, and rotation of said evacuation shaft by means of the energizing means is blocked by means of a stopper at a predetermined rotational position.

16. A sheet-shaped medium aligning apparatus as claimed in claim 15, wherein the predetermined rotational position of said evacuation shaft is a rotational position equal to the convex portion or the concave portion formed in said rotating shaft.

17. A sheet-shaped medium aligning apparatus as claimed in claim 16, wherein said stopper of said evacuation shaft is made of a combination of a long hole on an arc about an axis of said rotating shaft configured to allow said arranging members to be rotated in a given rotation range in a direction opposed to the rotating direction in receiving said arranging members and a projection portion engaging with said long hole, and said evacuation shaft is provided to be incorporated with said rotating shaft.

18. A sheet-shaped medium aligning apparatus as claimed in claim 17, wherein said given rotation range is a rotation range of said arranging members about said rotating shaft and is a range in which said arranging members are configured to be rotationally moved from said arranging rotational position to said receiving rotational position.

19. An image forming apparatus comprising:

means for forming an image on a sheet-shaped medium;

means for conveying the sheet-shaped medium formed with the image; and a sheet-shaped medium aligning apparatus comprising:

a body, means for discharging sheet-shaped mediums, said discharging means disposed in said body, means for piling the sheet-shaped mediums discharged from said discharging means, said piling means being attached to said body, means for arranging the sheet-shaped mediums piled on said sheet piling means, by contacting the sheet-shaped mediums to sandwich ends of the sheet-shaped mediums parallel to a direction of discharging the sheet-shaped mediums from said discharging means, said arranging means being attached to said body, and means for sorting the sheet-shaped mediums by moving said sheet piling means or said arranging means in a shift direction perpendicular to the direction of discharging the sheet-shaped mediums from said discharging means, wherein said arranging means is configured to be moved from a position predetermined to carry out an arrangement of the sheet-shaped mediums piled on said sheet piling means to a receiving position in said body and to be moved from the receiving position to the position predetermined to carry out the arrangement, said arranging means is disposed outside said body when in said position predetermined to carry out an arrangement, and said arranging means is disposed inside said body when in said receiving position.

20. A sheet-shaped medium after-treatment apparatus comprising:

means for carrying out an after-treatment on a sheet-shaped medium;

means for conveying the sheet-shaped medium after-treated; and a sheet-shaped medium aligning apparatus comprising:

a body, means for discharging sheet-shaped mediums, said discharging means disposed in said body, means for piling the sheet-shaped mediums discharged from said discharging means, said piling means being attached to said body, means for arranging the sheet-shaped mediums piled on said sheet piling means, by contacting the sheet-shaped mediums to sandwich ends of the sheet-shaped mediums parallel to a direction of discharging the sheet-shaped mediums from said discharging means, said arranging means being attached to said body, and means for sorting the sheet-shaped mediums by moving said sheet piling means or said arranging means in a shift direction perpendicular to the direction of discharging the sheet-shaped mediums from said discharging means, wherein said arranging means is configured to be moved from a position predetermined to carry out an arrangement of the sheet-shaped mediums piled on said sheet piling means to a receiving position in said body and to be moved from the receiving position to the position predetermined to carry out the arrangement, said arranging means is disposed outside said body when in said position predetermined to carry out an arrangement, and said arranging means is disposed inside said body when in said receiving position.

21. A sheet-shaped medium after-treatment apparatus as claimed in claim 20, wherein said sheet piling means is constructed to pass through said discharging means and to be moved up and down.

22. A sheet-shaped medium aligning apparatus, comprising:

a body;

means for discharging sheet-shaped mediums, said discharging means disposed in said body;

means for piling the sheet-shaped mediums discharged from said discharging means, said piling means being attached to said body;

means for arranging the sheet-shaped mediums piled on said sheet piling means, by contacting the sheet-shaped mediums to sandwich ends of the sheet-shaped mediums parallel to a direction of discharging the sheet-shaped mediums from said discharging means, said arranging means being attached to said body; and means for sorting the sheet-shaped mediums by moving said sheet piling means or said arranging means by predetermined amount in a shift direction perpendicular to the direction of discharging the sheet-shaped mediums from said discharging means, wherein said arranging means is moved from an arranging region predetermined to carry out an arrangement of the sheet-shaped mediums on said sheet piling means to a receiving region in said body to be received therein, said arranging means is disposed outside said body when in said arranging region, said arranging means is disposed inside said body when in said receiving region, and a driving means is adapted to move said arranging means from said arranging region to said receiving region and to carry out the arrangement.

23. A sheet-shaped medium aligning apparatus as claimed in claim 22, wherein in said shift direction, said receiving region is provided outside said discharging means.

24. A sheet-shaped medium aligning apparatus as claimed in claim 22, wherein in said shift direction, a position corresponding to said receiving region is a home position of said arranging means.

25. A sheet-shaped medium aligning apparatus as claimed in claim 22, wherein in said shift direction, said receiving region is provided outside said arranging region.

26. A sheet-shaped medium aligning apparatus as claimed in claim 22, wherein in said shift direction, said receiving region is provided outside said sheet piling means.

27. A sheet-shaped medium aligning apparatus as claimed in claim 26, wherein said sheet piling means is shifted between at least two predetermined positions, and said arranging means is received in said receiving region on the basis of a state where said sheet piling means is shifted to any position between the two predetermined positions.

28. A sheet-shaped medium aligning apparatus as claimed in claim 22, wherein said arranging means engages slide-ably and rotationally with a guide shaft of a guide vessel which is formed on a base end portion of said arranging means and of which a lengthwise direction is set to said shift direction.

29. A sheet-shaped medium aligning apparatus as claimed in claim 28, wherein said guide vessel is provided with an engagement hole having a depth in a direction perpendicular to said guide shaft, a part of a driving block is configured to impart a driving force enabling reciprocal movement to said shift direction that engages slide-ably with said engagement hole, and said guide vessel is rotated to said receiving region about said guide shaft within a range in which the engagement is not released.

30. A sheet-shaped medium aligning apparatus as claimed in claim 29, wherein an outer circumferential portion of said guide vessel is provided with means for regulating the rotational position of said arranging means.

31. A sheet-shaped medium aligning apparatus as claimed in claim 30, wherein said regulating means engages with a first projection which is a part of the means for regulating the rotation by means of a self weight moment of said arranging means in order to set a pose of said arranging means to the arranging rotational position in said arranging region and with a cam hole provided in a region corresponding to said receiving region.

32. A sheet-shaped medium aligning apparatus as claimed in claim 31, wherein said cam hole has a linear portion extending in said shift direction and a curved portion configured to rotate a free end of said arranging means toward said receiving region.

33. A sheet-shaped medium aligning apparatus as claimed in claim 31, wherein said first projection is rotated about said guide shaft by means of the self weight moment of said arranging means engaging with a weight bar supported movably with a given range of stroke in said driving block to be at said arranging rotational position and is pressure-moved by means of a pressure-moving means using a solenoid to be rotated along with said guide vessel, so that said arranging means is moved from said arranging rotational position to an evacuating rotational position.

34. A sheet-shaped medium aligning apparatus as claimed in claim 33, wherein said weight bar is provided correspondingly to said arranging region and does not reach a region corresponding to said receiving region, a sensor configured to switch said pressure-moving means to off state at a position right before said guide vessel is guided to said cam hole is provided.

35. A sheet-shaped medium aligning apparatus as claimed in claim 31, wherein said first projection is provided above a second projection and engages with said weight bar.

36. A sheet-shaped medium aligning apparatus as claimed in claim 33, wherein said arranging means raises said weight bar to an upper limit of said stroke by means of a self weight moment thereof to hold said arranging means at said arranging rotational position, and pressure-moves said weight bar to a lower limit of said stroke by a means for driving said weightbar to move said arranging means to said evacuating rotational position.

37. A sheet-shaped medium aligning apparatus as claimed in claim 36, wherein when said weight bar pressure-moving means is in off state, said arranging means is at a position in which said second projection matches an entrance of said cam hole.

38. A sheet-shaped medium aligning apparatus as claimed in claim 37, wherein said arranging means is provided with a sensor configured to detect a position of said driving block in said shift direction, as a means for detecting whether said arranging means is received in said receiving region.

39. An image forming apparatus comprising:

means for forming an image on a sheet-shaped medium;

means for conveying the sheet-shaped medium formed with the image; and a sheet-shaped medium aligning apparatus comprising:

a body, means for discharging sheet-shaped mediums, said discharging means disposed in said body, means for piling the sheet-shaped mediums discharged from said discharging means, said piling means being attached to said body, means for arranging the sheet-shaped mediums piled on said sheet piling means, by contacting the sheet-shaped mediums to sandwich ends of the sheet-shaped mediums parallel to a direction of discharging the sheet-shaped mediums from said discharging means, said arranging means being attached to said body, and means for sorting the sheet-shaped mediums by moving said sheet piling means or said arranging means by predetermined amount in a shift direction perpendicular to the direction of discharging the sheet-shaped mediums from said discharging means, wherein said arranging means is moved from an arranging region predetermined to carry out an arrangement of the sheet-shaped mediums on said sheet piling means to a receiving region in said body to be received therein, said arranging means is disposed outside said body when in said arranging region, said arranging means is disposed inside said body when in said receiving region, and a driving means is adapted to move said arranging means from said arranging region to said receiving region and to carry out the arrangement.

40. A sheet-shaped medium after-treatment apparatus comprising:

means for carrying out an after-treatment on a sheet-shaped medium;

means for conveying the sheet-shaped medium after-treated; and a sheet-shaped medium aligning apparatus comprising:

a body, means for discharging sheet-shaped mediums, said discharging means disposed in said body, means for piling the sheet-shaped mediums discharged from said discharging means, said piling means being attached to said body, means for arranging the sheet-shaped mediums piled on said sheet piling means, by contacting the sheet-shaped mediums to sandwich ends of the sheet-shaped mediums parallel to a direction of discharging the sheet-shaped mediums from said discharging means, said arranging means being attached to said body, and means for sorting the sheet-shaped mediums by moving said sheet piling means or said arranging means by predetermined amount in a shift direction perpendicular to the direction of discharging the sheet-shaped mediums from said discharging means, wherein said arranging means is moved from an arranging region predetermined to carry out an arrangement of the sheet-shaped mediums on said sheet piling means to a receiving region in said body to be received therein, said arranging means is disposed outside said body when in said arranging region, said arranging means is disposed inside said body when in said receiving region, and a driving means is adapted to move said arranging means from said arranging region to said receiving region and to carry out the arrangement.

41. A sheet-shaped medium after-treatment apparatus as claimed in claim 40, wherein said sheet piling means is constructed to pass through said discharging means and to be moved up and down.

42. A sheet-shaped medium aligning apparatus, comprising:

a body;

means for discharging sheet-shaped mediums, said discharging means disposed in said body;

means for piling the sheet-shaped mediums discharged from said discharging means, said piling means being attached to said body; and means for arranging the sheet-shaped mediums piled on said sheet piling means, by contacting the sheet-shaped mediums to sandwich ends of the sheet-shaped mediums parallel to a direction of discharging the sheet-shaped medium from said discharging means, said arranging means being attached to said body, wherein said arranging means is supported on a rotating shaft such that a base end portion thereof is freely rotated within a predetermined range of a rotational angle, and by controlling an amount of rotation of said rotating shaft, a pose of said arranging means is adjusted at an arranging rotational position predetermined to sandwich said base end portion, and said arranging means rotates from a position outside said body to a position inside said body within said predetermined range of the rotational angle.

43. A sheet-shaped medium aligning apparatus as claimed in claim 42, wherein said arranging means has arranging members, said apparatus further comprising:

means for sorting the sheet-shaped mediums by moving said sheet piling means or said arranging members in a shift direction perpendicular to the direction of discharging the sheet-shaped mediums from said discharging means, wherein in arrangement in a sorting mode, one of said arranging members constructing a pair is placed on an top surface of a bundle of sheet-shaped mediums piling-completed and constructing the previous part and the other of said arranging members is placed at the arranging position opposing the end of the bundle of sheet-shaped mediums, and when arrangement is carried out on the basis of this state by inserting the ends of the sheet-shaped mediums parallel to the direction of discharging the sheet-shaped mediums between these opposing arranging members, the other arranging member is controlled to a pose configured to sandwich said ends, on the basis of detected result of a pose of said one arranging member placed on the bundle of sheet-shaped mediums.

44. A sheet-shaped medium aligning apparatus as claimed in claim 43, wherein by determining the arranging member placed on the bundle of sheet-shaped mediums from the position of the sheet piling means and detecting rotational angle of said arranging members, said arranging members are controlled to a pose configured to sandwich the ends of the sheet-shaped mediums in arrangement of a next part.

45. A sheet-shaped medium aligning apparatus as claimed in claim 43, wherein by rotating each of said arranging members from an evacuating rotational position not interfering the sheet-shaped mediums piled on said sheet piling means to a position in which the rotation stops within a predetermined range of rotational angle and comparing the rotational angles of said arranging members with each other to detect the rotational angles of the arranging members through determining the arranging member placed on the bundle of sheet-shaped mediums from the arranging member of which rotational angle is smaller, said arranging members are controlled to a pose configured to sandwich the ends of the sheet-shaped mediums in arrangement of a next part.

46. A sheet-shaped medium aligning apparatus as claimed in claim 45, wherein if a difference in the rotational angle of each arranging member is of a predetermined or more value, a warning is displayed.

47. A sheet-shaped medium aligning apparatus as claimed in claim 43, wherein an encoder is provided in said base end portion of said arranging members and slits of the encoder are detected by a sensor comprising a plurality of detecting portions provided in different positions.

48. A sheet-shaped medium aligning apparatus as claimed in claim 47, wherein said sensor is moved along with said arranging members in a direction perpendicular to the direction of discharging the sheet-shaped mediums.

49. A sheet-shaped medium aligning apparatus as claimed in claim 42, wherein the pose of said arranging members are controlled such that said arranging position is set in accordance with the number of sheet-shaped mediums piled on said sheet piling means.

50. A sheet-shaped medium aligning apparatus as claimed in claim 42, wherein when in a simple piling mode, a predetermined number of sheet-shaped mediums are discharged onto said sheet piling means, the free end of one of said arranging members is placed on the sheet-shaped mediums and then a pose of the arranging member is detected, and on the basis of this pose, a pose of the other of said arranging members is controlled to the arranging position configured to sandwich the ends.

51. A sheet-shaped medium aligning apparatus as claimed in claim 42, wherein when in a simple piling mode, a predetermined number of sheet-shaped mediums are discharged onto said sheet piling means, each free end of said arranging members opposing each other in a direction perpendicular to the direction of discharging the sheet-shaped mediums is placed on the sheet-shaped mediums and then the poses of the arranging members are detected, and on the basis of these poses, said arranging members are controlled to the arranging position configured to sandwich the ends.

52. A sheet-shaped medium aligning apparatus as claimed in claim 51, wherein with reference to a position of the arranging member of which the free end is lower, out of said two arranging members, the poses of said arranging members are controlled to the arranging position configured to sandwich the ends.

53. A sheet-shaped medium aligning apparatus as claimed in claim 50, wherein a time interval in discharging the sheet-shaped mediums is made longer by delaying timing in discharging the sheet-shaped mediums from said discharging means, and pose detection and pose control of said arranging members are carried out during the time interval in discharging.

54. A sheet-shaped medium aligning apparatus as claimed in claim 53, wherein in order to delay the timing in discharging, conveying speed of the sheet-shaped mediums is slowed down.

55. A sheet-shaped medium aligning apparatus as claimed in claim 51, wherein when a difference in height of each free end of said two arranging members is greater than a predetermined value, a warning is displayed.

56. A sheet-shaped medium aligning apparatus, comprising:

a body;

means for discharging sheet-shaped mediums, said discharging means disposed in said body;

means for piling the sheet-shaped mediums discharged from said discharging means, said piling means being attached to said body; and a pair of arranging members having base end portions and configured to arrange the sheet-shaped mediums piled on said sheet piling means, by contacting the sheet-shaped mediums to sandwich ends of the sheet-shaped mediums parallel to a direction of discharging the sheet-shaped mediums from said discharging means, wherein a mode for sorting the sheet-shaped mediums is possible by moving said sheet piling means or said arranging members in a shift direction perpendicular to the direction of discharging the sheet-shaped mediums from said discharging means, said base end portions of said arranging members are supported on a rotating shaft, by controlling an amount of rotation of said rotating shaft, said arranging members are configured to be moved to an arranging rotational position configured to sandwich the ends and to an evacuating rotational position separated from the top surface of the sheet-shaped mediums and said evacuating rotational position is configured to be variably controlled, said arranging members are disposed outside said body when in said arranging position, and said arranging members are disposed inside said body when in said evacuating position.

57. A sheet-shaped medium aligning apparatus as claimed in claim 56, wherein in arrangement in the sorting mode, an evacuating angle from said evacuating rotational position to the position in which the arranging members are placed on the sheet-shaped mediums, with respect to the arranging member placed on the sheet-shaped mediums on said sheet piling means, in arrangement of a previous part is stored and in arrangement of a next part, the evacuating angle of said arranging members is set to a value obtained by adding a margin value to said stored value.

58. A sheet-shaped medium aligning apparatus as claimed in claim 57, wherein on the basis of a position of the arranging member of which the free end is lower, out of said two arranging members, said evacuating angle is set.

59. A sheet-shaped medium aligning apparatus as claimed in claim 56, wherein said evacuating rotational position is set depending on the number of sheet-shaped mediums piled on said sheet piling means.

60. An image forming apparatus comprising:

means for forming an image on a sheet-shaped medium;

means for conveying the sheet-shaped medium formed with the image; and a sheet-shaped medium aligning apparatus, said sheet-shaped medium aligning apparatus comprising:

a body, means for discharging sheet-shaped mediums, said discharging means disposed in said body, means for piling the sheet-shaped mediums discharged from said discharging means, said piling means being attached to said body, and means for arranging the sheet-shaped mediums piled on said sheet piling means, by contacting the sheet-shaped mediums to sandwich ends of the sheet-shaped mediums parallel to a direction of discharging the sheet-shaped medium from said discharging means, said arranging means being attached to said body, wherein said arranging means is supported on a rotating shaft such that a base end portion thereof is freely rotated within a predetermined range of a rotational angle, from a position inside said body to a position outside said body, and by controlling an amount of rotation of said rotating shaft, a pose of said arranging means is adjusted at an arranging rotational position configured to sandwich said base end portion.

61. A sheet-shaped medium after-treatment apparatus comprising:

means for carrying out an after-treatment on a sheet-shaped medium;

means for conveying the sheet-shaped medium after-treated; and a sheet-shaped medium aligning apparatus, said sheet-shaped medium aligning apparatus comprising:

a body, means for discharging sheet-shaped mediums, said discharging means disposed in said body, means for piling the sheet-shaped mediums discharged from said discharging means, said piling means being attached to said body, and means for arranging the sheet-shaped mediums piled on said sheet piling means, by contacting the sheet-shaped mediums to sandwich ends of the sheet-shaped mediums parallel to a direction of discharging the sheet-shaped medium from said discharging means, said arranging means being attached to said body, wherein said arranging means is supported on a rotating shaft such that a base end portion thereof is freely rotated within a predetermined range of a rotational angle, from a position outside said body to a position inside said body, and by controlling an amount of rotation of said rotating shaft, a pose of said arranging means is adjusted at an arranging rotational position configured to sandwich said base end portion.

62. An image forming apparatus comprising:

means for forming an image on a sheet-shaped medium;

means for conveying the sheet-shaped medium formed with the image; and a sheet-shaped medium aligning apparatus, said sheet-shaped medium aligning apparatus comprising:

a body, means for discharging sheet-shaped mediums, said discharging means disposed in said body, means for piling the sheet-shaped mediums discharged from said discharging means, said piling means being attached to said body, and a pair of means for arranging the sheet-shaped mediums piled on said sheet piling means, by contacting the sheet-shaped mediums to sandwich ends of the sheet-shaped mediums parallel to a direction of discharging the sheet-shaped mediums from said discharging means, said pair of arranging means being attached to said body, wherein a sorting mode configured to sort the sheet-shaped mediums is possible by moving said sheet piling means or said arranging means in a shift direction perpendicular to the direction of discharging the sheet-shaped mediums from said discharging means, base end portions of said arranging means are supported on a rotating shaft, and by controlling rotating amount of said rotating shaft, said arranging means is configured to be moved to an arranging rotational position predetermined to sandwich the ends and to an evacuating rotational position separated from the top surface of the sheet-shaped mediums and said evacuating rotational position is configured to be variably controlled, and said pair of arranging means is configured to be rotated from a position outside said body to a position inside said body.

63. A sheet-shaped medium after-treatment apparatus comprising:

means for carrying out an after-treatment on a sheet-shaped medium;

means for conveying the sheet-shaped medium after-treated; and a sheet-shaped medium aligning apparatus, said sheet-shaped medium aligning apparatus comprising:

a body, means for discharging sheet-shaped mediums, said discharging means disposed in said body, means for piling the sheet-shaped mediums discharged from said discharging means, said piling means being attached to said body, and a pair of means for arranging the sheet-shaped mediums piled on said sheet piling means, by contacting the sheet-shaped mediums to sandwich ends of the sheet-shaped mediums parallel to a direction of discharging the sheet-shaped mediums from said discharging means, said pair of arranging means being attached to said body, wherein a sorting mode configured to sort the sheet-shaped mediums is possible by moving said sheet piling means or said arranging means in a shift direction perpendicular to the direction of discharging the sheet-shaped mediums from said discharging means, base end portions of said arranging means are supported on a rotating shaft, and by controlling rotating amount of said rotating shaft, said arranging means is configured to be moved to an arranging rotational position predetermined to sandwich the ends and to an evacuating rotational position separated from the top surface of the sheet-shaped mediums and said evacuating rotational position is configured to be variably controlled, and said pair of arranging means is configured to be rotated from a position outside said body to a position inside said body.

64. A sheet-shaped medium aligning apparatus, comprising:

a body;

a discharging device configured to discharge sheet-shaped mediums, said discharging device disposed in said body;

a sheet piling device configured to pile the sheet-shaped mediums discharged from said discharging device, said sheet piling device being attached to said body;

an arranging device having a rotating shaft and configured to arrange the sheet-shaped mediums piled on said sheet piling device, by contacting the sheet-shaped mediums to sandwich ends of the sheet-shaped mediums parallel to a direction of discharging the sheet-shaped mediums from said discharging device, said arranging device being attached to said body; and a sorting device configured to sort the sheet-shaped mediums by moving said sheet piling device or said arranging device in a shift direction perpendicular to the direction of discharging the sheet-shaped mediums from said discharging device, said sorting device being attached to said body, wherein said arranging device is moved from a position predetermined to carry out an arrangement of the sheet-shaped mediums piled on said sheet piling device to a receiving position in a body and is also moved from the receiving position to the position predetermined to carry out the arrangement, said arranging device being disposed inside said body when in said receiving position, and said arranging device being disposed outside said body when in said position predetermined to carry out the arrangement.

65. A sheet-shaped medium aligning apparatus as claimed in claim 64, wherein said arranging device is constructed to be moved between said receiving position (receiving rotational position) and said position predetermined to carry out the arrangement (arranging rotational position) by means of rotation.

66. A sheet-shaped medium aligning apparatus as claimed in claim 65, wherein said rotating shaft which is a center in the rotation is configured to be used as a guide configured to slide said arranging device in said shift direction.

67. A sheet-shaped medium aligning apparatus as claimed in claim 66, wherein by rotating said rotating shaft, said arranging device is moved to said receiving rotational position, thereby to receive said arranging device.

68. A sheet-shaped medium aligning apparatus as claimed in claim 67, wherein said arranging device is configured to be moved, by a rotation of said rotating shaft, to said arranging rotational position, to said receiving rotational position, and to an evacuating rotational position which is a position between said arranging rotational position and said receiving rotational position and in which a free end of said arranging device is evacuated from the sheet-shaped medium on a tray, and movement to the positions is carried out by a driving source of said rotating shaft.

69. A sheet-shaped medium aligning apparatus as claimed in claim 68, wherein said arranging device has a predetermined amount of free rotation region with respect to said rotating shaft.

70. A sheet-shaped medium aligning apparatus as claimed in claim 69, wherein said free rotation region is formed by a convex portion formed at one of said rotating shaft and said arranging device and by a gap in said rotating direction in an engagement portion with a concave portion formed in the other of said rotating shaft and said arranging device.

71. A sheet-shaped medium aligning apparatus as claimed in claim 70, wherein said arranging device has a pair of arranging members configured to carry out an arrangement such that the arranging members contact and sandwich two ends, parallel to said discharging direction, of the sheet-shaped mediums discharged from said discharging device and piled on said tray and arrange positions of said ends, said arranging device carries out the arrangement such that the sheet-shaped mediums piled after sorting are arranged in order at a position other than the position in which the sheet-shaped mediums are piled before the sorting, and said arranging device is rotated and received in the body at a position which is determined as a home position of said arranging members.

72. A sheet-shaped medium aligning apparatus as claimed in claim 71, wherein after arrangement of a series of jobs are completed, said arranging members are moved to said home position and then are received in said receiving rotational position.

73. A sheet-shaped medium aligning apparatus as claimed in claim 72, wherein if there are succeeding jobs when arrangement of a series of jobs are completed, said arranging members are moved to said home position but are forbidden to be received in said receiving rotational position.

74. A sheet-shaped medium aligning apparatus as claimed in claim 73, wherein when said arranging members are loaded with a predetermined or more load in rotation of said arranging members, said arranging members are forbidden to rotate toward said receiving rotational position.

75. A sheet-shaped medium aligning apparatus as claimed in claim 74, wherein said predetermined or more load is greater than a load configured not to damage a part of human body when the part of human body acts as a load configured to prevent rotation of said arranging members.

76. A sheet-shaped medium aligning apparatus as claimed in claim 75, wherein said arranging members impart an energized force to the rotating direction.

77. A sheet-shaped medium aligning apparatus as claimed in claim 76, wherein said energized force is automatically imparted through movement of said arranging members from said entrance position to said home position.

78. A sheet-shaped medium aligning apparatus as claimed in claim 77, wherein said home position on said rotating shaft is provided with an evacuation shaft having a convex portion or a concave portion capable of engaging with a concave portion or a convex portion formed in said arranging members, said evacuation shaft is energized by an energizing device such that a rotating force acts in a direction equal to the rotating direction in receiving said arranging members, and rotation of said evacuation shaft by the energizing device is blocked by means of a stopper at a predetermined rotational position.

79. A sheet-shaped medium aligning apparatus as claimed in claim 78, wherein the predetermined rotational position of said evacuation shaft is a rotational position equal to the convex portion or the concave portion formed in said rotating shaft.

80. A sheet-shaped medium aligning apparatus as claimed in claim 79, wherein said stopper of said evacuation shaft is made of a combination of a long hole on an arc about an axis of said rotating shaft configured to allow said arranging members to be rotated in a given rotation range in a direction opposed to the rotating direction in receiving said arranging members and a projection portion engaging with said long hole, and said evacuation shaft is provided to be incorporated with said rotating shaft.

81. A sheet-shaped medium aligning apparatus as claimed in claim 80, wherein said given rotation range is a rotation range of said arranging members about said rotating shaft and is a range in which said arranging members are configured to be rotationally moved from said arranging rotational position to said receiving rotational position.

82. An image forming apparatus comprising:

an image forming device configured to form an image on a sheet-shaped medium;

a conveying device configured to convey the sheet-shaped medium formed with the image; and a sheet-shaped medium aligning apparatus comprising:

a body, a discharging device configured to discharge sheet-shaped mediums, said discharging device disposed in said body, a sheet piling device configured to pile the sheet-shaved mediums discharged from said discharging device, said sheet piling device being attached to said body, an arranging device having a rotating shaft and configured to arrange the sheet-shaped mediums piled on said sheet piling device, by contacting the sheet-shaped mediums to sandwich ends of the sheet-shaped mediums parallel to a direction of discharging the sheet-shaped mediums from said discharging device, said arranging device being attached to said body, and a sorting device configured to sort the sheet-shaped mediums by moving said sheet piling device or said arranging device in a shift direction perpendicular to the direction of discharging the sheet-shaved mediums from said discharging device, said sorting device being attached to said body, wherein said arranging device is moved from a position predetermined to carry out an arrangement of the sheet-shaped mediums piled on said sheet piling device to a receiving position in a body and is also moved from the receiving position to the position predetermined to carry out the arrangement, said arranging device being disposed inside said body when in said receiving position, and said arranging device being disposed outside said body when in said position predetermined to carry out the arrangement.

83. A sheet-shaped medium after-treatment apparatus comprising:

an after-treating device configured to carry out an after-treatment on a sheet-shaped medium;

a conveying device configured to convey the sheet-shaped medium after-treated; and a sheet-shaped medium aligning apparatus comprising:

a body, a discharging device configured to discharge sheet-shaped mediums, said discharging device disposed in said body, a sheet piling device configured to pile the sheet-shaped mediums discharged from said discharging device, said sheet piling device being attached to said body, an arranging device having a rotating shaft and configured to arrange the sheet-shaped mediums piled on said sheet piling device, by contacting the sheet-shaped mediums to sandwich ends of the sheet-shaped mediums parallel to a direction of discharging the sheet-shaped mediums from said discharging device, said arranging device being attached to said body, and a sorting device configured to sort the sheet-shaped mediums by moving said sheet piling device or said arranging device in a shift direction perpendicular to the direction of discharging the sheet-shaped mediums from said discharging device, said sorting device being attached to said body, wherein said arranging device is moved from a position predetermined to carry out an arrangement of the sheet-shaped mediums piled on said sheet piling device to a receiving position in a body and is also moved from the receiving position to the position predetermined to carry out the arrangement, said arranging device being disposed inside said body when in said receiving position, and said arranging device being disposed outside said body when in said position predetermined to carry out the arrangement.

84. A sheet-shaped medium after-treatment apparatus as claimed in claim 83, wherein said sheet piling device is constructed to pass through said discharging device and to be moved up and down.

85. A sheet-shaped medium aligning apparatus, comprising:

a body;

a discharging device configured to discharge sheet-shaped mediums, said discharging device disposed in said body;

a sheet piling device configured to pile the sheet-shaped mediums discharged from said discharging device, said sheet piling device being attached to said body;

an arranging device configured to arrange the sheet-shaped mediums piled on said sheet piling device, by contacting the sheet-shaped mediums to sandwich ends of the sheet-shaped mediums parallel to a direction of discharging the sheet-shaped mediums from said discharging device, said arranging device being attached to said body; and a sorting device configured to sort the sheet-shaped mediums by moving said sheet piling device or said arranging device by predetermined amount in a shift direction perpendicular to the direction of discharging the sheet-shaped mediums from said discharging device, said sorting device being attached to said body, wherein said arranging device is moved from an arranging region configured to carry out an arrangement of the sheet-shaped mediums on said sheet piling device to a receiving region in said body to be received therein and a driving device is adapted to move said arranging device from said arranging region to said receiving region and to carry out the arrangement, said driving device including a guide shaft, said arranging device being disposed inside said body when in said receiving region, and said arranging device being disposed outside said body when in said arranging region.

86. A sheet-shaped medium aligning apparatus as claimed in claim 85, wherein in said shift direction, said receiving region is provided outside said discharging device.

87. A sheet-shaped medium aligning apparatus as claimed in claim 85, wherein in said shift direction, a position corresponding to said receiving region is a home position of said arranging device.

88. A sheet-shaped medium aligning apparatus as claimed in claim 85, wherein in said shift direction, said receiving region is provided outside said arranging region.

89. A sheet-shaped medium aligning apparatus as claimed in claim 85, wherein in said shift direction, said receiving region is provided outside said sheet piling device.

90. A sheet-shaped medium aligning apparatus as claimed in claim 89, wherein said sheet piling device is shifted between at least two predetermined positions, and said arranging device is received in said receiving region on the basis of a state where said sheet piling device is shifted to any position between the two predetermined positions.

91. A sheet-shaped medium aligning apparatus as claimed in claim 85, wherein said arranging device engages slide-ably and rotationally with said guide shaft, said guide shaft in contact with a guide vessel which is formed on a base end portion of said arranging device and of which a lengthwise direction is set to said shift direction.

92. A sheet-shaped medium aligning apparatus as claimed in claim 91, wherein said guide vessel is provided with an engagement hole having a depth in a direction perpendicular to said guide shaft, a part of a driving block is configured to impart a driving force enabling reciprocal movement to said shift direction that engages slide-ably with said engagement hole, and said guide vessel is rotated to said receiving region about said guide shaft within a range in which the engagement is not released.

93. A sheet-shaped medium aligning apparatus as claimed in claim 92, wherein an outer circumferential portion of said guide vessel is provided with a regulating device configured to regulate the rotational position of said arranging device.

94. A sheet-shaped medium aligning apparatus as claimed in claim 93, wherein said regulating device engages with a first projection which is a part of the regulating device configured to regulate the rotation by means of a self weight moment of said arranging device in order to set a pose of said arranging device to the arranging rotational position in said arranging region and with a cam hole provided in a region corresponding to said receiving region.

95. A sheet-shaped medium aligning apparatus as claimed in claim 94, wherein said cam hole has a linear portion extending in said shift direction and a curved portion configured to rotate a free end of said arranging device toward said receiving region.

96. A sheet-shaped medium aligning apparatus as claimed in claim 94, wherein said first projection is rotated about said guide shaft by means of the self weight moment of said arranging device engaging with a weight bar supported movably with a given range of stroke in said driving block to be at said arranging rotational position and is pressure-moved by means of a pressure-moving device using a solenoid to be rotated along with said guide vessel, so that said arranging device is moved from said arranging rotational position to an evacuating rotational position.

97. A sheet-shaped medium aligning apparatus as claimed in claim 96, wherein said weight bar is provided correspondingly to said arranging region and does not reach a region corresponding to said receiving region, a sensor configured to switch said pressure-moving device to off state at a position right before said guide vessel is guided to said cam hole is provided.

98. A sheet-shaped medium aligning apparatus as claimed in claim 94, wherein said first projection is provided above a second projection and engages with said weight bar.

99. A sheet-shaped medium aligning apparatus as claimed in claim 96, wherein said arranging device raises said weight bar to an upper limit of said stroke by means of a self weight moment thereof to hold said arranging device at said arranging rotational position, and pressure-moves said weight bar to a lower limit of said stroke by means of the weight bar pressure-moving device configured to drive said weight bar to move said arranging device to said evacuating rotational position.

100. A sheet-shaped medium aligning apparatus as claimed in claim 99, wherein when said weight bar pressure-moving device is in off state, said arranging device is at a position in which said second projection matches an entrance of said cam hole.

101. A sheet-shaped medium aligning apparatus as claimed in claim 100, wherein said arranging device is provided with a sensor configured to detect a position of said driving block in said shift direction, as a device configured to detect whether said arranging device is received is said receiving region.

102. An image forming apparatus comprising:

an image forming device configured to form an image on a sheet-shaped medium;

a conveying device configured to convey the sheet-shaped medium formed with the image; and a sheet-shaped medium aligning apparatus comprising:

a body, a discharging device configured to discharge sheet-shaped mediums, said discharging device disposed in said body, a sheet piling device configured to pile the sheet-shaped mediums discharged from said discharging device, said sheet piling device being attached to said body, an arranging device configured to arrange the sheet-shaped mediums piled on said sheet piling device, by contacting the sheet-shaped mediums to sandwich ends of the sheet-shaped mediums parallel to a direction of discharging the sheet-shaped mediums from said discharging device, said arranging device being attached to said body, and a sorting device configured to sort the sheet-shaped mediums by moving said sheet piling device or said arranging device by predetermined amount in a shift direction perpendicular to the direction of discharging the sheet-shaped mediums from said discharging device, said sorting device being attached to said body, wherein said arranging device is moved from an arranging region configured to carry out an arrangement of the sheet-shaped mediums on said sheet piling device to a receiving region in said body to be received therein and a driving device is adapted to move said arranging device from said arranging region to said receiving region and to carry out the arrangement, said driving device including a guide shaft, said arranging device being disposed inside said body when in said receiving region, and said arranging device being disposed outside said body when in said arranging region.

103. A sheet-shaped medium after-treatment apparatus comprising:

an after-treating device configured to carry out an after-treatment on a sheet-shaped medium;

a conveying device configured to convey the sheet-shaped medium after-treated; and a sheet-shaped medium aligning apparatus comprising:

a body, a discharging device configured to discharge sheet-shaped mediums, said discharging device disposed in said body, a sheet piling device configured to pile the sheet-shaped mediums discharged from said discharging device, said sheet piling device being attached to said body, an arranging device configured to arrange the sheet-shaped mediums piled on said sheet piling device, by contacting the sheet-shaped mediums to sandwich ends of the sheet-shaped mediums parallel to a direction of discharging the sheet-shaped mediums from said discharging device, said arranging device being attached to said body, and a sorting device configured to sort the sheet-shaped mediums by moving said sheet piling device or said arranging device by predetermined amount in a shift direction perpendicular to the direction of discharging the sheet-shaped mediums from said discharging device, said sorting device being attached to said body, wherein said arranging device is moved from an arranging region configured to carry out an arrangement of the sheet-shaped mediums on said sheet piling device to a receiving region in said body to be received therein and a driving device is adapted to move said arranging device from said arranging region to said receiving region and to carry out the arrangement, said driving device including a guide shaft, said arranging device being disposed inside said body when in said receiving region, and said arranging device being disposed outside said body when in said arranging region.

104. A sheet-shaped medium after-treatment apparatus as claimed in claim 103, wherein said sheet piling device is constructed to pass through said discharging device and to be moved up and down.

105. A sheet-shaped medium aligning apparatus, comprising:

a body;

a discharging device configured to discharge sheet-shaped mediums, said discharging device disposed in said body;

a sheet piling device configured to pile the sheet-shaped mediums discharged from said discharging device, said sheet piling device being attached to said body; and an arranging device configured to arrange the sheet-shaped mediums piled on said sheet piling device, by contacting the sheet-shaped mediums to sandwich ends of the sheet-shaped mediums parallel to a direction of discharging the sheet-shaped medium from said discharging device, said arranging device being attached to said body, wherein said arranging device is supported on a rotating shaft such that a base end portion thereof is freely rotated within a predetermined range of a rotational angle from a position outside said body to a position inside said body, and, by controlling the rotating amount of said rotating shaft, a pose of said arranging device is adjusted at an arranging rotational position predetermined to sandwich said base end portion.

106. A sheet-shaped medium aligning apparatus as claimed in claim 105, wherein said arranging device has arranging members, said apparatus further comprising a sorting device configured to sort the sheet-shaped mediums by moving said sheet piling device or said arranging members in a shift direction perpendicular to the direction of discharging the sheet-shaped mediums from said discharging device, wherein in arrangement in a sorting mode, one of said arranging members constructing a pair is placed on an top surface of a bundle of sheet-shaped mediums piling-completed and constructing the previous part and the other of said arranging members is placed at the arranging position opposing the end of the bundle of sheet-shaped mediums, and when arrangement is carried out on the basis of this state by inserting the ends of the sheet-shaped mediums parallel to the direction of discharging the sheet-shaped mediums between these opposing arranging members, the other arranging member is controlled to a pose configured to sandwich said ends, on the basis of detected result of a pose of said one arranging member placed on the bundle of sheet-shaped mediums.

107. A sheet-shaped medium aligning apparatus as claimed in claim 106, wherein by determining the arranging member placed on the bundle of sheet-shaped mediums from the position of the sheet piling device and detecting the rotational angle of said arranging members, said arranging members are controlled to a pose configured to sandwich the ends of the sheet-shaped mediums in arrangement of a next part.

108. A sheet-shaped medium aligning apparatus as claimed in claim 106, wherein by rotating each of said arranging members from an evacuating rotational position not interfering with the sheet-shaped mediums piled on said sheet piling device to a position in which the rotation stops within a predetermined range of the rotational angle and comparing the rotational angles of said arranging members with each other to detect the rotational angles of the arranging members through determining the arranging member placed on the bundle of sheet-shaped mediums from the arranging member of which rotational angle is smaller, said arranging members are controlled to a pose configured to sandwich the ends of the sheet-shaped mediums in arrangement of a next part.

109. A sheet-shaped medium aligning apparatus as claimed in claim 108, wherein if a difference in the rotational angle of each arranging member is of a predetermined or more value, a warning is displayed.

110. A sheet-shaped medium aligning apparatus as claimed in claim 106, wherein an encoder is provided in said base end portion of said arranging members and slits of the encoder are detected by a sensor including a plurality of detecting portions provided in different positions.

111. A sheet-shaped medium aligning apparatus as claimed in claim 110, wherein said sensor is moved along with said arranging members in a direction perpendicular to the direction of discharging the sheet-shaped mediums.

112. A sheet-shaped medium aligning apparatus as claimed in claim 105, wherein the pose of said arranging members are controlled such that said arranging position is set in accordance with the number of sheet-shaped mediums piled on said sheet piling device.

113. A sheet-shaped medium aligning apparatus as claimed in claim 105, wherein when in a simple piling mode, a predetermined number of sheet-shaped mediums are discharged onto said sheet piling device, the free end of one of said arranging members is placed on the sheet-shaped mediums and then a pose of the arranging member is detected, and on the basis of this pose, a pose of the other of said arranging members is controlled to the arranging position predetermined to sandwich the ends.

114. A sheet-shaped medium aligning apparatus as claimed in claim 105, wherein when in a simple piling mode, a predetermined number of sheet-shaped mediums are discharged onto said sheet piling device, each free end of said arranging members opposing each other in a direction perpendicular to the direction of discharging the sheet-shaped mediums is placed on the sheet-shaped mediums and then the poses of the arranging members are detected, and on the basis of these poses, said arranging members are controlled to the arranging position predetermined to sandwich the ends.

115. A sheet-shaped medium aligning apparatus as claimed in claim 114, wherein with reference to a position of the arranging member of which the free end is lower, out of said two arranging members, the poses of said arranging members are controlled to the arranging position predetermined to sandwich the ends.

116. A sheet-shaped medium aligning apparatus as claimed in claim 113, wherein a time interval in discharging the sheet-shaped mediums is made longer by delaying timing in discharging the sheet-shaped mediums from said discharging device, and pose detection and pose control of said arranging members are carried out during the time interval in discharging.

117. A sheet-shaped medium aligning apparatus as claimed in claim 116, wherein in order to delay the timing in discharging, conveying speed of the sheet-shaped mediums is slowed down.

118. A sheet-shaped medium aligning apparatus as claimed in claim 114, wherein when a difference in height of each free end of said two arranging members is greater than a predetermined value, a warning is displayed.

119. A sheet-shaped medium aligning apparatus, comprising:

a body;

a discharging device configured to discharge sheet-shaped mediums, said discharging device disposed in said body;

a sheet piling device configured to pile the sheet-shaped mediums discharged from said discharging device, said sheet piling device being attached to said body; and a pair of arranging members configured to arrange the sheet-shaped mediums piled on said sheet piling device, by contacting the sheet-shaped mediums to sandwich ends of the sheet-shaped mediums parallel to a direction of discharging the sheet-shaped mediums from said discharging device, said pair of members being attached to said body, wherein a sorting mode configured to sort the sheet-shaped mediums is possible by moving said sheet piling device or said arranging members in a shift direction perpendicular to the direction of discharging the sheet-shaped mediums from said discharging device, base end portions of said arranging members are supported on a rotating shaft, and by controlling a rotating amount of said rotating shaft from a position outside said body to a position inside said body, said arranging members are configured to be moved to an arranging rotational position predetermined to sandwich the ends and to an evacuating rotational position separated from the top surface of the sheet-shaped mediums and said evacuating rotational position is configured to be variably controlled.

120. A sheet-shaped medium aligning apparatus as claimed in claim 119, wherein in arrangement in the sorting mode, an evacuating angle from said evacuating rotational position to the position in which the arranging members are placed on the sheet-shaped mediums, with respect to the arranging member placed on the sheet-shaped mediums on said sheet piling device, in arrangement of a previous part is stored and in arrangement of a next part, the evacuating angle of said arranging members is set to a value obtained by adding a margin value to said stored value.

121. A sheet-shaped medium aligning apparatus as claimed in claim 120, wherein on the basis of a position of the arranging member of which the free end is lower, out of said two arranging members, said evacuating angle is set.

122. A sheet-shaped medium aligning apparatus as claimed in claim 119, wherein said evacuating rotational position is set depending on the number of sheet-shaped mediums piled on said sheet piling device.

123. An image forming apparatus comprising:

an image forming device configured to form an image on a sheet-shaped medium;

a conveying device configured to convey the sheet-shaped medium formed with the image; and a sheet-shaped medium aligning apparatus, said sheet-shaped medium aligning apparatus comprising:

a body, a discharging device configured to discharge sheet-shaped mediums, said discharging device disposed in said body, a sheet piling device configured to pile the sheet-shaped mediums discharged from said discharging device, said sheet piling device being attached to said body, and an arranging device configured to arrange the sheet-shaped mediums piled on said sheet piling device, by contacting the sheet-shaped mediums to sandwich ends of the sheet-shaped mediums parallel to a direction of discharging the sheet-shaped medium from said discharging device, said arranging device being attached to said body, wherein said arranging device is supported on a rotating shaft such that a base end portion thereof is freely rotated within a predetermined range of a rotational angle from a position outside said body to a position inside said body, and by controlling the rotating amount of said rotating shaft, a pose of said arranging device is adjusted at an arranging rotational position predetermined to sandwich said base end portion.

124. A sheet-shaped medium after-treatment apparatus comprising:

an after-treating device configured to carry out an after-treatment on a sheet-shaped medium;

a conveying device configured to convey the sheet-shaped medium after-treated; and a sheet-shaped medium aligning apparatus, said sheet-shaped medium aligning apparatus comprising:

a body, a discharging device configured to discharge sheet-shaped mediums, said discharging device disposed in said body, a sheet piling device configured to pile the sheet-shaped mediums discharged from said discharging device, said sheet piling device being attached to said body, and an arranging device configured to arrange the sheet-shaped mediums piled on said sheet piling device, by contacting the sheet-shaped mediums to sandwich ends of the sheet-shaped mediums parallel to a direction of discharging the sheet-shaped medium from said discharging device, said arranging device being attached to said body, wherein said arranging device is supported on a rotating shaft such that a base end portion thereof is freely rotated within a predetermined range of a rotational angle from a position outside said body to a position inside said body, and by controlling the rotating amount of said rotating shaft, a pose of said arranging device is adjusted at an arranging rotational position predetermined to sandwich said base end portion.

125. An image forming apparatus comprising:

an image forming device configured to form an image on a sheet-shaped medium;

a conveying device configured to convey the sheet-shaped medium formed with the image; and a sheet-shaped medium aligning apparatus, said sheet-shaped medium aligning apparatus comprising:

a body, a discharging device configured to discharge sheet-shaped mediums, said discharging device disposed in said body, a sheet piling device configured to pile the sheet-shaped mediums discharged from said discharging device, said sheet piling device being attached to said body, and a pair of arranging members configured to arrange the sheet-shaped mediums piled on said sheet piling device, by contacting the sheet-shaped mediums to sandwich ends of the sheet-shaped mediums parallel to a direction of discharging the sheet-shaped mediums from said discharging device, said pair of arranging members being attached to said body, wherein a sorting mode configured to sort the sheet-shaped mediums is possible by moving said sheet piling device or said arranging members in a shift direction perpendicular to the direction of discharging the sheet-shaped mediums from said discharging device, base end portions of said arranging members are supported on a rotating shaft, and by controlling a rotating amount of said rotating shaft, said arranging members are configured to be moved to an arranging rotational position predetermined to sandwich the ends and to an evacuating rotational position separated from the top surface of the sheet-shaped mediums and said evacuating rotational position is configured to be variably controlled, said arranging position is outside said body, and said evacuating position is inside said body.

126. A sheet-shaped medium after-treatment apparatus comprising:

an after-treating device configured to carry out an after-treatment on a sheet-shaped medium;

a conveying device configured to convey the sheet-shaped medium after-treated; and a sheet-shaped medium aligning apparatus, said sheet-shaped medium aligning apparatus comprising:

a body, a discharging device configured to discharge sheet-shaped mediums, said discharging device disposed in said body, a sheet piling device configured to pile the sheet-shaped mediums discharged from said discharging device, said sheet piling device being attached to said body, and a pair of arranging members configured to arrange the sheet-shaped mediums piled on said sheet piling device, by contacting the sheet-shaped mediums to sandwich ends of the sheet-shaped mediums parallel to a direction of discharging the sheet-shaped mediums from said discharging device, said pair of arranging members being attached to said body, wherein a sorting mode configured to sort the sheet-shaped mediums is possible by moving said sheet piling device or said arranging members in a shift direction perpendicular to the direction of discharging the sheet-shaped mediums from said discharging device, base end portions of said arranging members are supported on a rotating shaft, and by controlling a rotating amount of said rotating shaft, said arranging members are configured to be moved to an arranging rotational position predetermined to sandwich the ends and to an evacuating rotational position separated from the top surface of the sheet-shaped mediums and said evacuating rotational position is configured to be variably controlled, said arranging position is outside said body, and said evacuating position is inside said body.

* * * * *